US006729085B2

(12) United States Patent
Newhouse et al.

(10) Patent No.: US 6,729,085 B2
(45) Date of Patent: May 4, 2004

(54) WALL PANEL SYSTEM

(75) Inventors: Thomas J. Newhouse, Grand Rapids, MI (US); David B. Martin, Jenison, MI (US); Kevin Scott Breuker, Hudsonville, MI (US); Mark James Dinneweth, Spring Lake, MI (US); Steven M. Van Weiren, Grandville, MI (US); Thomas L. Verkaik, Hudsonville, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 10/068,801

(22) Filed: Feb. 5, 2002

(65) Prior Publication Data

US 2002/0129574 A1 Sep. 19, 2002

Related U.S. Application Data

(60) Provisional application No. 60/267,867, filed on Feb. 9, 2001.

(51) Int. Cl.[7] ..... E04H 1/00

(52) U.S. Cl. ..... 52/239; 52/36.1; 52/584.1; 52/590.2

(58) Field of Search ..... 52/239, 24.1, 36.1, 52/578, 582.2, 584.1, 590.2, 720.1, 726.1, 726.3, 36.6, 127.11, 281

(56) References Cited

U.S. PATENT DOCUMENTS

| | | | |
|---|---|---|---|
| 2,970,677 | A | 2/1961 | Springs, Jr. et al. |
| 3,066,770 | A | 12/1962 | Millard et al. |
| 3,180,459 | A | 4/1965 | Liskey, Jr. |
| 3,228,157 | A | 1/1966 | Jacobson |

(List continued on next page.)

OTHER PUBLICATIONS

"Ethospace Interiors Planning Guide, 1st Edition," Herman Miller, Source Book © 1985, pp. 1–107.

"Action Office® Planning Guide Series 2 Panels," Herman Miller Planning Guide, 07/91.

"Action Office® Series 3 Panels," Herman Miller Planning Guide, 01/93.

*Primary Examiner*—Ramon O. Ramirez
*Assistant Examiner*—Jon Szumny
(74) *Attorney, Agent, or Firm*—Brinks Hofer Gilson & Lione

(57) ABSTRACT

A stackable wall panel assembly including a lower wall panel having a top, a bottom, vertically extending ends and opposite sides and an upper wall panel having a top, a bottom, vertically extending ends and opposite sides. A vertically extending stanchion has a lower end connected to the top of the lower wall panel and an upper end connected to the bottom of the upper wall panel. The bottom of the upper wall panel is spaced from the top of the lower wall panel to form an open space between the upper and lower wall panels. In a preferred embodiment, a rail extends between the stanchions. Also in a preferred embodiment, a cover covers the space formed between the upper and lower wall panels. In another aspect, a second stanchion is connected to the top of the upper wall panel and a second upper wall panel is connected to the top of the second stanchion. In one preferred embodiment, draw members connect the first upper wall panel to the first stanchion and connect the second upper wall panel to the second stanchion. Alternatively, a draw block, insert and draw rod are used to connect the first upper wall panel to the lower wall panel, and to connect the first and second upper wall panels. In another aspect, a draw rod connects a lower connector post to a first upper connector post, with a spacer post disposed therebetween. A method for assembling a stackable wall panel assembly is also provided.

20 Claims, 93 Drawing Sheets

U.S. PATENT DOCUMENTS

| | | | | | |
|---|---|---|---|---|---|
| 3,261,625 | A | | 7/1966 | Cripe | |
| 3,370,389 | A | | 2/1968 | Macaluso | |
| 3,430,977 | A | | 3/1969 | Propst et al. | |
| 3,477,492 | A | | 11/1969 | Suess | |
| 3,486,287 | A | | 12/1969 | Guillon | |
| 3,517,467 | A | * | 6/1970 | Propst et al. | 52/36.6 |
| 3,546,834 | A | | 12/1970 | Murawski | |
| 3,550,337 | A | | 12/1970 | Lorenz | |
| 3,553,916 | A | | 1/1971 | Lickliter et al. | |
| 3,621,635 | A | | 11/1971 | DeLange | |
| 3,691,709 | A | | 9/1972 | Ostborg | |
| 3,745,732 | A | | 7/1973 | Pritchard et al. | |
| 3,789,567 | A | | 2/1974 | Rae et al. | |
| 3,987,836 | A | | 10/1976 | LeMay | |
| 4,030,219 | A | | 6/1977 | Donovan | |
| 4,056,903 | A | | 11/1977 | Guarnere | |
| 4,104,838 | A | | 8/1978 | Hage et al. | |
| 4,120,124 | A | | 10/1978 | Temple et al. | |
| 4,245,442 | A | | 1/1981 | Durham | |
| 4,308,695 | A | | 1/1982 | Ehrsam | |
| 4,388,790 | A | | 6/1983 | Greco | |
| 4,391,069 | A | | 7/1983 | Vermillion | |
| 4,391,073 | A | | 7/1983 | Mollenkopf et al. | |
| 4,406,101 | A | | 9/1983 | Heidmann | |
| 4,434,596 | A | | 3/1984 | McAteer et al. | |
| 4,448,003 | A | | 5/1984 | Hasbrouck | |
| 4,535,577 | A | | 8/1985 | Tenser et al. | |
| 4,545,168 | A | | 10/1985 | Dalton, Jr. | |
| 4,557,091 | A | | 12/1985 | Auer | |
| 4,571,907 | A | | 2/1986 | DeFouw et al. | |
| 4,573,513 | A | | 3/1986 | Small et al. | |
| 4,601,146 | A | | 7/1986 | Harter et al. | |
| 4,625,476 | A | | 12/1986 | Shimada | |
| 4,631,881 | A | | 12/1986 | Charman | |
| 4,644,993 | A | | 2/1987 | Cooper et al. | |
| 4,685,255 | A | | 8/1987 | Kelley | |
| 4,709,517 | A | | 12/1987 | Mitchell et al. | |
| 4,712,336 | A | | 12/1987 | Backer | |
| 4,716,699 | A | | 1/1988 | Crossman et al. | |
| 4,719,730 | A | | 1/1988 | Winkowski | |
| 4,771,583 | A | | 9/1988 | Ball et al. | |
| RE32,890 | E | | 3/1989 | DeFouw et al. | |
| 4,821,477 | A | | 4/1989 | Rydqvist | |
| 4,821,788 | A | | 4/1989 | Nelson | |
| 4,832,152 | A | | 5/1989 | Schuelke et al. | |
| 4,860,812 | A | | 8/1989 | DePietro et al. | |
| 4,876,835 | A | | 10/1989 | Kelley et al. | |
| 4,881,349 | A | | 11/1989 | Brown et al. | |
| 4,905,334 | A | | 3/1990 | Oppenhuizen | |
| 4,905,428 | A | | 3/1990 | Sykes | |
| 4,907,384 | A | | 3/1990 | Underwood | |
| 4,914,873 | A | | 4/1990 | Newhouse | |
| 4,914,878 | A | | 4/1990 | Tamaki et al. | |
| 4,936,066 | A | | 6/1990 | Rutsche et al. | |
| 4,947,601 | A | | 8/1990 | McGuire | |
| 4,962,805 | A | | 10/1990 | Allen | |
| 4,993,205 | A | | 2/1991 | Dull et al. | |
| 5,009,043 | A | | 4/1991 | Kurrasch | |
| 5,025,603 | A | | 6/1991 | Johnson | |
| 5,038,539 | A | | 8/1991 | Kelley et al. | |
| 5,056,285 | A | | 10/1991 | Frascaroli et al. | |
| 5,056,577 | A | | 10/1991 | DeLong et al. | |
| 5,058,347 | A | * | 10/1991 | Schuelke et al. | 52/239 |
| 5,060,434 | A | | 10/1991 | Allison | |
| 5,062,246 | A | | 11/1991 | Sykes | |
| 5,065,556 | A | | 11/1991 | DeLong et al. | |
| 5,067,294 | A | | 11/1991 | McGowan | |
| 5,069,263 | A | | 12/1991 | Edwards | |
| 5,070,666 | A | | 12/1991 | Looman | |
| 5,086,597 | A | | 2/1992 | Kelley et al. | |
| 5,088,541 | A | | 2/1992 | Persing et al. | |
| 5,112,240 | A | | 5/1992 | Nienhuis et al. | |
| 5,117,599 | A | | 6/1992 | Voss | |
| 5,134,826 | A | | 8/1992 | La Roche et al. | |
| 5,159,793 | A | | 11/1992 | Deugo et al. | |
| 5,174,086 | A | | 12/1992 | Payne et al. | |
| 5,175,969 | A | | 1/1993 | Knauf et al. | |
| 5,187,908 | A | | 2/1993 | Losensky | |
| 5,216,859 | A | | 6/1993 | Moreno et al. | |
| 5,251,413 | A | | 10/1993 | Goodman | |
| 5,274,970 | A | | 1/1994 | Roberts | |
| 5,277,005 | A | | 1/1994 | Hellwig et al. | |
| 5,277,007 | A | | 1/1994 | Hellwig et al. | |
| 5,285,602 | A | | 2/1994 | Felton | |
| 5,287,666 | A | | 2/1994 | Frascaroli et al. | |
| 5,305,567 | A | | 4/1994 | Wittler | |
| 5,377,461 | A | | 1/1995 | DeGrada et al. | |
| 5,377,466 | A | * | 1/1995 | Insalaco et al. | 52/238.1 |
| 5,382,719 | A | | 1/1995 | Fagan | |
| 5,394,558 | A | | 2/1995 | Arakawa et al. | |
| 5,394,658 | A | | 3/1995 | Schreiner et al. | |
| 5,394,668 | A | | 3/1995 | Lim | |
| 5,400,560 | A | | 3/1995 | Hellwig et al. | |
| 5,406,760 | A | | 4/1995 | Edwards | |
| 5,430,984 | A | | 7/1995 | Young et al. | |
| 5,433,046 | A | | 7/1995 | MacQuarrie et al. | |
| 5,487,246 | A | | 1/1996 | Hodges et al. | |
| 5,490,357 | A | | 2/1996 | Lin | |
| 5,491,943 | A | | 2/1996 | Vondrejs et al. | |
| 5,546,718 | A | | 8/1996 | Way | |
| 5,561,960 | A | | 10/1996 | Minnick et al. | |
| 5,562,469 | A | | 10/1996 | Nienhuis et al. | |
| 5,586,593 | A | | 12/1996 | Schwartz | |
| 5,600,926 | A | | 2/1997 | Ehrlich | |
| 5,603,370 | A | | 2/1997 | Boer | |
| 5,625,991 | A | * | 5/1997 | Sturrus | 52/584.1 |
| 5,634,305 | A | | 6/1997 | Erlanger | |
| 5,638,650 | A | | 6/1997 | Edwards | |
| 5,638,653 | A | | 6/1997 | Rossi | |
| 5,642,593 | A | | 7/1997 | Shieh | |
| 5,644,878 | A | | 7/1997 | Wehrmann | |
| 5,657,885 | A | | 8/1997 | White et al. | |
| 5,682,719 | A | | 11/1997 | Huang | |
| 5,687,859 | A | | 11/1997 | Miller | |
| 5,692,345 | A | | 12/1997 | Mogaki et al. | |
| 5,724,779 | A | | 3/1998 | Chang | |
| 5,737,887 | A | | 4/1998 | Smeenge | |
| 5,737,893 | A | | 4/1998 | Rossiter et al. | |
| 5,746,034 | A | | 5/1998 | Luchetti et al. | |
| 5,746,035 | A | | 5/1998 | Seiber et al. | |
| 5,802,789 | A | | 9/1998 | Goodman et al. | |
| 5,806,258 | A | | 9/1998 | Miedema et al. | |
| 5,809,714 | A | | 9/1998 | Kurrasch et al. | |
| 5,809,715 | A | | 9/1998 | Tanaka | |
| 5,839,240 | A | | 11/1998 | Elsholz et al. | |
| 5,852,904 | A | | 12/1998 | Yu et al. | |
| 5,867,955 | A | | 2/1999 | Russell | |
| 5,870,867 | A | | 2/1999 | Mitchell | |
| 5,875,594 | A | | 3/1999 | Hellwig et al. | |
| 5,896,710 | A | | 4/1999 | Hoyle | |
| 5,899,025 | A | | 5/1999 | Casey et al. | |
| 5,899,035 | A | | 5/1999 | Waalkes et al. | |
| 5,918,422 | A | | 7/1999 | Bucher, Jr. | |
| 5,930,963 | A | | 8/1999 | Nichols | |
| 5,974,742 | A | | 11/1999 | Schreiner et al. | |
| 6,000,179 | A | | 12/1999 | Musculus et al. | |
| 6,003,273 | A | | 12/1999 | Elsholz et al. | |
| 6,009,675 | A | | 1/2000 | Waalkes et al. | |

6,009,676 A 1/2000 Feldpausch et al.
6,047,509 A 4/2000 Savoie
6,052,958 A 4/2000 Miedema et al.
6,167,665 B1 * 1/2001 Dame et al. ..... 52/239
6,173,536 B1 1/2001 Boyce
6,223,485 B1 5/2001 Beck et al.
6,244,002 B1 6/2001 Martin
6,295,764 B1 10/2001 Berridge et al.

* cited by examiner

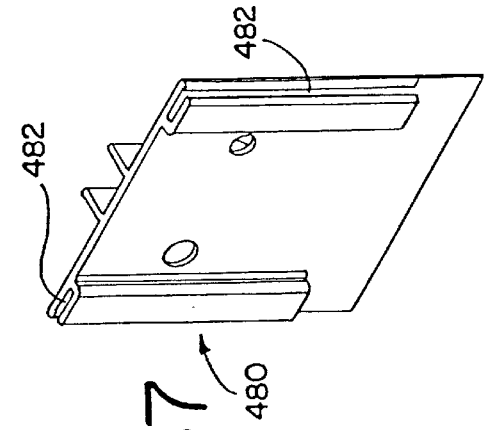
FIG. 57
FIG. 56
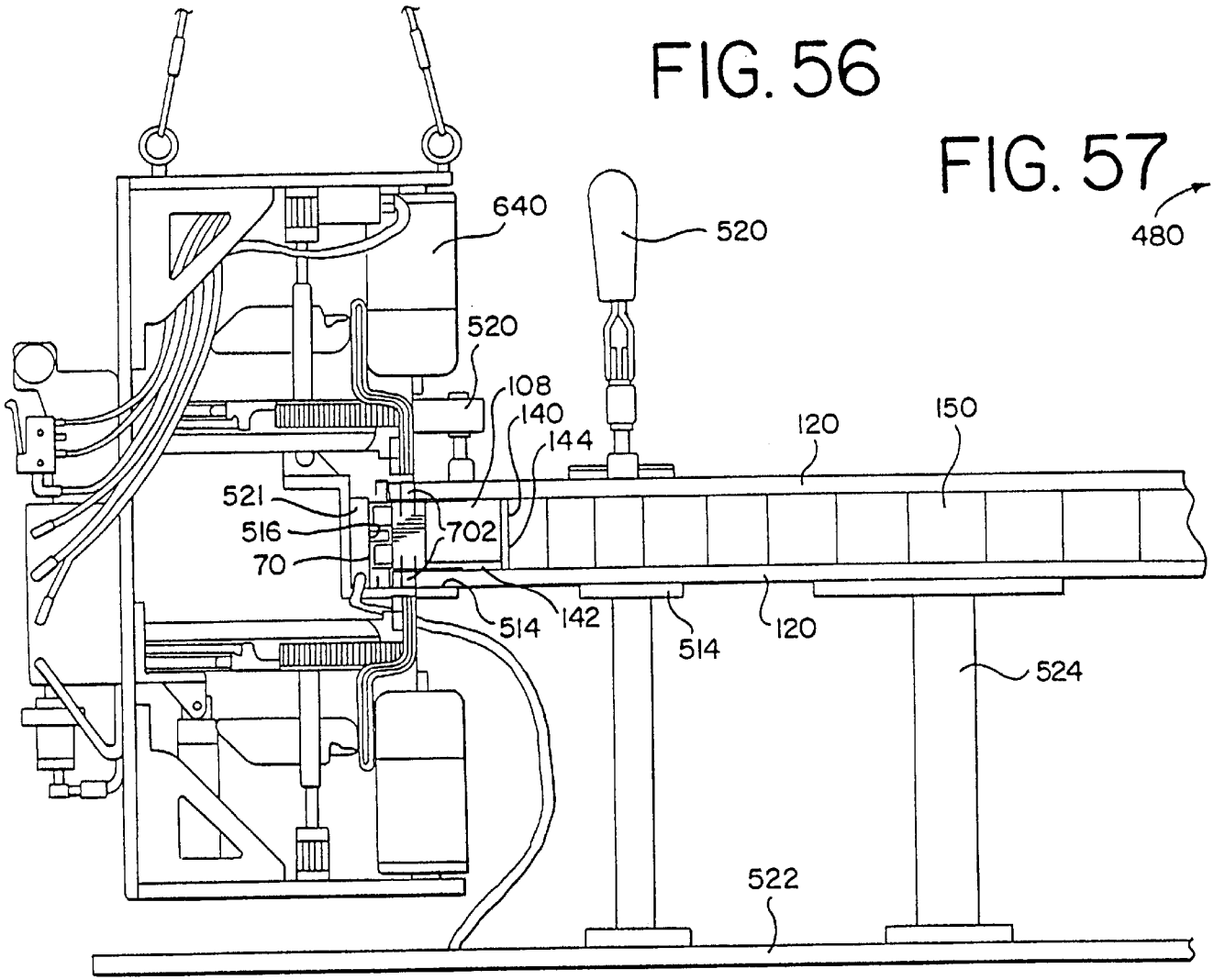

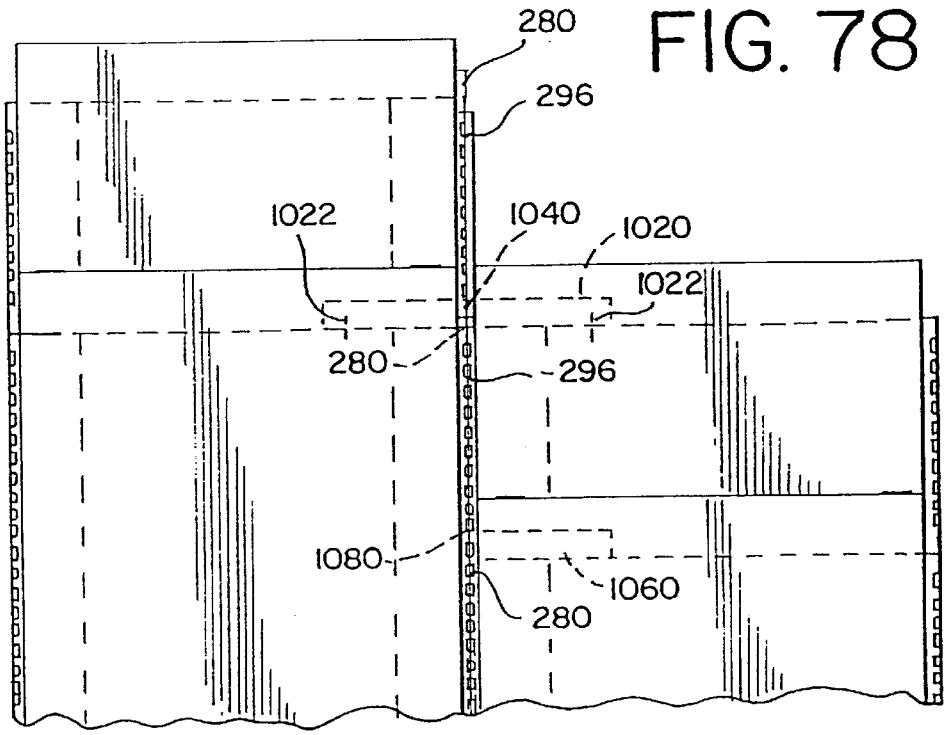
FIG. 78
FIG. 79
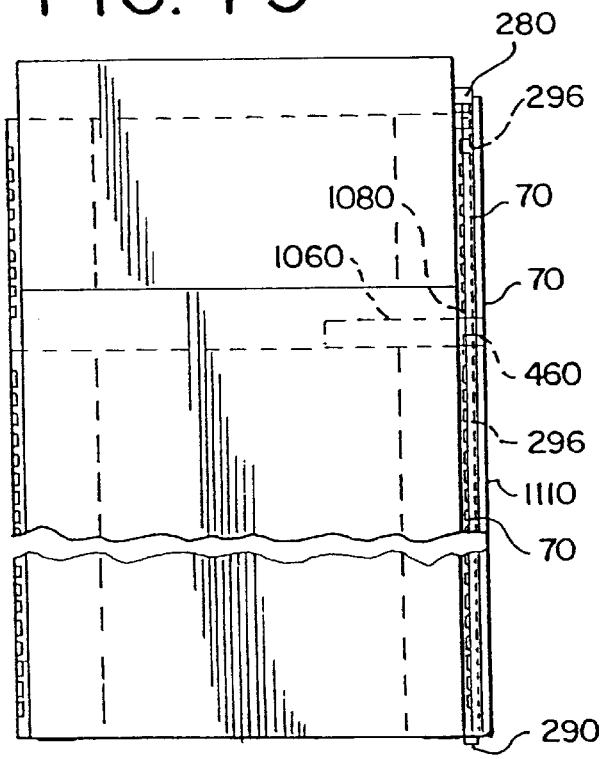
FIG. 80
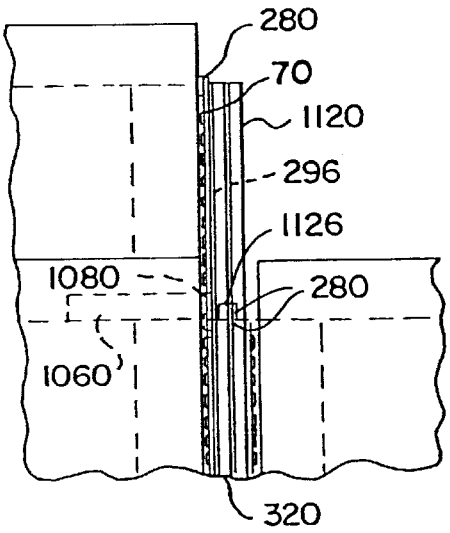

FIG. 138
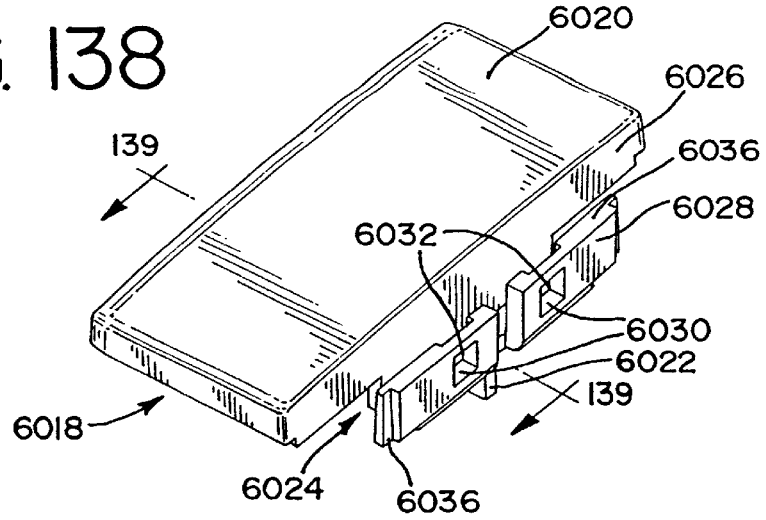
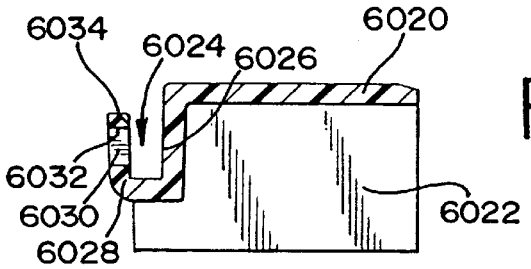
FIG. 139
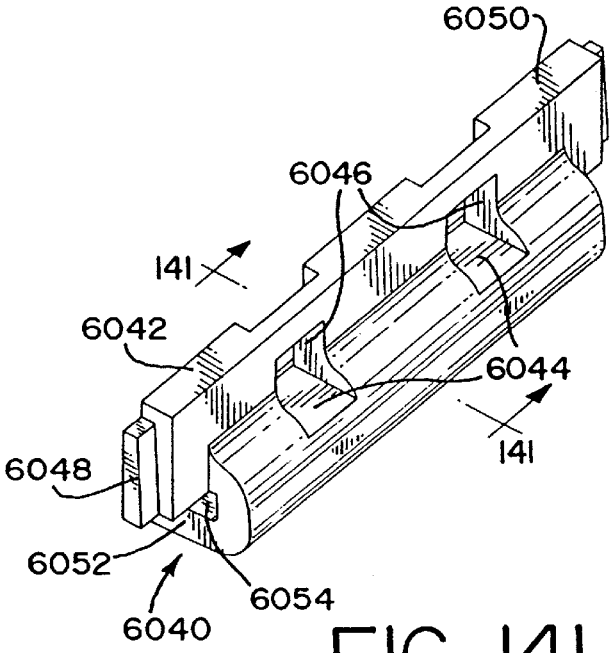
FIG. 140
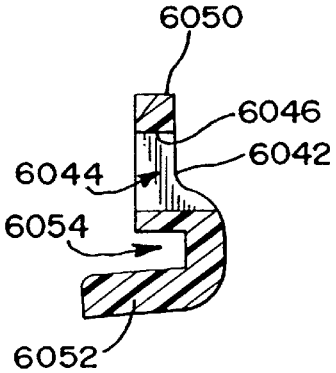
FIG. 141

6060
8026
8020
110
8023
8000
8022
108
8004
112
8028
801
6060
8024
8023
8021
108
8004
800
190
70
200
570
250
232
224
240
250

WALL PANEL SYSTEM

This application claims the benefit of U.S. Provisional Application No. 60/267,867, filed Feb. 9, 2001, the entire disclosure of which is hereby incorporated herein by reference.

BACKGROUND

The present invention relates generally to a wall panel system, and in particular, to a stackable wall panel system.

Panel systems are commonly used to divide large, open office space into separate work spaces. For example, Herman Miller, Inc., the assignee of the present application, manufacturers and sells three such work space management systems: the ACTION OFFICE® system, the ETHOSPACE® system and the Q™ System. Typically, workspace management systems are comprised of a series of wall panels arranged in various configurations. For example, wall panels can be connected in series in an end-to-end configuration, or they can be arranged around and connected to a corner post in a two-way, three-way or four-way configuration. Often, it is desirable to provide wall panels of differing heights so as to allow the user of the workspace to have flexibility in configuring the workspace. For example, shorter wall panels can be used to ease and promote communication with a user of the workspace, e.g., at a reception area. Conversely, taller wall panels can be used to provide greater privacy for the user.

In other systems, upper wall panels can be arranged above lower wall panels so as to allow the user to reconfigure the workspace. In this way, the height of a wall panel defining in part the workspace can be altered with stackable upper wall panels, rather than removing entirely a lower wall panel and replacing it with a taller or shorter wall panel. Often, however, the addition or removal of stackable upper wall panels can involve complex, multiple parts and require excessive amounts of time and manpower to effect the necessary or desired change.

Moreover, it can be important to provide for the routing of various communication and power lines and other utilities in the office work space environment. Typically, such lines are run internally within the panel system so as to improve the aesthetics of the system and to avoid tampering or inadvertent dislodgment by the workspace user. At the same time, it is desirable to provide access to such lines so as to facilitate repairs to and/or routing of the lines.

SUMMARY

Briefly stated, one aspect of the invention is directed to an improved wall panel. The wall panel includes a rectangular frame, a pair of sheetlike wall members and two thin decorative sheets. The rectangular frame includes two spaced apart, and generally parallel vertical side frame members and spaced apart and generally parallel horizontal lower and upper frame members. The frame members are connected at opposite ends thereof to form the rectangular frame. The sheetlike wall members, preferably made of fiberboard, have an inner surface attached to the side of each frame member. The thin decorative sheets, preferably cloth, cover the outer surface of the wall members on each side of the panel.

In one embodiment, each of the frame members includes a core member and a pair of sidewall members attached to opposite sides of the core member. The sidewall members preferably include a substantially flat leg portion having an inner surface attached to the core member and an outer surface attached to the wall member. The sidewall member includes an edge portion extending laterally outward from the leg portion. Preferably, the edge portion is configured as a C-shaped channel facing inwardly away from the wall panel surface. When the frame members are assembled into a rectangular frame, the edge portions extend around the periphery of the wall panel. The sidewalls, including the edge portions, form a shallow recess on opposite sides of the panel. Each recess has a bottom surface defined by the outer surface of the leg portions. The wall members are received in the recesses on opposite sides of the panel.

In another embodiment of the wall panel, a pair of inner sheetlike wall members are attached to the rectangular frame to form a core assembly. In this embodiment, the frame members are preferably of a one-piece wooden construction. A pair of outer wall members are then attached to the inner wall members of the core assembly. The outer wall members extend outwardly from the periphery of the inner wall members to form a channel between them.

In one aspect of the invention, the core assembly includes at least one locator opening therethrough. The outer wall members each include at least one locator member that is received in the at least one locator opening as the wall members are mounted to the core assembly. The locator members and openings are arranged on the wall members and core assembly, respectively, so that the wall members are centered on the core assembly from side to side. The locator members and openings can also be arranged so as to ensure that the top of the wall member is positioned a predetermined distance from the top of the core assembly, or channel thereon, so as to provide a uniform and continuous line or appearance along the top of a plurality of wall panels arranged in a system of wall panels.

In another aspect of the invention, a thin barrier sheet, or scrim, is disposed between the decorative sheet and the outer surface of the wall member as a fire blocking member. The barrier sheet preferably includes a thin aluminum foil layer laminated to a fiberglass layer.

The wall panel also includes an inner filler member disposed between the wall members. The filler member extends between the upper and lower horizontal frame members. Preferably, the inner surface of the wall members are attached to the filler member.

In one embodiment of the invention, the sidewall members on the upper horizontal frame member extend upwardly from the upper core member to form a horizontal channel running substantially the length of the wall panel. The bottom of the channel is defined by the upper surface of the upper core member and the sides of the channel are defined by the upwardly extending sidewall members. A top cap is releasably secured to the upper frame member to cover the channel.

In another embodiment, a channel member is attached to the upper horizontal frame member in the space formed between the outer wall members to further define a horizontal channel. A top cap is secured to the channel member to cover the channel.

In one aspect of the invention, the wall panel also includes at least one vertical channel communicating with the upper horizontal channel and a bottom portion of the wall panel. Preferably, the vertical channel is defined by an inner surface of one of the vertical frame members, a partition member spaced apart from the inner surface of the vertical member and the inner surface of the wall member. Preferably, the partition member extends between the inner surfaces of the opposing wall members and is attached to at least one of the wall members. The partition member also extends substantially between the upper and lower frame members.

In another aspect of the invention, a power distribution system is provided at the base of the wall panel. The power distribution system includes a power distribution server, including a harness and a module receptacle, which is attached to a bottom of the lower frame member. The power distribution system is adapted to be electrically connected with power distribution systems located in adjacent panels. In addition, an outlet box is attached to one or more of the wall members between the upper and lower frame members. At least one of the wall members has an opening provided to allow access to the outlet box. The outlet box is electrically connected to the power distribution system with an electrical conduit disposed in the vertical channel.

In another aspect of the invention, a plastic strip is attached to the decorative sheet at each of its edges. The strip includes a first hook member that is adapted to engage the edge portion of the sidewall member of the frame members in one embodiment of the wall panel. Preferably, the strip also includes a second hook member that is adapted to receive a tool member which can be used to stretch the decorative sheet between opposing frame members while simultaneously disposing the first hook member on the edge portion of the sidewall.

In an alternative embodiment a strip member is disposed along the periphery of the wall member to protect the edges thereof and is covered with the thin decorative sheet. A plurality of fasteners are used to attach the decorative sheet and strip member to the wall member.

In another aspect of the invention, wall panels placed end-to-end are attached using an upper and lower draw block that engage hanger brackets attached to the ends of the wall panels. A draw rod operably engages the draw blocks which pull the hanger brackets and corresponding panels together.

In yet another aspect of the invention, a corner post is provided for connecting two or more panels at 90°. The corner post includes an elongated tube having a pair of inwardly facing channels formed on each side of the tube. A plate member is secured inside each end of the tube; the upper plate having a threaded hole in the middle of the plate.

In one embodiment, the corner post is provided with a height adjustable cap which includes a post member and a cover member supported by the post member. The post member threadably engages the hole in the upper plate and can be rotated to adjust the height of the cover. In this way, the cover can be raised or lowered to provide a smooth transition between adjacent wall panel top caps.

In another embodiment, a corner post cap is attached to light seal members that are disposed in openings formed in the ends of the top caps. Preferably, the corner post cap and light seal members are attached with a snap-fit engagement.

In another aspect of the invention, an outwardly facing groove is formed in each corner of the tube. A cover has diagonally oriented beaded portions. The cover is attached to the corner post by releasably engaging two of the corner grooves with the beaded portions. The corner post cover is used to cover those sides of the corner post not connected to a wall panel, so as to thereby provide an aesthetically pleasing appearance.

In another aspect of the invention, one or more upper, stackable wall panels are mounted to one or more lower wall panels, or to a corner post, using a combination of connector members, including various brackets, spanner members, draw blocks and draw rods. In one embodiment, a corner post extension is provided to facilitate the attachment of the upper, stackable panel to a corner post and lower wall panel.

In yet another aspect of the invention, a stackable wall panel assembly comprises a lower wall panel comprising a top, a bottom, vertically extending opposite ends, and opposite sides, and an upper wall panel comprising a top, a bottom, vertically extending opposite ends, and opposite sides. A vertically extending stanchion comprises a lower end supported on the top of the lower wall panel and an upper end supporting a bottom of the upper wall panel. In a preferred embodiment, a horizontally extending rail is connected to the upper end of the stanchion. The upper wall panel overlies the lower wall panel, and is spaced apart from the top of the lower wall panel to form an open space between the upper and lower wall panels. In one preferred embodiment, a post extends upwardly from the rail and is disposed in an opening formed in the bottom of the upper wall panel. In one preferred embodiment, a draw member connects the upper wall panel and the stanchion. In a preferred embodiment, one or more covers cover the space formed between the upper and lower wall panels. In one preferred embodiment, an electrical harness is connected to the rail in the open space. A method is also provided for assembling a stackable wall panel assembly.

In one embodiment, an upper and lower connector post are connected to the upper and lower wall panels. Preferably, a spacer post is disposed between the upper and lower connector posts as a draw rod connects the upper and lower connector posts so as to thereby clamp the spacer post therebetween.

In another aspect, a second stanchion is supported on the top of the upper wall panel and a second upper wall panel is supported by the second stanchion. In one preferred embodiment, the second stanchion includes a post that is received in an opening formed in the bottom of the second upper wall panel. In one preferred embodiment, a draw member preferably connects the second upper wall panel and the second stanchion.

In another aspect, a draw block, insert and draw rod can be used to connect the first upper wall panel to the lower wall panel, and to connect the first and second upper wall panels. In one preferred embodiment, a first draw block is connected to the lower wall panel, the insert is engaged with the first draw block and a second draw block is engaged with the upper wall panel. The draw rod connects the insert and second draw block. In a preferred embodiment, the insert is releasably engaged with the first draw block, and preferably includes a catch portion that engages the draw block.

In yet another aspect, a first and second wall panel each comprise a pair of laterally extending, vertically offset and horizontally staggered alignment members. The first and second wall panels are disposed serially adjacent one another such that the alignment members on the first wall panel matingly interface with the alignment members on the second wall panel. Preferably, the first and second wall panels are upper wall panels disposed respectively on first and second lower wall panels. In a preferred embodiment, a first and second stanchion are disposed on said first and second upper wall panels and each include a pair of alignment members. Preferably, a third and fourth upper wall panel are disposed on the first and second stanchions above the first and second upper wall panels respectively.

In another aspect of the invention, a variety of light seal members are provided for spanning or blocking the gaps formed between adjacent wall panels, or between the corner post and any wall panel attached thereto. In a preferred embodiment, the light seal members are disposed on the connectors, preferably configured as draw blocks, used to interconnect the wall panels and corner post. The light seals comprise a longitudinally extending leg portion. Preferably, one of the light seal and the connector include a protuberance that is snap-fitted with a recess formed on the other of the light seal and connector. In yet another embodiment, a light seal can be disposed on an end cover, which is attached to the end of the wall panel. The end cover light seal preferably comprises a flange flexibly extending between the end cover and the end of the wall panel.

In another aspect of the invention, a method is provided for manufacturing the vertical side frame member of one embodiment of the wall panel. In particular, the method includes providing a core member, a pair of sidewall members each having an edge portion, and a hanger bracket. The hanger bracket is attached to the core member. The core member and attached hanger bracket are then positioned in a fixture such that the hanger bracket engages a first surface of the fixture. The sidewall members are positioned in the fixture on both sides of the core member such that the edge portion of each sidewall member engages a second and third surface of the fixture, respectively, positioned predetermined distances from the first surface. The sidewall members are then attached to the core member.

A similar method is provided for making the upper and lower horizontal frame members, wherein the fixture surfaces are positioned to support the edge portion of the sidewall members and the outer surface of the core member.

A method also is provided for manufacturing the various wall panel embodiments. In particular, and with respect to a first embodiment, one of the sheetlike wall members is placed in a fixture. The side frame members and upper and lower horizontal frame members also are positioned in the fixture. The wall member fills the recess formed by the sidewall members on one side of the rectangular frame. Adhesive is applied to one of the sidewall members and wall member before the frame is disposed on the wall member. Adhesive also is applied to both sides of the filler member. One or more partition members is adhesively attached to the inner surface of the wall member so as to form a vertical channel with the inner surface of one of the side core members. The filler member is inserted into the space formed by the frame members and the partition members. The second sheetlike wall member is then disposed in the recess on the opposite side of the frame. The wall members are attached to each frame member with mechanical fasteners. A decorative sheet and barrier sheet are secured over the outer surface of each wall member.

In a second embodiment, the frame members are connected to form a frame. A first pair of inner wall members are attached to the frame, with a filler member and one or more partition members disposed therein, to form a core assembly. Preferably, the first pair of wall members each have a peripheral edge that is substantially flush with the outer surface of the frame members. When assembled, the frame and first pair of wall members form a core assembly. The second pair of wall members are then attached to the first pair of wall members of the core assembly and have at least one peripheral edge that extends beyond the peripheral edge of the inner wall members so as to form a channel therebetween. The decorative sheet and barrier material are secured over the outer surface of the second, or outer, pair of wall members.

In another aspect, a system is provided for centering the outer wall member on a core assembly. The system includes a machine for centering and providing a plurality of locator holes in the core assembly and a machine for centering and disposing a plurality of corresponding locator members on the outer wall members. The outer wall members are then centered on the core assembly by mating the locator members and holes.

The present invention provides significant advantages over other wall panel systems and methods of manufacture. In particular, the frame member, comprising either a three-piece construction of a pair of sidewall members attached to a core member, or a core member by itself, yields a simple, inexpensive structural part that provides several advantages over roll-formed or extruded metal channels. By using a wood core member, the sidewall members can be easily attached to the core with staples, rather than by welding or other more expensive methods of manufacture. Similarly, the wall members can be stapled directly to the frame members, as well as adhesively secured, so as to improve the strength of the panel. In addition, various accessories, such as the power distribution server, can be easily mounted to the bottom of the panel with wood fasteners, without providing mounting holes in the lower frame member. Moreover, the wood can be easily cut to length for each frame member, or shortened so as to provide access to the vertical channel, without wasting material or making complicated cuts or stampings in the sheet metal.

Also important, the three-piece frame member construction allows the manufacturer to provide precise dimensions between the outermost surface of the hanger bracket and the outermost surface of the sidewall members. This dimension is critical when two panels are installed adjacent to each other. For example, when two panels are connected, the adjacent hanger brackets are pulled together by a wedge block, as explained below. When connected in this manner, the panel-to-panel interface, or joint between the panels, is defined by the distance between the adjacent outer surfaces of opposing edge portions covered with fabric. Thus, by maintaining the distance between the outer surface of the edge portion and the hanger bracket as a constant, the joints at each panel interface are kept constant, i.e., have the same gap between panels. Moreover, when a wall panel has a thicker fabric installed around the edge portions, the distance between the edge portion and hanger bracket can be increased so that the gap between panels, when connected, remains the same, regardless of the fabric thickness.

Alternatively, an outer wall member can be centered on a core assembly. In this way, the dimensions between the outer edge of the wall member and the outermost surface of the hanger bracket can be maintained relatively constant so as to provide a relatively uniform gap between adjacent wall panels.

The vertical channel also provides significant advantages. For example, wires can be easily routed from the top of the panel to the bottom. The channel also provides ideal passage for the electrical conduit running from the outlet box installed inside the panel. In addition, because the channel is inside of the frame and adjacent to the box, rather than on the outside of the frame, the frame member does not have to be pierced in order to rout the wiring to the outlet box. Moreover, wires disposed in the channel are not exposed when the panels are disconnected and cannot therefore be caught or hooked by the panel-to-panel connectors.

The improved corner post also provides significant advantages over similar devices. For example, the corner post cover is height adjustable, so that it can be adjusted to provide a continuous line across the top of a system of panels. Moreover, the grooves provided in the corner post tube provide a simple but efficient way to attach covers, whether they be flat, or formed at 90°. As such, the orientation of the tube is irrelevant to the placement of connecting panels and/or post covers. Because the tube is symmetrical, the cover and panels can be arranged in any configuration, without having to reorient the tube member.

Yet another significant advantage is the various methods of fabric attachment. In one embodiment, the double-hook strip configuration allows an installer to use a tool to install the fabric. As such, the installer can apply a considerable force to tightly stretch the fabric between opposing frame members to thereby provide a smooth and pleasing appearance. Moreover, the releasable hook allows the user to easily replace the fabric if it becomes damaged or if a color change is desired. The new fabric can be installed quickly and easily without adhesives or difficult to install elastic bands that run around the periphery of the wall panel. Indeed, adjacent panels need not even by disconnected in order to install a new sheet of fabric, thereby avoiding the task of disassembling the panels.

Alternatively, the strip member disposed along the edge of the wall panel protects the edge from impact damage and the like. In addition, the strip member anchors the fasteners used to secure the decorative sheet to the wall member.

Another significant advantage is the ability to install light seals between wall panels and between a wall panel and the corner post. The light seals can be installed quickly without having to disassemble the wall panel assembly. In a preferred embodiment, the various light seals can be releasably secured to a connector or to a top cap, so as to prevent the light seals from becoming dislodged and/or misplaced.

Another significant advantage is the ability to install one or more upper, stackable wall panels on one or more lower wall panels or corner posts. In particular, a system of wall panels can be easily and quickly reconfigured to provide more or less privacy by adding one or more upper wall panels without affecting the connection of the lower wall panel (or panels) to adjacent wall panels or corner posts. The combination of spanner members, support brackets, draw blocks and draw rods can be installed or removed quickly and easily with minimum effort, while simultaneously providing a robust, rigid structure.

Another significant advantage is realized by the use of a stanchion disposed between an upper and lower wall panel, and/or between one or more stacked upper panels. The stanchion provides a space to be formed between the upper and lower wall panels. Various communication and power cables, electrical harnesses and lines can be routed in this space formed between the upper and lower wall panels. Moreover, outlets and other utility boxes can be easily installed in the space. Covers can be provided to hide the unsightly cables and lines, but can easily be removed or opened to allow easy access to the various utilities.

The upper and lower connector posts and spacer posts provide an easy to assemble corner post allowing cables and the like to be passed from one panel stack to another. The connector posts can be easily assembled with minimal tools and manpower using easy to install draw rods.

The stacked wall panels also can be easily connected to each other, and to other panel stacks or connector post assemblies, using the external draw blocks and draw rods. The insert member can be easily engaged and disengaged with the draw block for connecting the adjacent panel stack.

The alignment members extending from the wall panels also provide a significant advantage. In particular, the staggered and offset alignment members can be matingly interfaced to align serially adjacent wall panels. This can be especially important for upper stackable wall panels, wherein the interface of the alignment members provides additional lateral stability to the wall panel system and prevents the adjacent wall panels from becoming laterally disengaged from each other. Moreover, in the preferred embodiment, wherein the alignment members are formed on various stanchions or connector members, the stanchions and connector members can be removed when not needed, such that the wall panel can be used without the alignment members.

Finally, the wall panel construction lends itself to improved manufacturability and overall quality. Most importantly, as described above, each frame member can be made with extremely tight tolerances so that the gap between panels is maintained as a constant when the wall panels are assembled as a system. Or, in an alternative embodiment, the wall members can be centered on the core assembly so as to maintain similar uniform gaps. By locating the frame members to outside dimensions in the fixture, the overall panel construction is improved by providing extremely tight tolerances for the height and width of each panel. The improved quality associated with this method of manufacture in turn facilitates and eases installation of the panels while providing an improved overall look for the system.

The present invention, together with further objects and advantages, will be best understood by reference to the following detailed description taken in conjunction with the accompanying drawings.

BRIEF DESCRIPTION OF THE DRAWINGS

FIG. 56 is a side view of a dual staple gun engaging a wall panel installed in the wall panel assembly fixture.

FIG. 57 is a perspective view of an end cover support bracket.

FIG. 78 is a side view of an upper wall panel attached to a tall lower panel positioned in an end-to-end configuration with an upper wall panel attached to a short lower wall panel.

FIG. 79 is a side view of an upper wall panel attached to a lower wall panel.

FIG. 80 is a side view of an upper wall panel attached to a lower wall panel and to a corner post having a corner post extension.

FIG. 116 is an enlarged plan view of the rack and pinion mechanism used in the machines shown in FIGS. 104 and 107.

FIG. 117 is an enlarged end view of the rack and pinion mechanism and encoding device.

FIG. 118 is an enlarged side view of the rack and pinion mechanism and encoding device.

FIG. 119 is an exploded perspective view of a corner post extension with a light seal member and corner post cap.

FIG. 120 is an exploded perspective view of a support bracket and a short lower wall panel positioned in an end to end configuration with a tall lower wall panel.

FIG. 121 is an exploded side view of an upper wall panel, a tall lower wall panel, a short lower wall panel, a support bracket member, a spanner member and a connector member.

FIG. 122 is an exploded side view of a pair of upper wall panels, a pair of lower wall panels, a pair of spanner members and a connector member.

FIG. 123 is an exploded perspective view of a spanner member and a pair of lower wall panels.

FIG. 124 is an exploded side view of an upper wall member, a pair of lower wall panels, a spanner member and a connector member.

FIG. 125 is an exploded side view of a lower wall panel, an upper wall panel and connector members including a stand-alone hanger bracket.

FIG. 126 is an exploded perspective view of an upper wall panel supported by a pair of lower wall panels, a pair of end cover brackets and a light seal member.

FIG. 127 is a perspective view of the components shown in FIG. 126 with an end cover being applied thereto.

Figure 128:
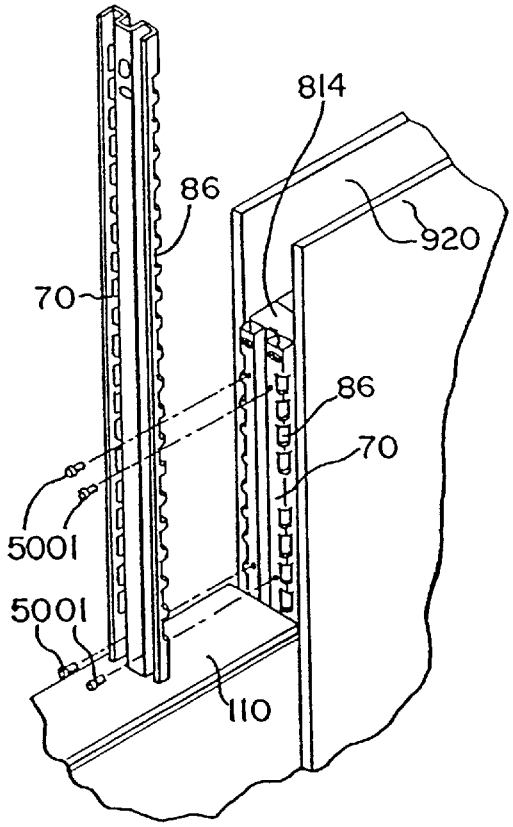

FIG. 128 is an exploded perspective view of a stand-along hanger bracket being applied to a tall lower wall panel attached to a short lower wall panel.

Figure 129:
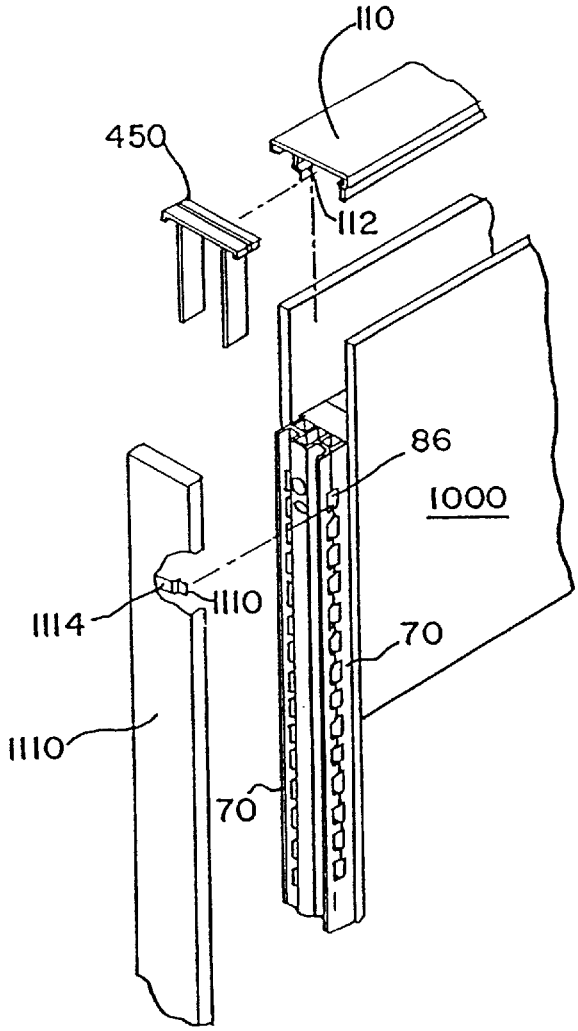

FIG. 129 is an exploded perspective view of an end cover, light seal member and top cap being applied to an upper wall panel secured to the tall lower wall panel shown in FIG. 128.

Figure 114:
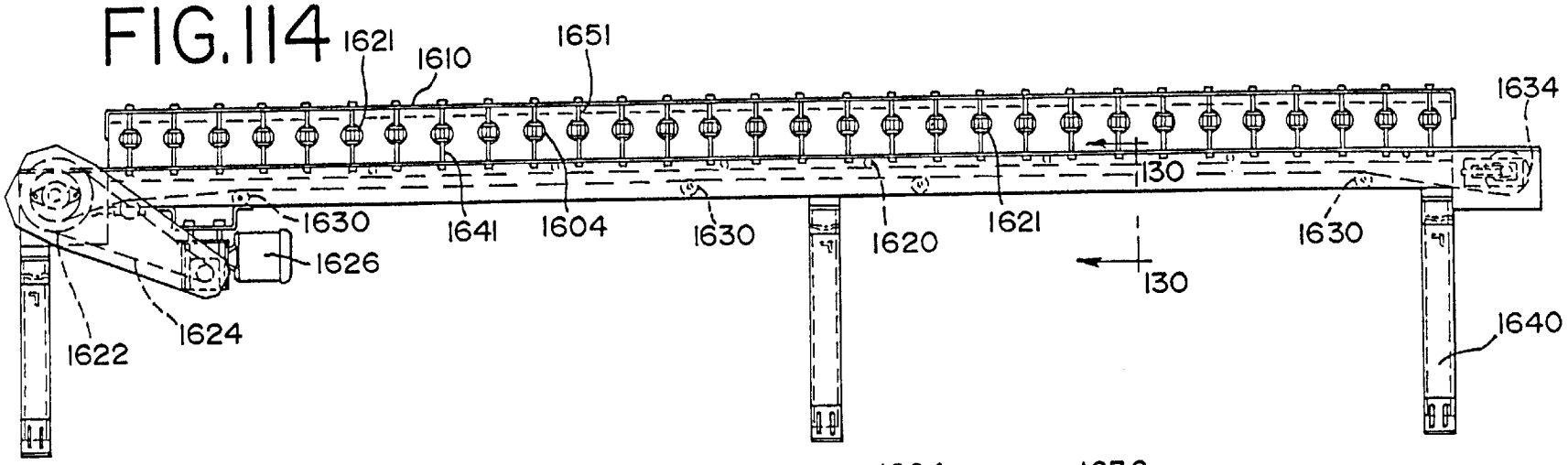
FIG. 114 is a side view of the machine shown in FIG. 113.
Figure 130:
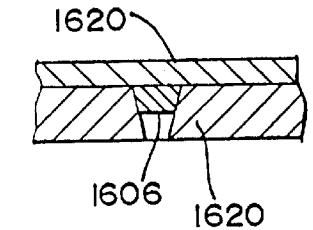

FIG. 130 is a partial cross-sectional view of two belts supported by the press conveyor machine bed taken along line 130—130 of FIG. 114.

Figure 131:
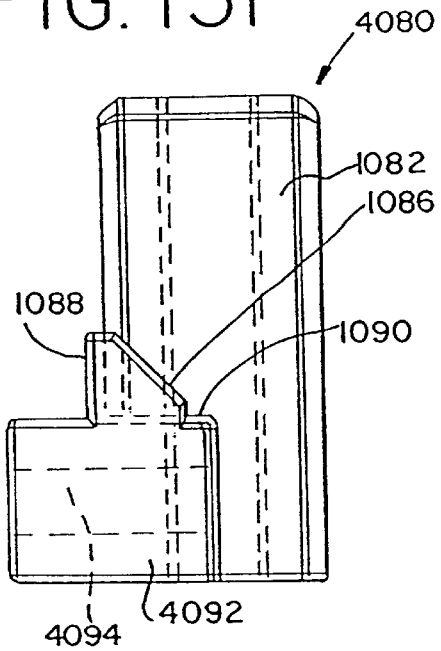

FIG. 131 is an end view of an alternative embodiment of a lower draw block.

Figure 132:
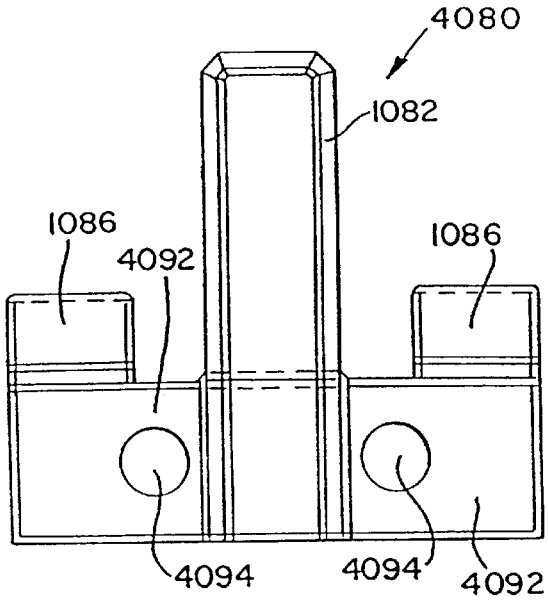

FIG. 132 is an end view of the lower draw block shown in FIG. 131.

Figure 133:
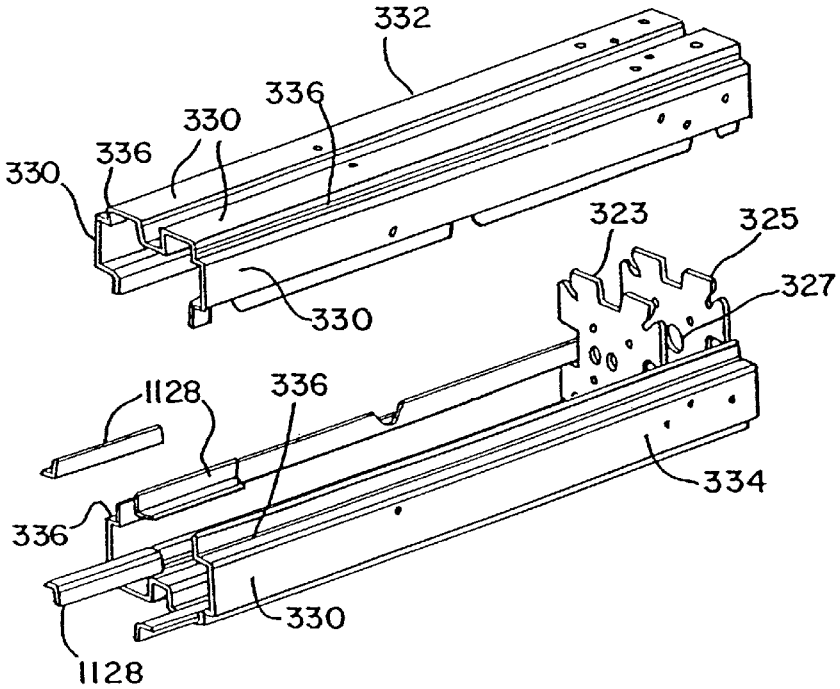

FIG. 133 is an exploded view of an alternative embodiment of the corner post extension.

Figure 134:
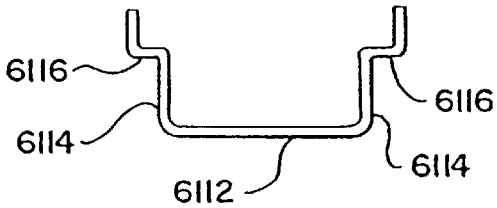

FIG. 134 is an end view of an alternative embodiment of a clip for a cover member.

Figure 135:
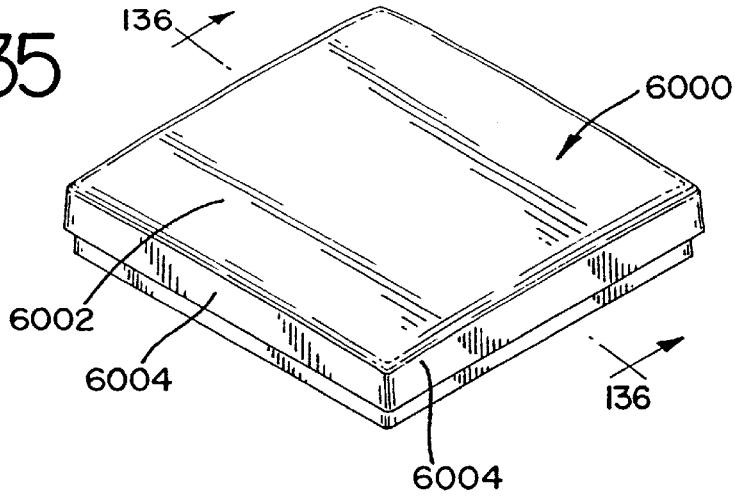

FIG. 135 is a perspective view of an alternative embodiment of a corner post cap.

Figure 136:
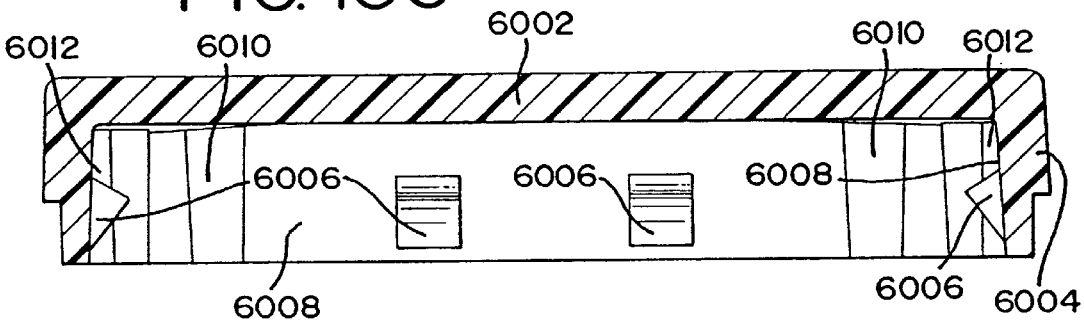

FIG. 136 is a section cross-sectional view of the corner post cap taken along line 136—136 of FIG. 135.

Figure 137:
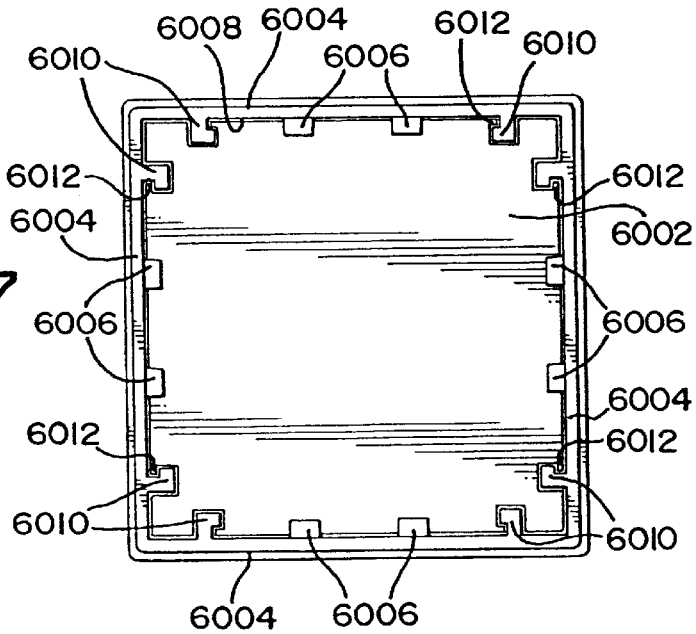

FIG. 137 is a bottom view of the corner post cap shown in FIG. 135.

FIG. 138 is a perspective view of a light seal.

FIG. 139 is a cross-sectional view of the light seal shown in FIG. 138 taken along line 139—139.

FIG. 140 is a perspective view of a clip for a corner post cover.

FIG. 141 is a cross-sectional view of the clip shown in FIG. 140 taken along line 141—141.

Figure 142:
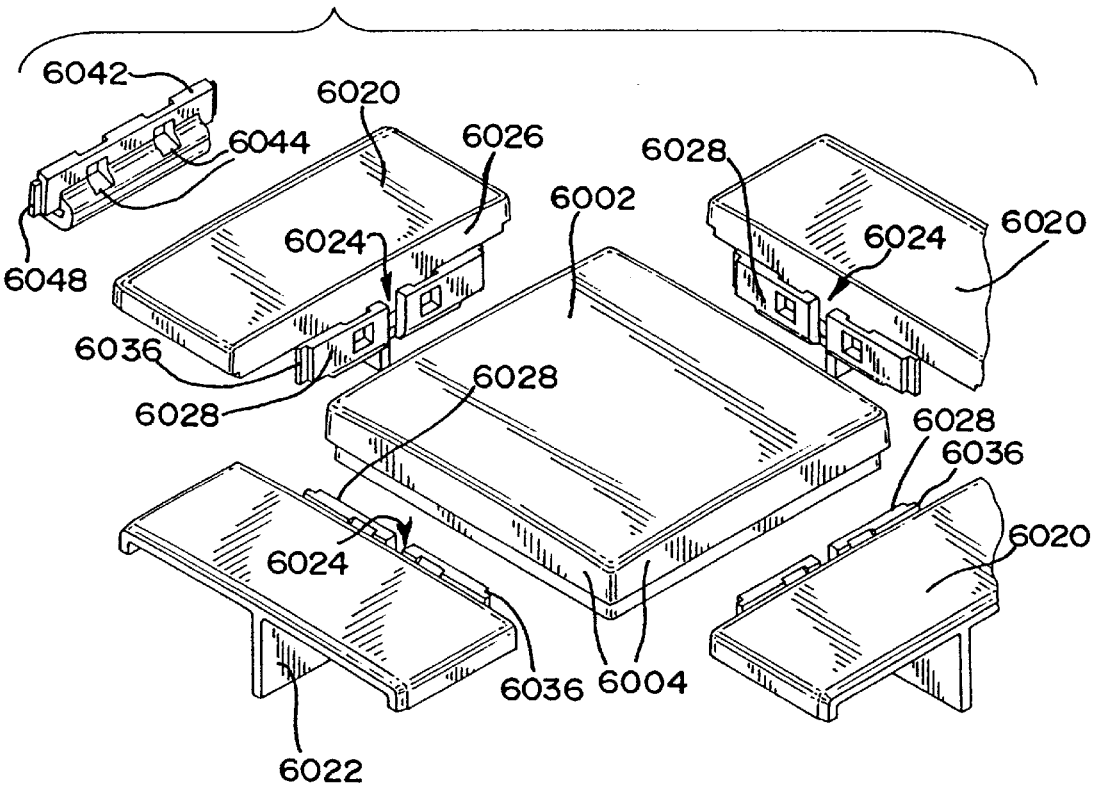

FIG. 142 is an exploded perspective view of a corner post cap with a plurality of light seals arranged thereabout.

Figure 143:
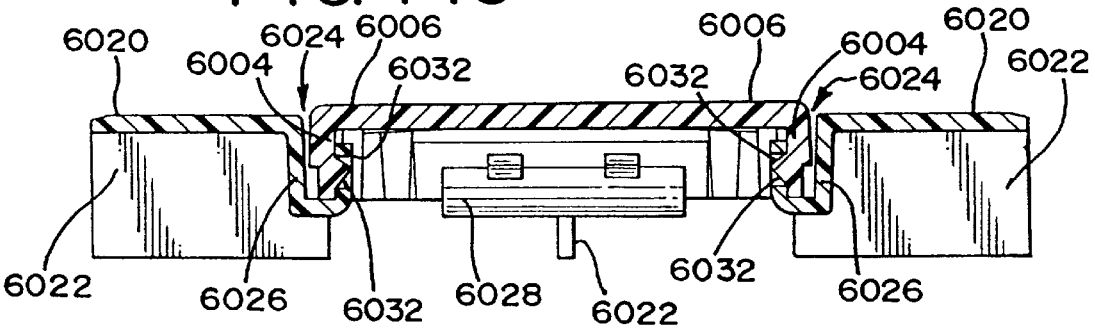

FIG. 143 is a cross-sectional view of a pair of light seals connected with a corner post cap.

Figure 144:
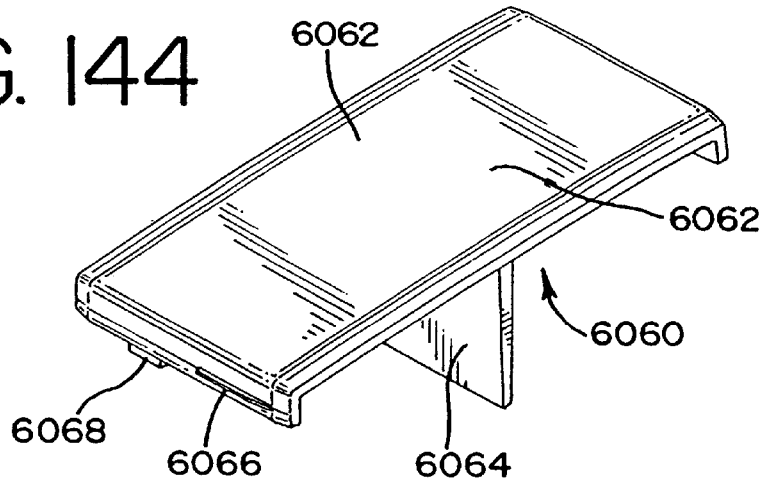

FIG. 144 is a perspective view of an alternative embodiment of a light seal.

Figure 145:
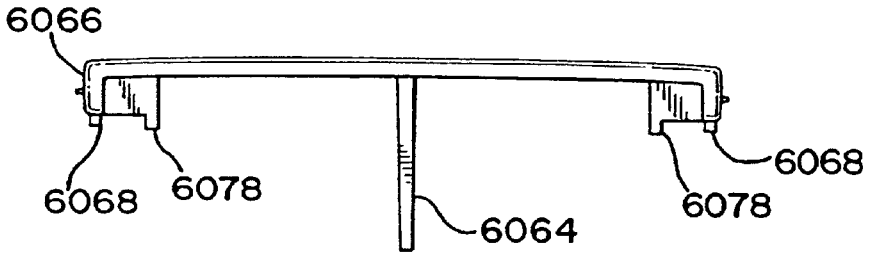

FIG. 145 is an end view of the light seal shown in FIG. 144.

Figure 146:
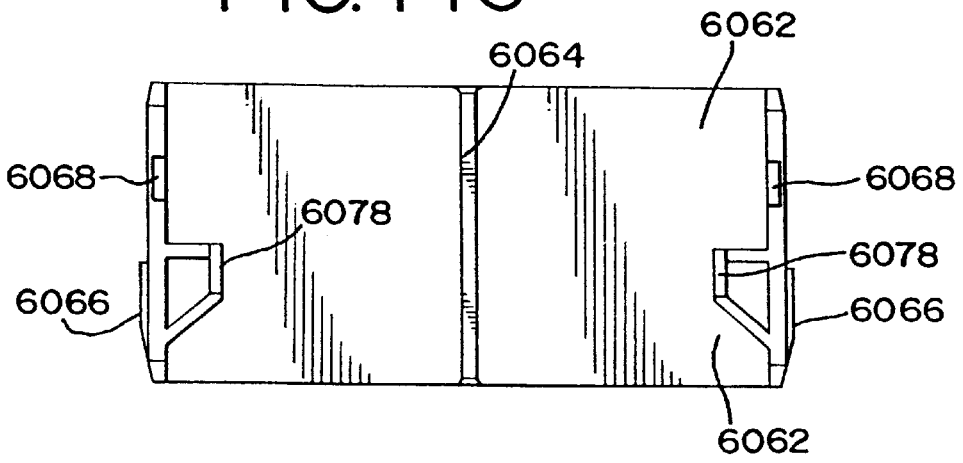

FIG. 146 is a bottom view of the light seal shown in FIG. 145.

Figure 147:
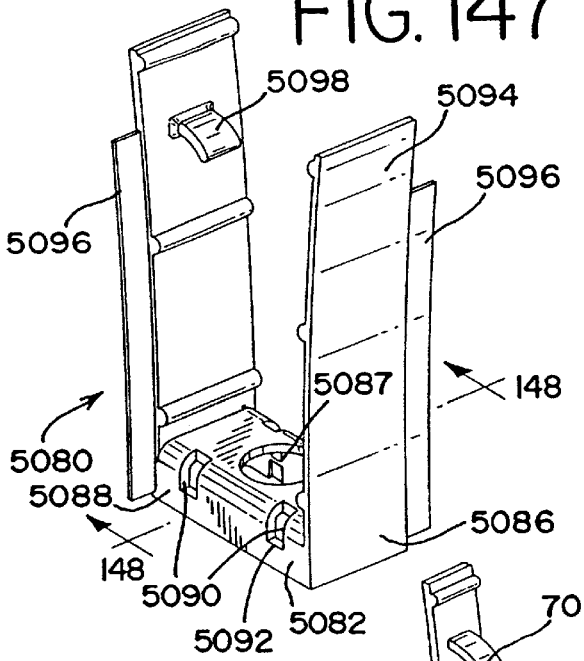

FIG. 147 is a perspective view of an alternative embodiment of a light seal.

Figure 148:
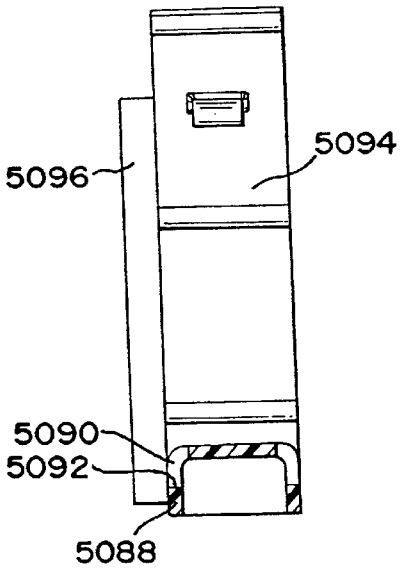

FIG. 148 is a cross-sectional view of the light seal shown in FIG. 147 taken along line 148—148.

Figure 149:
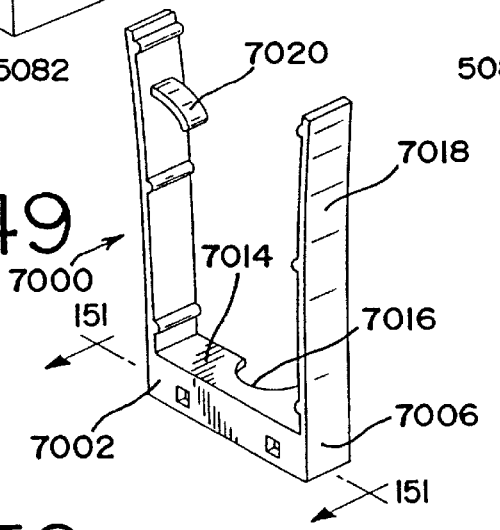

FIG. 149 is a perspective view of an alternative embodiment of a light seal.

Figure 150:
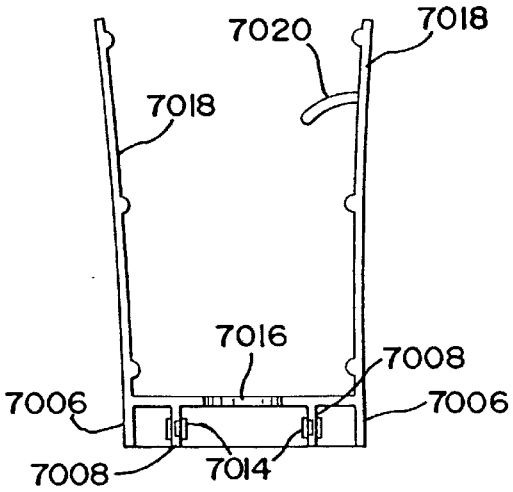

FIG. 150 is a side view of the light seal shown in FIG. 149.

Figure 151:
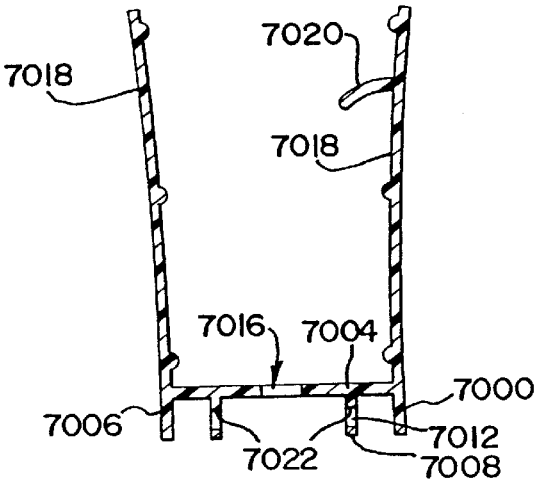

FIG. 151 is a cross-sectional view of the light seal shown in FIG. 149 taken along line 151—151.

Figure 152:
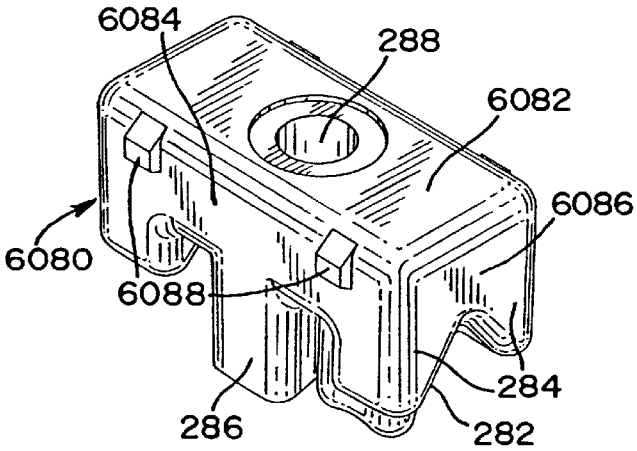

FIG. 152 is a perspective view of an alternative embodiment of a draw block.

Figure 153:
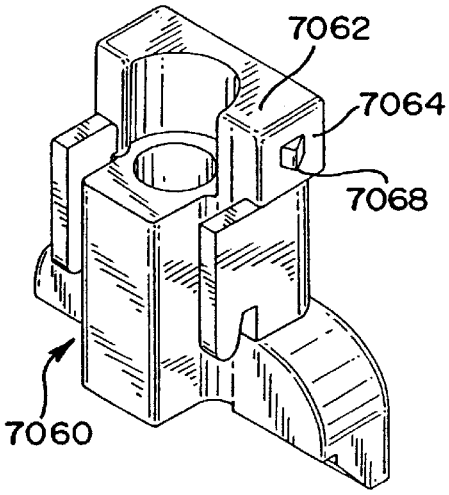

FIG. 153 is a perspective view of an alternative embodiment of a draw block.

Figure 154:
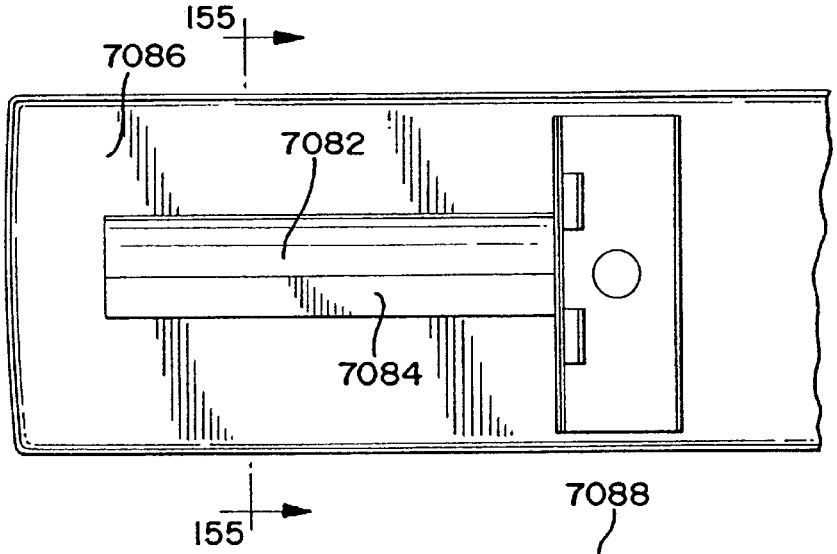

FIG. 154 is an inner end view of an end cover.

Figure 155:
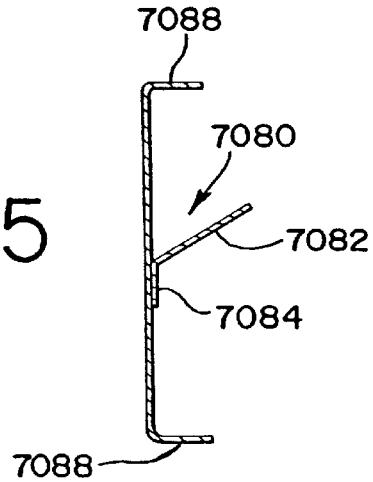

FIG. 155 is a side view of the end cover shown in FIG. 154.

Figure 156:
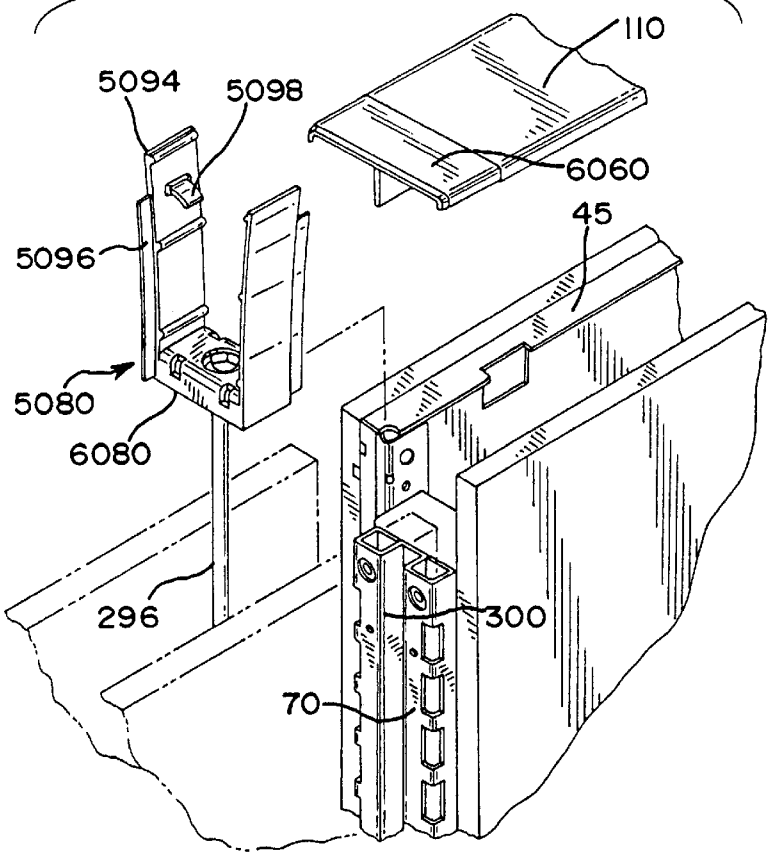

FIG. 156 is a partially exploded perspective view of an alternative embodiment of a wall panel assembly.

Figure 157:
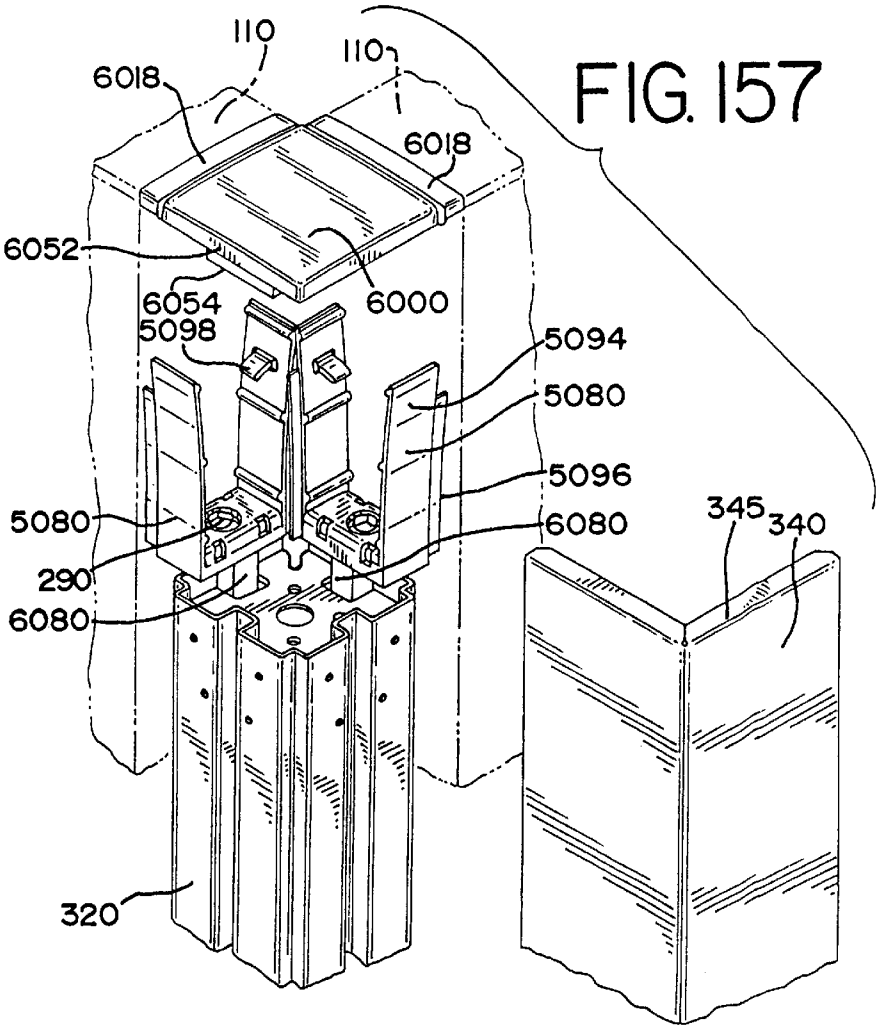

FIG. 157 is a partially exploded perspective view of a corner post and light seals with a corner post cap.

Figure 158:
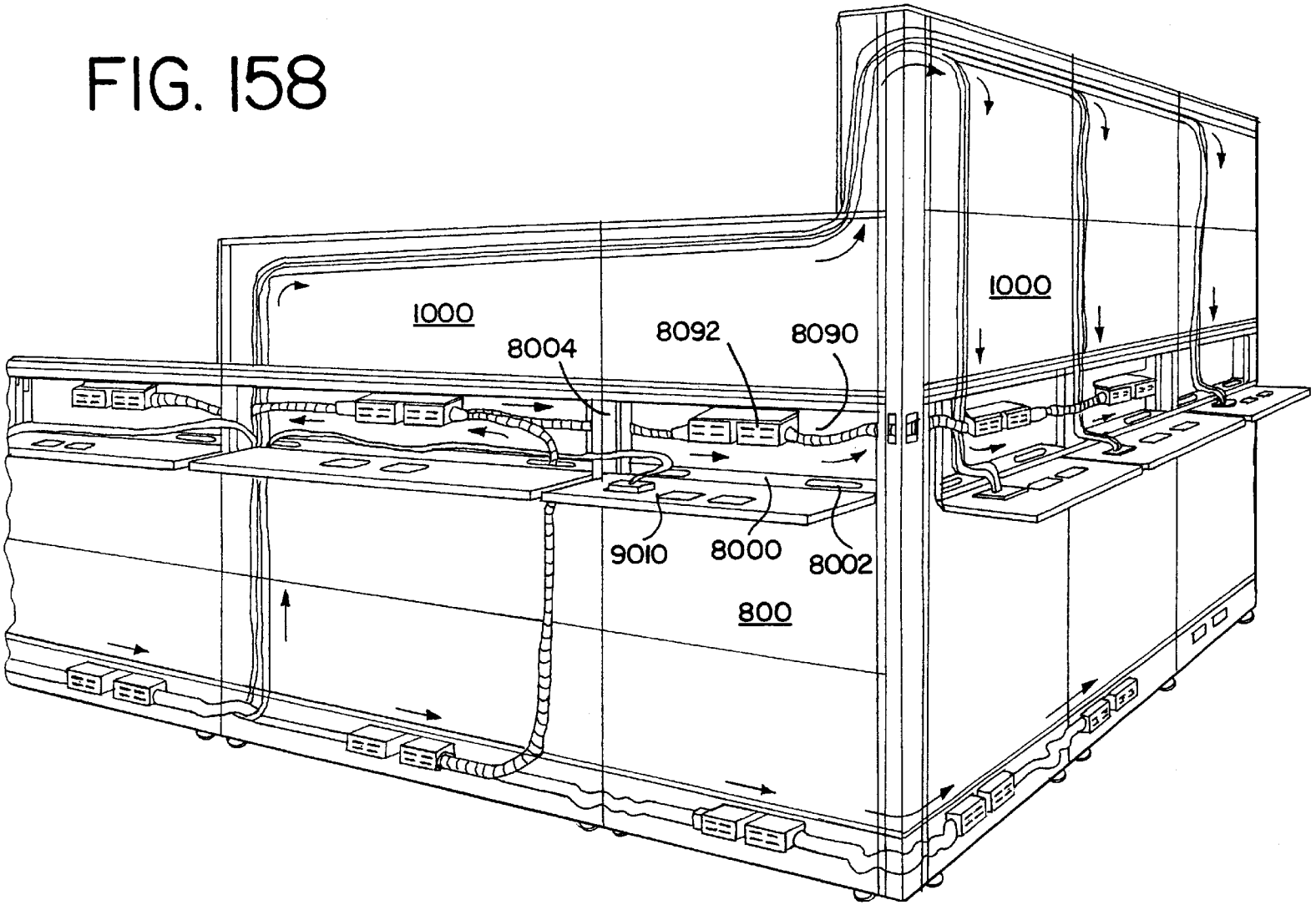

FIG. 158 is a perspective view of one embodiment of a stackable wall panel system.

Figure 159:
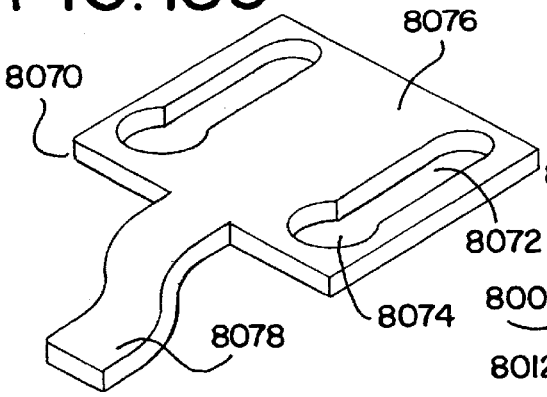

FIG. 159 is a perspective view of a connector member.

Figure 160:
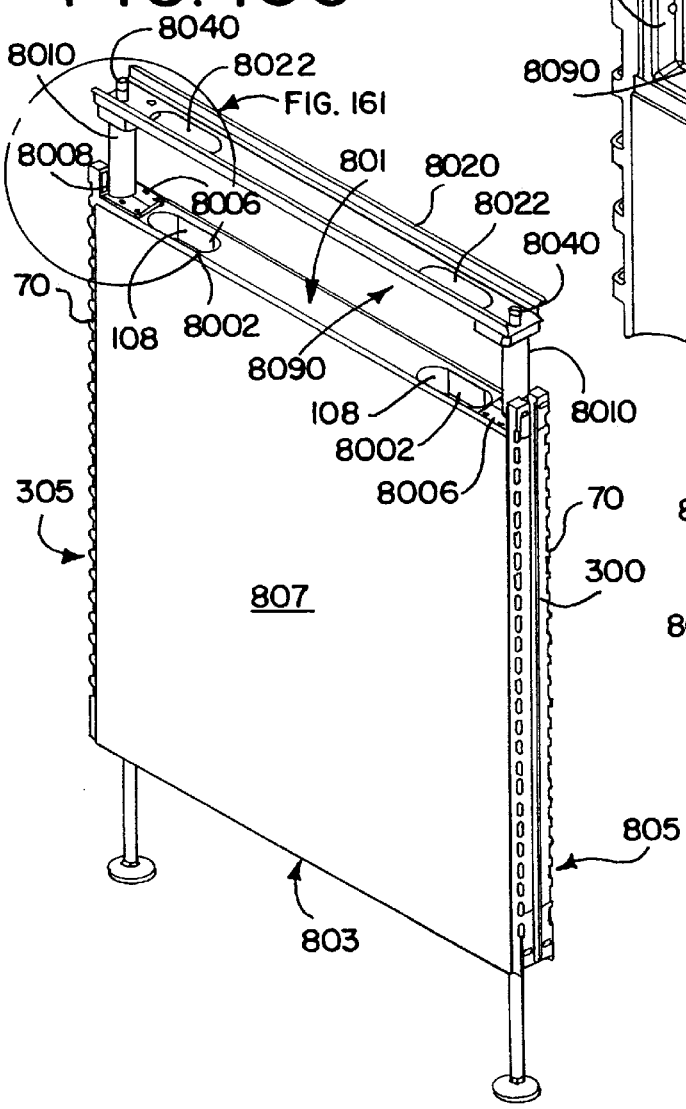

FIG. 160 is a perspective view of a lower wall panel having a pair of stanchions and a rail connected thereto.

Figure 161:
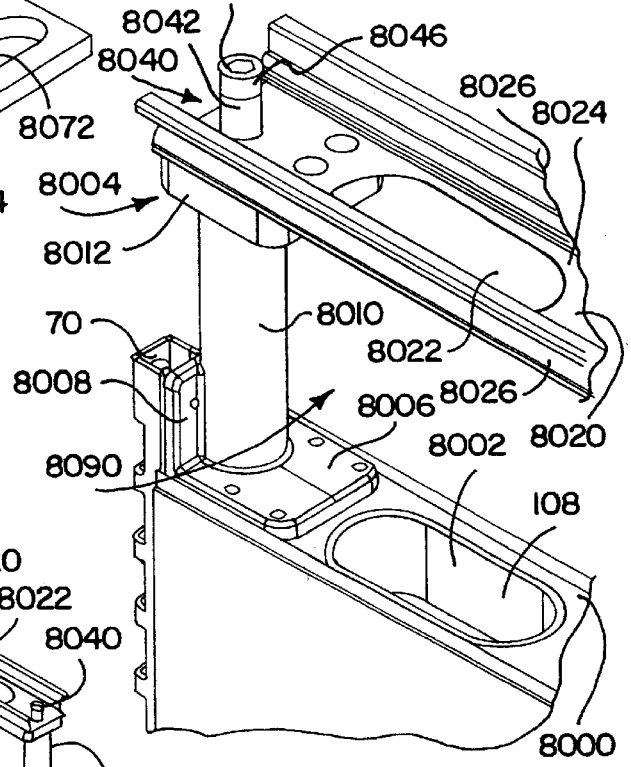

FIG. 161 is an enlarged partial perspective view of a stanchion and rail connected to a lower wall panel.

Figure 162:
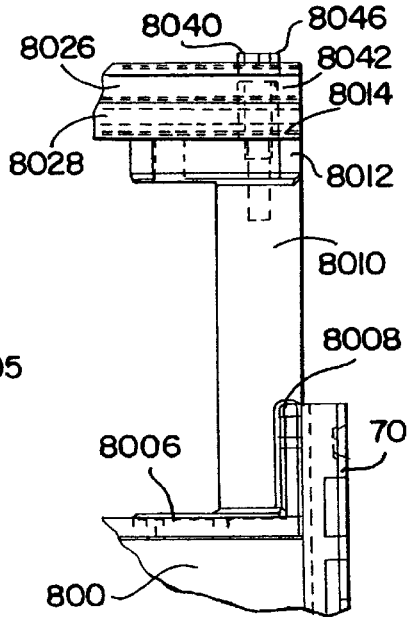

FIG. 162 is a side view of the stanchion, rail and lower wall panel shown in FIG. 161.

Figure 163:
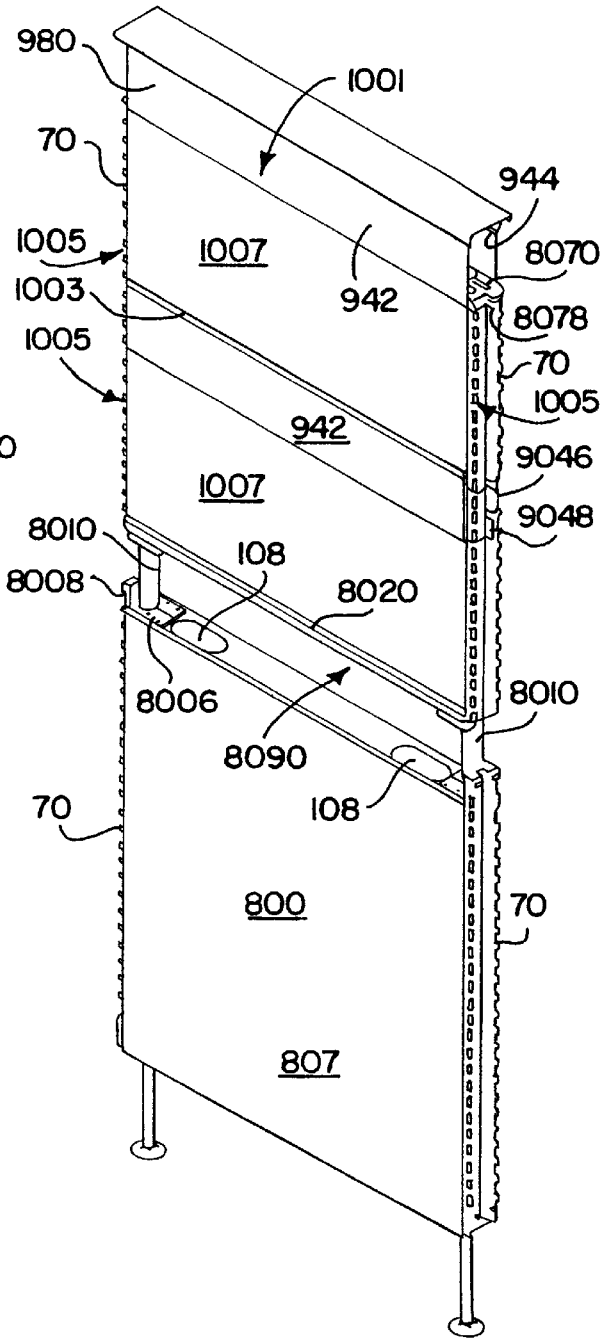

FIG. 163 is a perspective view of a lower wall panel with a first and second upper wall panel connected thereto.

Figure 164:
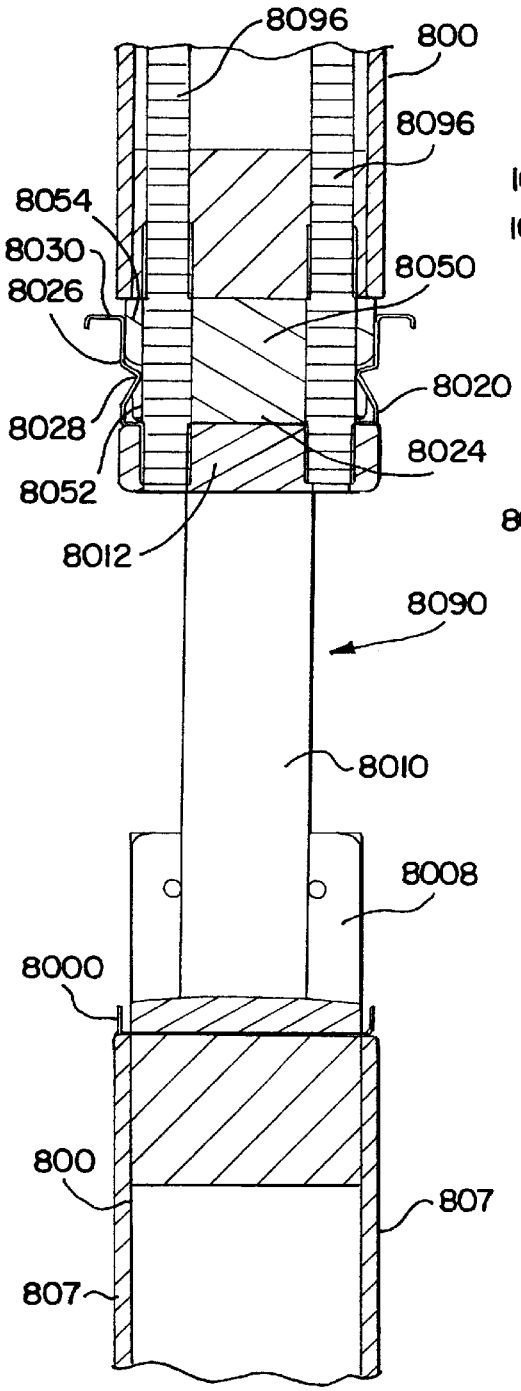

FIG. 164 is an enlarged partial end view of an upper and lower wall panel with a stanchion disposed therebetween.

Figure 165:
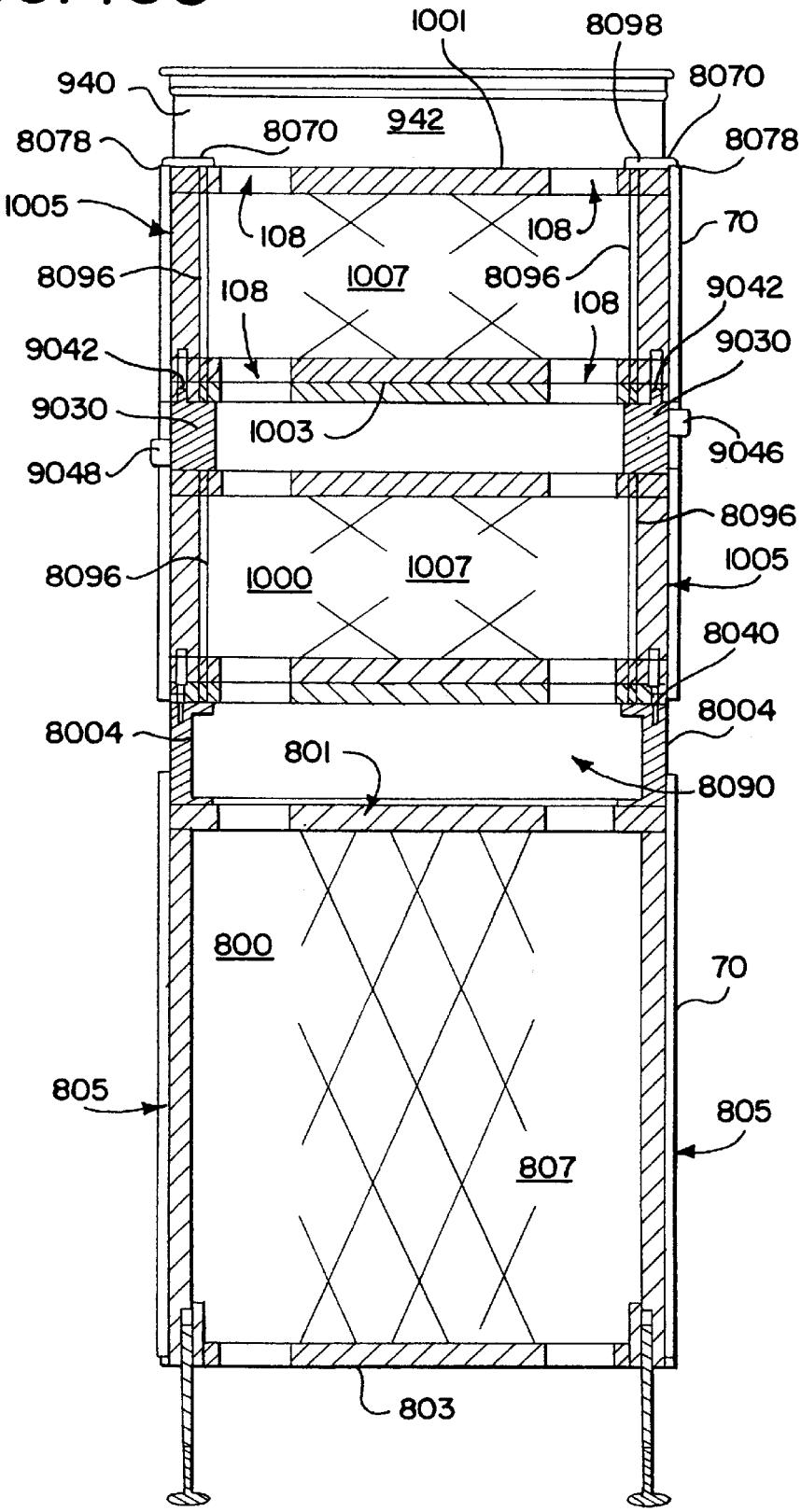

FIG. 165 is a side view of the stackable wall panel assembly shown in FIG. 163.

Figure 166:
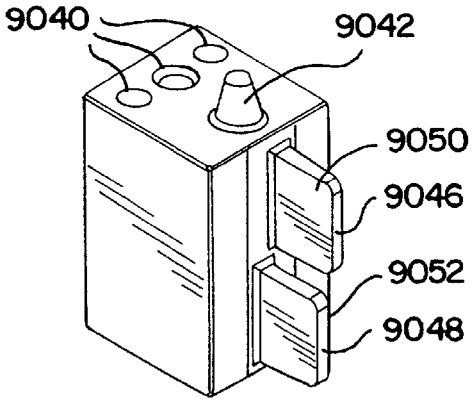

FIG. 166 is a perspective view of an alternative embodiment of a stanchion.

Figure 167:
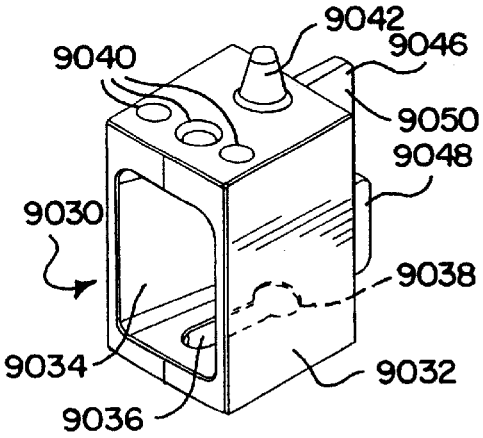

FIG. 167 is an opposite perspective view of the stanchion shown in FIG. 166.

Figure 168:
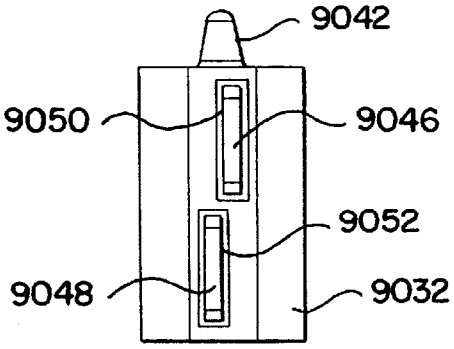

FIG. 168 is an end view of the stanchion shown in FIG. 166.

Figure 169:
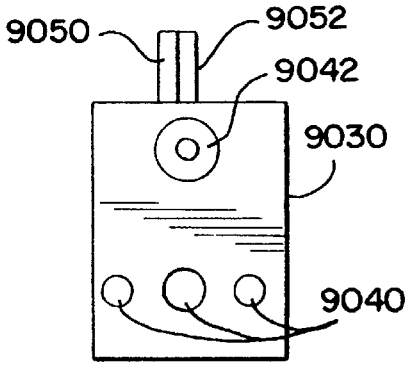

FIG. 169 is a top view of the stanchion shown in FIG. 166.

Figure 170:
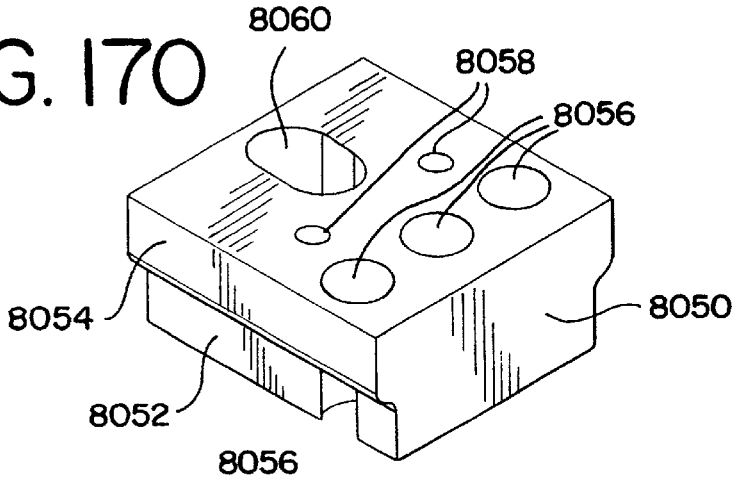

FIG. 170 is a perspective view of a spacer member.

Figure 171:
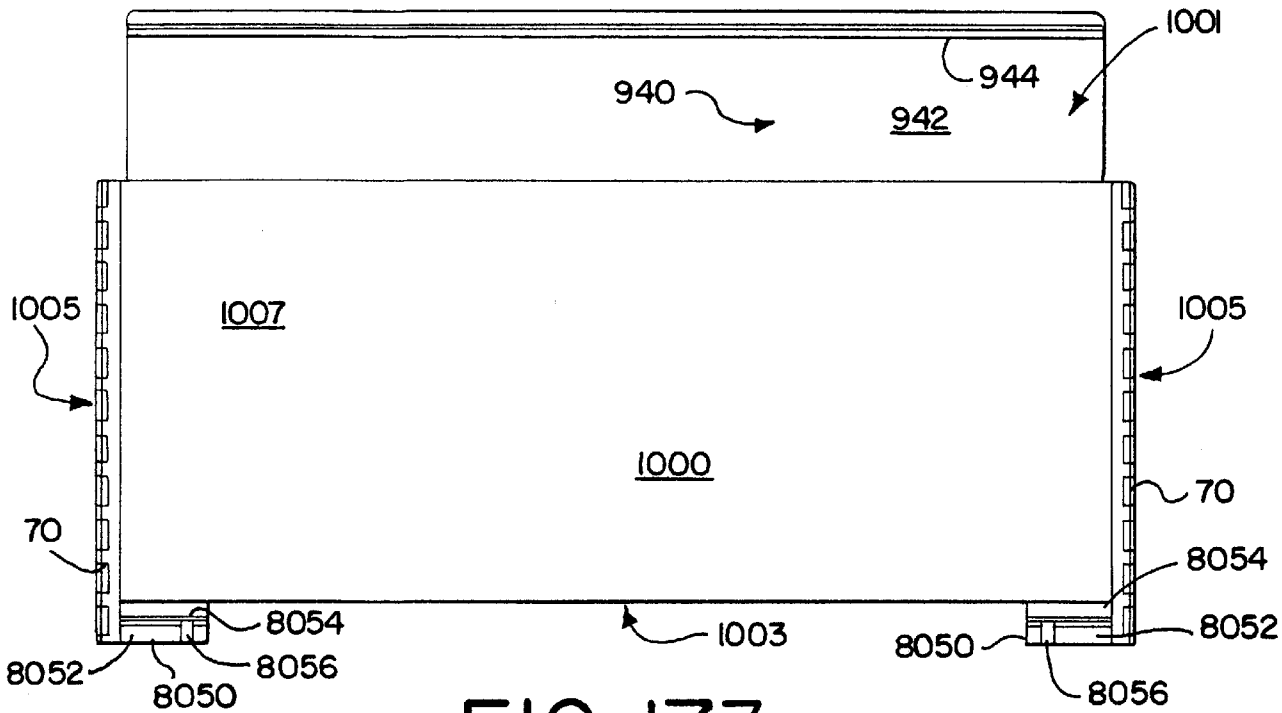

FIG. 171 is a side view of an upper wall panel with a pair of spacer members affixed thereto.

Figure 172:
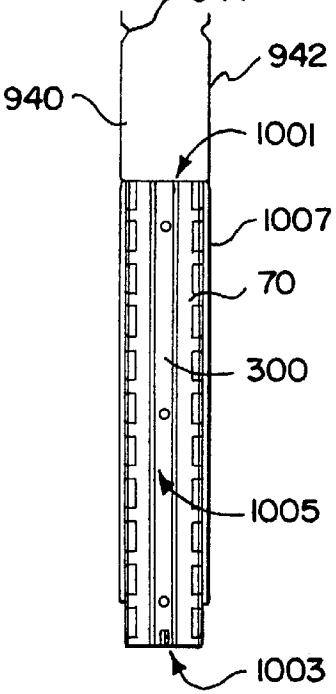

FIG. 172 is an end view of the upper wall panel shown in FIG. 171.

Figure 173:
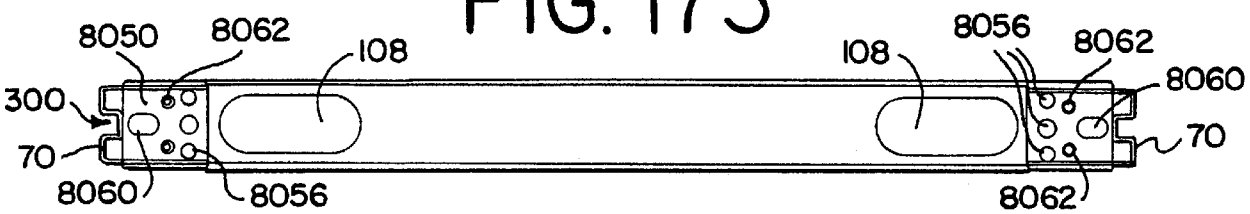

FIG. 173 is a bottom view of the upper wall panel shown in FIG. 171.

Figure 174:
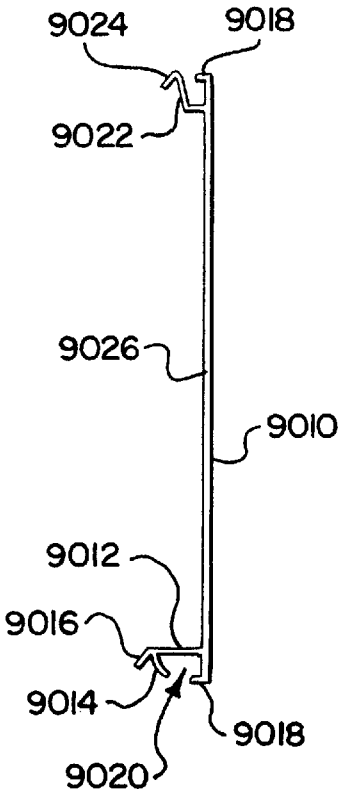

FIG. 174 is an end view of a cover.

Figure 175:
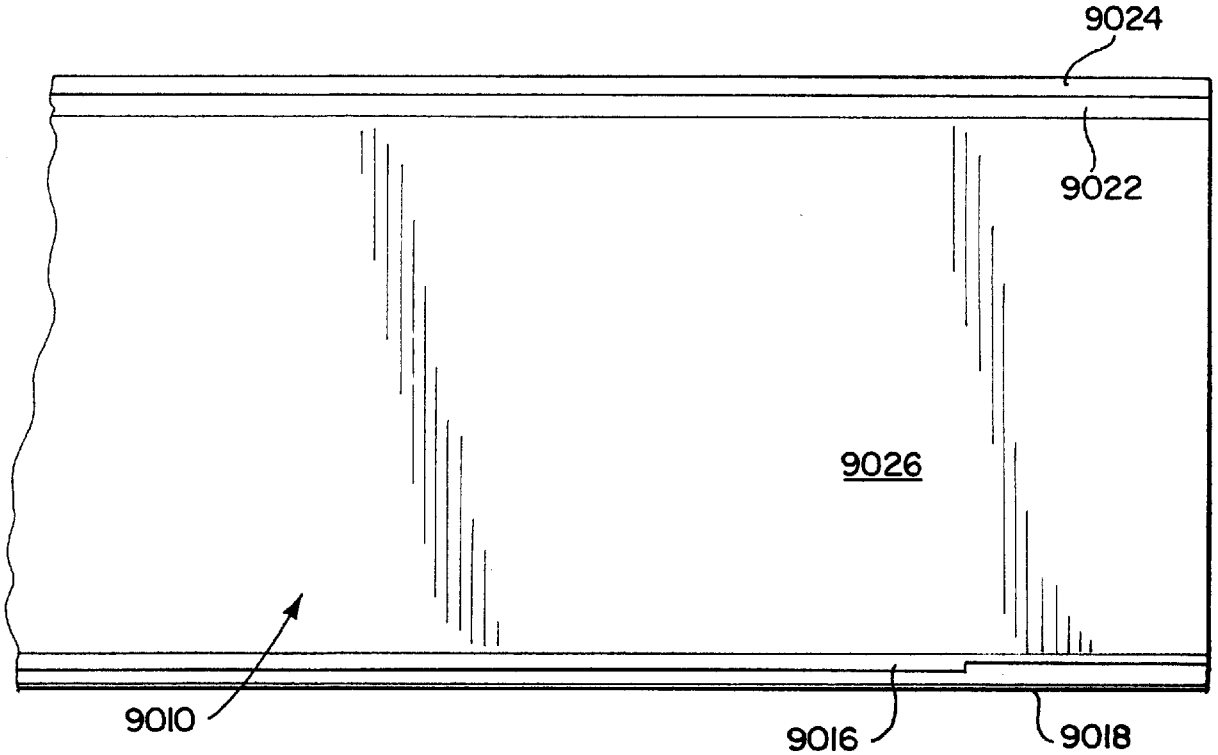

FIG. 175 is a side view of a cover.

Figure 176:
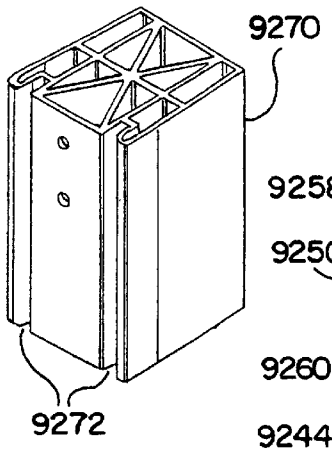

FIG. 176 is an upper perspective view of an alternative embodiment of a stanchion.

Figure 177:
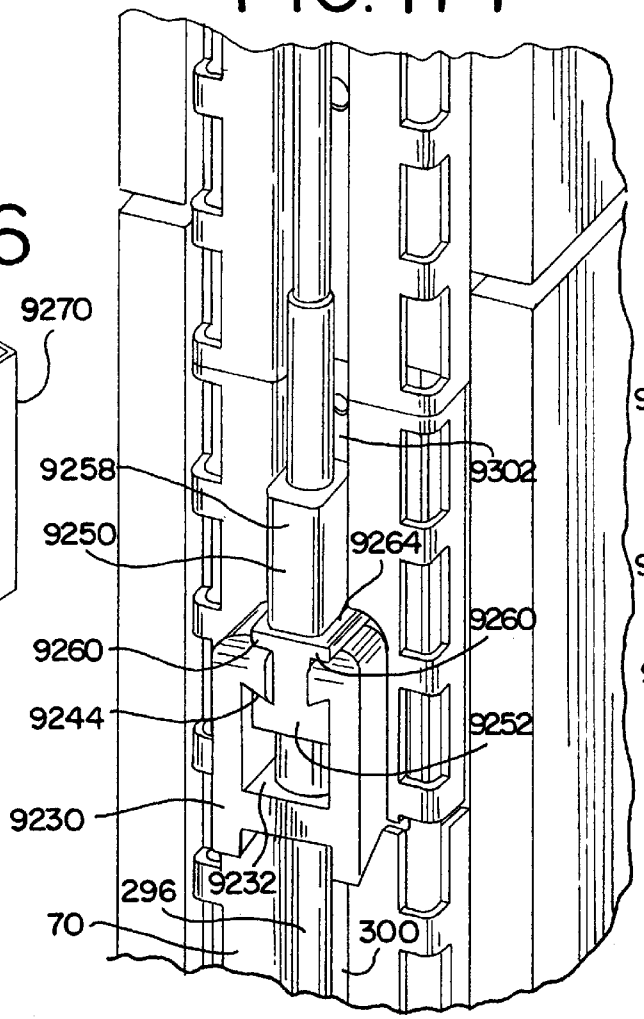

FIG. 177 is a partial perspective view of a connector system connecting a first and second upper wall panel.

Figure 178:
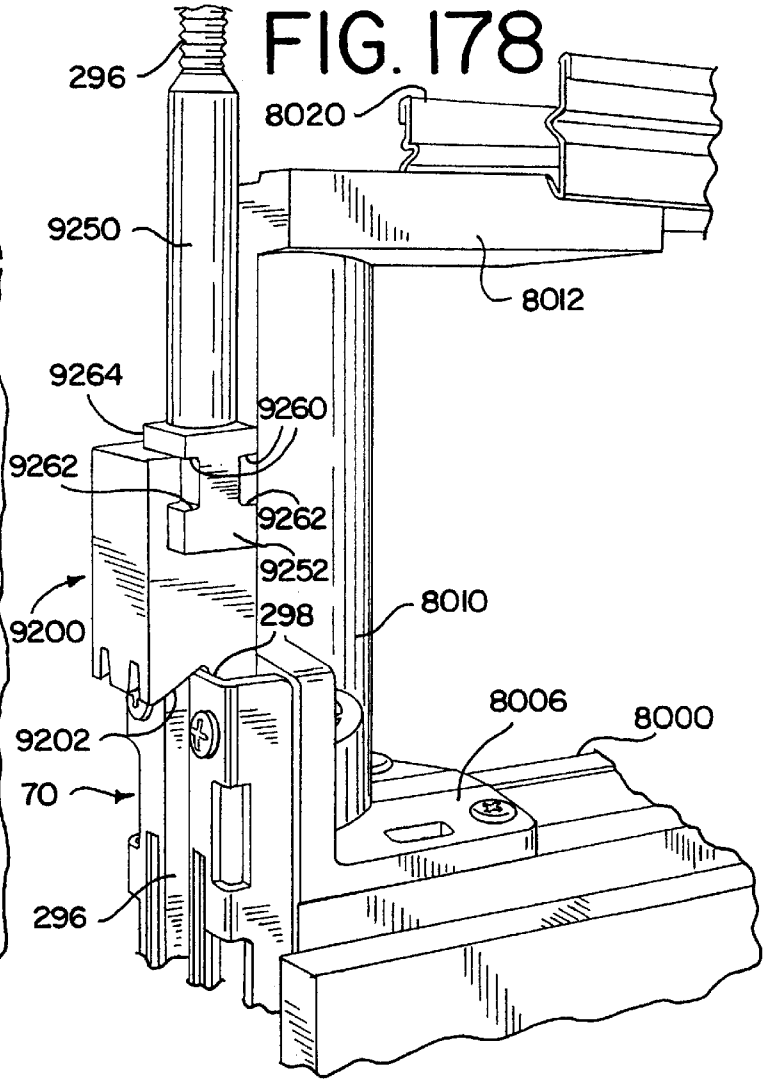

FIG. 178 is a partial perspective view of a connector system connected to a lower wall panel.

Figure 179:
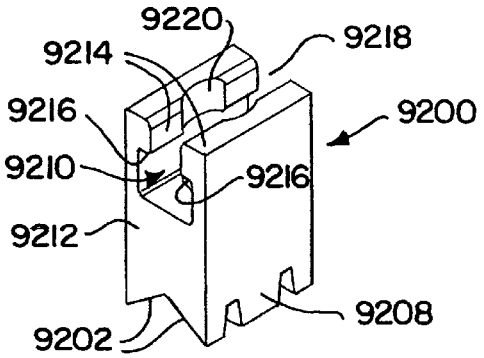

FIG. 179 is a top perspective view of an alternative embodiment of a draw block.

Figure 180:
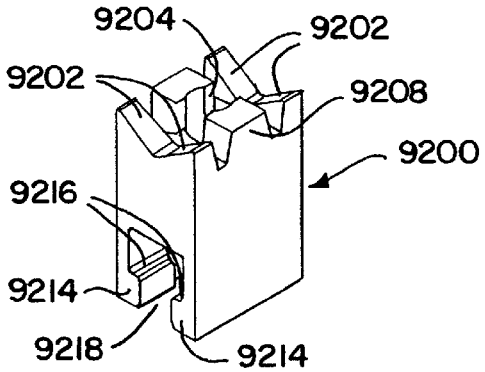

FIG. 180 is a bottom perspective view of the draw block shown in FIG. 179.

Figure 181:
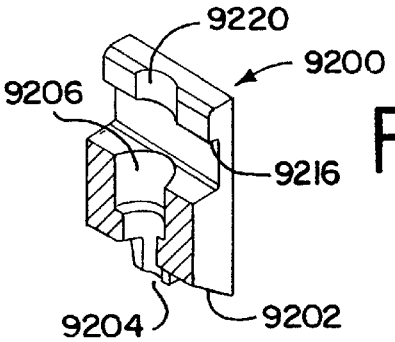

FIG. 181 is a partial cross-sectional perspective view of the draw block shown in FIG. 179.

Figure 182:
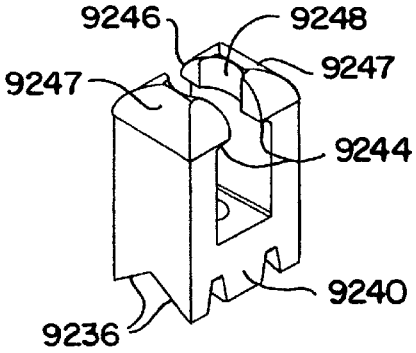

FIG. 182 is a top perspective view of an alternative embodiment of a draw block.

Figure 183:
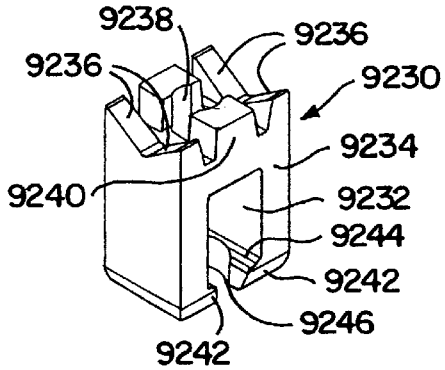

FIG. 183 is a bottom perspective view of the draw block shown in FIG. 182.

Figure 184:
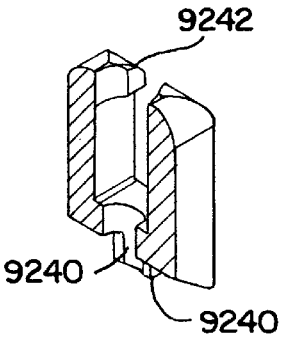

FIG. 184 is a partial cross-sectional perspective view of the draw block shown in FIG. 182.

Figure 185:
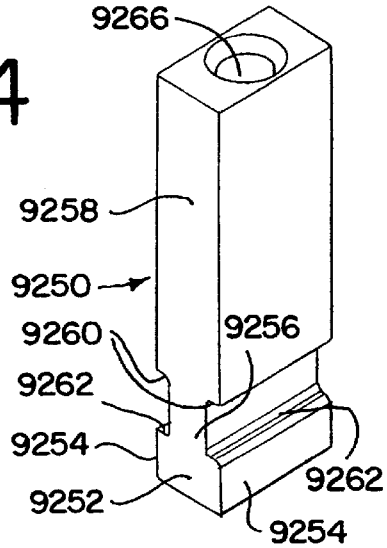

FIG. 185 is a perspective view of an insert.

Figure 186:
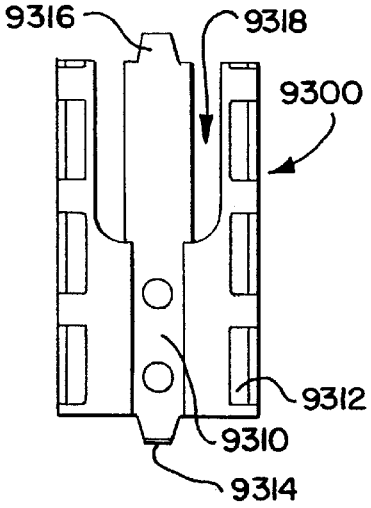

FIG. 186 is a front view of a hanger bracket insert.

Figure 187:
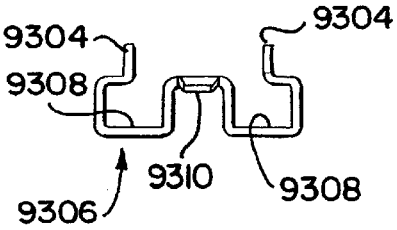

FIG. 187 is a top view of the hanger bracket insert shown in FIG. 186.

Figure 188:
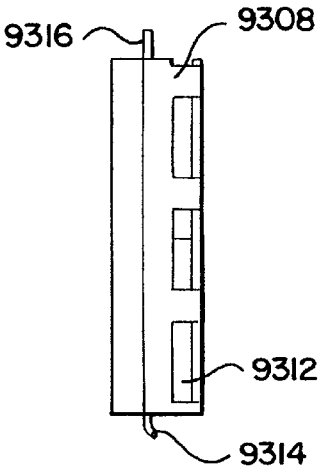

FIG. 188 is a side view of the hanger bracket insert shown in FIG. 186.

Figure 189:
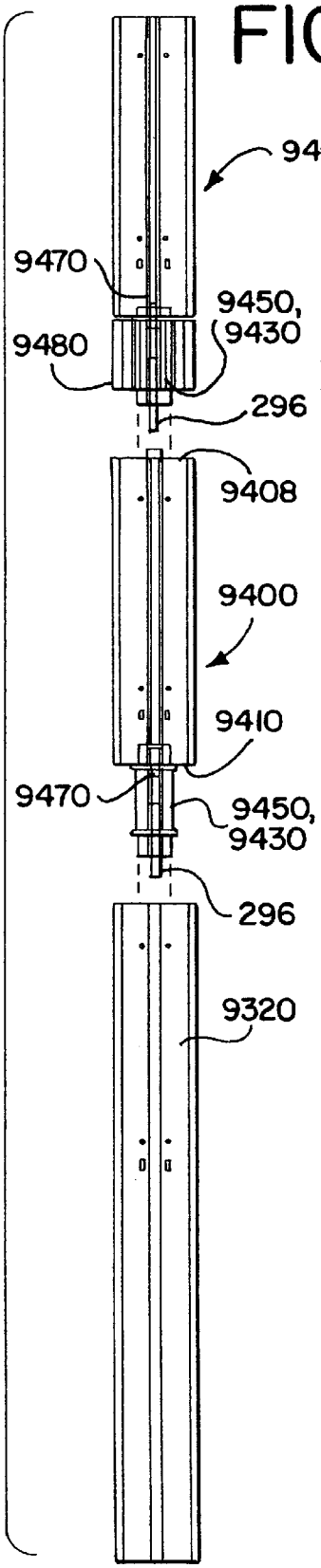

FIG. 189 is an exploded side view of a connector post assembly.

Figure 190:
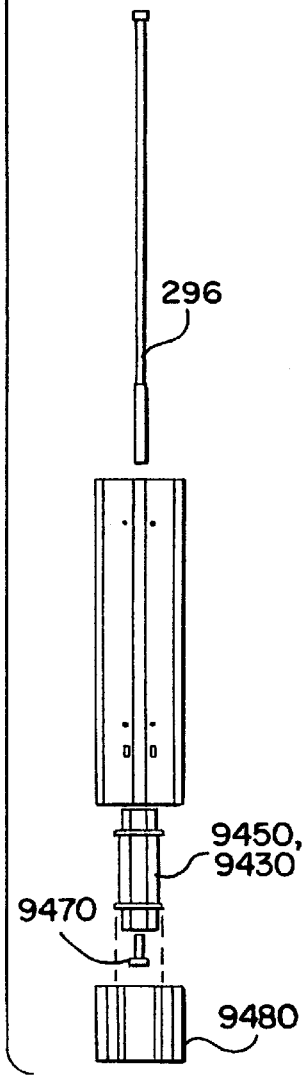

FIG. 190 is an enlarged exploded view of a first upper connector post connected to a lower connector post.

Figure 191:
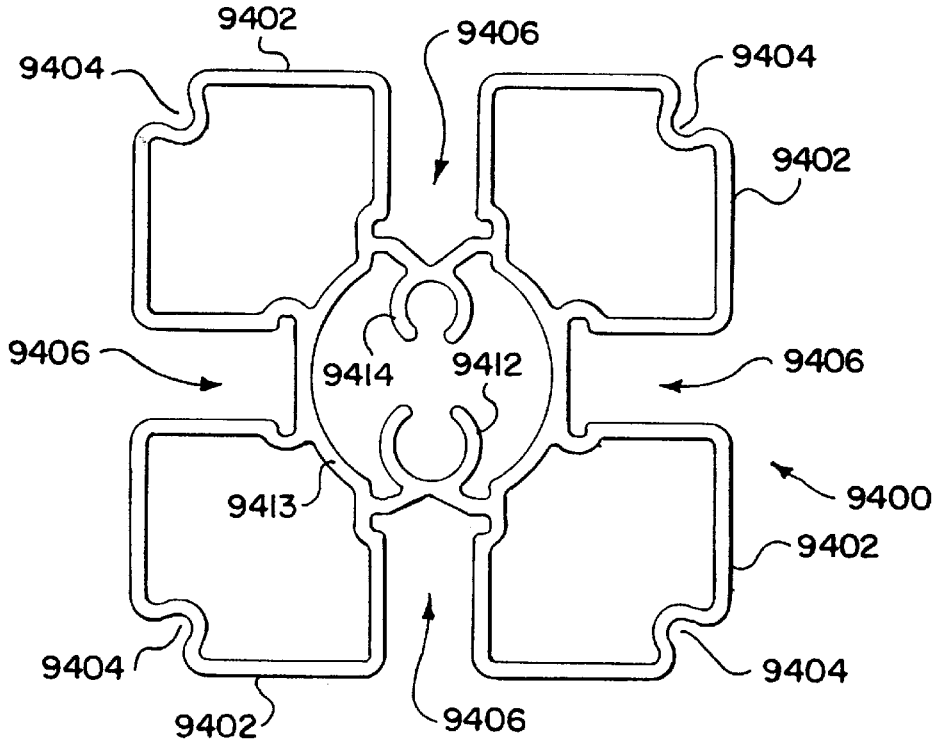

FIG. 191 is an end view of one embodiment of a connector post.

Figure 192:
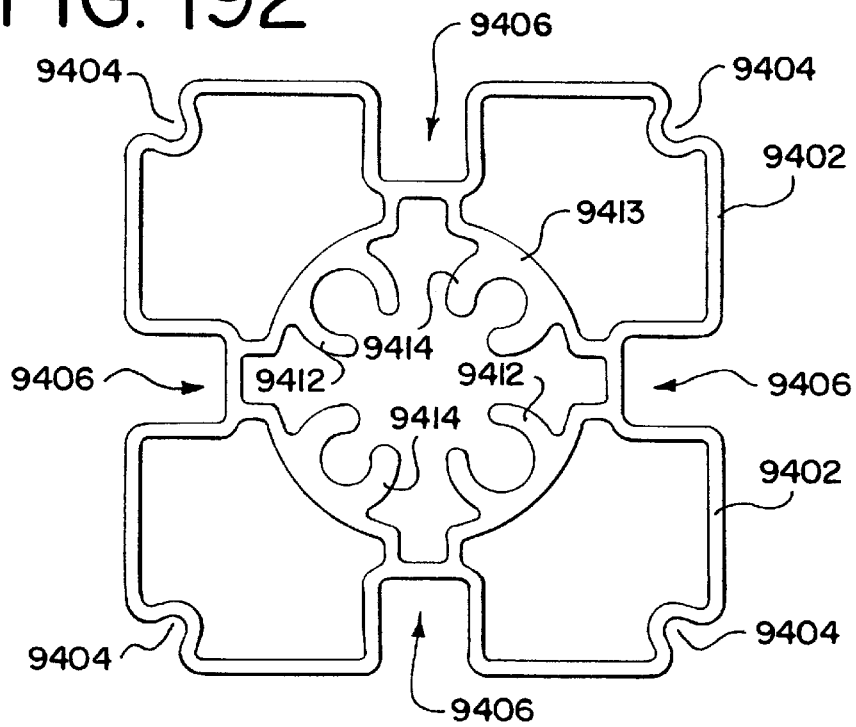

FIG. 192 is an end view of an alternative embodiment of a connector post.

Figure 193:
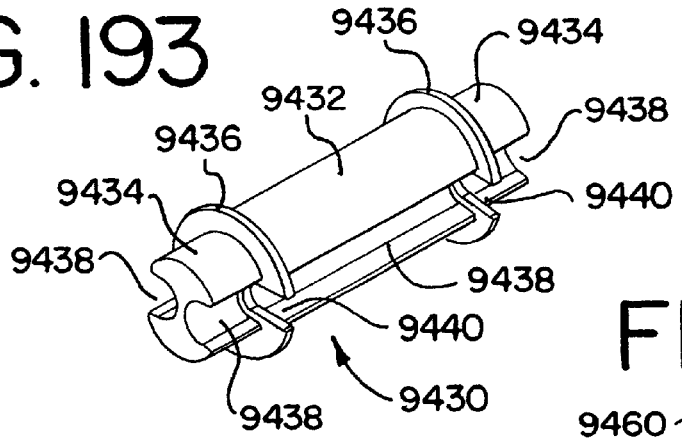

FIG. 193 is a perspective view of a first embodiment of a spacer post.

Figure 194:
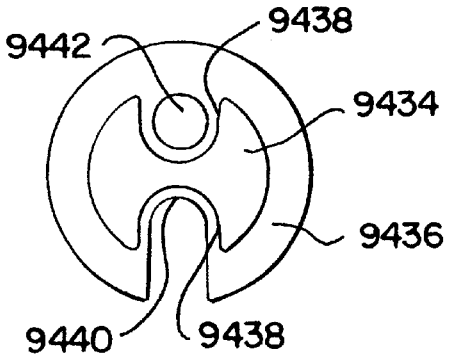

FIG. 194 is an end view of the spacer post shown in FIG. 193.

Figure 195:
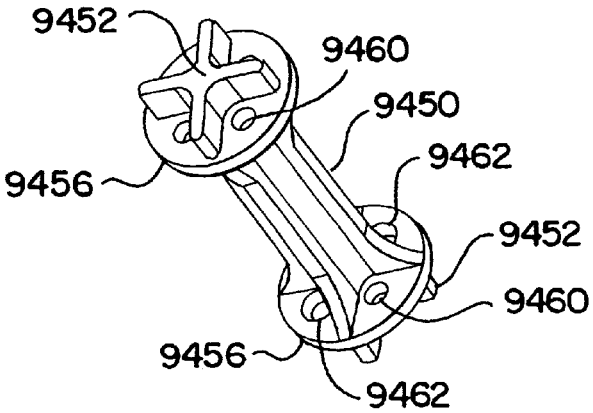

FIG. 195 is a perspective view of a second embodiment of a spacer post.

Figure 196:
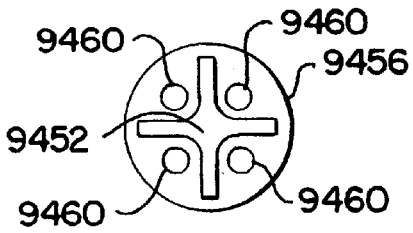

FIG. 196 is a top end view of the spacer post shown in FIG. 195.

Figure 197:
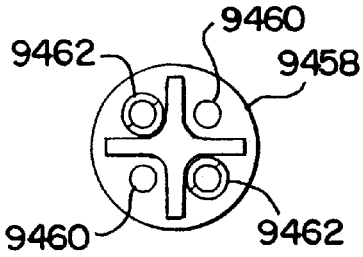

FIG. 197 is a bottom end view of the spacer post shown in FIG. 195.

Figure 198:
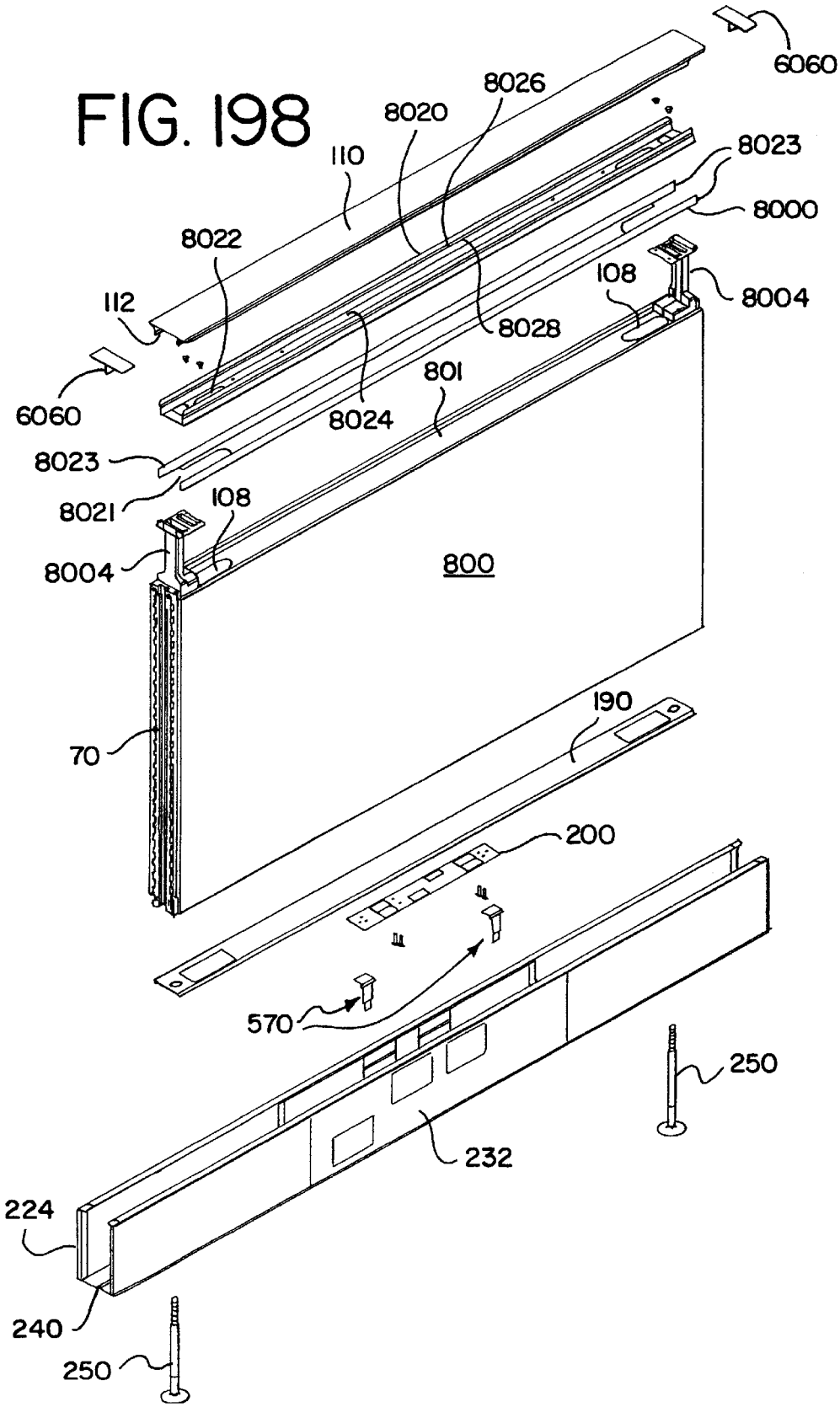

FIG. 198 is an exploded perspective view of one embodiment of a lower wall panel assembly.

Figure 199:
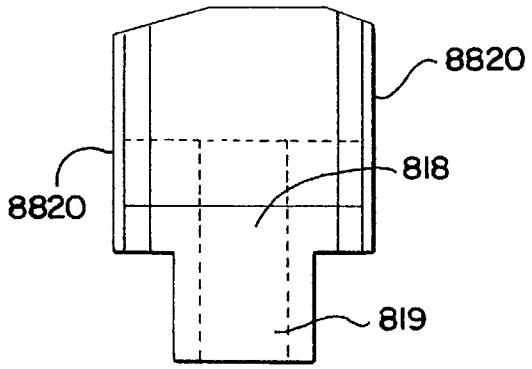

FIG. 199 is a partial end view of a bottom of an upper wall panel.

Figure 200:
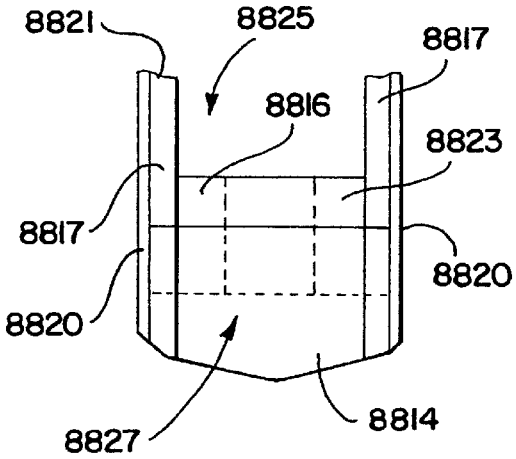

FIG. 200 is a partial end view of a top of a wall panel.

Figure 201:
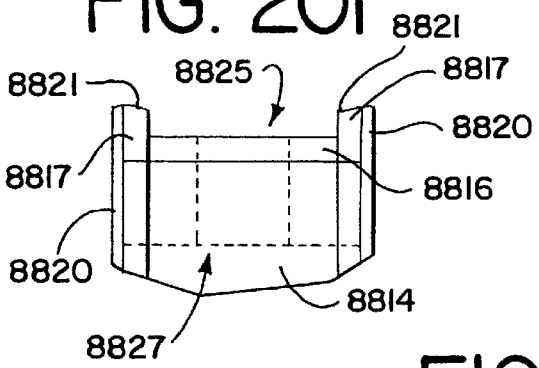

FIG. 201 is a partial end view of a top of a lower wall panel used in the beltline stackable assembly.

Figure 202:
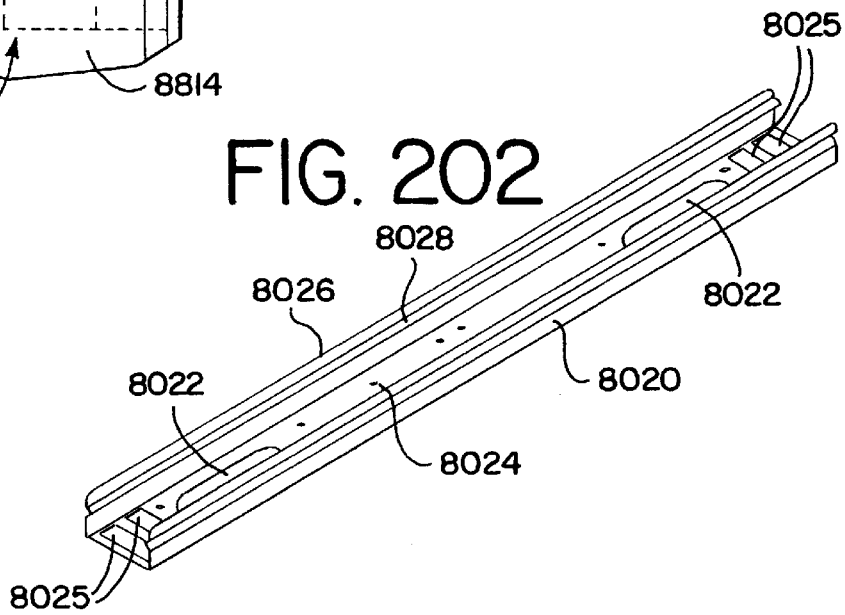

FIG. 202 is a perspective view of an alternative embodiment of a rail.

Figure 203:
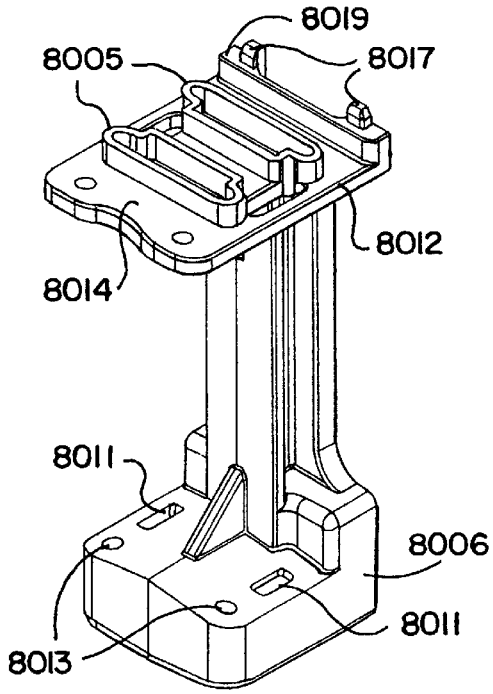

FIG. 203 is a perspective view of a stanchion.

Figure 204:
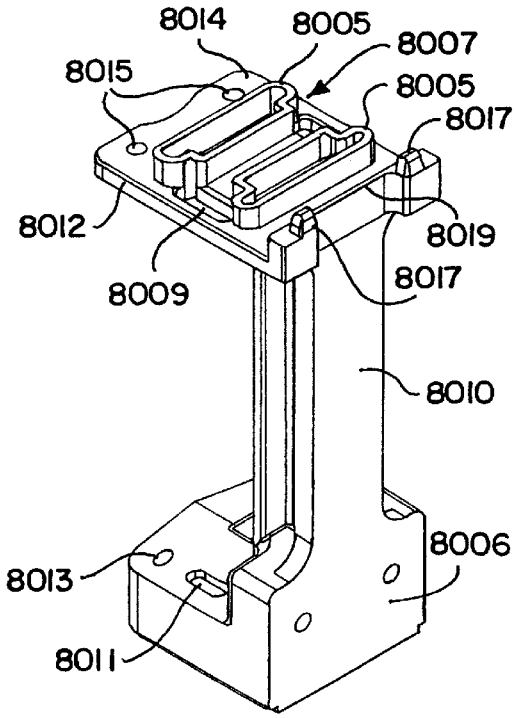

FIG. 204 is an opposite perspective view of the stanchion shown in FIG. 203.

Figure 205:
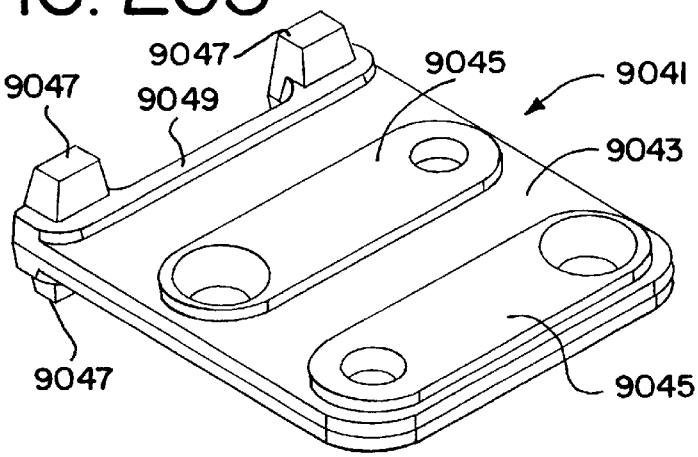

FIG. 205 is a perspective view of a locator member.

Figure 206:
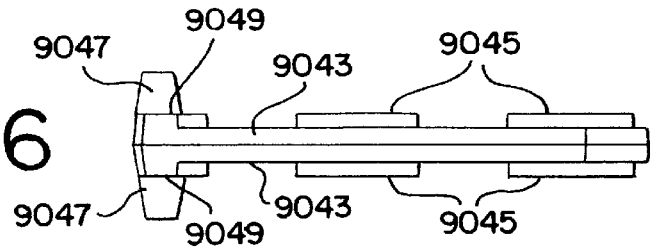

FIG. 206 is a side view of the locator member shown in FIG. 205.

Figure 207:
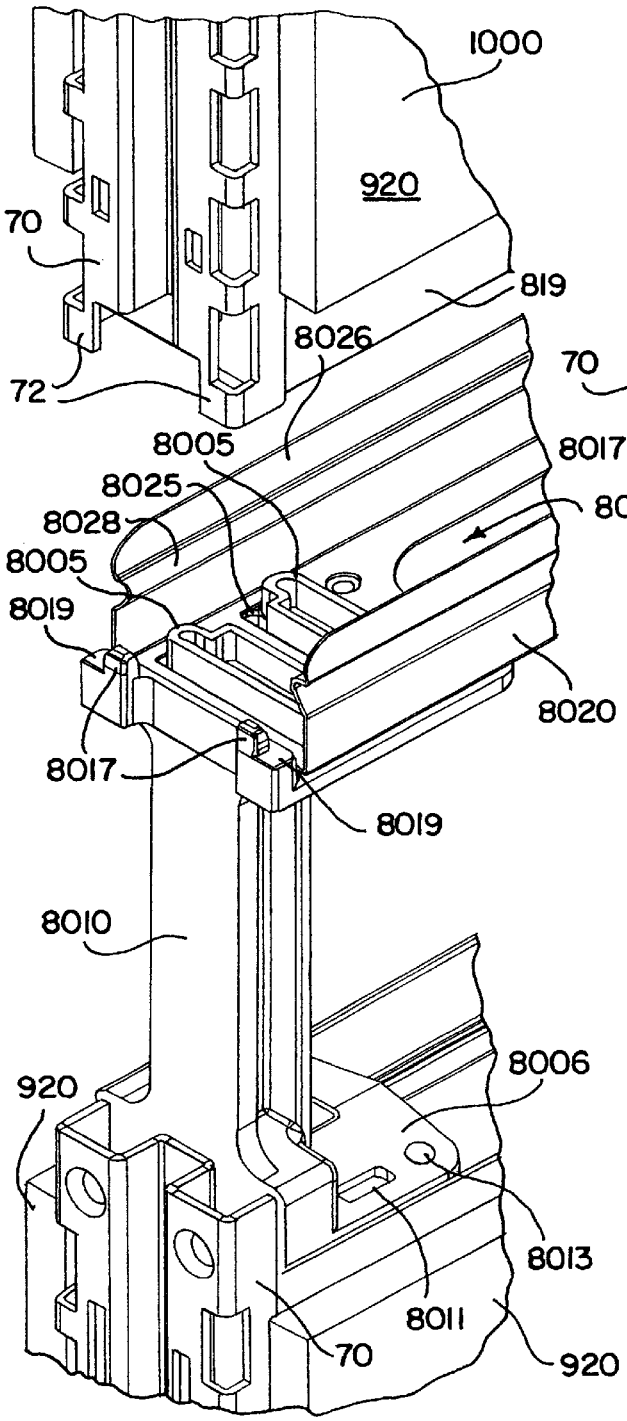

FIG. 207 is a partial perspective view of a beltline stackable assembly.

Figure 208:
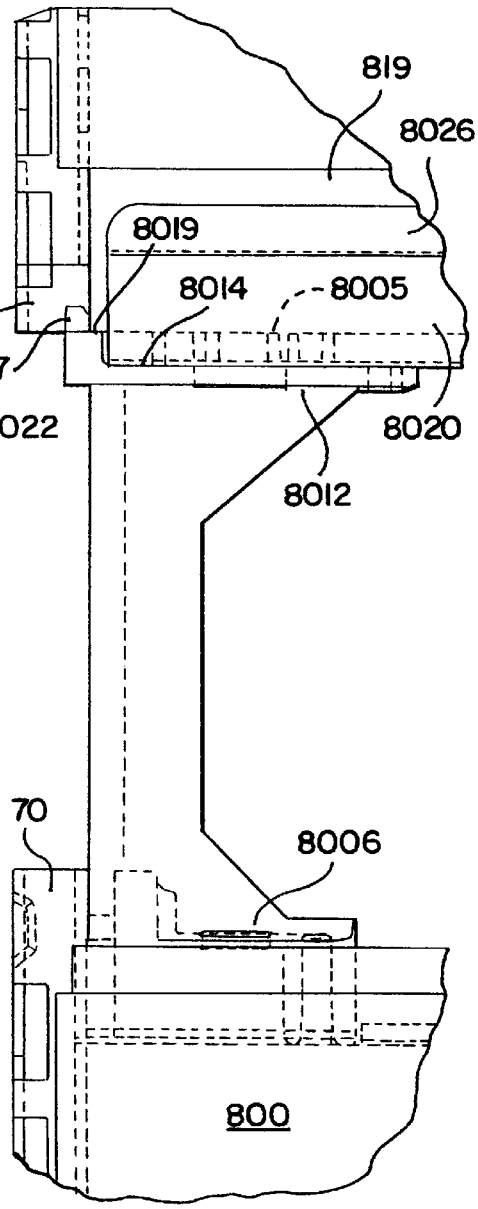

FIG. 208 is a partial side view of the assembly shown in FIG. 207.

Figure 209:
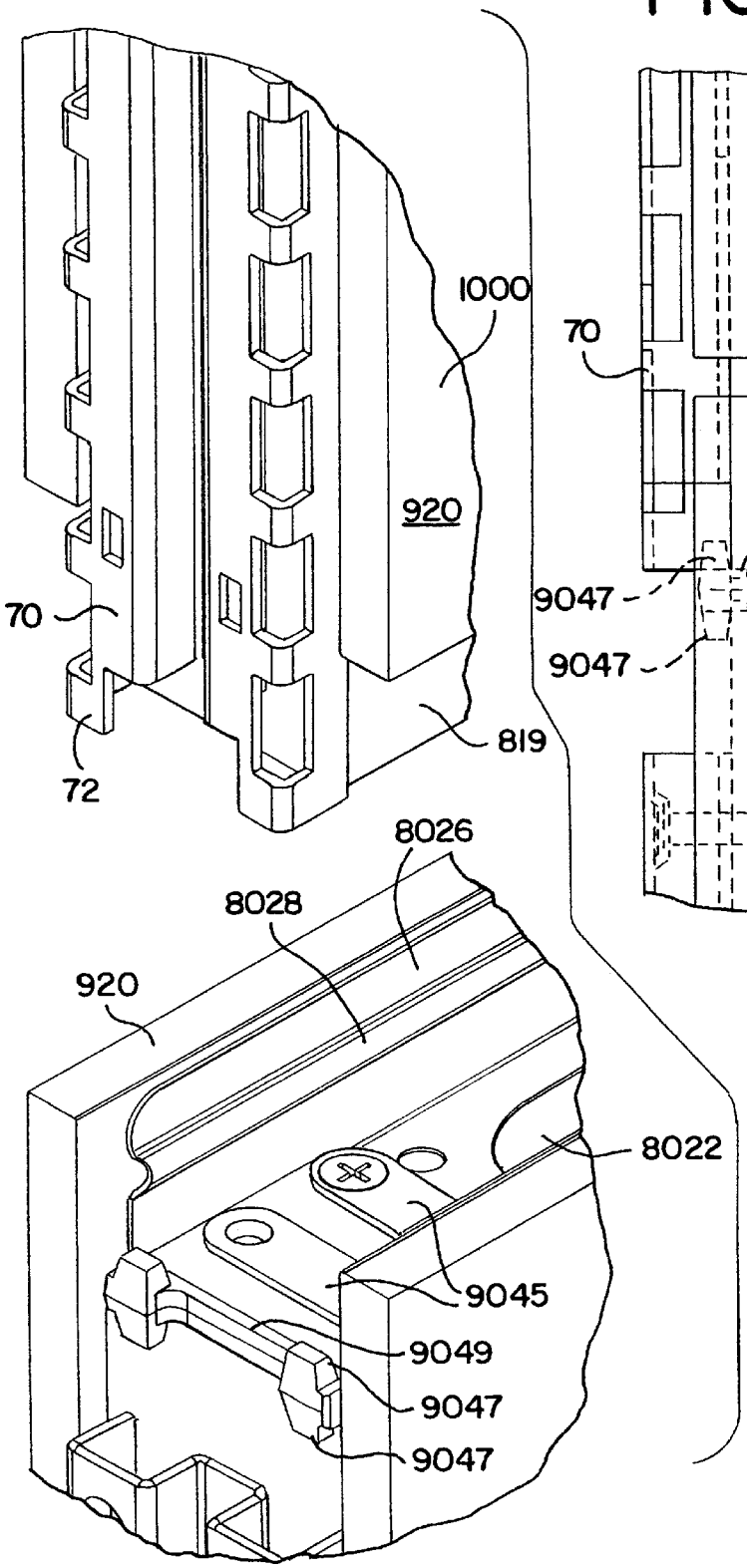

FIG. 209 is a partial perspective view of a stackable assembly.

Figure 210:
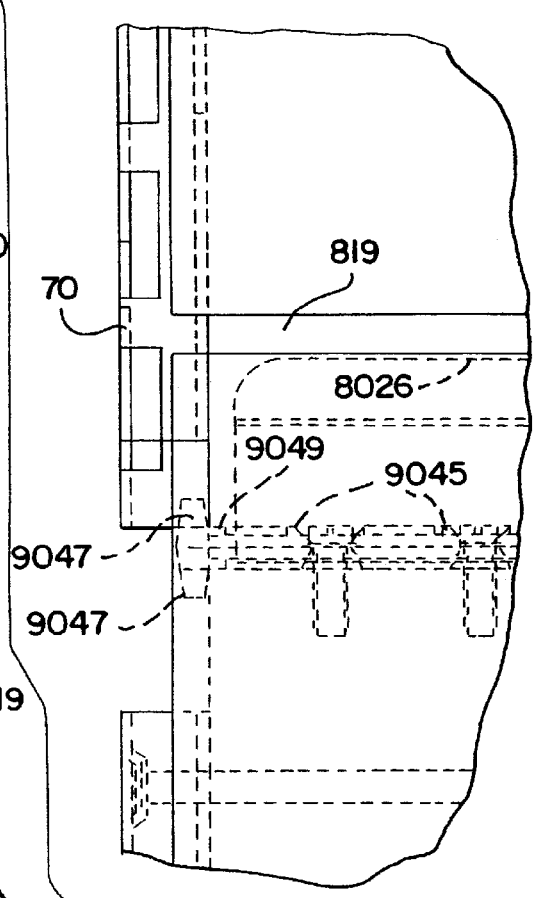

FIG. 210 is a partial side view of the assembly shown in FIG. 209.

Figure 211:
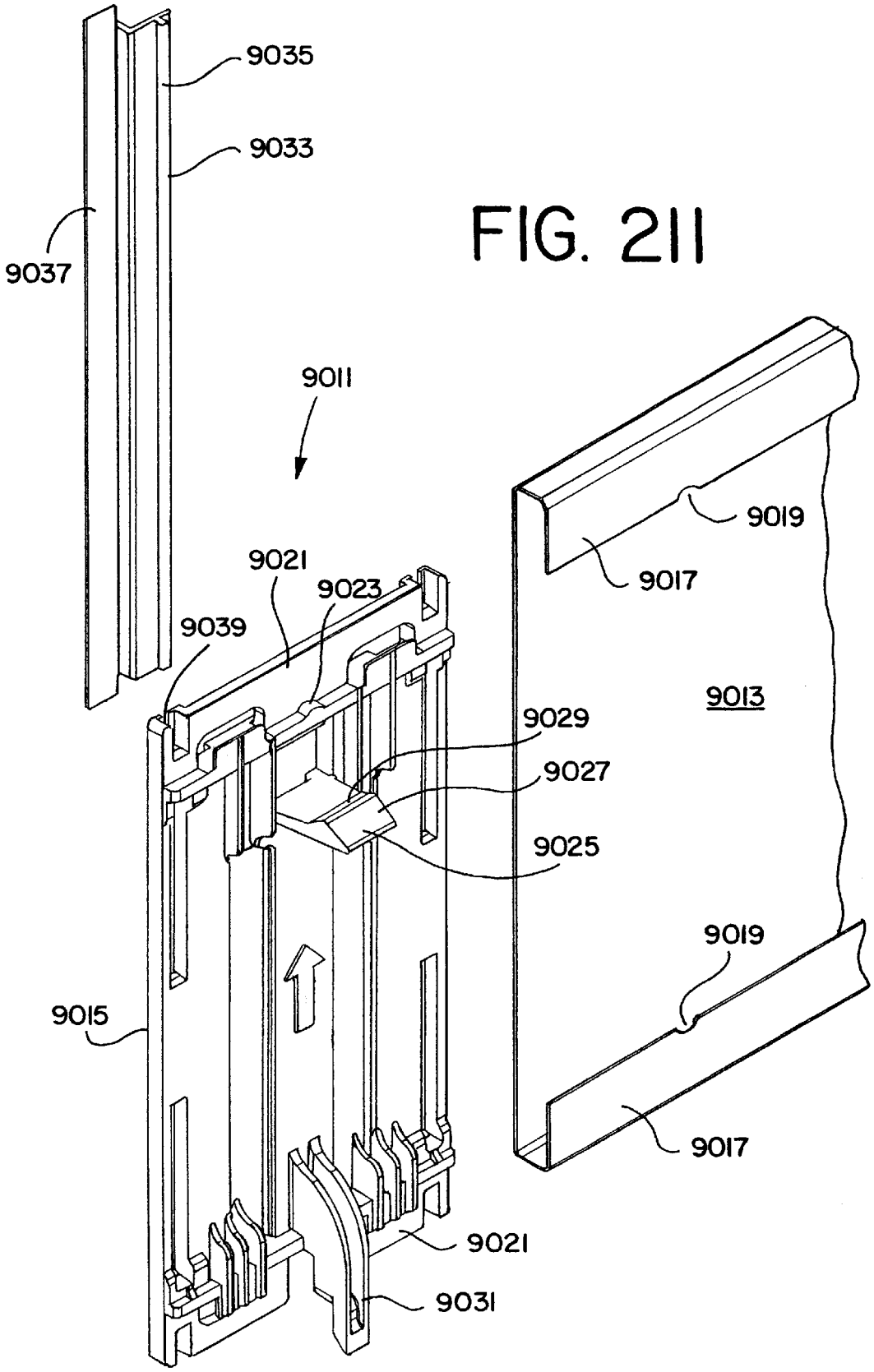

FIG. 211 is an exploded perspective view of a cover assembly.

Figure 212:
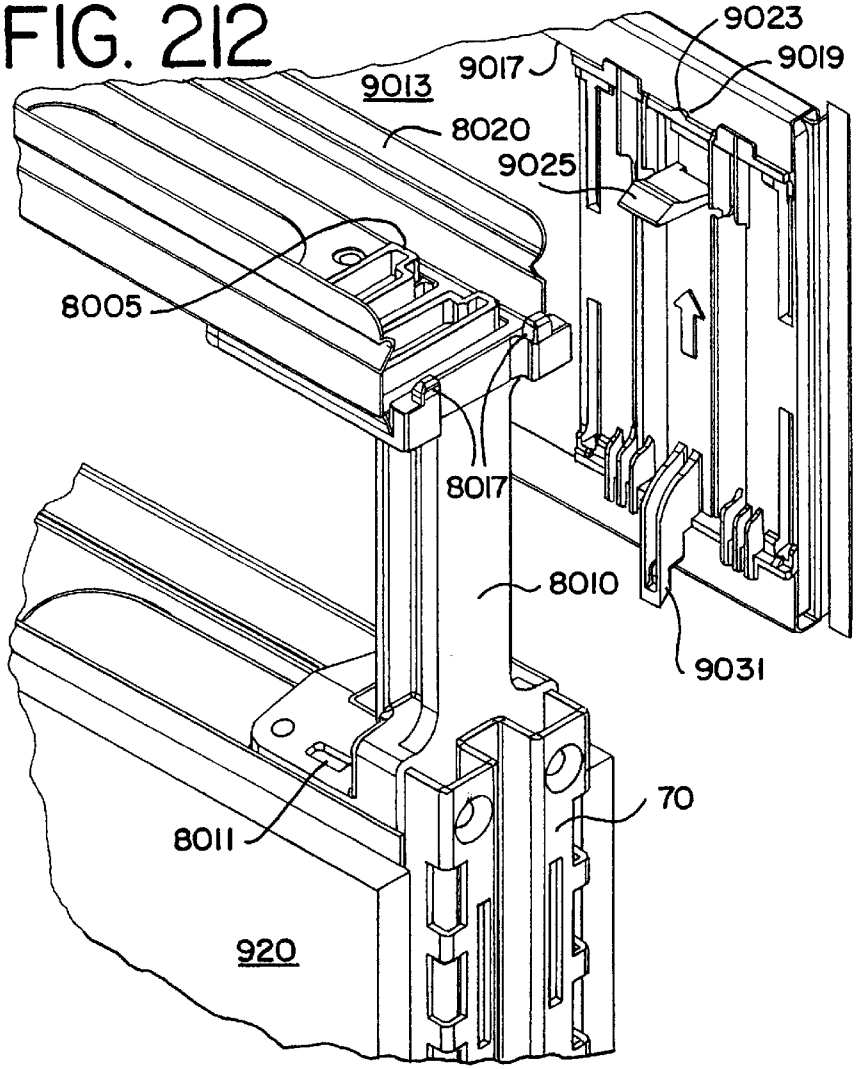

FIG. 212 is an exploded perspective view of a cover assembly and beltline wall panel.

Figure 213:
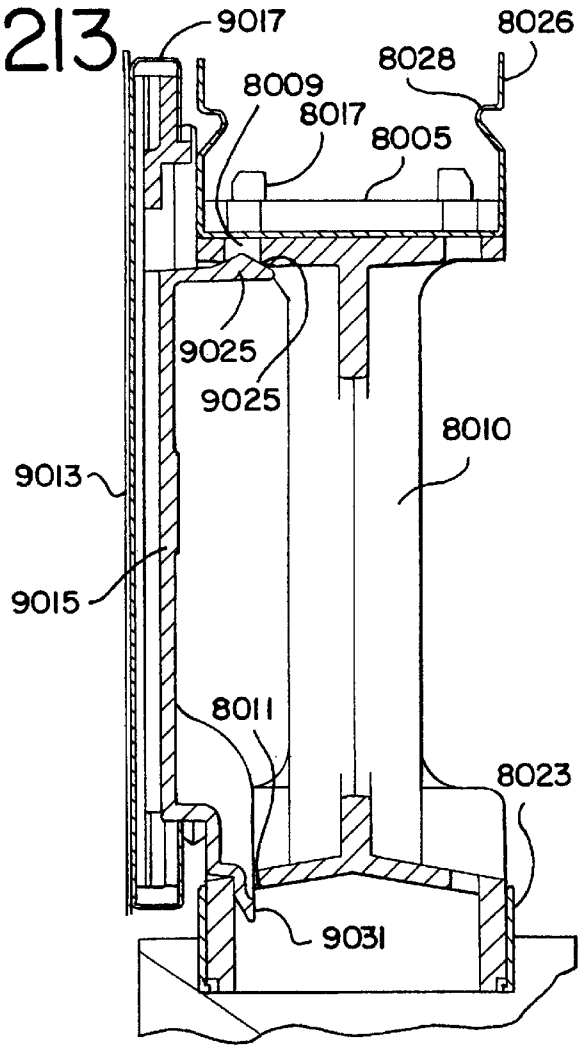

FIG. 213 is an end view of a cover assembly mounted to a beltline wall panel.

Figure 214:
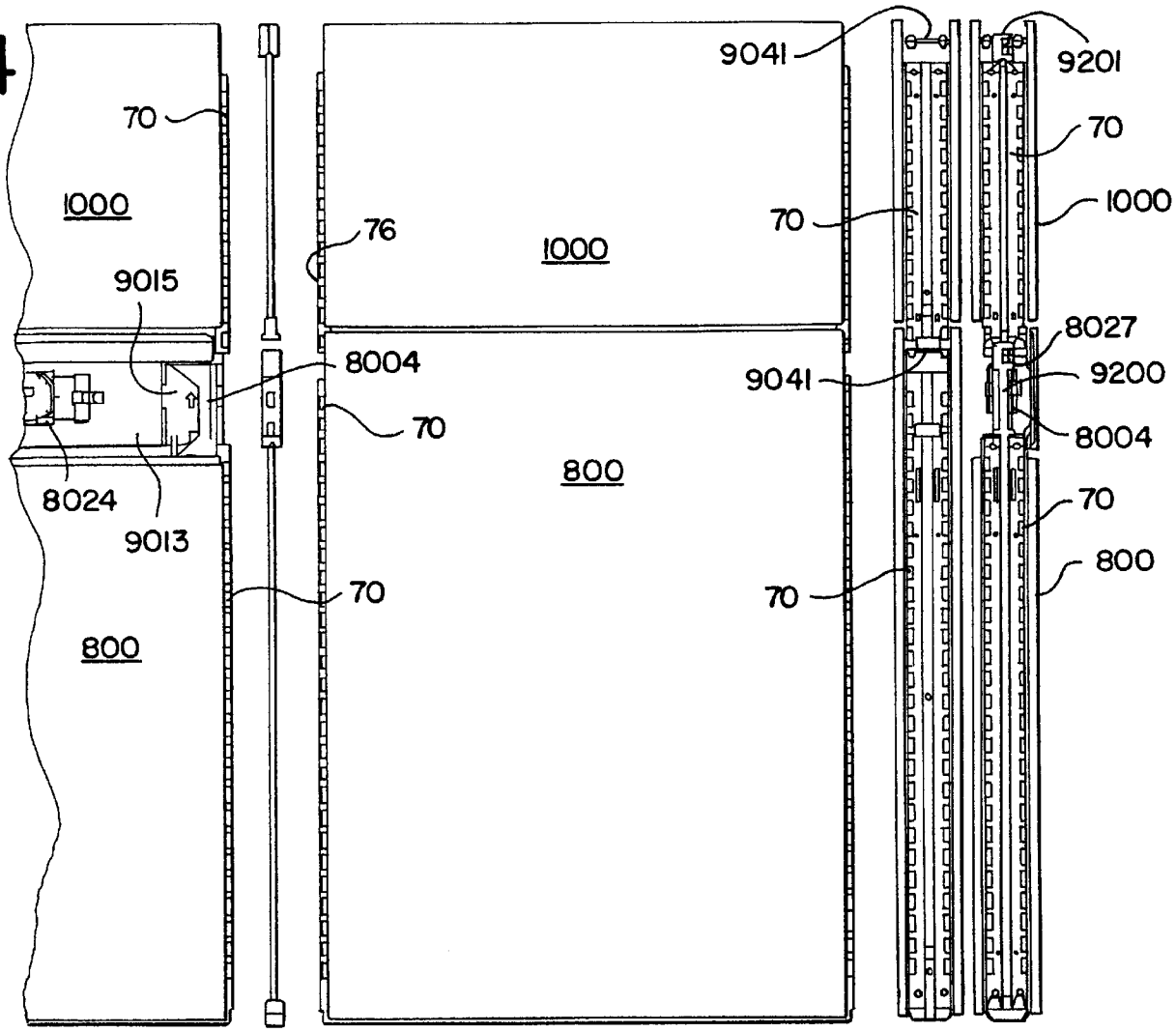

FIG. 214 is an exploded side view of a wall panel assembly.

Figure 215:
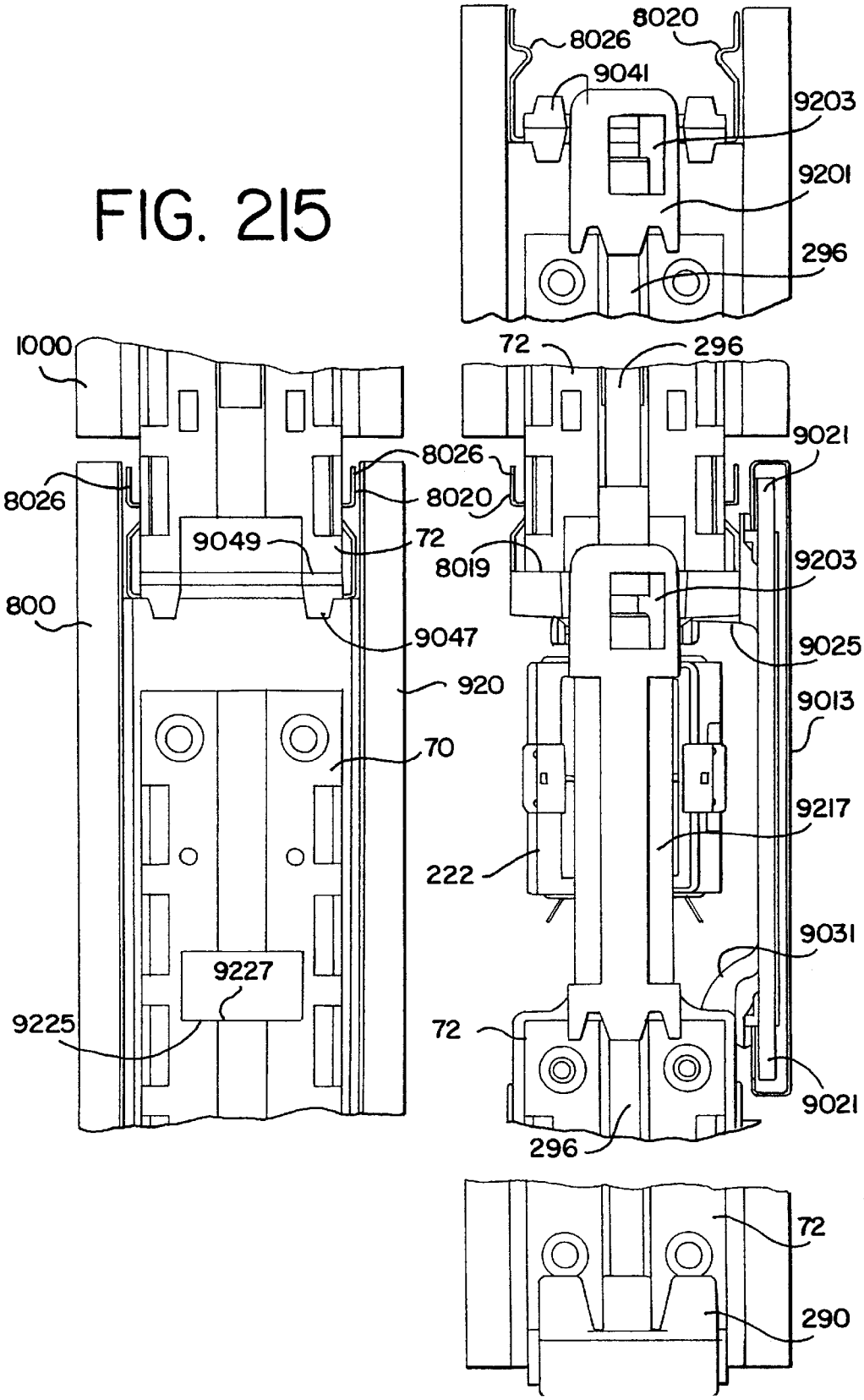

FIG. 215 is an end view of a pair of stackable assemblies.

Figure 216:
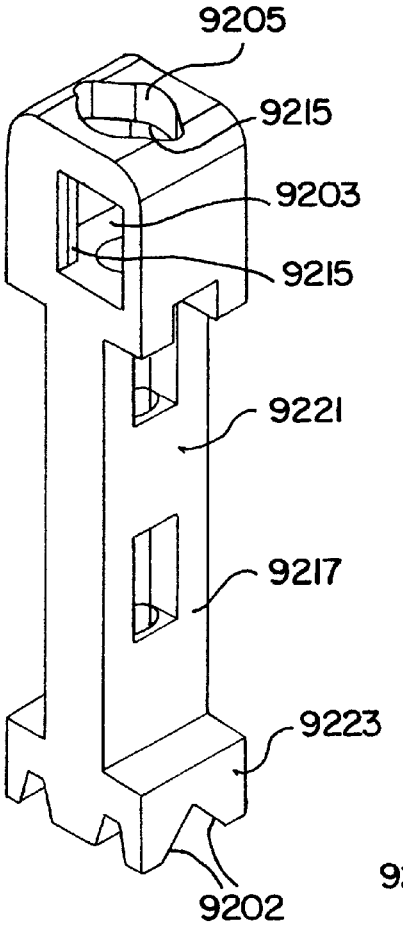

FIG. 216 is a perspective view of an alternative embodiment of a draw block.

Figure 217:
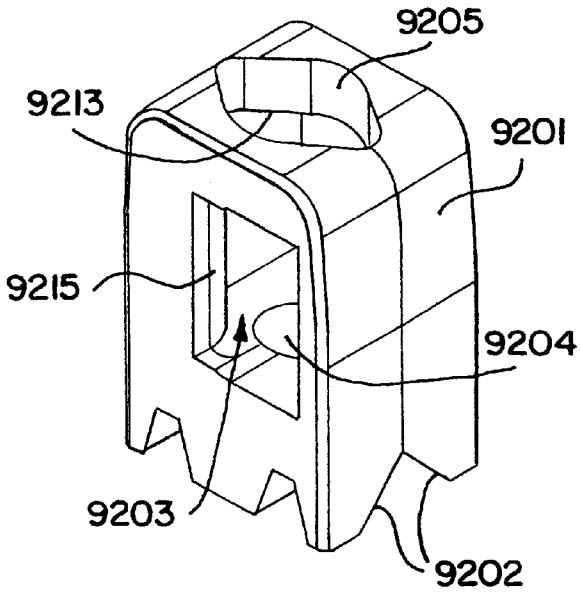

FIG. 217 is a perspective view of an alternative embodiment of a draw block.

Figure 218:
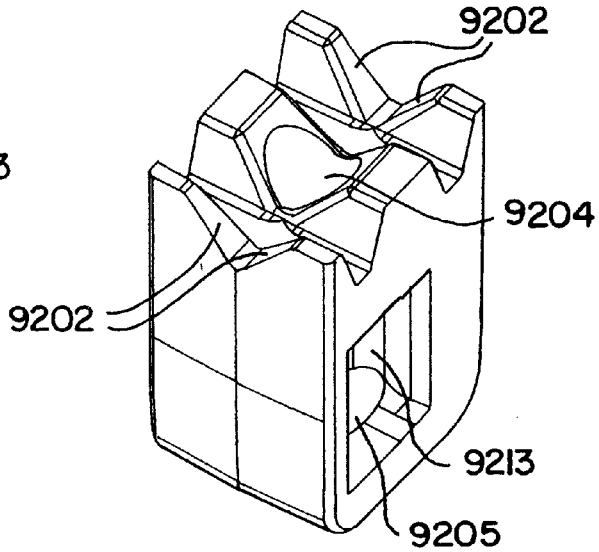

FIG. 218 is an opposite perspective view of the draw block shown in FIG. 217.

Figure 219:
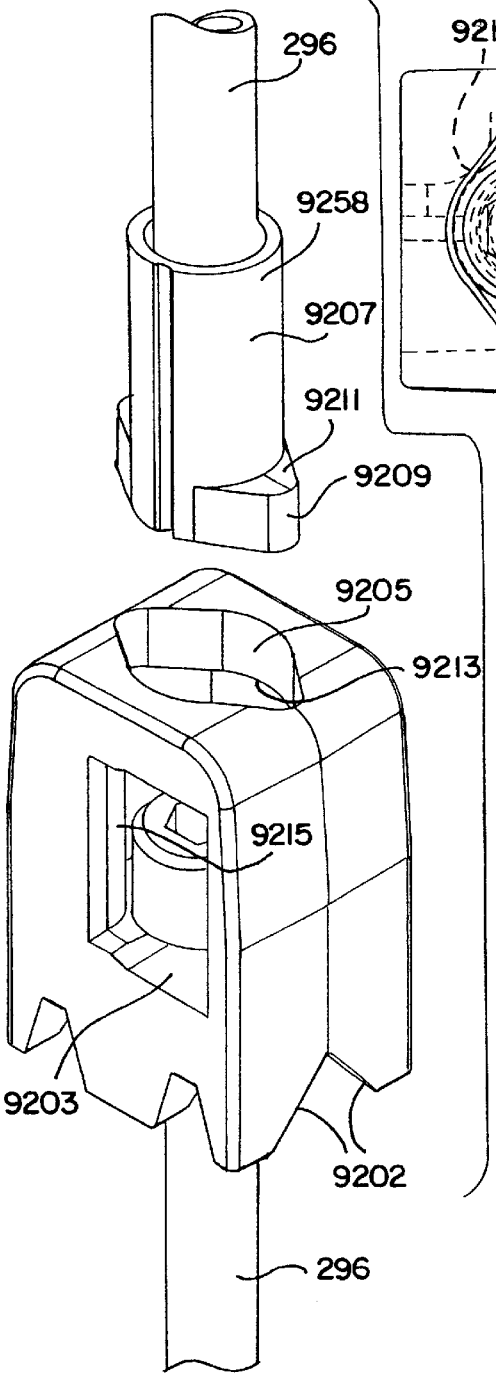

FIG. 219 is an exploded perspective view of a connector assembly.

Figure 220:
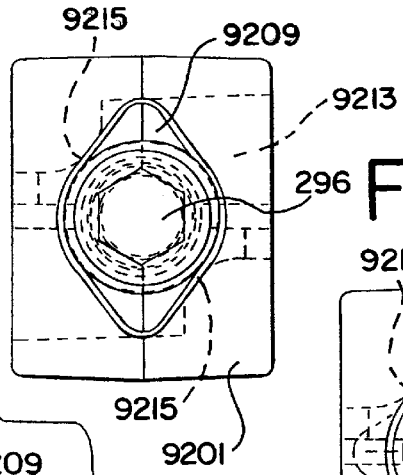

FIG. 220 is a cross-sectional plan view of the connector assembly with an insert positioned in a disengaged position.

Figure 221:
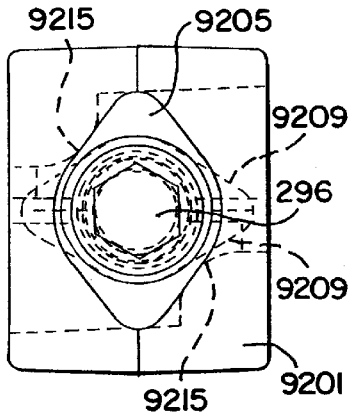

FIG. 221 is a cross-sectional plan view of the connector assembly with an insert positioned in an engaged position.

Figure 222:
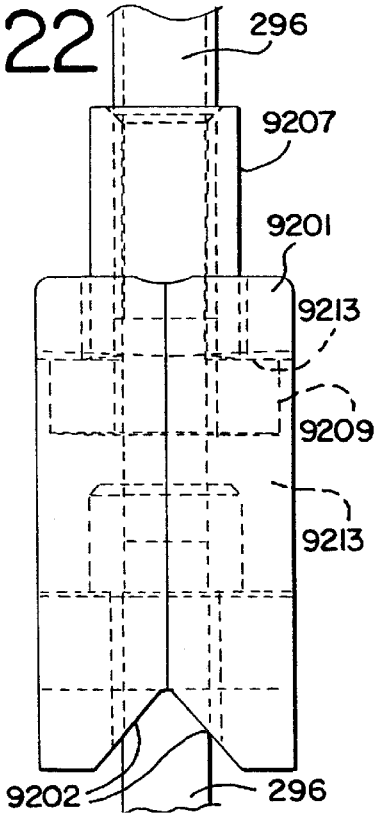

FIG. 222 is a partial side view of a connector assembly.

Figure 223:
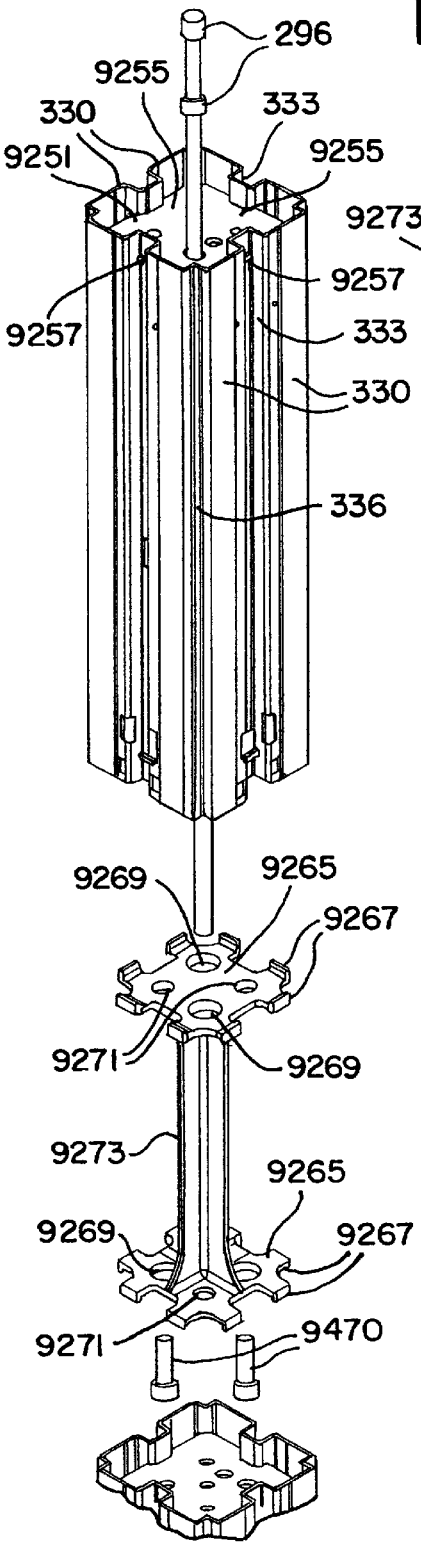

FIG. 223 is a partial exploded perspective view of a connector post assembly.

Figure 224:
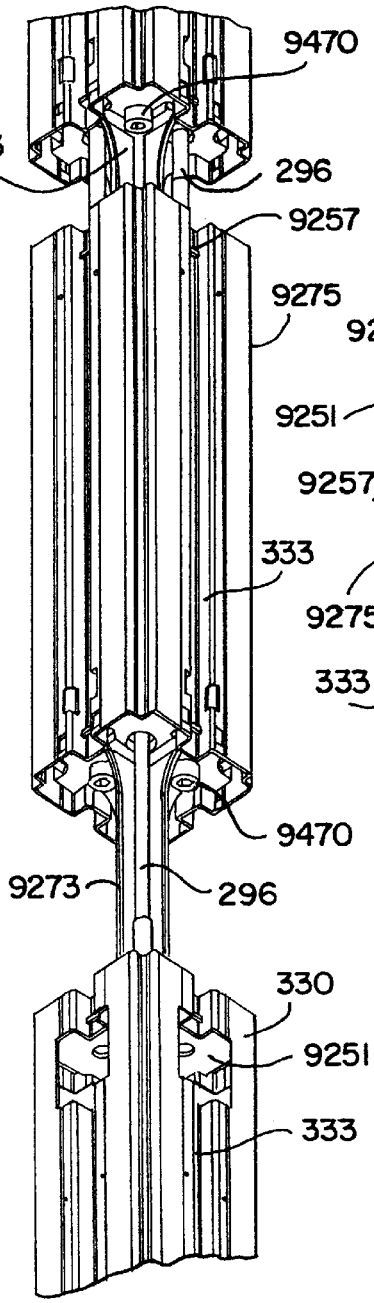

FIG. 224 is a partial bottom perspective view of the connector post assembly.

Figure 225:
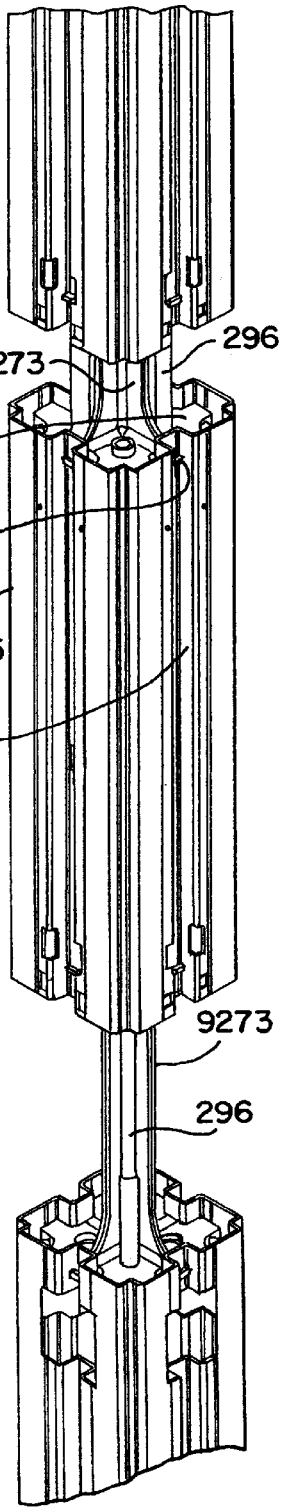

FIG. 225 is a partial upper perspective view of the connector post assembly.

Figure 226:
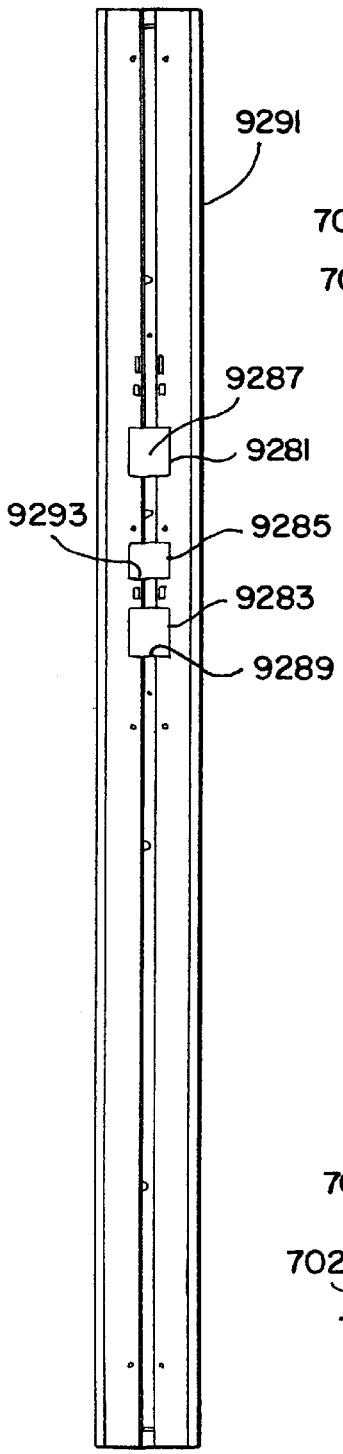

FIG. 226 is a side view of a connector post.

Figure 227:
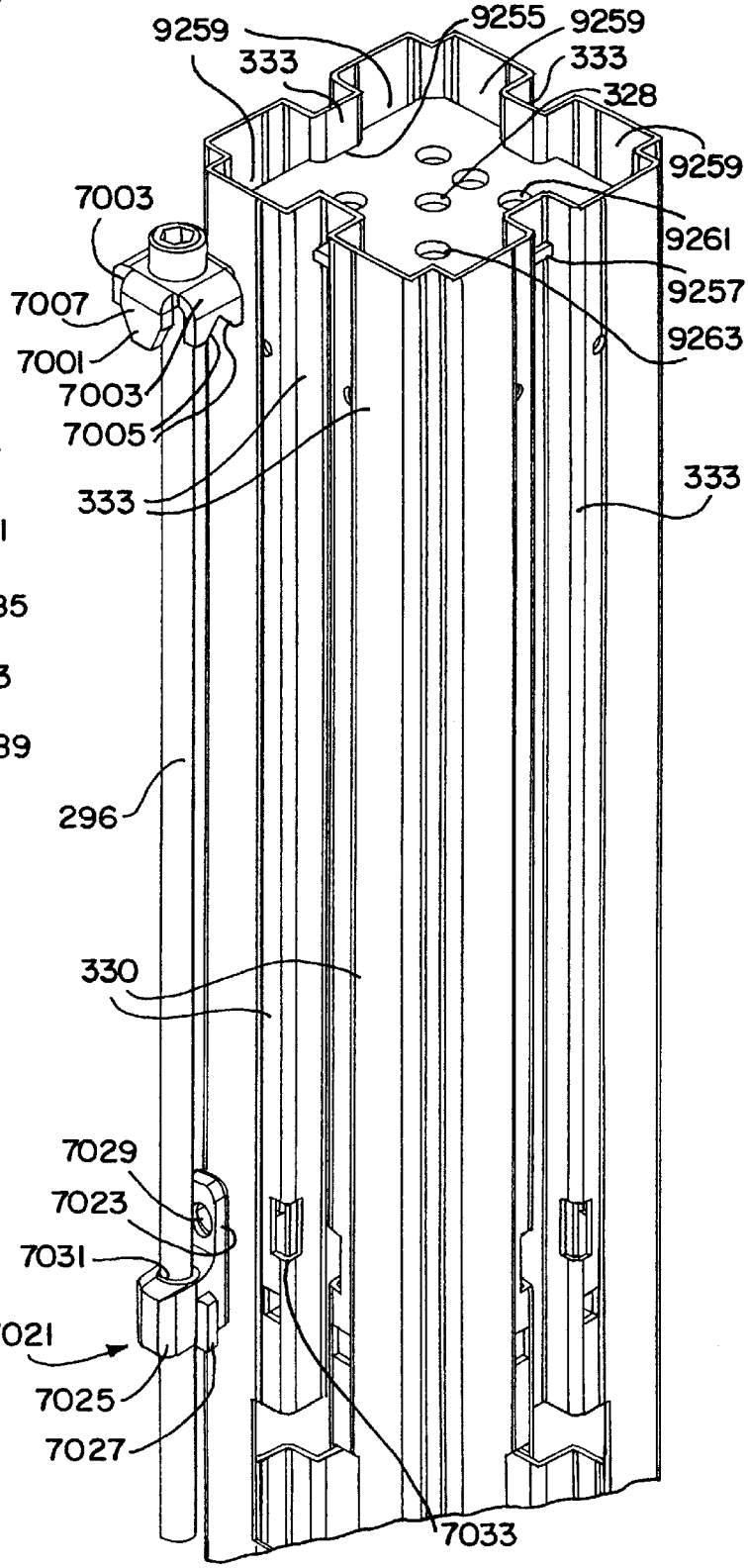

FIG. 227 is a partial exploded perspective view of a connector post with a connector system.

Figure 228:
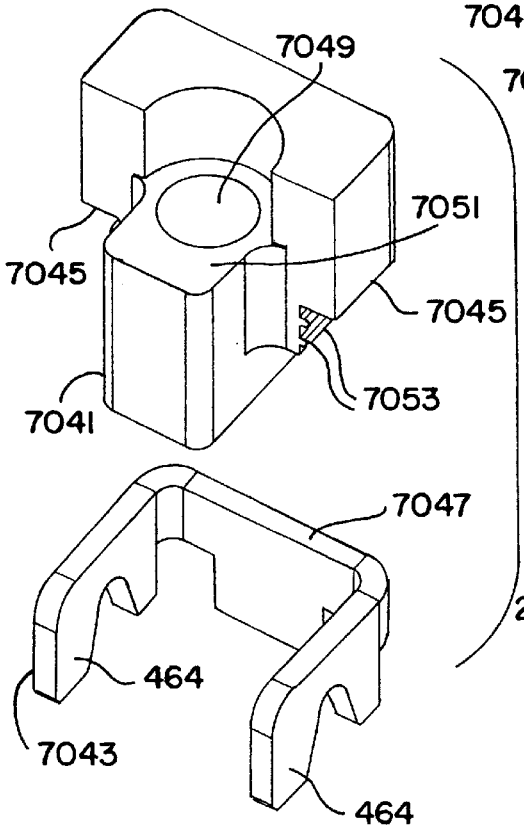

FIG. 228 is an exploded perspective view of an alternative embodiment of a draw block.

Figure 229:
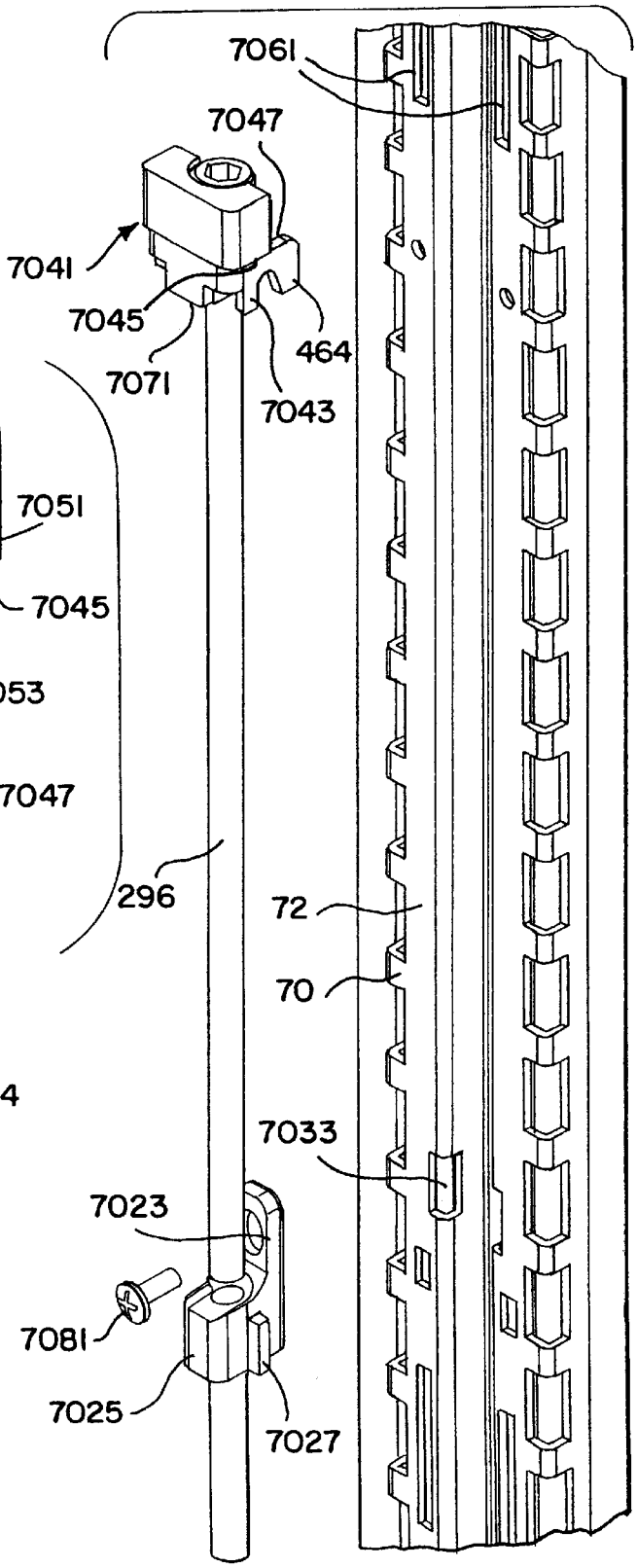

FIG. 229 is a partial exploded perspective view of a connector post with a connector system.

DETAILED DESCRIPTION OF THE PRESENTLY PREFERRED EMBODIMENTS

Figure 1:
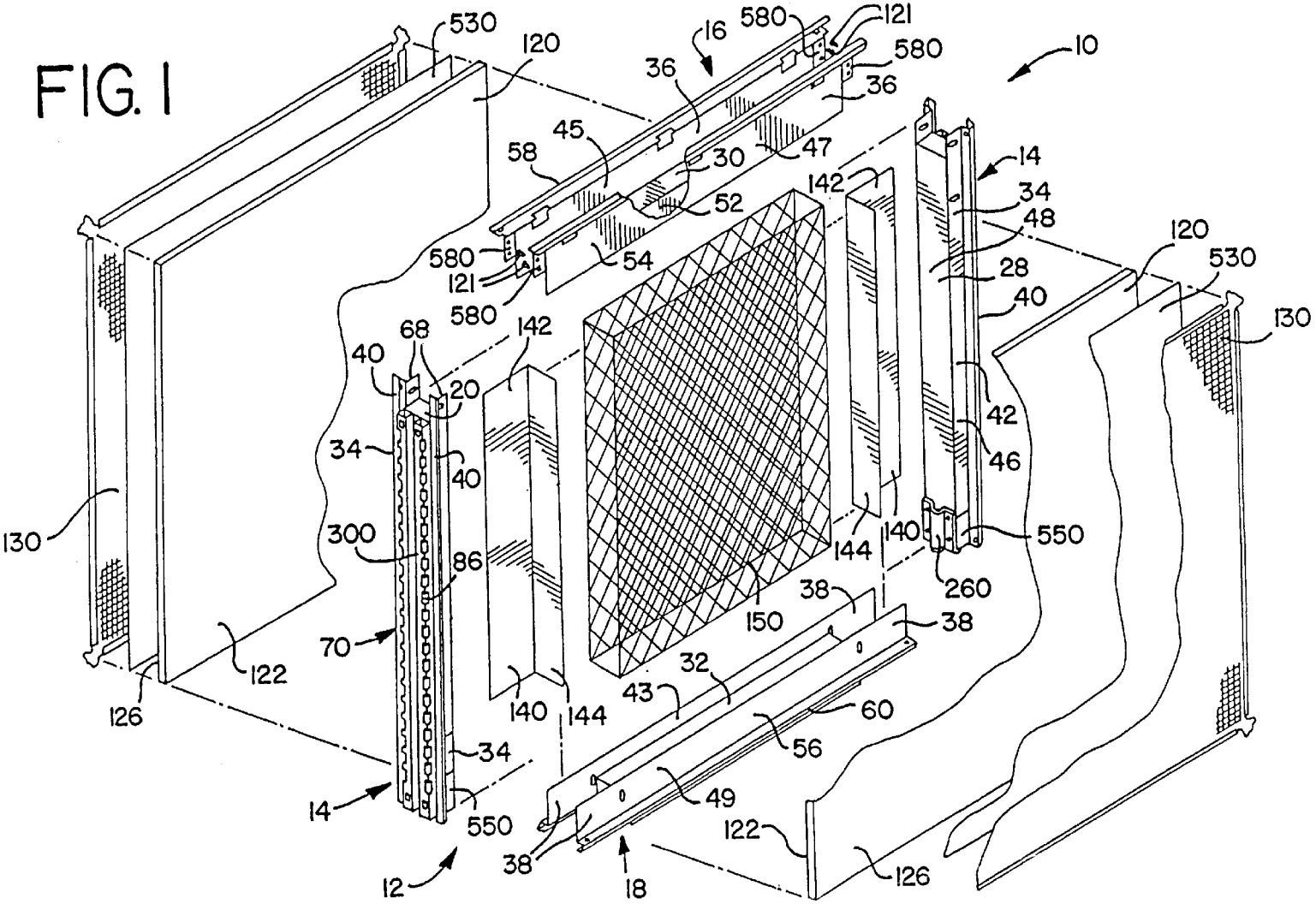
FIG. 1 is an exploded perspective view of the wall panel.

Referring to the drawings, FIG. 1 shows an improved wall panel 10 including a rectangular frame 12, a pair of sheetlike wall members 120 and a pair of thin decorative sheets 130. The frame 12 includes two spaced apart, and generally parallel vertical side frame members 14 and spaced apart and generally parallel horizontal lower and upper frame members 18, 16.

Each frame member 14, 16, 18 includes an elongated core member 28, 30, 32 and a pair of elongated sidewall members 34, 36, 38. Preferably, the core member is made of wood. As used herein, the terms "wood" and "wooden" are intended to have relatively broad meanings, including but not limited to, solid wood and wood products, such as particle board, fiber board and laminated strand lumber. Most preferably, the side core members 28 are made of laminated strand lumber, such as the 38# density material available from TrusJoist/MacMillan Ltd. Partnership in Deerwood, Minn. The horizontal core members 30, 32 preferably are made of 45# density particle board. Alternatively, other materials, such as foamed polymers or composites, may be used.

Figure 16:
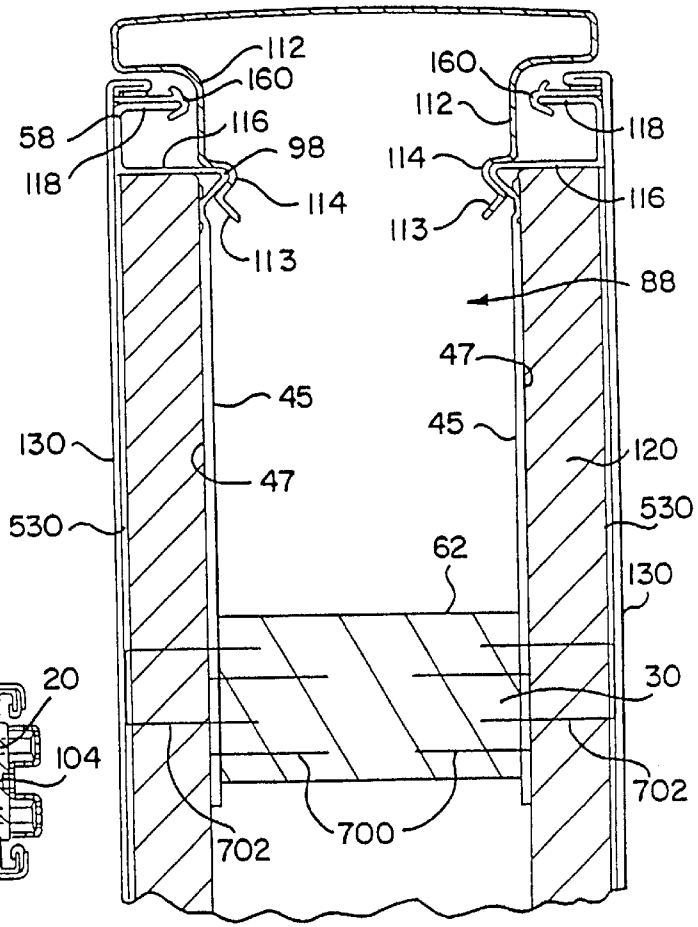
FIG. 16 is a cross-sectional view of the wall panel taken along line 16—16 of FIG. 8.

Each sidewall member 34, 36, 38 includes a substantially flat leg portion 42, 54, 56 and edge portion 40, 58, 60 respectively. The edge portion 40, 58, 60 extends laterally outward from the leg portion 42, 54, 56. Preferably, the sidewall members are made from 12 or 24 gauge steel sheet metal and are roll formed. However, it should be understood that other materials, such as plastic could also be used. Each leg portion has an inner 44, 45, 43 and outer surface 46, 47, 49; the inner surface 44, 45, 43 engages the side surface of the core member. Preferably, the inner surface 44, 45, 43 is mechanically fastened to the side 52, 53, 57 of the core member, for example, by using staples 700, as shown in FIG. 16. Alternatively, adhesive, nails, rivets or screws can be used to secure the sidewall member to the core member.

Figure 2:
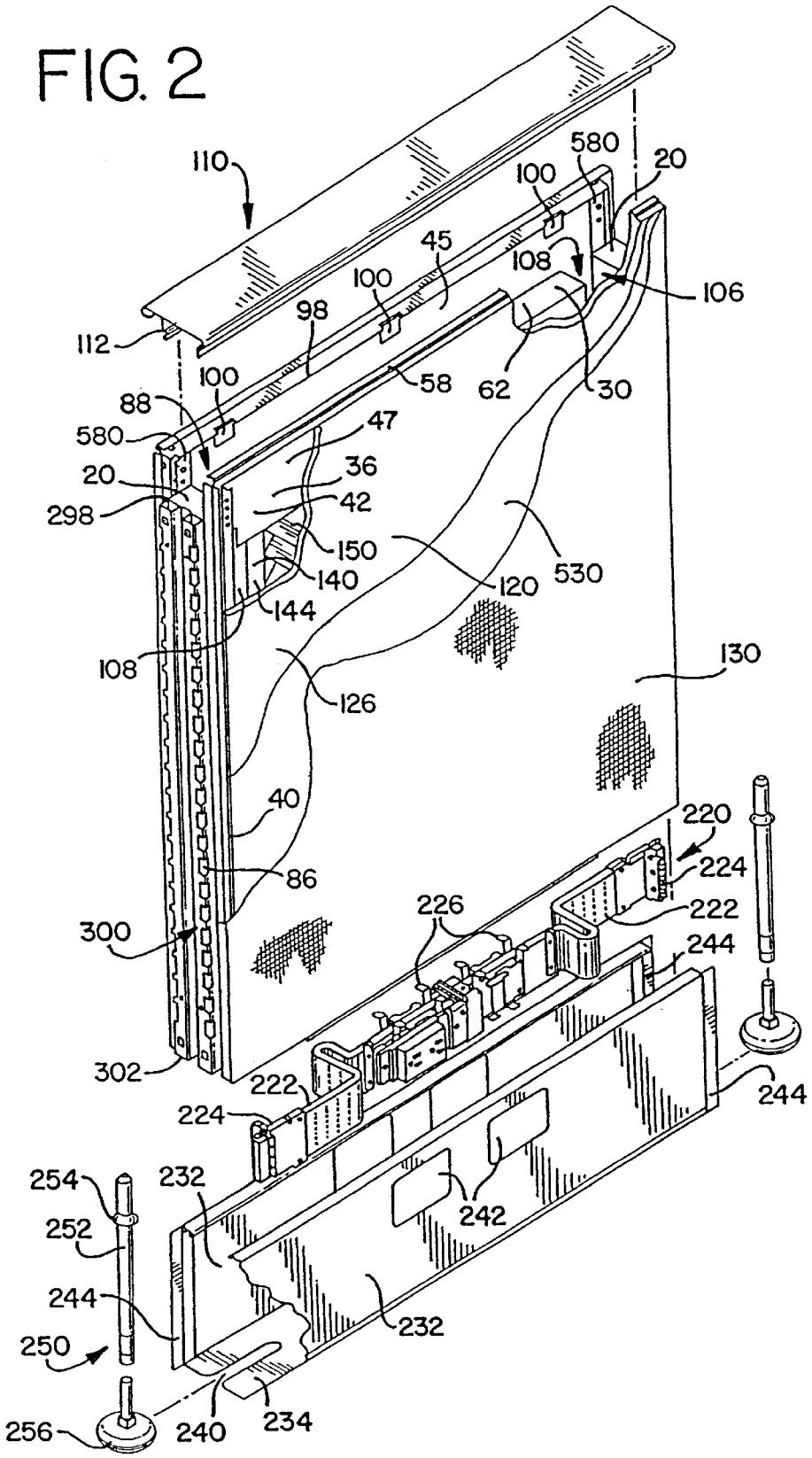
FIG. 2 is an exploded perspective view of the wall panel with a top cap, base cover and power distribution system.

As shown in FIG. 1, the sidewall members 34 of each vertical frame member include an end portion 68 that extends upwardly past the top end 20 of the side core member 28 along the longitudinal direction of the vertical frame member 14. The upwardly extending end portions 68 of the sidewall members 34 overlap the sidewall members 36 of the upper frame member 18, which include leg portions 54 that extend upwardly from the upper frame core member 30. Each end of the upper frame member sidewall members 36 includes a flange portion 580 stepped inwardly from the leg portion 54, as shown in FIGS. 1 and 2. The flange portion 580 extends from and is integrally formed with the leg portion. The upwardly extending end portions 68 overlap and are attached to the corresponding stepped flange portions 580 and the wall member 120, preferably with mechanical fasteners. Because the flanged portion 580 is stepped inwardly, the outer surfaces 46, 49 are flush. The edge portion 58 of the upper frame member and the edge portion 40 of the vertical frame are mitered at approximately 45° at the point of intersection in order to form a corner.

As shown in FIGS. 1, 2, 9 and 10, an elongated hanger bracket 70 is mounted to the outer surface 50 of each vertical core member. The hanger bracket 70 includes two spaced apart, inwardly facing channels 72 connected by a bridge portion 74 that is fastened to the core 28, preferably with a plurality of fasteners 540. Fasteners 542 also secure each end of each channel 72 to the core member 28. Each channel 72 has an inner leg 76, an outer leg 78 and an outer surface member 82. The inner legs 76 of the channels and the bridge portion 74 form an outwardly facing channel 300. The outermost corners 84 on each bracket, formed by the intersection of the outer leg and the surface member, have a plurality of slots 86 running the length of the hanger bracket. The outer surface member 82 of the inwardly facing channels 72 defines the outermost surface of each end of the wall panel. The slots 86 in the hanger bracket are adapted to receive and support various components attached to the wall panel. For example, overhead units and work surface bracket supports, not shown in the Figures, typically engage the wall panel at the slots. For example, a cantilever bracket assembly adapted to engage the hanger bracket is described in U.S. Pat. No. 6,019,331 entitled CANTILEVER BRACKET ASSEMBLY, the entire disclosure of which is hereby incorporated herein by reference.

As shown in FIGS. 2, 8, 9 and 44, the inner surface 43 of the upwardly extending sidewalls 36 on the upper frame member and the outer surface 62 of the upper core member 30 form a horizontal channel 88 which runs the width of the panel. At each end of the wall panel, the upper end 20 of the vertical side core member 28 lies substantially flush with, or slightly higher than, the outer surface 62 of the upper core member 30 so that wires, cables and the like can be passed easily from one panel to the next. In this way, the upper end 20 of the vertical core member 28 helps to define a portion of the bottom of the horizontal channel 88.

Figure 43:
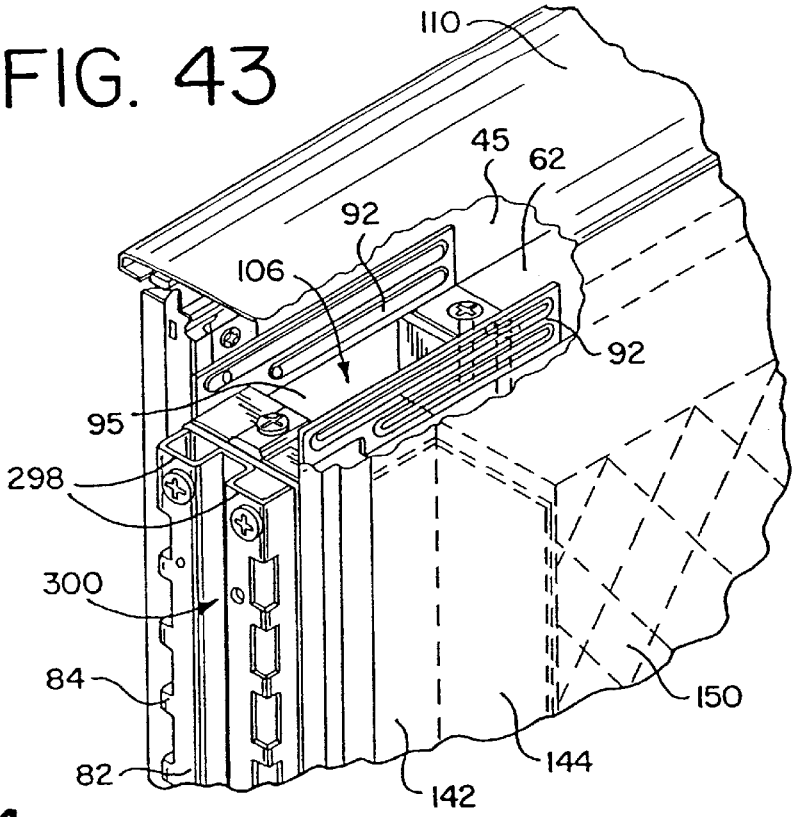
FIG. 43 is a perspective view of a brace member installed on a wall panel.
Figure 44:
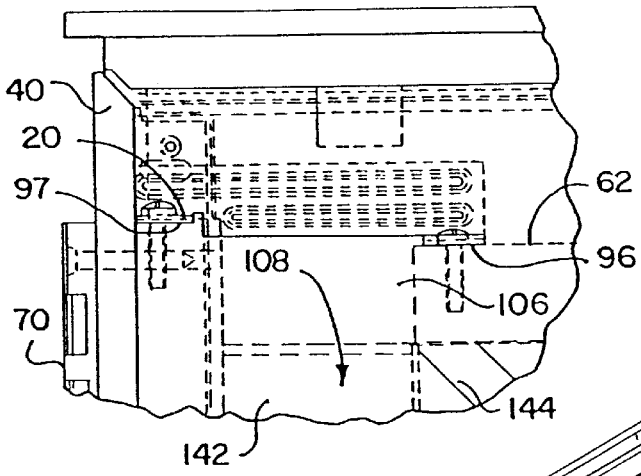
FIG. 44 is a side view of a brace member installed on a wall panel.
Figure 45:
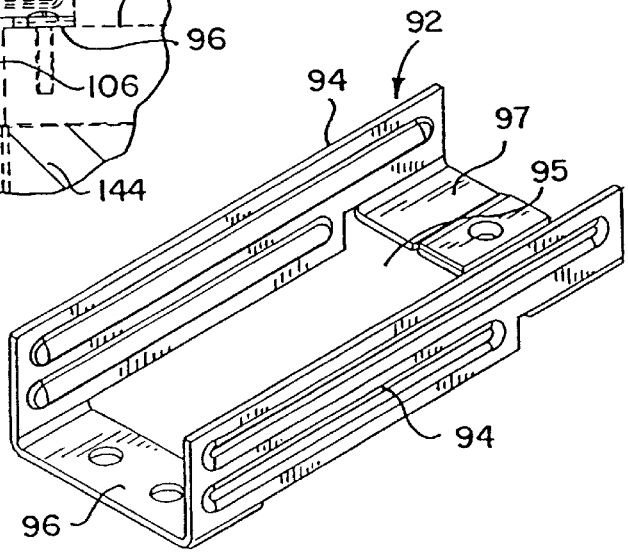
FIG. 45 is a perspective view of a brace member.

As shown in FIGS. 43–45, a brace member 92 can be mounted at each end of the channel to provide additional support for the panel. The brace member 92 includes a pair of sidewall members 94 disposed along the inner surface 45 of the sidewall members. The brace member 92 also includes a bottom plate 97 attached to the end 20 of the core member and a second bottom plate 96 attached to the outer surface 62 of the upper core member 30. It should be understood that the sidewall members can also be attached to the wall members. An opening 95 is provided between the plates to provide access to a vertical channel 108. The brace member 92 provides additional support for loads applied laterally to the top or side of the panel. In particular, the brace member helps distribute the load between opposing wall members, the upper frame member and the vertical frame member.

Figure 18:
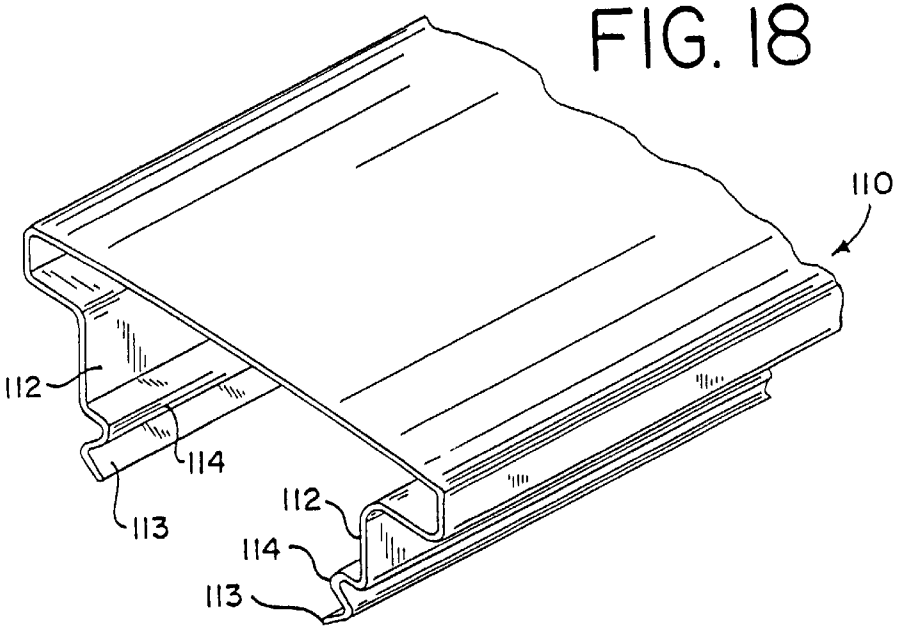
FIG. 18 is a partial perspective view of the top cap.

As shown in FIGS. 2, 16 and 18, the top portion of each sidewall leg portion on the upper frame members includes an inwardly facing ridge 98 that runs substantially the length of the upper frame member 18. Intermittent openings 100 are provided along the top portion. The openings are provided to locate the sidewalls in various tool fixtures during the assembly of the frames and wall panel.

A top cap 110 is attached to the upper frame member 18. The top cap 110 includes a pair of downwardly facing flanges 112 that have a ribbed portion 114 running the length of the flanges. The ribbed portion 114 engages the ridge 98 formed on the inside of each sidewall member and releasably secures the top cap to the upper frame member. Each of the flanges 112 also includes an edge portion 113 that is angled inwardly from the ribbed portion 114. The edge portion 113 facilitates installation of the top cap by engaging the ridges on the upper frame member as the top cap is first inserted into the channel 88. As the top cap 110 is pushed downwardly, the edge portions 113 slide along the ridge so that the flanges are biased inwardly until the ribbed portion engages the ribbed portion 114. The flanges 112 then spring back to their original position, as the ribbed portion releasably locks the top cap to the upper frame member. In this way, the top cap 110 covers and encloses the channel 88.

Figure 17:
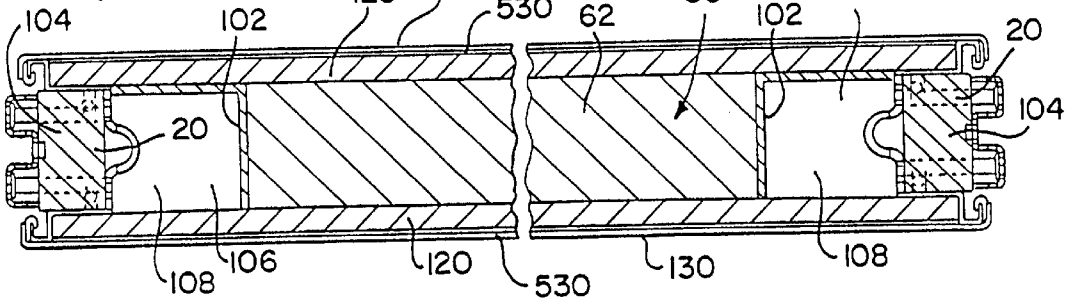
FIG. 17 is a cross-sectional view of the wall panel taken along line 17—17 of FIG. 8.

In a preferred embodiment, the ends 102 of the upper core member are spaced apart from the ends 104 of the vertical core member to form an opening 106 between the members near each end of the panel as shown in FIG. 17. These openings 106 provide access to a vertical channel 108, or tube, that extends between the upper horizontal channel 88 and the bottom of the wall panel, as shown in FIGS. 2, 8, 10, and 11. Each vertical channel 108 is formed and defined by the inner surface 48 of the vertical core member, a partition member 140 that extends between the upper and lower horizontal frame members 16, 18 and the inner surface 122 of the wall member 120.

Figure 12:
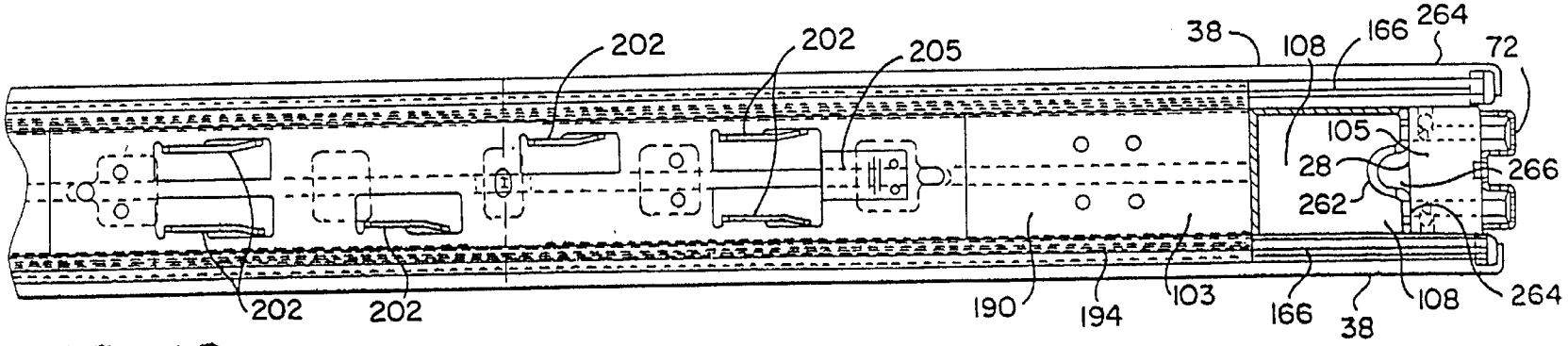
FIG. 12 is a bottom view of the wall panel taken along line 12—12 of FIG. 8, with the power distribution server omitted.

The ends 103 of the lower horizontal core member are spaced apart from the lower end 105 of the vertical core members so as to provide access to the vertical channel 108 from the bottom of the panel as shown in FIG. 12. In addition, the sidewall members 38 on the lower frame member extend outwardly past the end 103 of the core member along the longitudinal direction of the frame member, as shown in FIG. 1. The sidewalls 34 are cut away at the lower end 105 of the vertical side core member to provide an exposed portion 550 of the side core member. The outwardly extending bottom sidewall members 38 overlap the exposed portion, and lie flush with the side frame sidewalls 34. The edge portions 60, 40 intersect and are mitered at approximately 45° to form a corner. The lower core member 32 also includes a groove 33 running the length of the core member along the middle of the outer surface 66.

Figure 10:
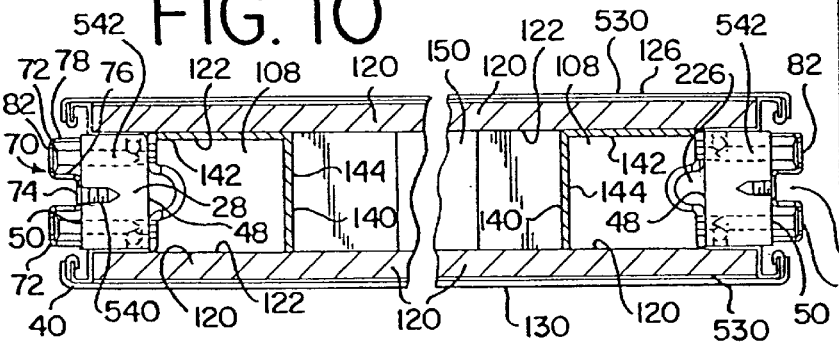
FIG. 10 is a cross-sectional view of the wall panel taken along line 10—10 of FIG. 8.
Figure 14:
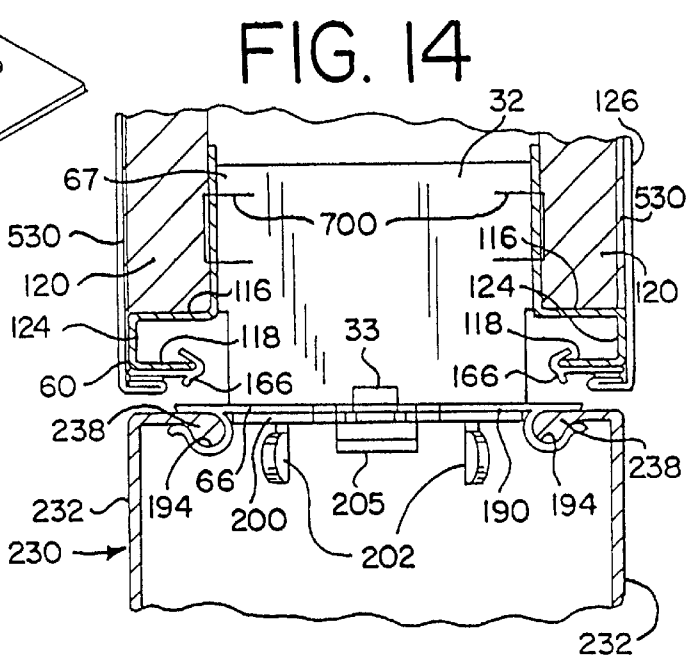
FIG. 14 is a cross-sectional view of the wall panel taken along line 14—14 of FIG. 8 with the power distribution server not shown.
Figure 15:
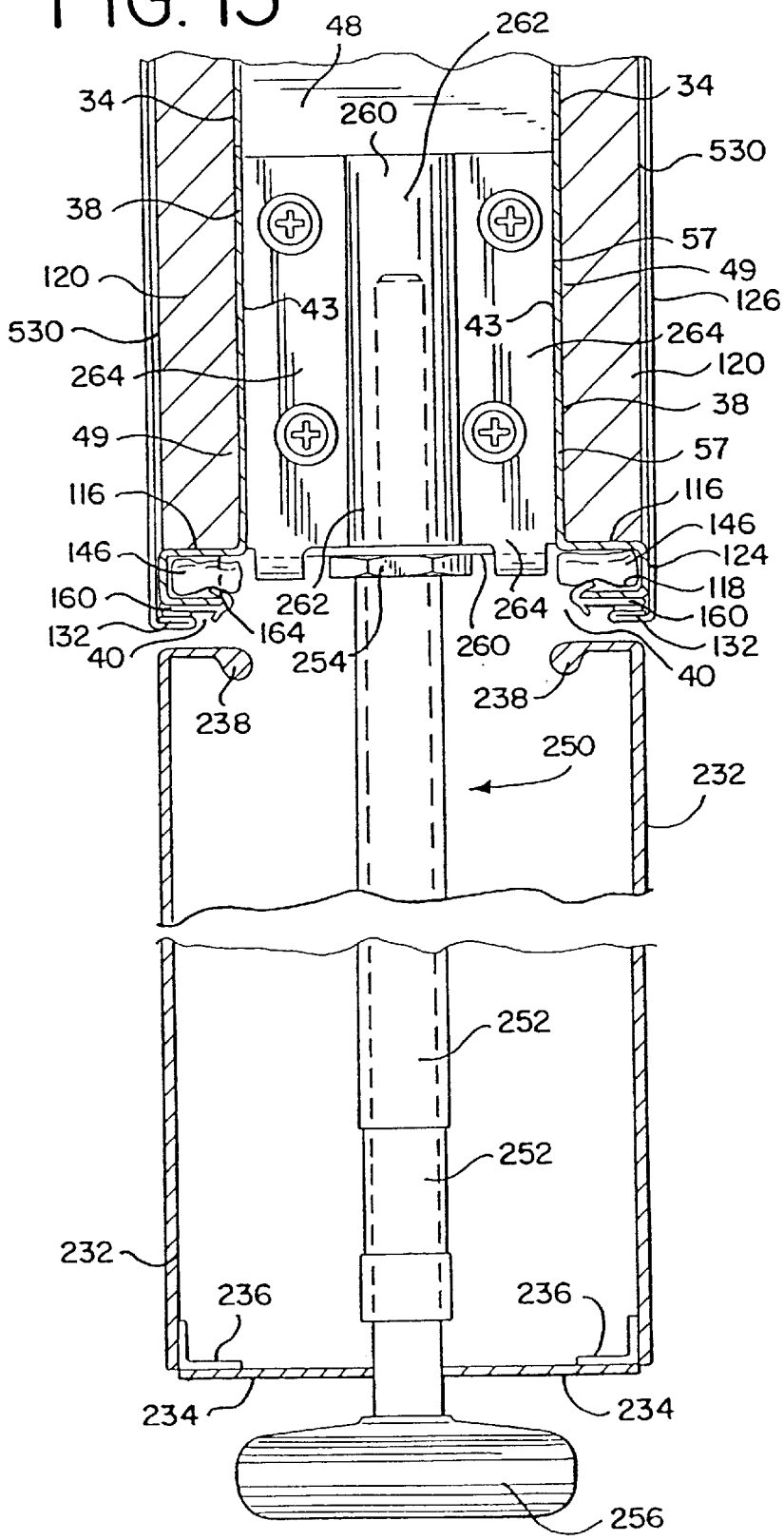
FIG. 15 is a cross-sectional view of the wall panel taken along line 15—15 of FIG. 8.

As shown in FIGS. 10, 14 and 16, the edge portions 40, 58, 60 of each sidewall member are preferably configured as a C-shaped channel that runs the length of each sidewall member. When the frame members are connected, the edge portions 40, 58, 60 run substantially around the entire periphery on each side of the panel. Each channel includes an inner leg 116 that extends laterally outward in a perpendicular relationship from the leg portion and an outer leg 118 that defines the outer peripheral edge of the wall panel. An intermediate surface member 124 connects the inner 116 and outer leg 118. The surface member 124 is in substantially the same plane as the outer surface 126 of the wall member as shown in FIGS. 14–16. The inner leg 116 of the edge portion and the outer surface 46, 47, 49 of the sidewall leg portions 42, 54, 56 define a shallow, outwardly facing recess on each side of the frame. The recess is shaped to receive the sheetlike wall member 120. Preferably, the wall member 120 substantially fills the recess and is bounded around its periphery by the inner legs 116 of the sidewalls.

As just described, each wall member is attached to one side of the frame with staples 702, as shown in FIG. 16. The wall members stabilize and strengthen the wall panel. Preferably, the wall member 120 is made of ½ inch thick fiberboard, such as the industrial insulation board available from Masonite in Lisbon Falls, Me., which is sanded, ironed and sealed. Preferably, the wall member 120 is tackable, so that a user can attach various items to the wall member with tacks, or the like. Other materials, such as particle board or mineral board are also acceptable. Preferably, the wall member 120 is both adhesively secured to the outer surface 46, 47, 49 of the sidewalls and is mechanically fastened to the core members 34, 36, 38 through the sidewall members, preferably by stapling. The overlapping portions of the sidewall members 34, 36 of the vertical frame and the upper frame members are mechanically fastened to each other and to the wall member 120 from the inside out, preferably with screws 121 as described above and shown in FIGS. 1, 2 and 8.

As shown in FIGS. 1, 8 and 10–11, a filler member 150 is installed inside the rectangular frame 12. The filler member 150 is disposed between the wall members 120 and each side of the frame, and extends between the upper and lower horizontal frame members 16, 18. In a preferred embodiment, the filler member 150 is a honeycomb structure made from corrugated cardboard. The honeycomb is adhesively secured to the inner surface 122 of each wall member. The honeycomb increases the strength of the panel and provides sound dampening for the panel. Preferably, the honeycomb filler member is bounded along each vertical end by the partition members 140 installed to form the vertical channels 108. In this way, the vertical channels are separated from the honeycomb filler member.

Figure 11:
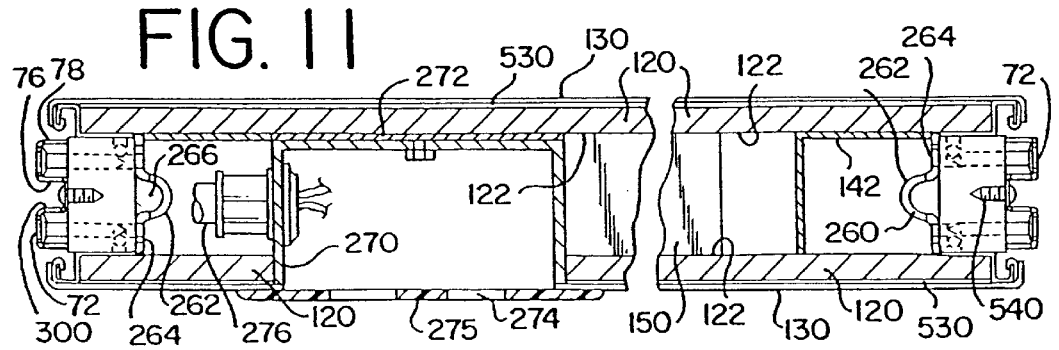
FIG. 11 is a cross-sectional view of the wall panel taken along line 11—11 of FIG. 8.

The partition member 140 includes a mounting flange 142 and a boundary flange 144 as shown in FIG. 1. Referring to FIGS. 10 and 11, the mounting flange 142 is adhesively bonded to the inner surface 122 of one of the wall members 120. The boundary flange 144 extends between the two wall members 120 and can be attached to the side of the honeycomb filler member.

Referring to FIGS. 1 and 2, a thin barrier sheet 530, or scrim, is disposed between the decorative sheet 130 and the wall member 120. The barrier sheet 530 preferably includes a layer of aluminum foil laminated to a thin layer of fiberglass. The barrier sheet 530 is preferably about 0.005 inches thick and is used as a fire blocking material. A commercially available barrier sheet is the MANNIGLAS 12077 wet-lay glass fiber mat produced by Lydall Corporation. The barrier sheet can be attached to the wall member with adhesive or mechanical fasteners. Alternatively, the barrier sheet can wrap around the outer leg of the edge portion beneath the decorative sheet, which is attached to the leg with a strip member as described below.

Referring to FIGS. 1 and 2, each thin decorative sheet 130 is disposed over one of the outer surfaces 126 of the wall members. The decorative sheet is preferably a cloth fabric, although it should be understood that other flexible materials would be suitable for covering the wall panel. Referring to FIGS. 10, 14, 15 and 16, the sheet is wrapped around the edge portion 40, 58, 60 of each sidewall member and is attached to the outer leg 118 of the edge portion. Preferably, a strip 160 is attached to each edge 132 of the sheet. The strip may be sewn to the sheet or adhesively bonded. For example, as shown in FIGS. 21–23, the strip is attached with a double-sided tape 162 and sewn to the sheet.

Figure 21:
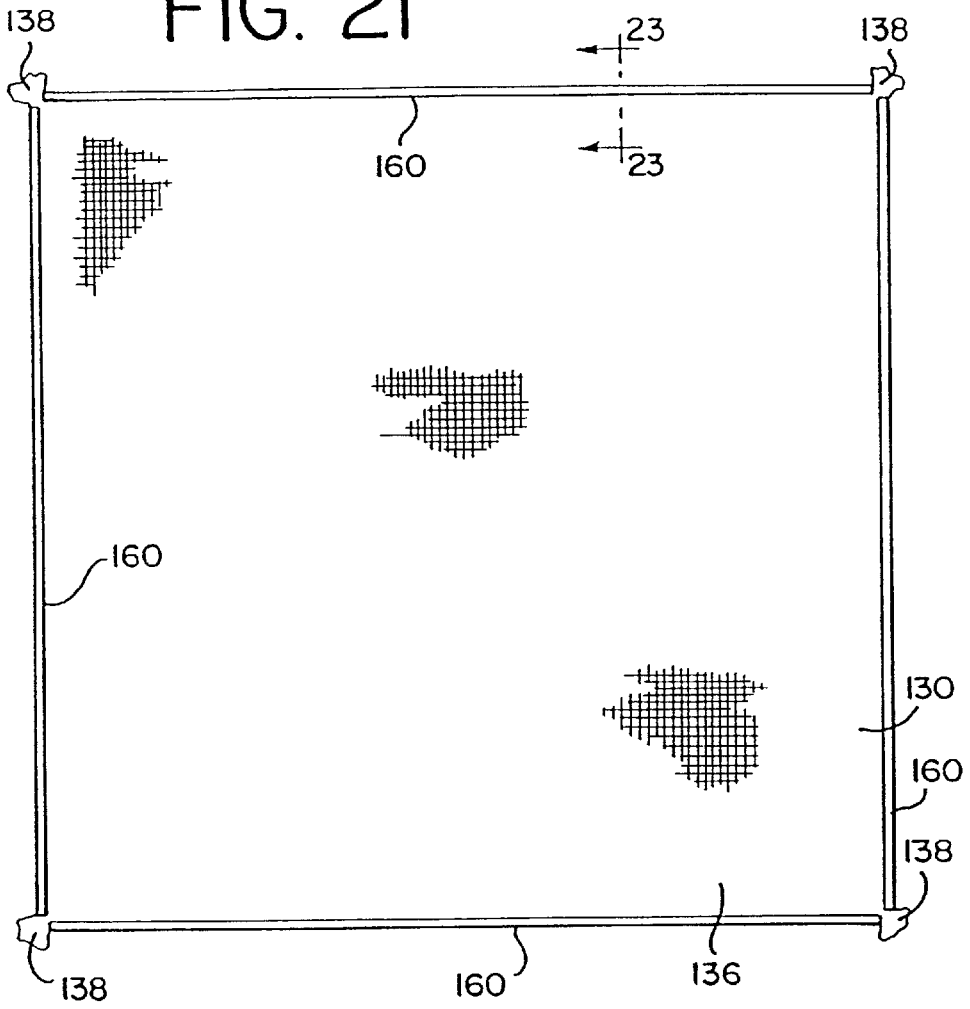
FIG. 21 is a side view of the fabric sheet.
Figure 22:
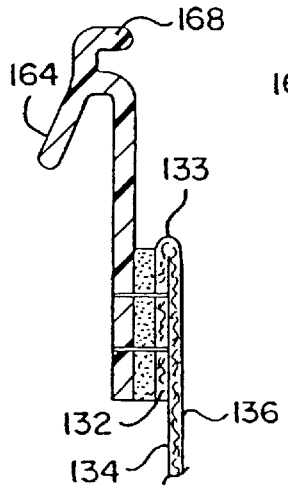
FIG. 22 is a cross-section of the strip attached to the fabric.
Figure 23:
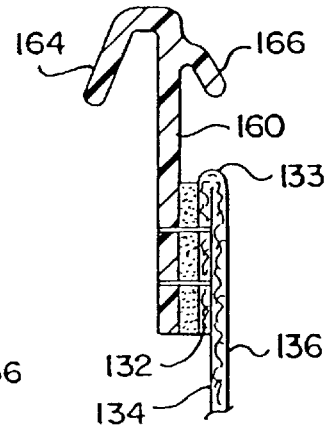
FIG. 23 is a cross-section of an alternative embodiment of the strip attached to the fabric.

Referring to FIGS. 21 and 23, the strip 160, preferably made from plastic, includes a first hook member 164 adapted to engage the outer leg 118. The strip 160 is attached to the outer surface 136 of the fabric sheet 130 so that the first hook member 164 faces outwardly towards the edge of the fabric. Before installing the fabric, however, the fabric is folded over as shown in FIGS. 22–23 so that the strip 160 is positioned along the inner surface 134 of the fabric and so that the first hook 164 faces inwardly away from the folded edge 133 of the fabric. The first hook member 164 is disposed on the outer leg 118 of the edge portion of the sidewall member as shown in FIGS. 14–16.

Figure 24:
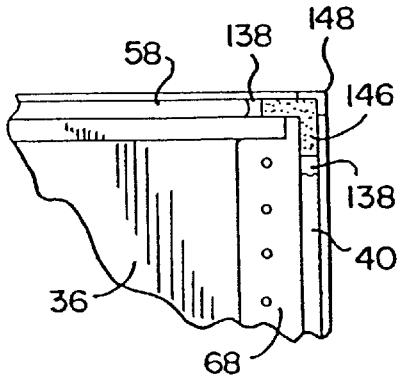
FIG. 24 is a side view of the inside corner of the upper horizontal channel.

Excess portions of the decorative sheet, or fabric, extend outwardly from each corner of the fabric sheet between the ends of the adjacent strip members to form a corner patch 138 of material as shown in FIG. 21. The corner patch 138 is tucked inside the eight corners formed by the edge portion channels 40, 58, 60 of the vertical, upper and lower frame members as the first hook member is installed on the outer leg of each channel. As shown in FIG. 24, a flexible corner block 146 is inserted into intersecting channels 40, 58 at one of the upper corners to hold the excess fabric, or corner patch 138, in the channels. Preferably, the corner block 146 is made of foam, although other resilient and flexible materials, such as rubber, may also be used. By tucking the excess fabric, or corner patch 138, into the channels 40, 58, the exterior, exposed corner 148 of the wall panel is covered and provided with an aesthetically pleasing appearance.

In a preferred embodiment, the strip 160 also includes a second hook member 166. In one embodiment, shown in FIG. 23, the second hook member 166 is positioned opposite of the first hook 164 and faces the same direction as the first hook member, i.e., opens inwardly away from the folded edge 133 of the fabric when it is folded over on itself. In a second embodiment, shown in FIG. 22, the second hook 168 is positioned at the end of the strip and opens outwardly away from the outer surface 136 of the fabric. In either embodiment, the second hook member 166, 168 is adapted to allow an installer to stretch tightly the fabric 130 while installing the first hook 164 on the outer leg 118 of the sidewall member.

Figure 46:
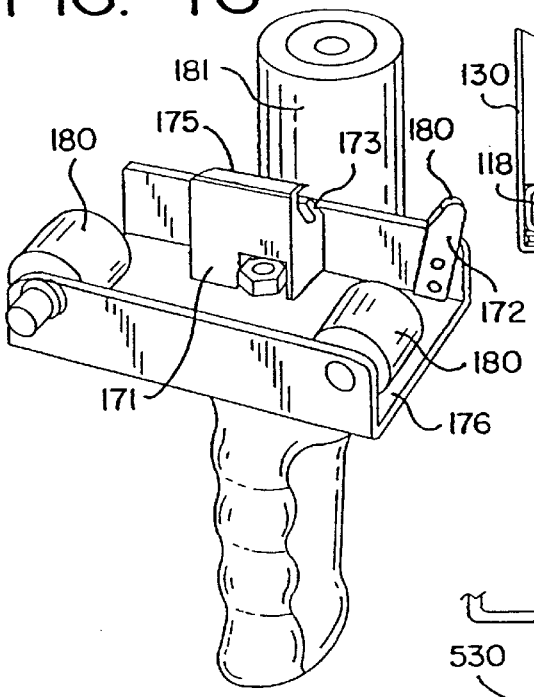
FIG. 46 is a perspective view of a fabric installation tool.
Figure 47:
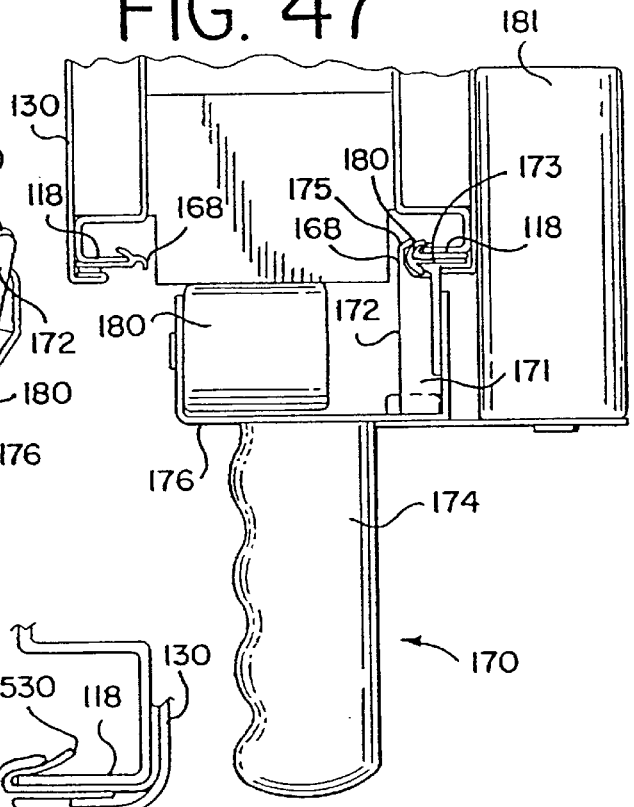
FIG. 47 is a top view of the fabric installation tool engaging a fabric sheet on a wall panel.

To facilitate the installation of the fabric 130, a tool 170 is provided. The tool 170 includes a mounting block 171, a blade 172, a handle 174 and a housing 176 as shown in FIGS. 46–47. The mounting block 171 is mounted to the housing and includes a lip portion 173 adapted to engage the second hook 168, and a guide member 175 configured as a hook that is adapted to be disposed around the end of the strip and first hook 164. The tool also includes a plurality of wheels 180, 181 rotatably mounted to the housing 176 and adapted to rotatably engage the side of the wall panel as the tool is moved around the periphery of the panel while engaging the strip 160.

To install the sheet of fabric, at least one edge 132 is installed by disposing the first hook 164 on one of the sidewall member outer legs 118 as shown in FIGS. 14–16. The installer then engages the fabric with the tool by inserting the lip portion 173 in one of the second hooks 166, 168 on one of the remaining strips, as shown in FIG. 47, and moves the tool along the edge of the wall panel. As the tool moves along the edge of the panel, the lip portion 173, which is inserted into the second hook 168 as the guide member 175 encircles the end of the strip, pulls the strip inwardly so that the first hook 164 can be inserted onto the outer leg 118 as the end of the strip and first hook passes through the space between the core member, or hanger bracket, and the free edge of the outer leg 118. The blade 172 includes an edge 180 that is adapted to engage the strip and force the hook member past the outer leg. Thus, the installer uses the tool 170 to stretch the fabric 130 and force the first hook 164 of the strip past the end portion and dispose it on the outer leg 118. It should be understood that various tool configurations would work equally well for stretching and mounting the fabric sheet.

Figure 47A:
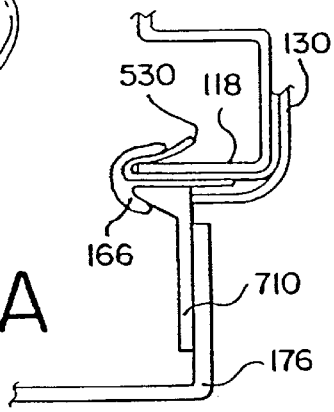
FIG. 47A is a partial enlarged view of an installation tool with an alternative blade configuration.

In another embodiment, the tool includes a second blade member 710 having an edge 602, as shown in FIG. 47A. The blade member 710 is adapted to engage the second hook and install the first hook on the sidewall as described above with the lip portion. As shown in FIG. 47A, the barrier sheet 530 is wrapped around the outer leg 118 and secured to the sidewall beneath the first hook.

Figure 48:
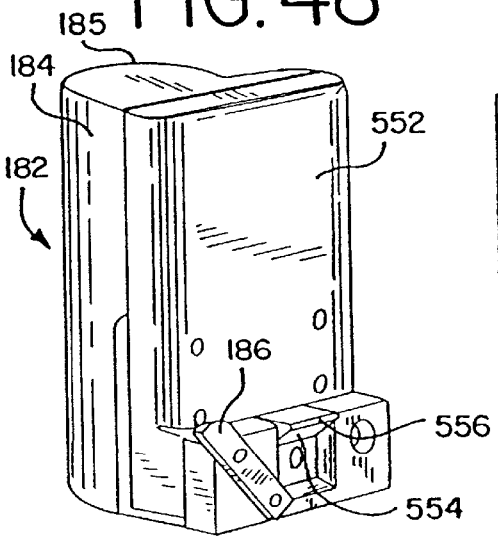
FIG. 48 is a perspective view of an alternative embodiment of the fabric installation tool.
Figure 49:
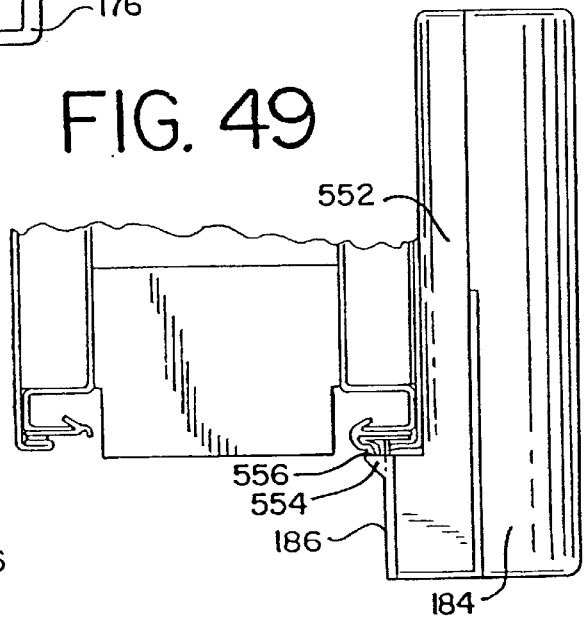
FIG. 49 is a top view of the fabric installation tool of FIG. 44 engaging a fabric sheet on a wall panel.

As shown in FIGS. 48–49, yet another embodiment of the tool 182 includes a handle member 184 having a curvilinear surface grip 185, a surface member 552, a mounting block 554 having a lip portion 556 and a blade 186. As just described, the lip portion engages the second hook, while the blade pushes the strip, and first hook, against the outer leg 118. The surface member is preferably made of plastic, such as Delrin, so that it slides easily along the edge of the panel without damaging or tearing the fabric. This embodiment could also employ a second blade member as just described. It should also be understood that alternative embodiments, such as a simple putty knife, also can be used to engage the second hook, stretch the fabric and dispose the first hook on the outer leg of the edge portion.

The strip and hook arrangement disclosed herein is ideally suited for attaching fabric to a wall panel. For example, if the fabric were to become stained, worn or torn, an installer can remove the fabric quickly and easily by using a tool in the opposite manner as described above to disengage the first hook from the outer leg on the sidewall member. Moreover, the fabric can be removed while the panel is connected to adjacent panels if using a tool that can be inserted into the gap between the panels to engage the second hook member.

This provides significant advantages over the prior art fabric attachments, which were either permanently secured to the panel or were retained by an elastic band running around the periphery of the panel. In either configuration, the panel had to be disconnected from the adjacent panels so as to access and remove the band or to remove the adhesive.

It should also be understood by one skilled in the art that the strip and hook fabric attachment device can also be used to secure fabric to objects besides wall panels, such as chairs, cabinets, etc. All that is needed is an edge on which to secure the hook member. Thus, the attachment of the fabric to the wall panel as described above is meant to be illustrative rather than limiting.

The lower horizontal frame member, shown in FIGS. 12, 14, 58 and 62, includes a mounting strip 190 and a bracket 200 mounted to the outer surface 66 of the lower core member. As shown in FIG. 14, the outer surface 66 preferably extends below the end portions of the sidewalls. The side surface 67 of the portion of the lower core member extending below the leg portion of the sidewall member is stepped inward to permit the hook member on the strip to be installed on the outer leg. The groove 33 runs along the outer surface of the core member.

Figure 13:
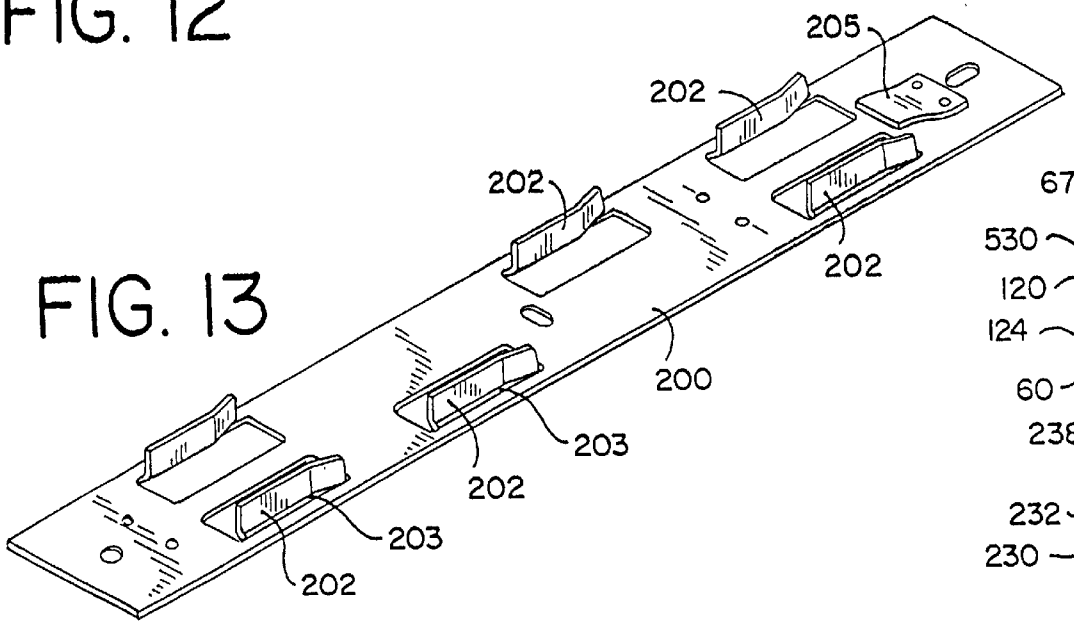
FIG. 13 is a perspective view of the power distribution bracket.
Figure 59:
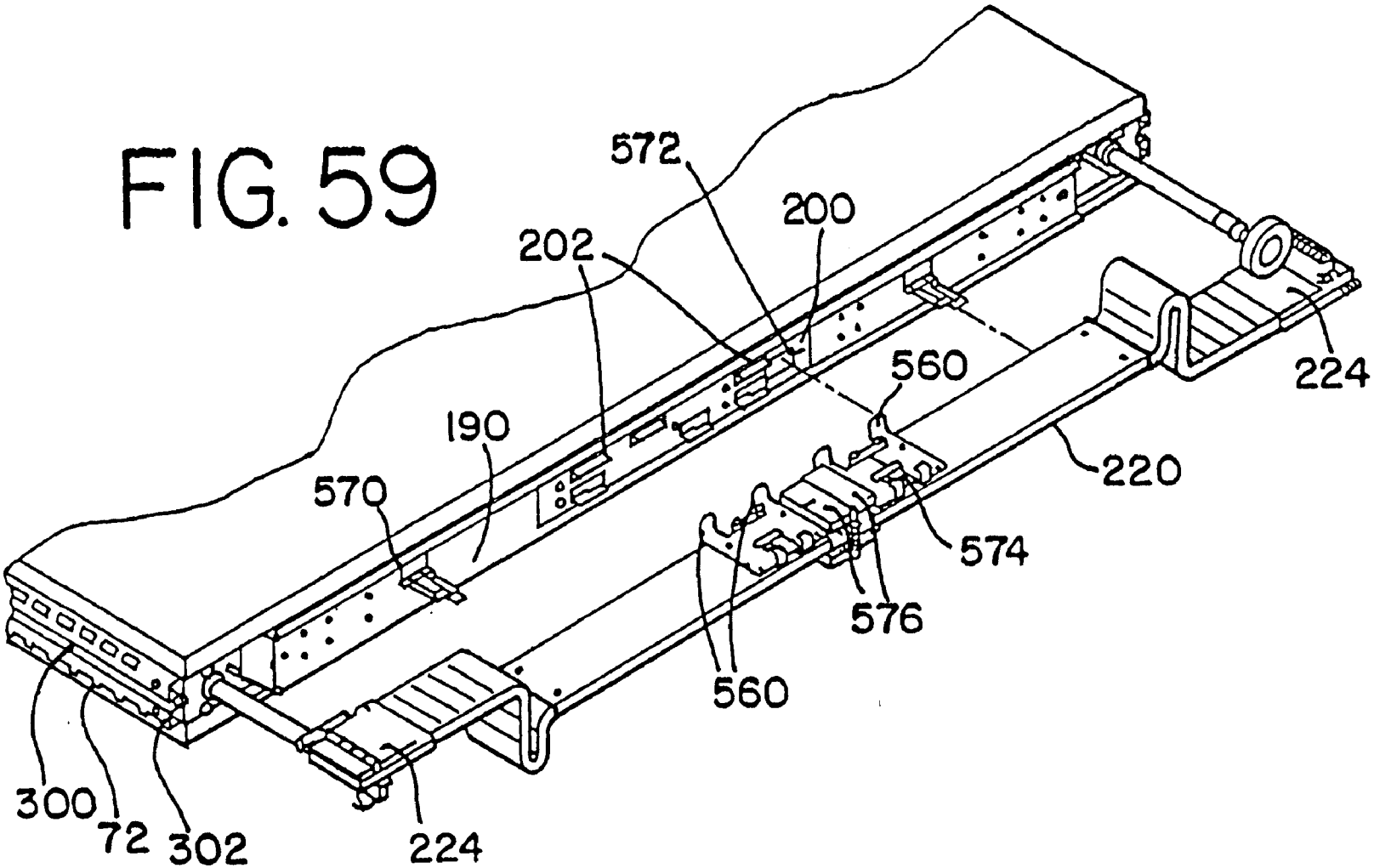
FIG. 59 is a bottom perspective exploded view of a wall panel and power distribution server.

The bracket 200 includes several tab members 202 which are adapted to engage and support a power distribution server 220, including an electrical power harnesses 222, as shown in FIGS. 2 and 59. Referring to FIGS. 12 and 13, the tab members 202 form slots 203 that receive bracket hooks 560 extending upwardly from the power distribution server as shown in FIG. 59. In operation, the harness 222 is installed by sliding the bracket hooks 560 into the slots 203 until the end of the bracket 560 passes a resilient locking tab 578 which springs downwardly to releasably secure the harness 222 on the bracket 200. When the wall panel is particularly long, the bracket may also include stabilizer brackets 570 that extend downwardly from the bracket and include two arms that engage the harness.

Figure 25:
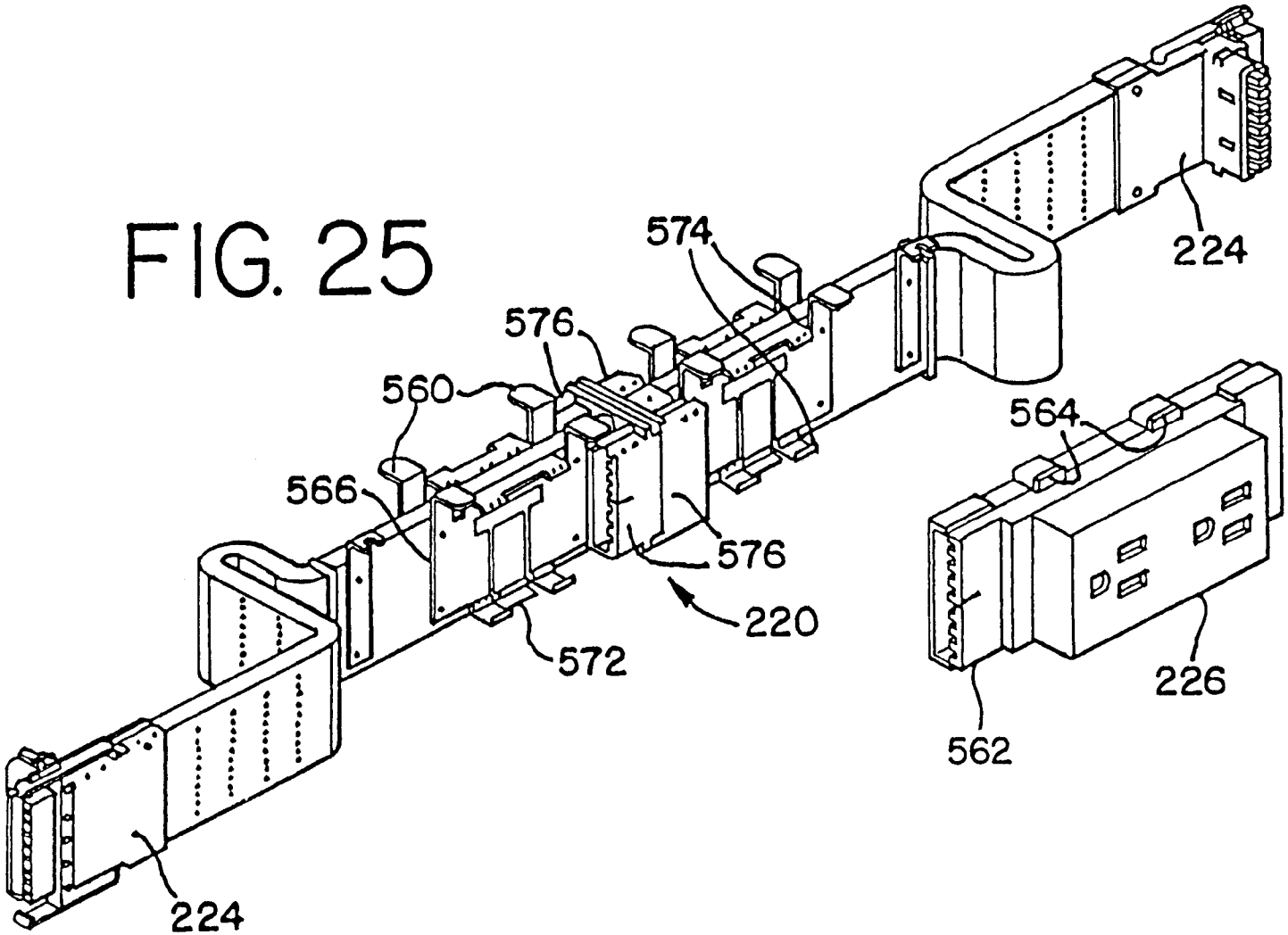
FIG. 25 is a perspective view of the power distribution server.
Figure 27:
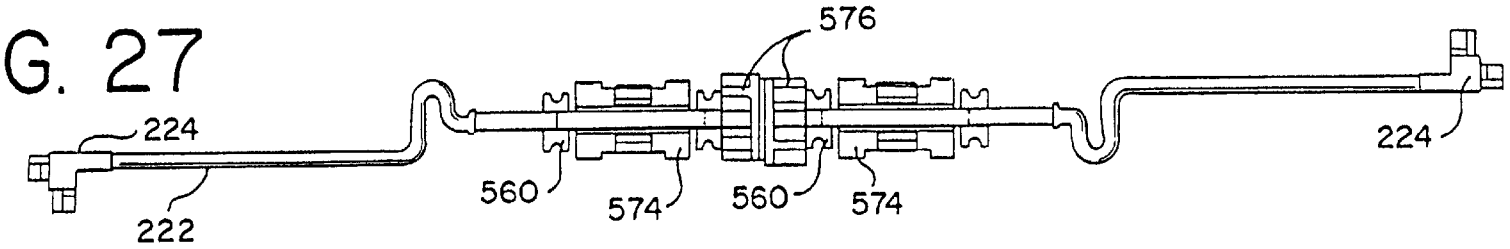
FIG. 27 is a top view of the power distribution server.
Figure 26A:
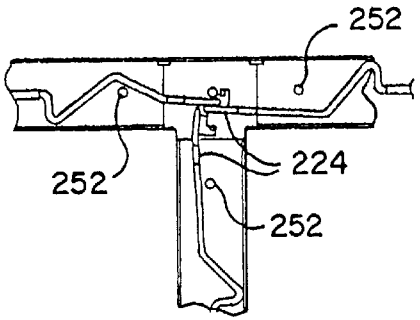
FIG. 26A is a top view of a wall panel junction showing a three-way connection of power distribution servers located in the adjacent wall panels.
Figure 26C:
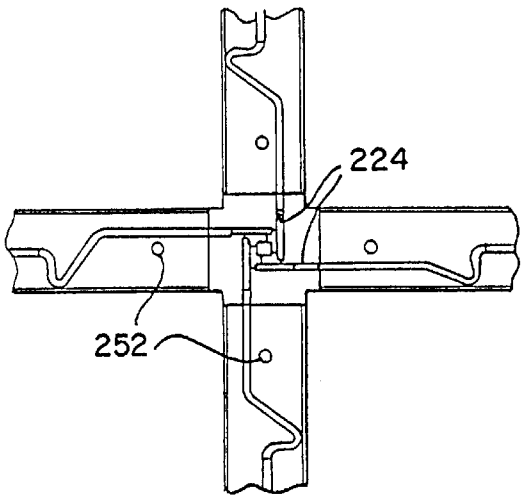
FIG. 26C is a top view of a wall panel junction showing a four-way connection of power distribution servers located in the adjacent wall panels.
Figure 26B:
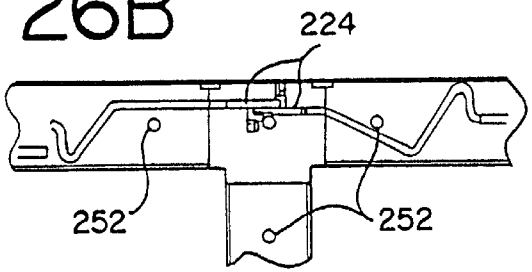
FIG. 26B is a top view of a wall panel junction showing a two-way connection of power distribution servers located in the adjacent wall panels.

Referring to FIGS. 25–27, the harness includes a receptacle bracket 566, a spring tab 572 and a plurality of module bracket hooks 574. A plurality of receptacle modules 226 are secured to the harness by engaging the bracket hooks 574 with mounting lugs 564 disposed on the module. Each module 226 is electrically connected to the harness 222 at one of a four receptacle ports 576. Similarly, conduit 276 from an outlet box installed in the panel, as described below, preferably includes a connector that can electrically engage one of the receptacle ports in place of a receptacle module. For a complete description of the power distribution server, including the power harnesses, one is directed to U.S. Pat. No. 5,013,252, issued to Neinhuis et al. on May 7, 1991, the disclosure of which is hereby incorporated herein by reference. The harness also includes electrical connector ports 224 positioned at the end of the harness and which provide a means for electrically connecting adjacent panels, such that a first panel receives power from a second panel. A commercially available harness, Model No. 225409, is sold by PENT Assemblies of Kendallville, Ind. FIGS. 26A–C show various configurations of panels electrically interconnected. In this way, an entire system of panels can be electrically connected and provide power to users at individual work spaces.

Figure 62:
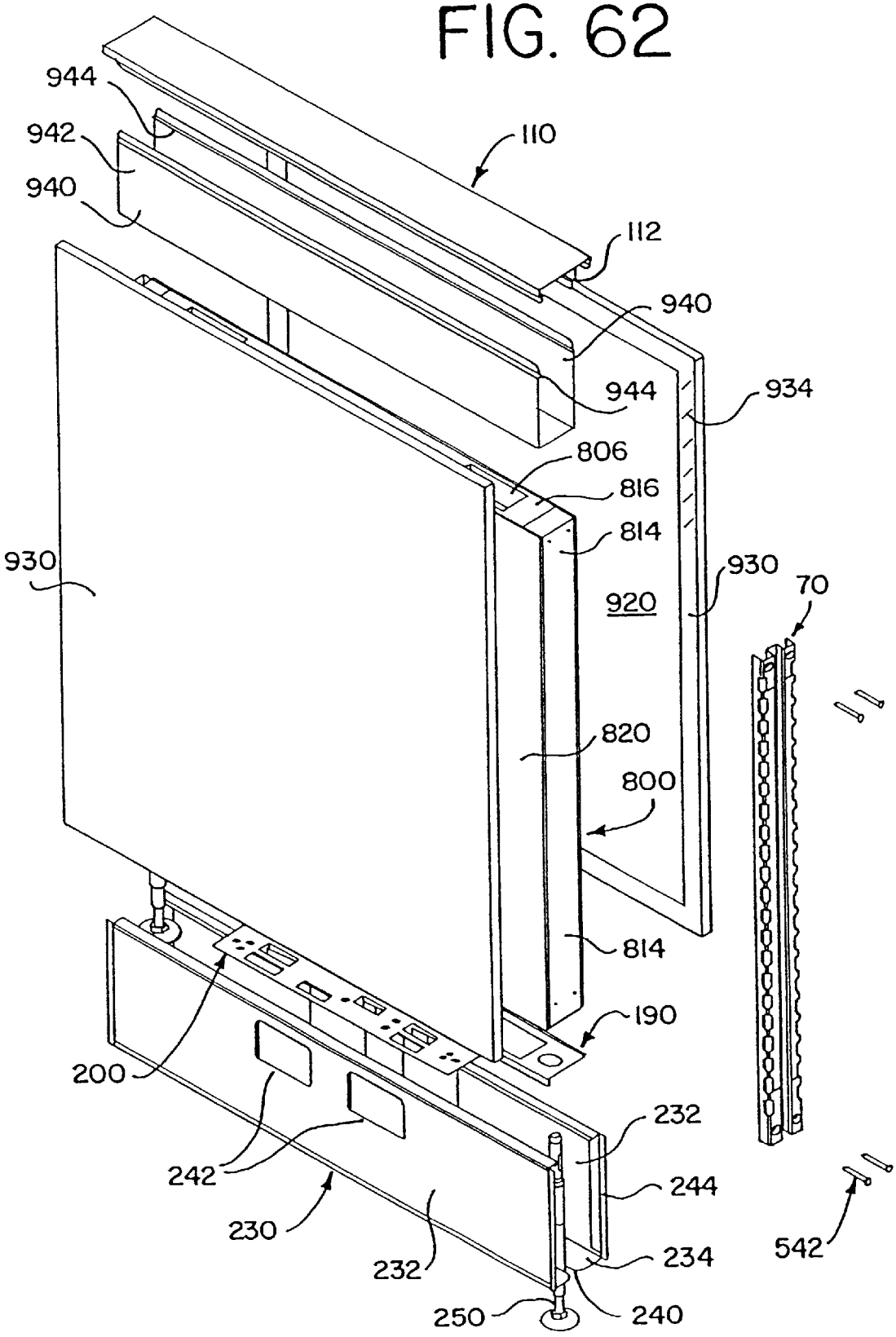
FIG. 62 is an exploded view of an alternative embodiment of the wall panel assembly.
Figure 63:
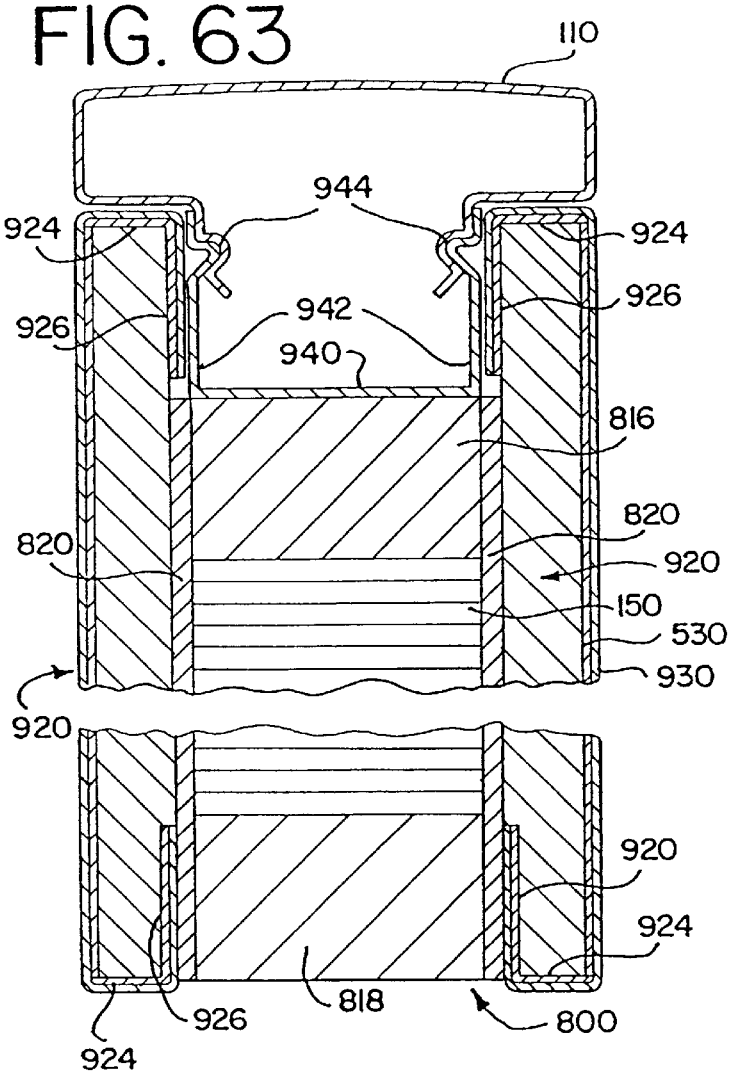
FIG. 63 is a vertical, cross-sectional view of the alternative embodiment of the wall panel assembly shown in FIG. 62.
Figure 65:
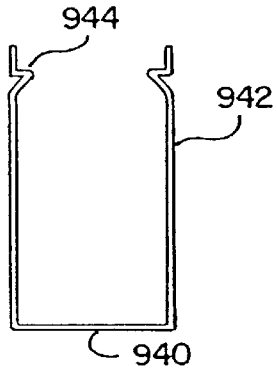
FIG. 65 is an end view of the top channel.

Referring to FIGS. 14 and 62, the mounting strip 190 is disposed between the bracket 200 and the core member 32. The mounting strip 190 has a pair of elongated grooves 194 running longitudinally along the edges of the mounting strip 190. The mounting strip supports a base cover 230. The base cover 230 includes a pair of sidewalls 232 and a bottom wall 234, as shown in FIGS. 14, 15 and 62. The sidewalls 232 and bottom wall 234 are hinged along the longitudinal length of the base cover, preferably by using a flexible hinge material 236. The cover members can also be mechanically hinged. The upper portion of each wall includes a beaded flange 238 that is disposed in the groove 194 in the mounting strip. When mounted on the mounting strip, the base cover 230 forms and defines a horizontal channel for storing and protecting cables and wires beneath the panel. The lower horizontal channel also provides a concealed passage way for the cables and wires as they pass from one panel to the next.

Referring to FIG. 2, the bottom wall 234 of the base cover includes a slot 240 at each end which is adapted to receive a support leg 250 extending down from the vertical frame members 14, as explained below. The sidewalls 232 extend between the lower edge of the wall panel and the floor and include openings 242 adapted to allow a user to access outlets in the modules 226 secured to the power distribution server, which is mounted to the bottom of the lower frame member. Each end of the sidewall 232 on the base cover includes a flexible strip 244 that extends outwardly from the end of the panel. When two panels are installed end-to-end, the opposing flexible strips 244 overlap and conceal the gap between the panels.

Referring to FIGS. 2 and 15, the wall panel is supported on and spaced apart from the floor by a support leg 250 attached to each vertical frame member 14. A support bracket 260 is mounted to the bottom of each core member 28 on the inner surface 48 of the core member. The bracket 260 is mounted in the space 106 provided between the end of the lower core member and the bottom end of the vertical core member, as shown in FIG. 12. The bracket 260 includes a U-shaped sleeve portion 262 and a pair of flanges 264. The flanges 264 are fastened to the inner surface of the core member 28 such that the sleeve portion 262 forms an opening 266 with the surface of the core member.

The support leg 250 includes a shaft 252 having a shoulder 254 and a foot 256. An upper portion of the shaft is received in the opening 266 formed by the support bracket and core member until the shoulder 254 of the shaft engages the bottom of the 260 bracket. The bottom of the shaft 252 is threaded and threadably engages the foot member 256 whereby the height of the wall panel can be adjusted by rotating the foot 256 relative to the shaft 252.

Figure 60:
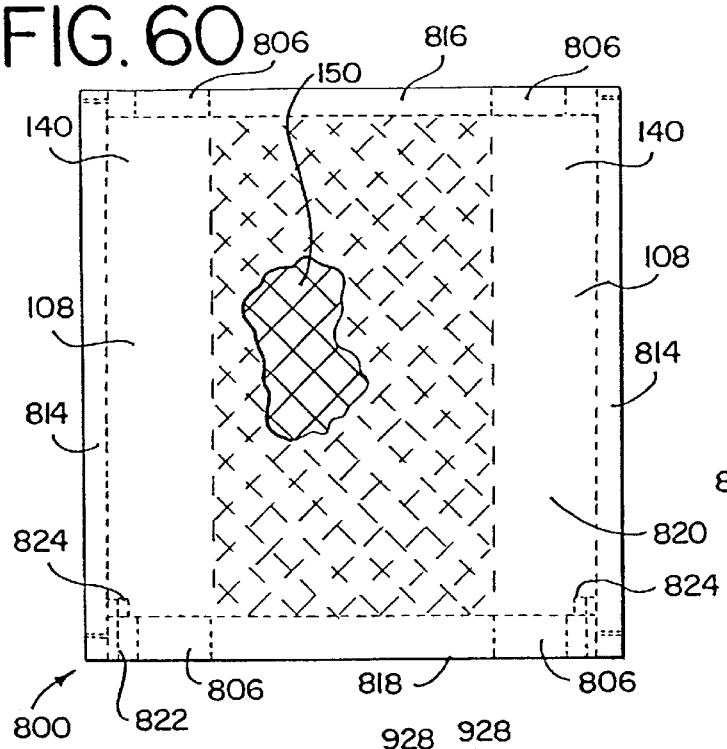
FIG. 60 is a side view of a core assembly of an alternative embodiment of the wall panel.

An alternative construction of the wall panel is shown in FIGS. 60–63. For the sake of clarity and simplicity, parts and assemblies previously described above with reference to other wall panel constructions are referred to and identified by the same reference number. As best illustrated in FIG. 62, the wall panel includes a core assembly 800 and a pair of outer sheetlike wall members 920. The core assembly is shown in FIG. 60, and includes upper and lower horizontal frame members 816, 818 and vertical side frame members 814. Each frame member is preferably made of wood and has a rectangular cross section, similar to the core members 28, 30, 32 of frame member 14, 16, 18 without sidewall members attached thereto. Opposite ends of the vertical frame members are attached to opposite ends of the horizontal frame members with fasteners, adhesive, and/or the like. The upper and lower horizontal frame members 816, 818 each have a pair of openings 806 that provide access to a pair of vertical channels. Similar to the construction of the wall panel shown in FIGS. 1–2 and 8–12, a filler member 150 is disposed between the upper and lower horizontal frame members, while partition members 140 extend between the filler member and the vertical side frame members to form a pair of vertical raceways 108. A first and second sheetlike inner wall members 820 are mounted to opposite sides of the filler member and frame members to complete the core assembly with adhesive, such as glue, and/or mechanical fasteners. The wall members 820 are preferably made of a relatively thin hardboard, e.g., ⅛ or ¼ inch, although other thicknesses would also work. The wall members close off and form the vertical raceways 108 inside the core assembly. The periphery or edges of the wall members 820, preferably lie flush with, or inward from, the outer surface of the frame members. Preferably, the thickness of the core assembly is about 2 inches, with the total thickness of the wall panel being approximately 3 inches.

Figure 60A:
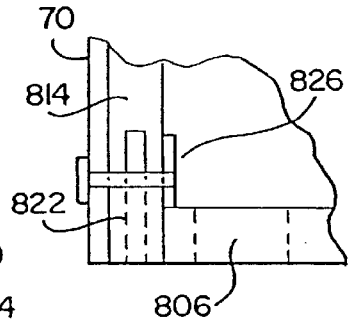
FIG. 60A is a partial view of the wall panel of FIG. 60 with an alternative positioning of the opening for the support leg.

As shown in FIG. 60, a hole 822 is positioned through the lower horizontal frame member and is shaped to receive the shaft 252 of the support leg. A stiffener block 824 can be inserted inside the core assembly at each of the junctures of the lower frame member and the side frame members to strengthen the panel and to provide further support for the support leg shaft. Alternatively, as shown in FIG. 60A, the hole is positioned in the end of each vertical frame member and extends longitudinally therein. The shaft 252 of the support leg is press fit into the hole. A stiffener 826, preferably a piece of plywood, can also be mounted to the inner surface of the vertical frame member to prevent the frame member from splitting when the support leg is installed. The plywood is secured to the frame member with adhesive and/or by fasteners used to install the hanger member 70 to the outer surface of the frame member, as described above. The fasteners extend through the frame member on opposite sides of the hole and thereby help to support the frame member around the shaft so as to prevent the frame member from splitting.

Figure 61:
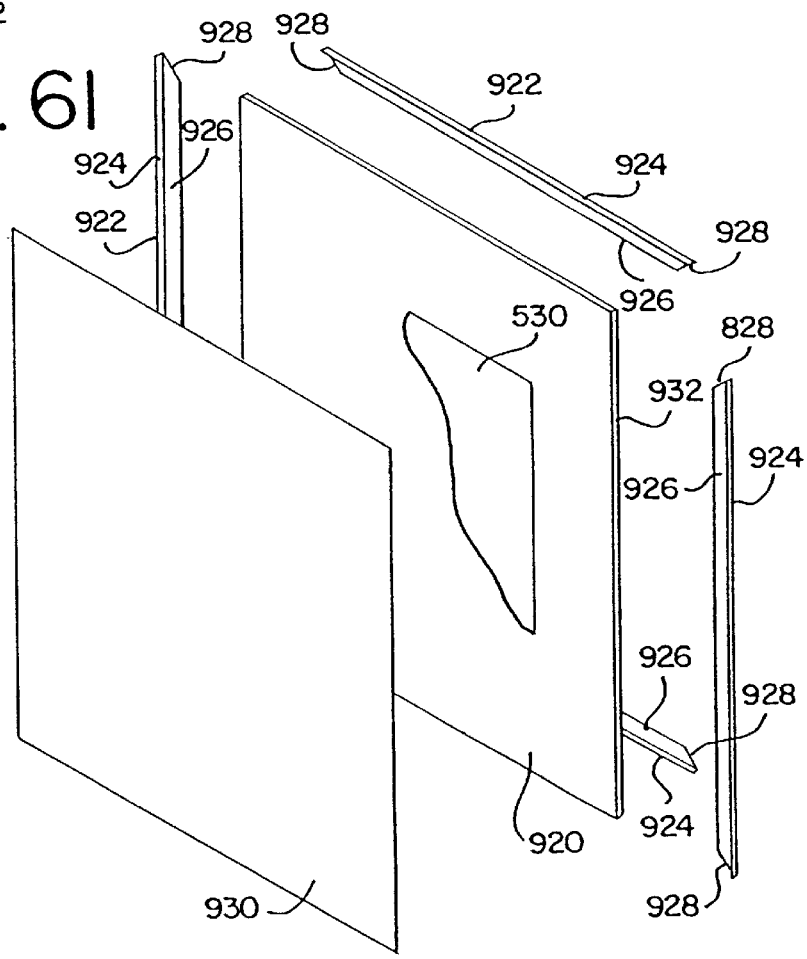
FIG. 61 is an exploded view of an alternative embodiment of a wall member.
Figure 67:
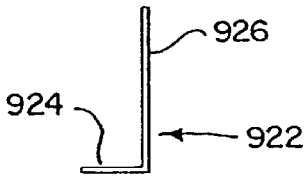
FIG. 67 is an end view of the protective strip.
Figure 64:
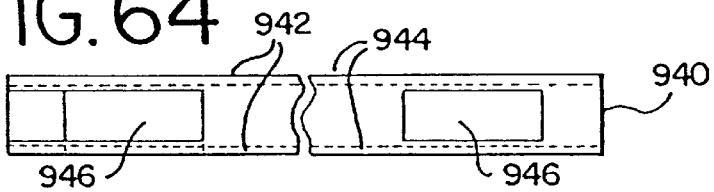
FIG. 64 is a top view of a top channel.
Figure 66:
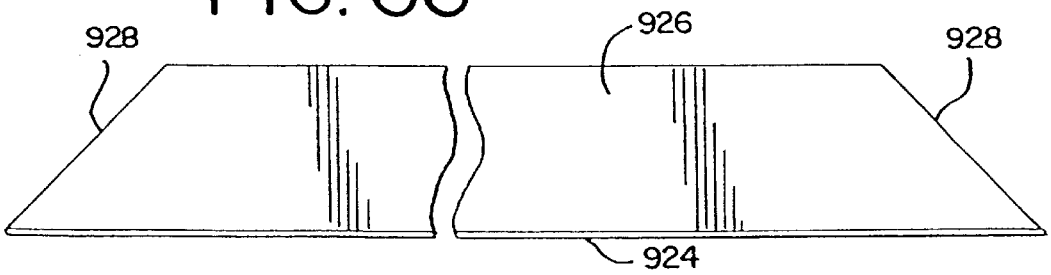
FIG. 66 is a side view of the protective strip.

Referring to FIG. 61, a plurality of protective strip members 922 (shown as four) are positioned around the periphery of wall member 920. Each strip member, shown in FIGS. 66 and 67, is L-shaped and has a long flange and a short flange. The short flange 924, which has a length substantially the same as, or slightly less than, the thickness of the wall member, is disposed along the edge 932 of the wall member to protect it from impact damage and the like. The long flange is disposed along the inner surface of the wall member. The strip members 922 preferably run the length of the edge of the wall member upon which they are disposed, although it should be understood that a plurality of strip members having shorter lengths could be placed end to end to cover the entire length of the wall member edge. The ends 928 of the long flange are tapered, or mitered, to mate with the ends of adjacent strip members at each corner of the wall member. As shown in FIGS. 61 and 62, a thin decorative sheet 930, preferably a fabric, is then applied over the panel, with a barrier sheet 530 inserted therebetween if desired. The decorative sheet is attached to the wall member by applying a plurality of fasteners 934 through the decorative sheet and strip members and into the wall member as shown in FIG. 62. The strip members 922 anchor the fasteners, shown as staples, and help prevent the decorative sheet from being pulled from the wall member. The strip members 922 cab be attached to the wall member using the fasteners 934 for attaching the decorative sheet, or they can first be attached to the wall member using additional fasteners or adhesive.

After the decorative sheet is mounted to the wall member, each wall member 920 is mounted to the core assembly using an adhesive, preferably a hot melt, applied between the wall member 920 and the wall member 820 of the core assembly. Alternatively, or in combination with the adhesive, the wall members 920 can also be mounted to the core assembly with fasteners, such as barbed fasteners, nails, staples and the like. When installed, the periphery, or edges, of the wall members 920 extends beyond the periphery of the wall member 820 along the top and sides of the core assembly so as to form channels along three sides of the wall panel, with the channel formed along the top of the panel preferably being the deepest. The wall members can also overhang or extend beyond the bottom periphery of the wall member 820 so as to form a channel along the bottom of the wall panel. Hanger brackets 70 are disposed in the relatively shallow channels along the sides of the wall panel and are secured to the vertical side frame members such that the slots 86 of the hanger brackets are exposed beyond the edge of the wall members 920. The slots 86 are configured to receive and support various components.

Figure 99:
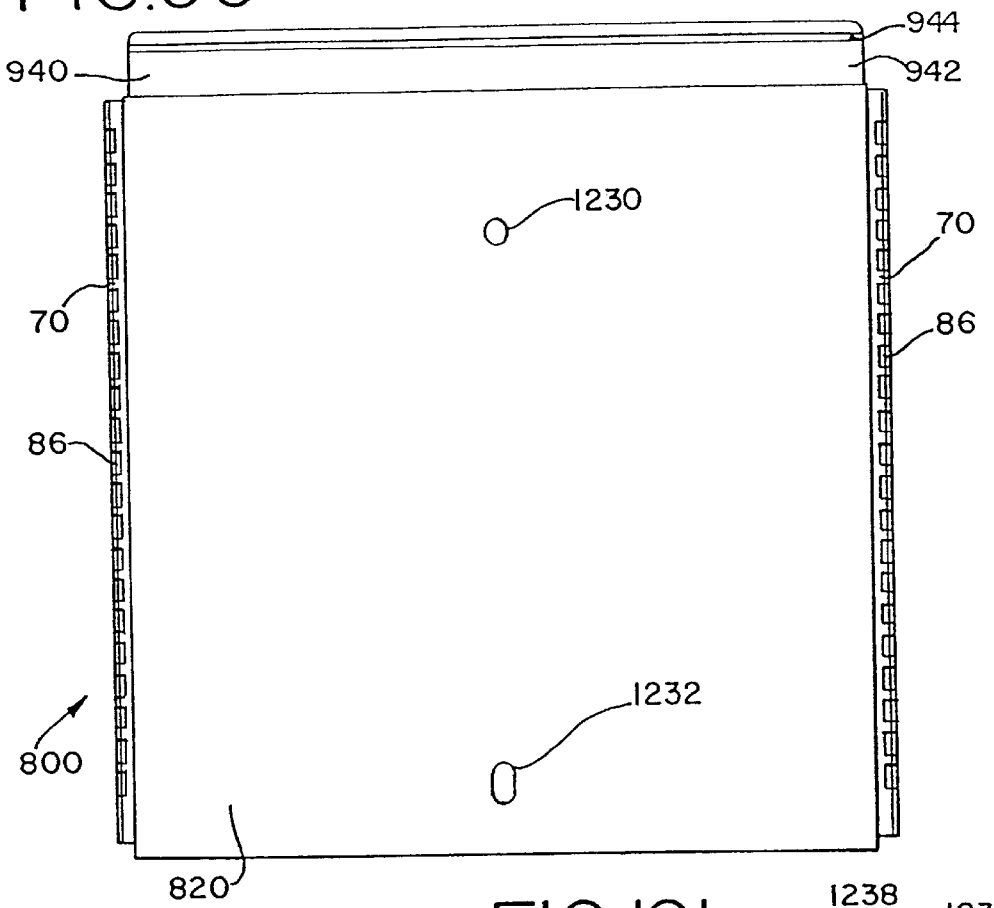
FIG. 99 is a side view of a core assembly having a pair of locator holes disposed therethrough.
Figure 103:
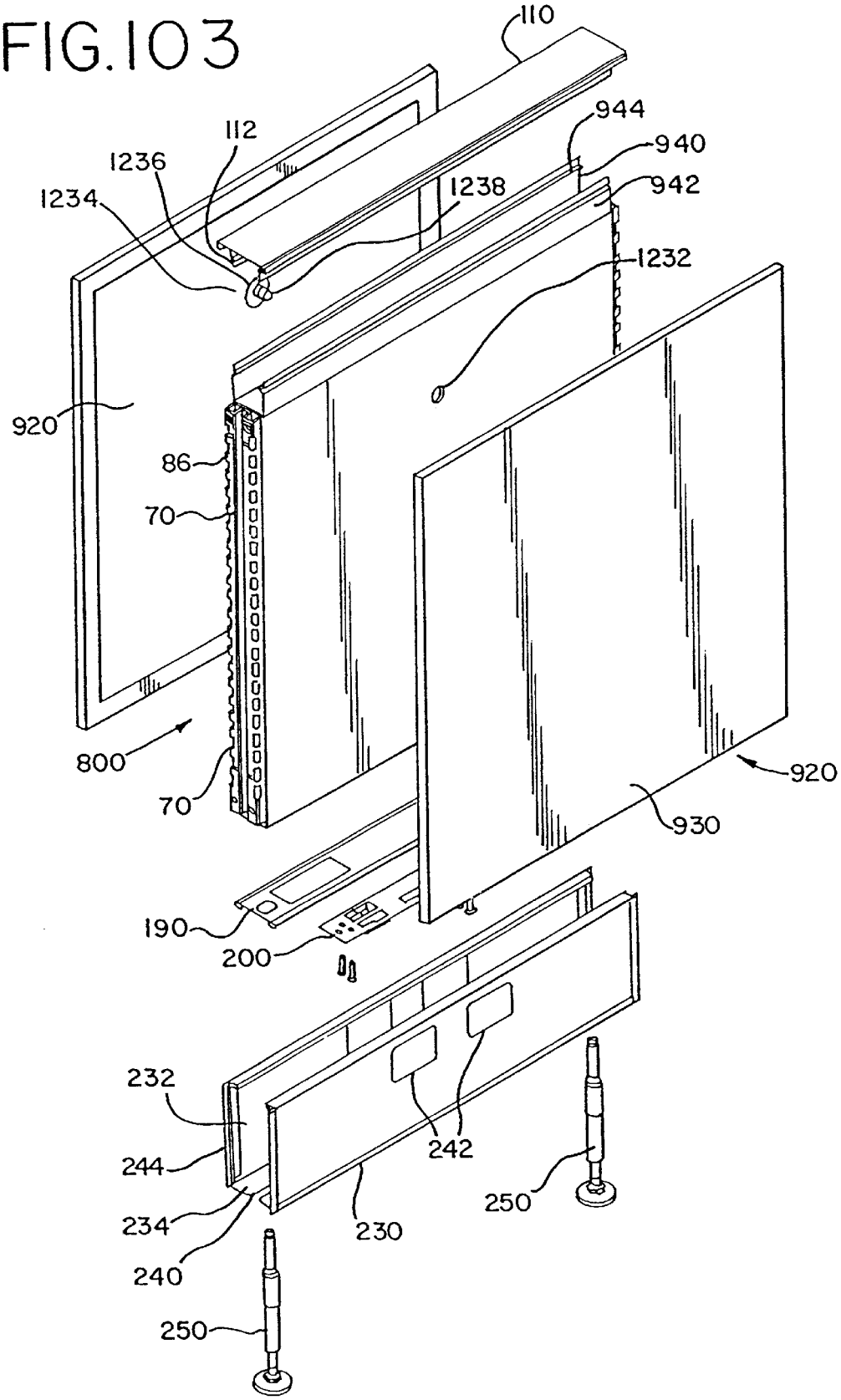
FIG. 103 is an exploded perspective view of a wall panel assembly.
Figure 104:
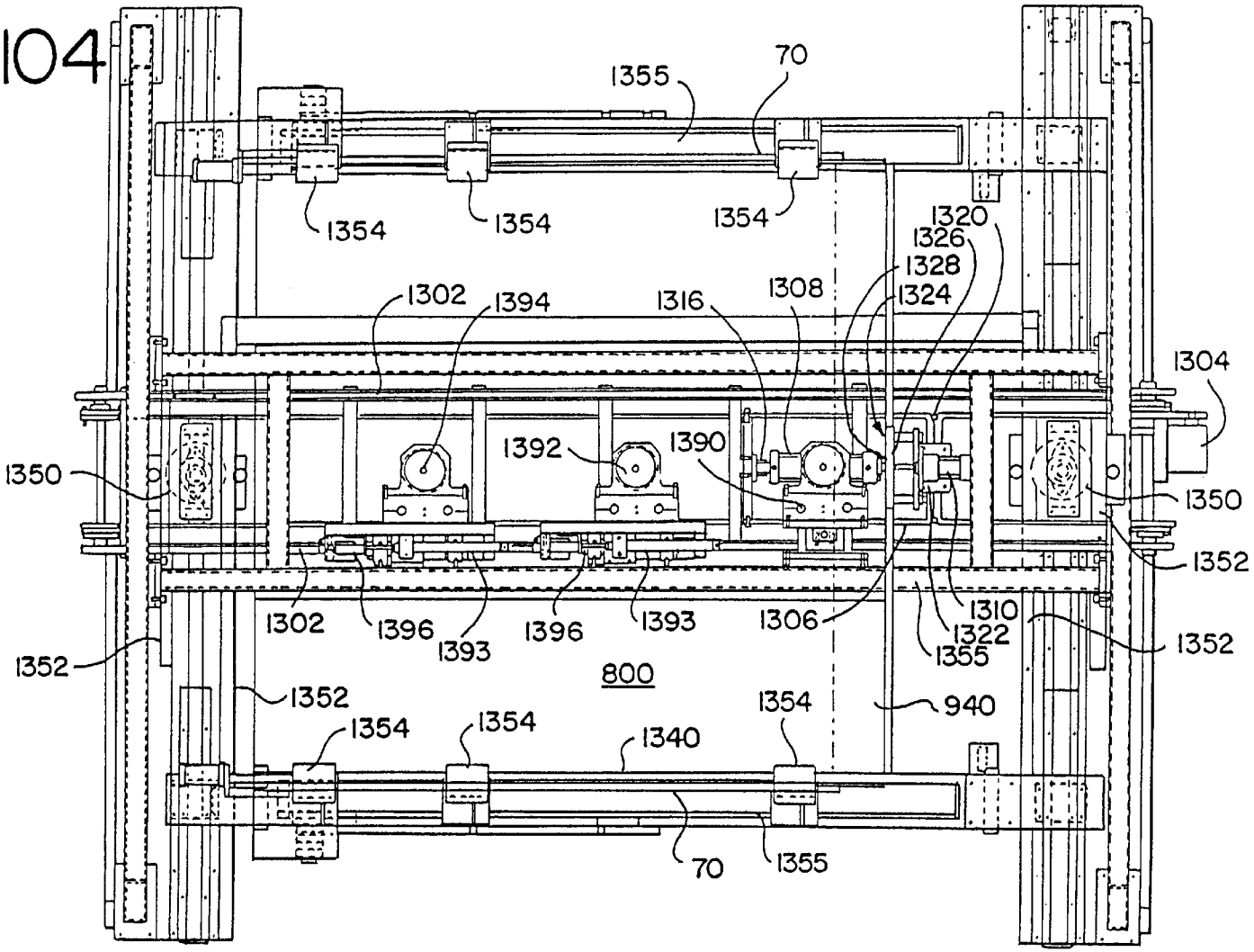
FIG. 104 is a plan view of a machine used to make locator openings in a core assembly.

As shown in FIG. 103, the wall member 920 can be centered on the core assembly 800 from side to side such that there is an equal overhang of the wall members on each side of the wall panel. The centering of the wall members on the core assembly provides an equal exposure of the hanger brackets 70, and slots therein, on each side of the wall panel. In particular, and referring to FIGS. 99 and 103, the core assembly 800 has a pair of locator openings 1230, 1232 bored therethrough along the centerline of the panel. The upper locator opening 1230 is preferably circular, while the lower locator opening 1232 is preferably slotted along the vertical direction. Preferably, the upper locator opening has a ½ inch diameter, while the lower locator opening is ½ inch side and 1¼ inches long. Obviously, it should be understood that other diameters and sizes would also work. It should also be understood that the location of the circular and slotted openings could be interchanged, or that both openings could be circular or slotted, or assume any other shape, including for example a rectangular or triangular shape. Moreover, it should be understood that one or more locator openings, and preferably more than one, can be used to locate the wall member 920 on the core assembly, and that the disclosure of two locator openings is meant to be illustrative, rather than limiting. Preferably, the upper locator opening is keyed off of or located a predetermined with respect to the top of the core assembly, or a channel attached thereto. For example, in one embodiment, the locator openings are keyed off of or located a predetermined distance from the upper surface of the ridges on the channel, which surface acts as a reference.

Figure 100:
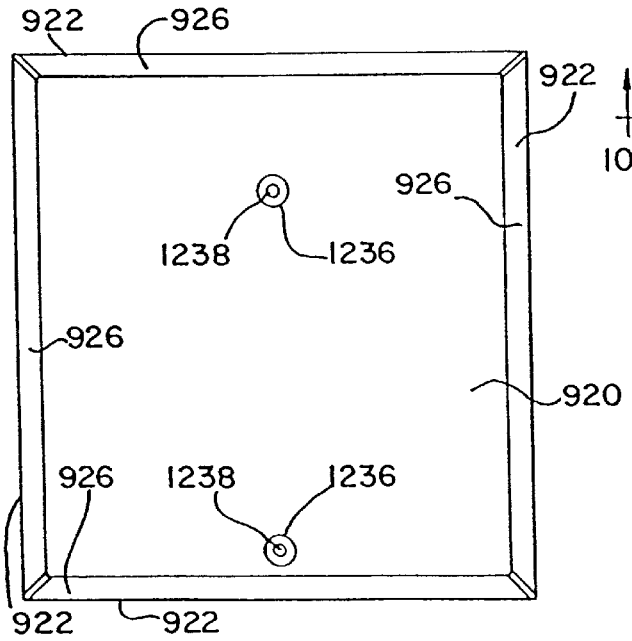
FIG. 100 is a side view of a wall member with a pair of locator members disposed thereon.
Figure 101:
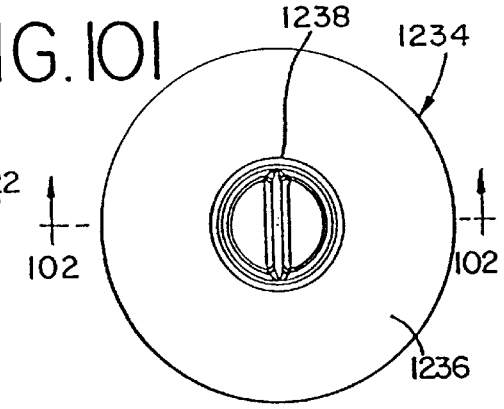
FIG. 101 is a plan view of a locator member.
Figure 102:
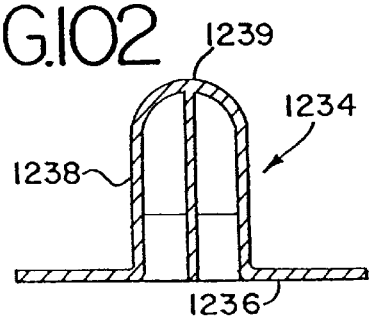
FIG. 102 is a cross-sectional view of the locator member taken along line 102—102 of FIG. 101.

Referring to FIGS. 100 and 103, the wall member 920 includes two locator members 1234, which are receive in the locator openings. The locator members 1234 are attached along the centerline of the wall member 920. The upper locator member is received in the upper locator opening which is circular and dimensioned to receive the locator member without play so as to determine the top-to-bottom positioning of the wall member with respect to the core assembly. The lower locator opening, which is slotted, can accommodate some tolerance buildup, or other slop, in the placement of the locator members along the vertical axis, as it is not intended to locate the wall member along the vertical direction, but is dimensioned to closely receive the locator member in the lateral or side-to-side direction so to prevent any play therealong. In this way, the upper and lower locator member and openings work in combination to center the wall member on the core assembly from side-to-side, while the upper locator member and opening position the wall member on the core assembly from top to bottom.

Each locator member includes a base portion 1236 and a post member 1238 extending outwardly therefrom. The post member 1238 has a rounded nose portion 1239 that facilitates its insertion into the locator openings positioned in the core assembly. The locator members are preferably made of high density polyethylene, although it should be understood that other materials, including other types of plastic, wood or metal would also work. The post member 1238 is shaped to be received in the locator holes 1232, 1234, and preferably has a length less than one half the thickness of the core assembly so that the post members 1238 on the opposing wall members 920 can be inserted in the same locator openings 1232, 1234 from both sides of the core assembly.

The base portion 1236, which is preferably flat, circular and relatively thin, is attached to the inner surface of the wall member 920 with a plurality of mechanical fasteners, such as staples, nails or the like. Alternatively, or in combination with the mechanical fasteners, the bottom surface of the base portion can be attached to the wall member with an adhesive or the like, including for example a two sided tape, glue or other bonding agent.

Preferably, the upper locator member is keyed off of or located a predetermined distance from the top edge of the wall member, which acts as a reference. The location of the upper locator member is correlated to the location of the upper locator opening with respect to the top of the core assembly, or channel thereon, such that a uniform appearance is provided from wall panel to wall panel when the core assembly and wall member components are assembled to form the wall panels.

It should be understood that the predetermined distance between the upper locator opening and the top of the core assembly, or channel, and the predetermined distance between the locator member and the top edge of the wall member are not by themselves (individually) important. Rather, one of skill in the art should understood that it is the relationship between the two predetermined distances that is important, as it is that relationship that ensures that the wall member is properly located on the core assembly from top to bottom. Thus, the predetermined distance of the locator opening from the its reference, whether it be the top of the core assembly, or a surface on the channel attached thereto, refers to any distance arbitrarily set, but preferably calculated so that the upper locator opening is below and does not pass through the upper horizontal frame member. The predetermined distance of the locator member from the top edge of the wall member is then calculated so as to ensure that the wall member extends a certain distance above the core assembly, and preferably to the top of the channel attached thereto. Conversely, the predetermined location of the locator member can first be calculated, with the predetermined location of the locator opening thereafter set.

When attaching the wall member 920 to the core assembly 800, the locator members 1234 are disposed in the locator openings 1230, 1232, which are dimensioned to receive the locator members, so as to ensure that the wall member is centered on the core assembly from side to side. In addition, the upper locator opening, which is preferably not slotted and therefore controls the position of the upper locator member, ensures that the top edge of the wall member is also located a predetermined distance with the respect to the top of the core assembly, or the channel member attached thereto, as the locator member is received in the upper locator opening. Although the locator members and openings are shown as being located along the centerline of the wall member and core assembly respectively, it should be understood that the locator members and holes could be located off the center line and still function to center the wall member on the core assembly as long as the location of the locator members and openings are keyed off the side surfaces of the wall member and core assembly so as to provide an equal overhang as explained above.

One of skill in the art should also understand, as explained in more detail below, that the locator members and openings could be reversed, with the locator members attached to the core assembly, and with the locator openings disposed in the wall members.

As shown in FIGS. 62–65, 99 and 103, the top channel member 940, or liner, is mounted to the top of the upper horizontal frame member 816 in the channel formed between the upper portions of the opposing wall members 920. The channel member can be attached to the upper horizontal frame member with fasteners, adhesive, or a combination thereof, before or after the wall members are secured to the core assembly. As with the sidewalls of the upper frame member described above, each leg 942 of the top channel includes an inwardly facing ridge 944 or lip portion that engages the ribbed portion 114 of the top cap 110. In a preferred embodiment, the upper surface of the ridge 944 serves as the reference for locating the position of the upper locator opening. The top channel also includes a pair of openings that are aligned with the openings 946 in the upper frame member and the vertical raceway 108 beneath it. The top channel member can be made of plastic, metal or any other suitable material.

Figure 8:
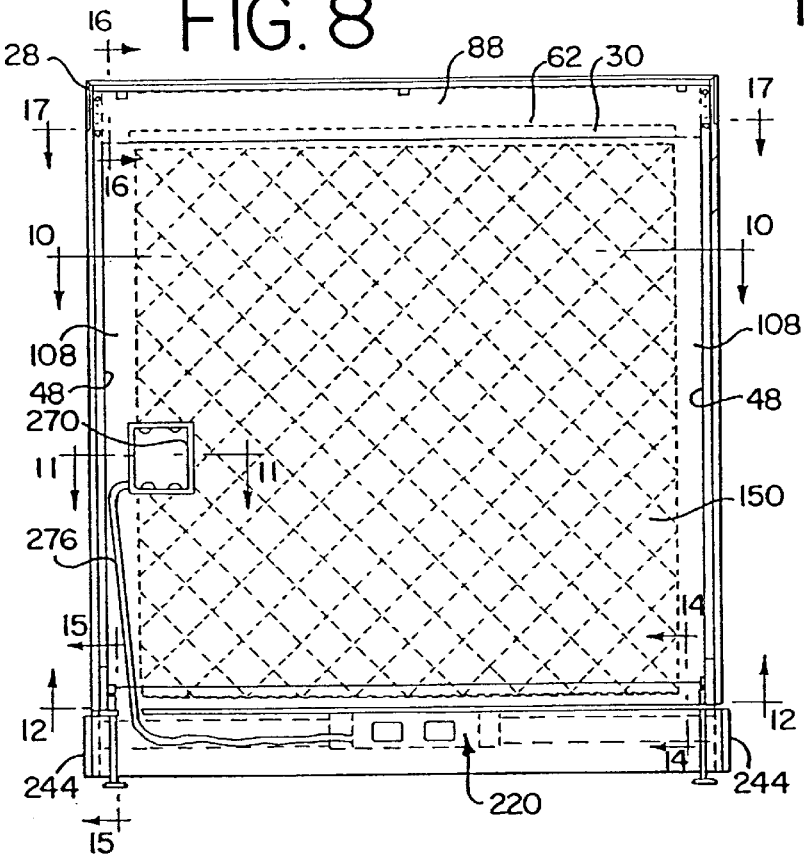
FIG. 8 is a side view of a wall panel.
Figure 9:
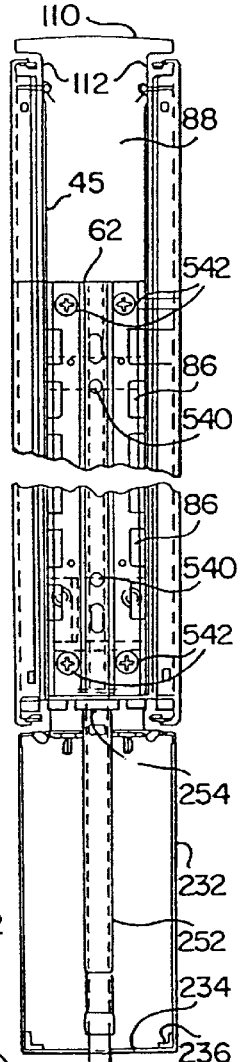
FIG. 9 is an end view of a wall panel with the power distribution server omitted.

In a preferred embodiment, an outlet box 270 is installed inside the wall panel frame between the upper and lower frame members 16, 18, 816, 818. As shown in FIGS. 8 and 11, the outlet box 270 is first attached, preferably with bolts, to a plate member 272, preferably a piece of hardboard. The plate member 272 is then attached, preferably by adhesive bonding, to the inner surface 122 of one of the wall members. The opposite wall member has an opening 274 aligned with the outlet box 270 so as to allow the user access to the box. An outlet cover 275 can be installed over the opening. The outlet box is electrically connected to the power distribution server with an electrical conduit 276 that is disposed in the vertical channel 108, as described above. Outlets, which are not shown, are installed in the outlet box. It should be understood that the same or similar box can be installed to provide access to data and communication wiring and cables. The outlet box also can be field installed by cutting a hole in one of the thin sheets, the barrier sheet and the wall member.

In an alternative embodiment, the outlet box can be installed using a bracket that is mounted inside the panel as shown and described in U.S. Pat. No. 5,873,553, entitled Mounting Bracket Assembly for an Outlet Box, the entire disclosure of which is hereby incorporated herein by reference.

Figure 95:
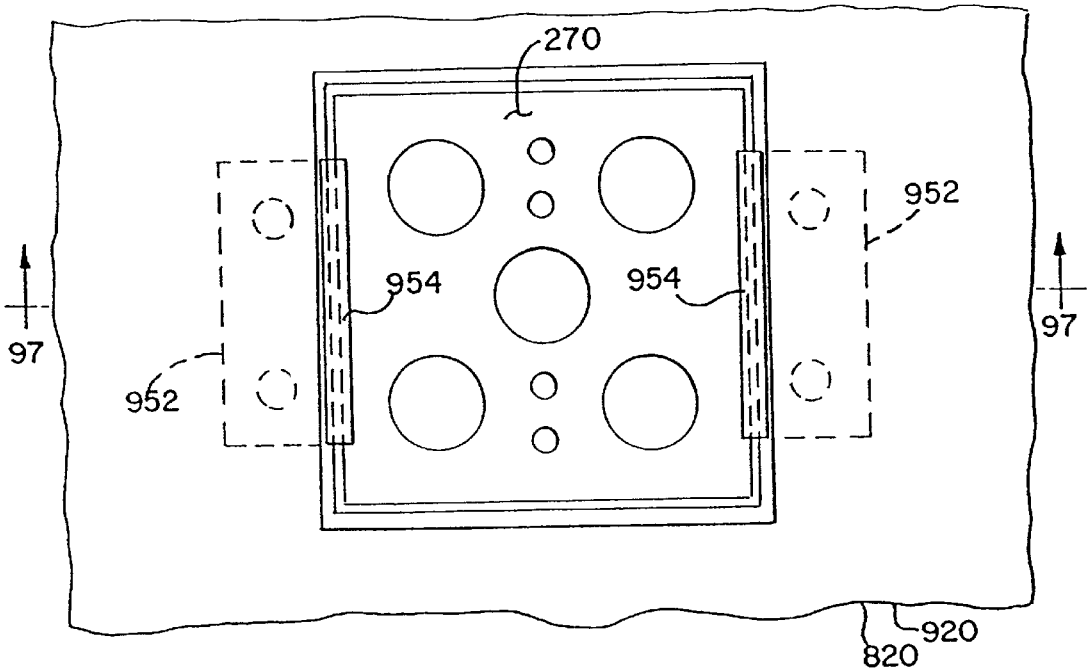
FIG. 95 is a front view of the outlet box mounted in the wall panel using an alternative bracket assembly.
Figure 96:
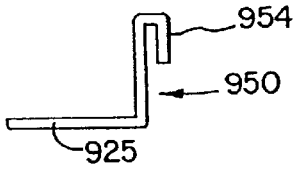
FIG. 96 is an end view of a bracket member used to install the outlet box in the wall panel.
Figure 97:
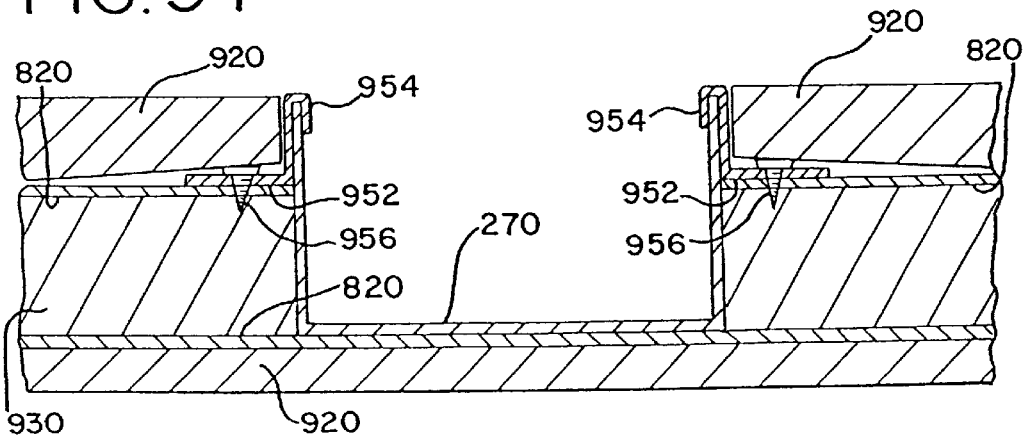
FIG. 97 is a cross-sectional view of the assembly shown in FIG. 95.

In yet another alternative embodiment, shown in FIGS. 95–97, a pair of brackets 950 each include a flange portion 952 and a hook portion 954 extending laterally from the flange portion. The flange portion 952 is attached to the wall member 820 of the core assembly with a pair 956 of fasteners. The wall member 920 is then laid over the flange portion 952 and attached to the wall member 820 as described above. The hook portion engages an outwardly facing edge of the outlet box and holds the back of the outlet box against the inner surface of the opposing wall member 820.

The wall panels can be connected to form a system of panels that defines and divides large office spaces into work spaces. For example, the wall panels can be connected end-to-end in a simple linear arrangement as shown in FIGS.

Figure 28:
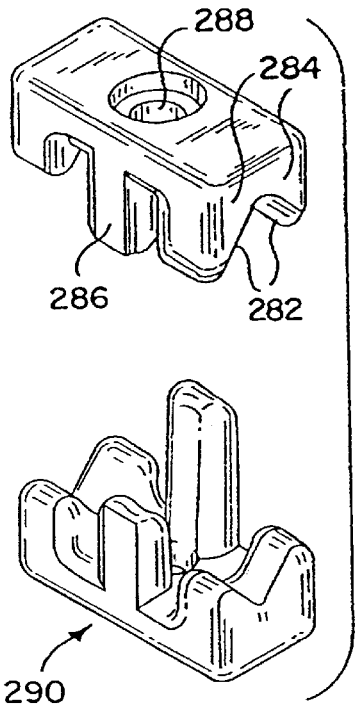
FIG. 28 is a perspective view of the upper and lower draw blocks.
Figure 29:
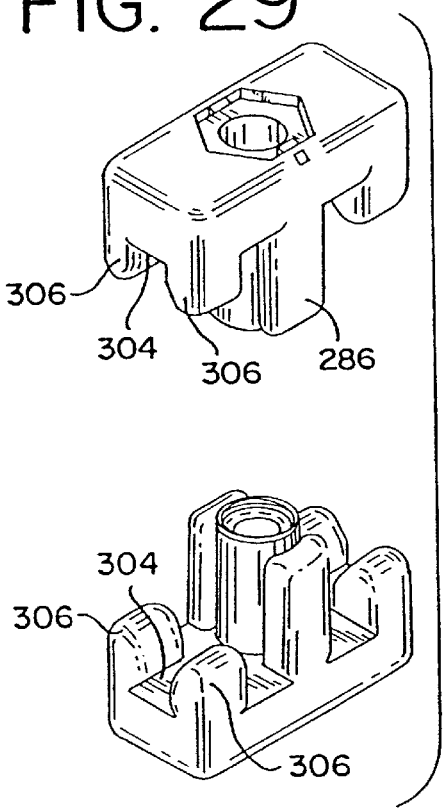
FIG. 29 is a perspective view of an alternative configuration of the upper and lower draw blocks.
Figure 30:
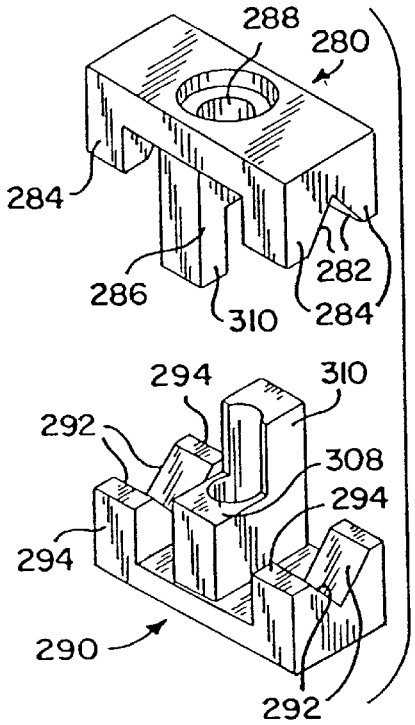
FIG. 30 is a perspective view of an alternative configuration of the upper and lower draw blocks.

19 and 20. In such an arrangement, the panels are positioned adjacent to each other such that opposing outer surfaces 80 of the hanger brackets are in a proximal relationship. A connector member connects the adjacent hanger brackets and generally includes an upper and lower draw block and a draw rod, although, as explained below, other connector member confirmations can further include a corner post, or can be configured as a hanger bracket. For example, as shown in FIGS. 28–30, an upper draw block 280 is provided which has a downwardly facing V-shaped draw surface 282 defined by four wedge members 284. The upper draw block 280 includes a middle portion 286 that has a hole 288. Similarly, a lower draw block 290 has an upwardly facing V-shaped draw surface 292 defined by four wedge members 294. A draw rod 296 connects the two draw blocks 280, 290.

Figure 19:
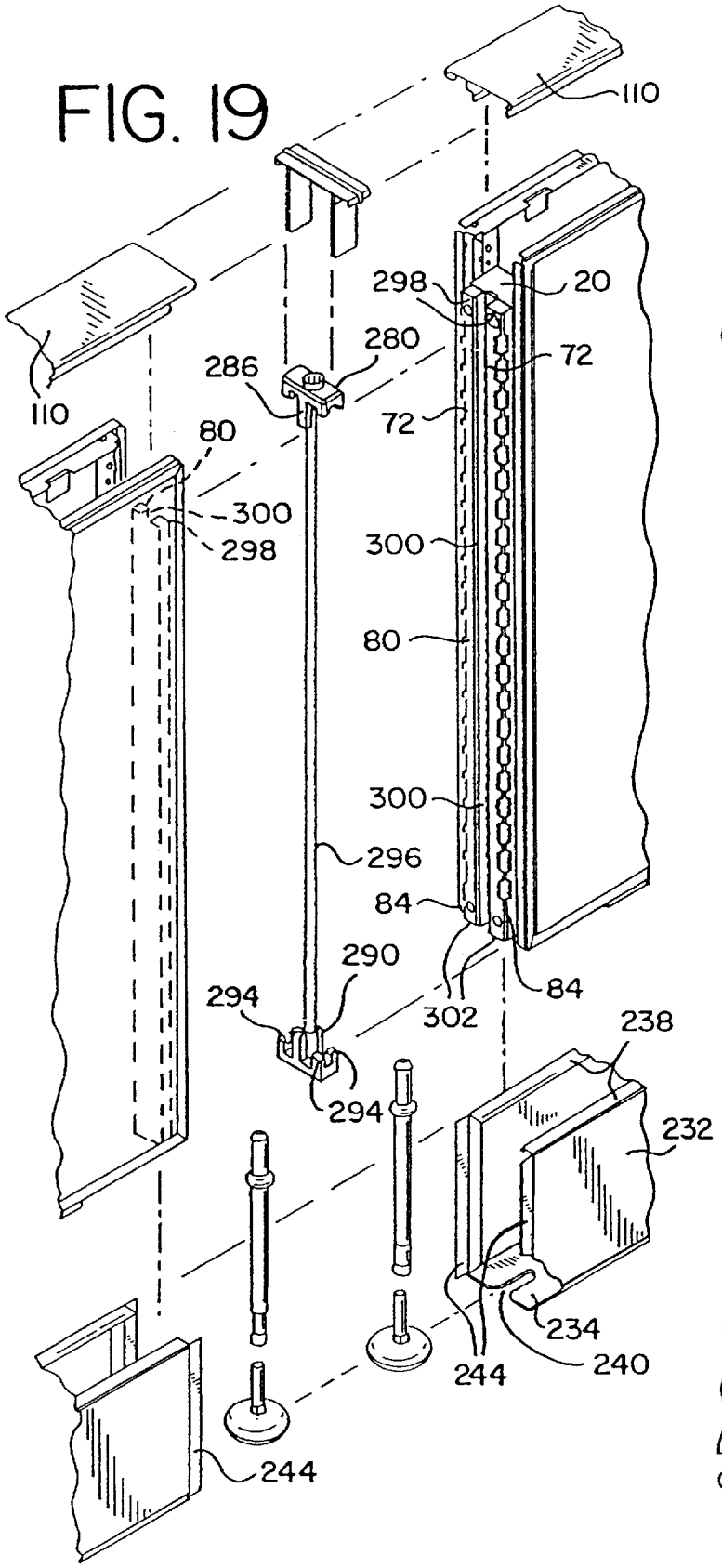
FIG. 19 is an exploded perspective view of two wall panels placed end-to-end without the fabric installed.
Figure 20:
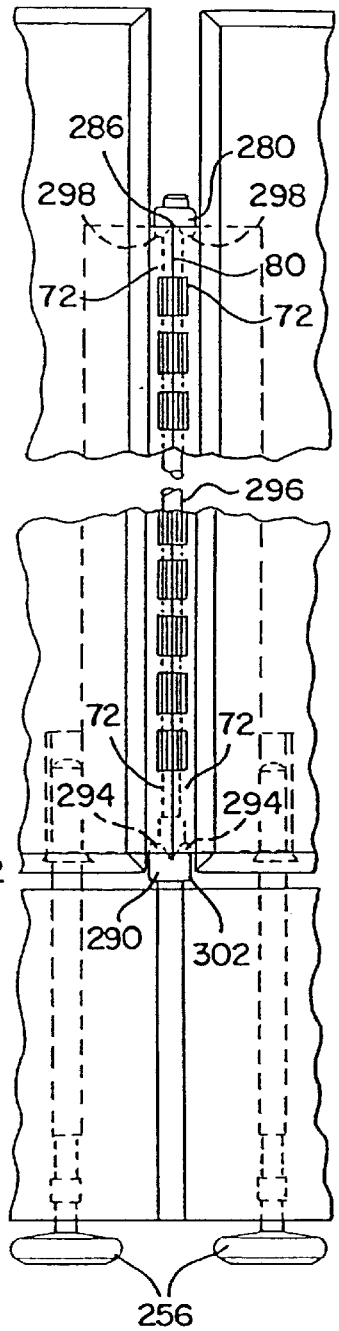
FIG. 20 is a side view of two wall panels connected together without the fabric installed.

Referring to FIGS. 19–20, the upper draw block 280 is positioned such that the wedge members 284 engage the top edge 298 of the hanger bracket on the adjacent panels by inserting the wedge members 284 into the inwardly facing channels 72. The middle portion 286 of the draw block is disposed in the space formed between the outwardly facing channels 300, which is formed by the inner legs of the channel and the bridge portion.

Figure 32:
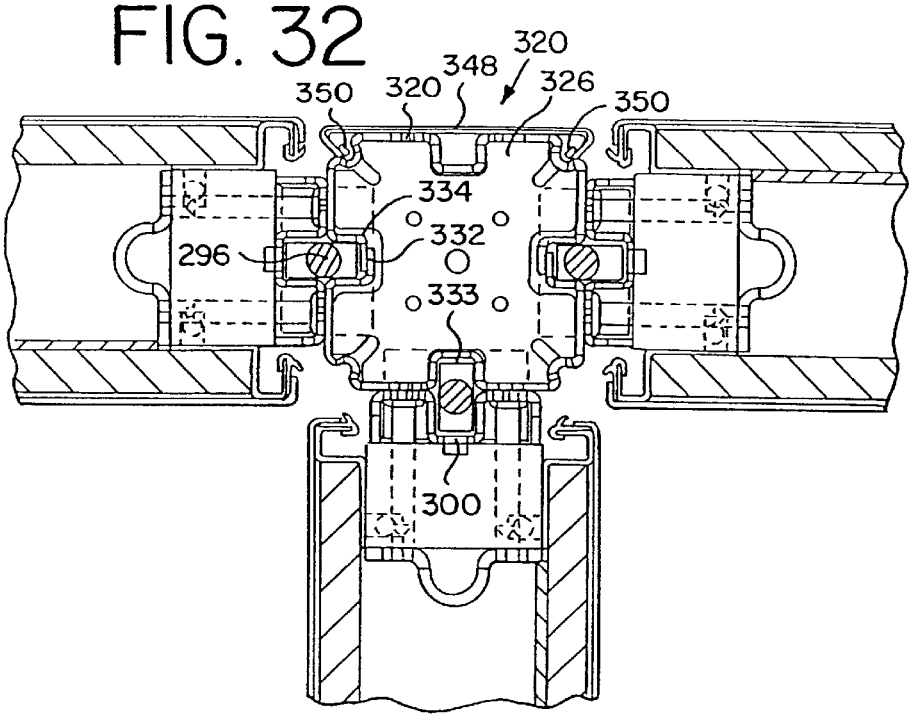
FIG. 32 is a top cross-sectional view of three wall panels connected to a corner post.
Figure 33:
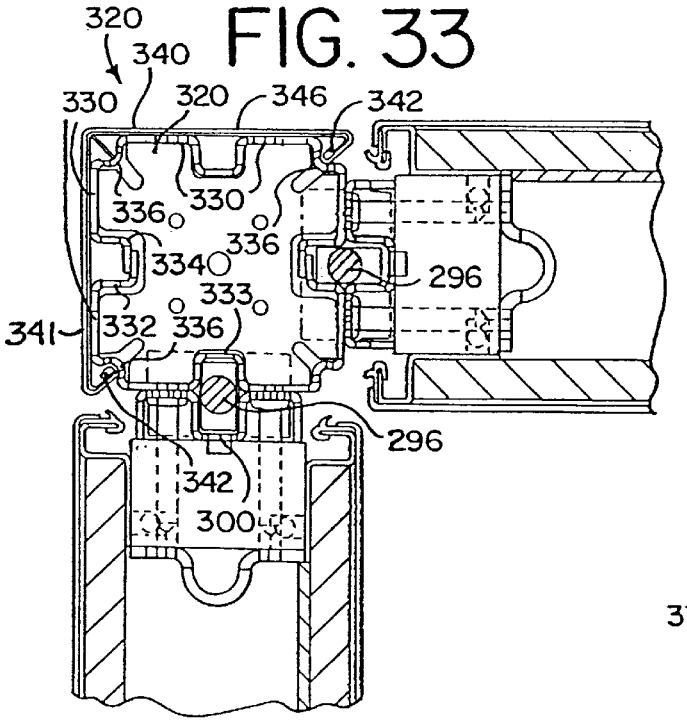
FIG. 33 is a top cross-sectional view of two wall panels connected to a corner post.
Figure 34:
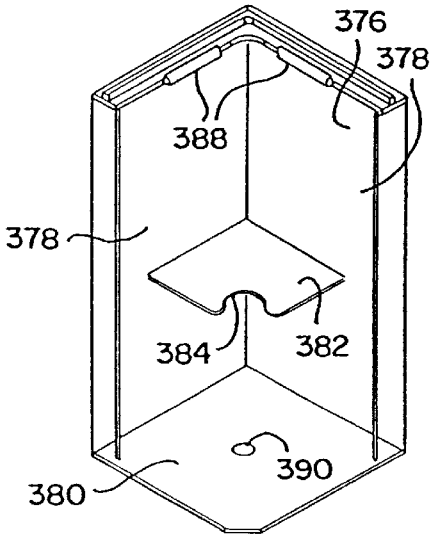
FIG. 34 is a perspective view of a corner post base cover.
Figure 35:
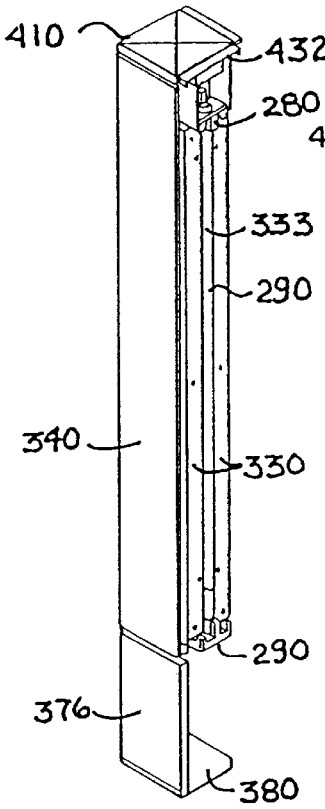
FIG. 35 is a perspective view of a draw rod and draw blocks engaging a corner post.

Similarly, the lower draw block 290 is inserted into the bottom end of the channels 72 such that the wedge members 294 engage the bottom edge 302 of the hanger bracket 70 and the middle portion is received in the space formed by the channels 300. The draw rod 296 is rotatably connected to the lower draw block and threadably engages the upper draw block. Alternatively, the draw rod can be rotatably secured to the upper draw block and threadably secured to the lower draw block, or it can be threadably secured to both. The draw rod is disposed in the space formed by the two outwardly facing channels 300 of the opposing hanger brackets as shown in FIGS. 32–33. When rotated, the draw rod threadably engages the upper draw block, pulling it closer to the lower draw block. As the draw rod is tightened, the draw surfaces 282, 292 of the draw blocks operably engage the ends 298, 302 of the hanger brackets and pull the hanger brackets together. In an alternative embodiment shown in FIG. 29, the draw blocks include a flat surface 304 between the wedge members 306. When drawn together, the ends of the hanger brackets engage the flat surface 304, wherein the hanger brackets are locked into position between the wedge members.

As shown in FIG. 30, one embodiment of the draw blocks includes a landing 308 and a tang member 310 extending from the landing on one side of the opening 288. This configuration facilitates the installation of the draw blocks and draw rod. In particular, the installer can rest the land portion 308 of the upper draw block on the bridge portion 74 of one of the hanger brackets, while the tang member 310 is disposed in the channel 300 to align the draw block with the hanger bracket. In this way, the connector assembly, i.e., the draw rod and two draw blocks, can be positioned and retained by a first panel as the second wall panel is moved into place next to the first panel. The draw rod 296 and blocks 280, 290 can then be lifted up and aligned with the channels 72 on the ends of both panels. The draw rod 296 is then tightened as explained above so as to connect the two panels.

As shown in FIGS. 4–5 and 31–33, two or more panels can also be connected in a perpendicular relationship. In such a configuration, the connector member further includes a corner post 320 installed between adjacent panels and one or more pairs of draw rods and upper and lower draw blocks connecting the panels to the corner post. The corner post 320 includes a substantially square, elongated tube 322 and an upper and lower plate 324, 326 mounted inside each end of the tube, preferably by welding. Each plate 324, 326 includes a threaded hole 328 in the middle of the plate. A pair of inwardly facing channels 330 are formed longitudinally along each side of the tube 322. The inwardly facing channels 330 also form an outwardly facing channel between them. Preferably, the tube 322 is made from two overlapping C-shaped pieces 332, 334 welded together as shown in FIGS. 32–33.

Figure 4:
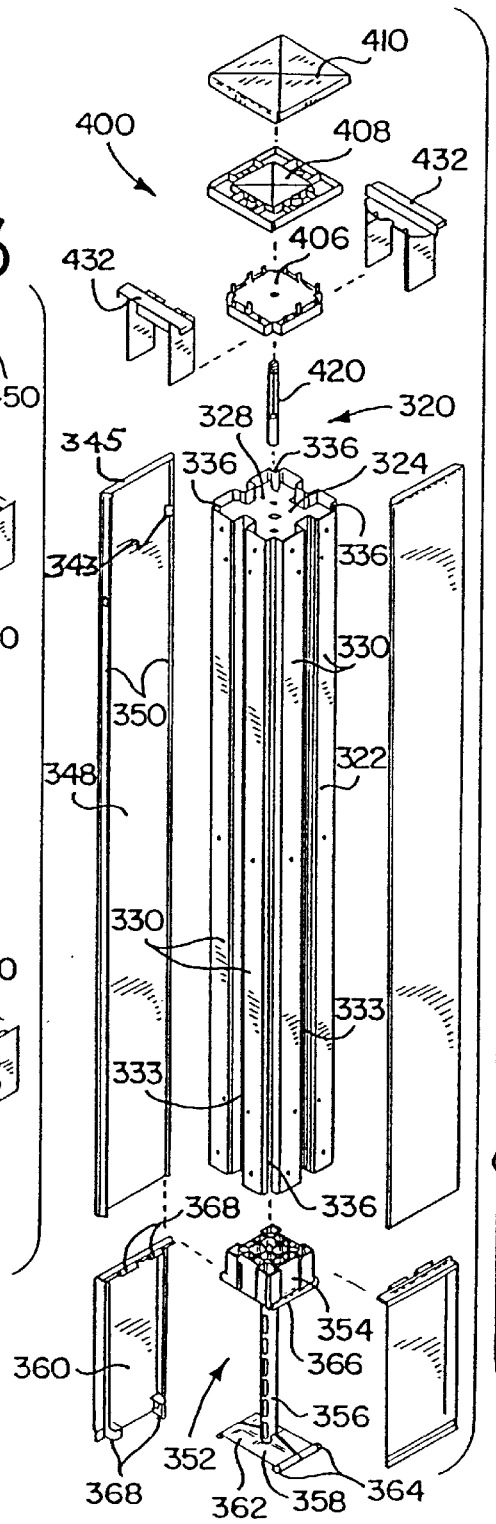
FIG. 4 is an exploded view of a corner post configuration.
Figure 5:
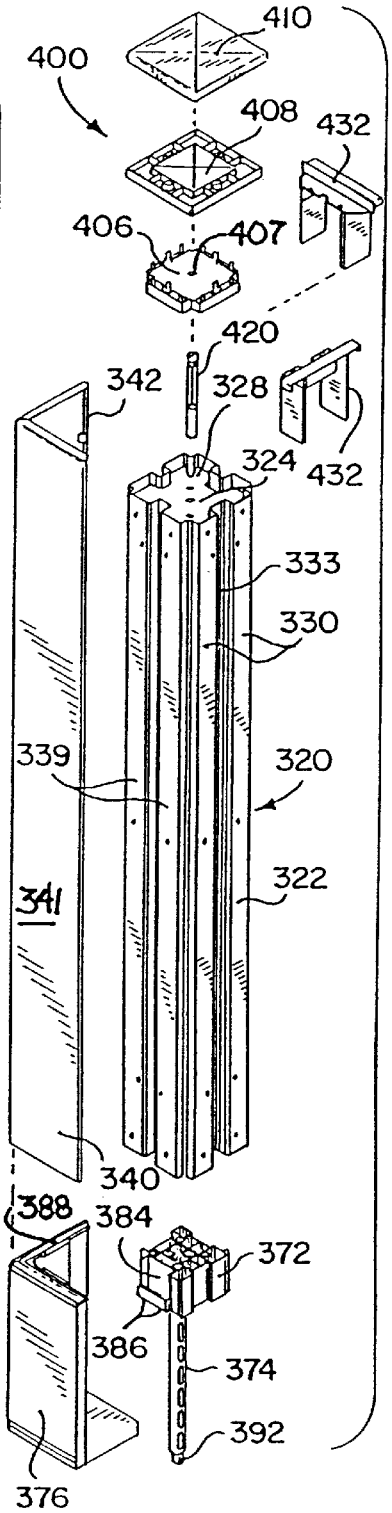
FIG. 5 is an exploded view of an alternative embodiment of a corner post configuration.

Referring to FIGS. 4 and 5, each corner of the tube includes an outwardly facing groove 336 that runs longitudinally along the length of the tube 322. As shown in FIGS. 32 and 33, the groove 336 is preferably formed by the outer legs of the channels 330, which are joined at the corners of the tube at approximately 90°.

Figure 31:
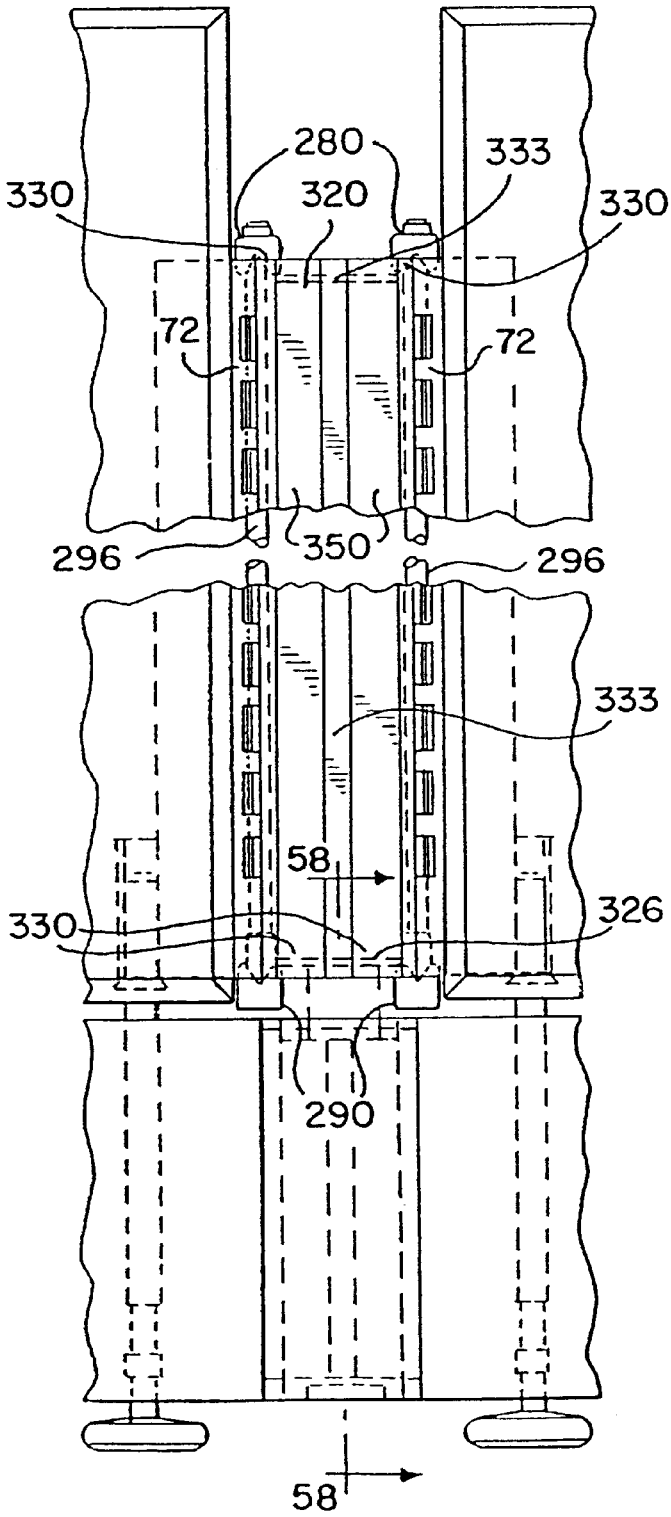
FIG. 31 is a side view of two wall panels connected to a corner post.

As shown in FIG. 31, each wall panel is connected to the corner post in the same way as described above. An upper and lower draw block 280, 290 engage the top and bottom edge of the two channels 330 on the side of the tube and the two channels 72 of the hanger bracket mounted on the side of the wall panel being connected. The draw rod 296, connecting the draw blocks, is tightened to pull the draw blocks together and to pull the wall panel towards the corner post so that the hanger bracket engages the side of the tube. It should be understood that one, two, three or four wall panels can be connected to the corner post at any time depending on the desired configuration.

As shown in FIGS. 5 and 33, when two wall panels are connected to the corner post 320 at 90°, the opposing two sides of the corner post are concealed by an V-shaped cover member 340 adapted to be disposed on the adjacent, perpendicular sides of the corner post. The cover member 340 includes two wall members 341 joined in a substantially perpendicular relationship. The cover member 340 includes a beaded portion 342 running longitudinally along the side edges 344 of the cover. The beaded portions 342 are adapted to engage the outwardly facing groove 336 formed along each corner of the tube 322. The beaded portion 342 extends diagonally inward from the cover at approximately 45°. A tab 343 is formed along the inside of the beaded portion. The tab buts up against the top edge of the tube so as to ensure that the cover member is located at the proper height along the length of the tube. In addition, a patch or similar marker can be attached to the inside of the cover member to indicate which end is up. The upper end of the cover member includes a horizontal flange portion 345. The cover member 340 includes an outer layer of fabric 346 that matches the thin sheet of fabric disposed on the adjacent wall panels.

When two wall panels are arranged in a 180° relationship on opposite sides of the tube, a flat cover member 348 can be installed on one or both of the exposed sides of the tube 322 as shown in FIGS. 4 and 32. The flat cover member 348 includes diagonally facing beaded portions 350 running longitudinally along its length. In addition, the flat cover member 348 includes a locator tab member 343 and an upper horizontal flange 345.

Referring to FIG. 4, a support member 352 is attached to the bottom of the tube member 322. The support member 352 includes a base portion 354, a leg 356 and a foot 358. The base portion 354 is attached to the lower plate 326 secured in the bottom end of the tube 322. A base cover 360 is installed on the support member 352 to conceal the support member 352 and the space below the panel. The base cover 360 extends between the base portion 354 and the foot 358. The foot 358 includes a bottom member 362 and a pair of cylindrical lug members 364 positioned on opposite sides of the bottom member 362. The base portion 354 includes slotted portions 366 positioned on the same side as the lug members 364. The base cover 360 includes upwardly facing tab members 368 that engage the slotted portions 366 and a pair of flange members 368 that engage the lug members. The leg 356 is preferably a thin shaft that allows cables and wires to pass between the leg 356 and base cover 360 as they are passed between adjacent panels. In this way, the cover 360 forms part of the lower horizontal channel. It should be understood that the support does not engage the floor, but rather is provided to support the base cover member, which conceals and protects wires in the lower channel.

When two panels are attached to a corner post at 90°, the support does not include a foot. In this arrangement, the support includes a base portion 372 and a leg 374 as shown in FIG. 5. The base cover 376, shown in FIG. 30, includes two walls 378, a base plate 380 and a guide plate 382. The base portion 372 includes a slot 384 and two tab members 386 on two sides of the base portion. A lip portion 388 is positioned on the top of each base cover wall 378. When installed, the lip portion 388 is inserted into the slot 384 as the two tab members 386 engage the bottom of the lip 388 to releasably secure the base cover 376 to the base portion 372. The guide plate 382 extends between the walls 378 and lies parallel to the base plate 380. The guide plate 382 includes a slot 384 adapted to receive the leg 374 of the support. The base plate 380 includes an opening 390 that is adapted to receive an end of the leg, which includes a lug 392. In this way, the base cover is supported by the support base portion and is stabilized by the leg.

Figure 7:
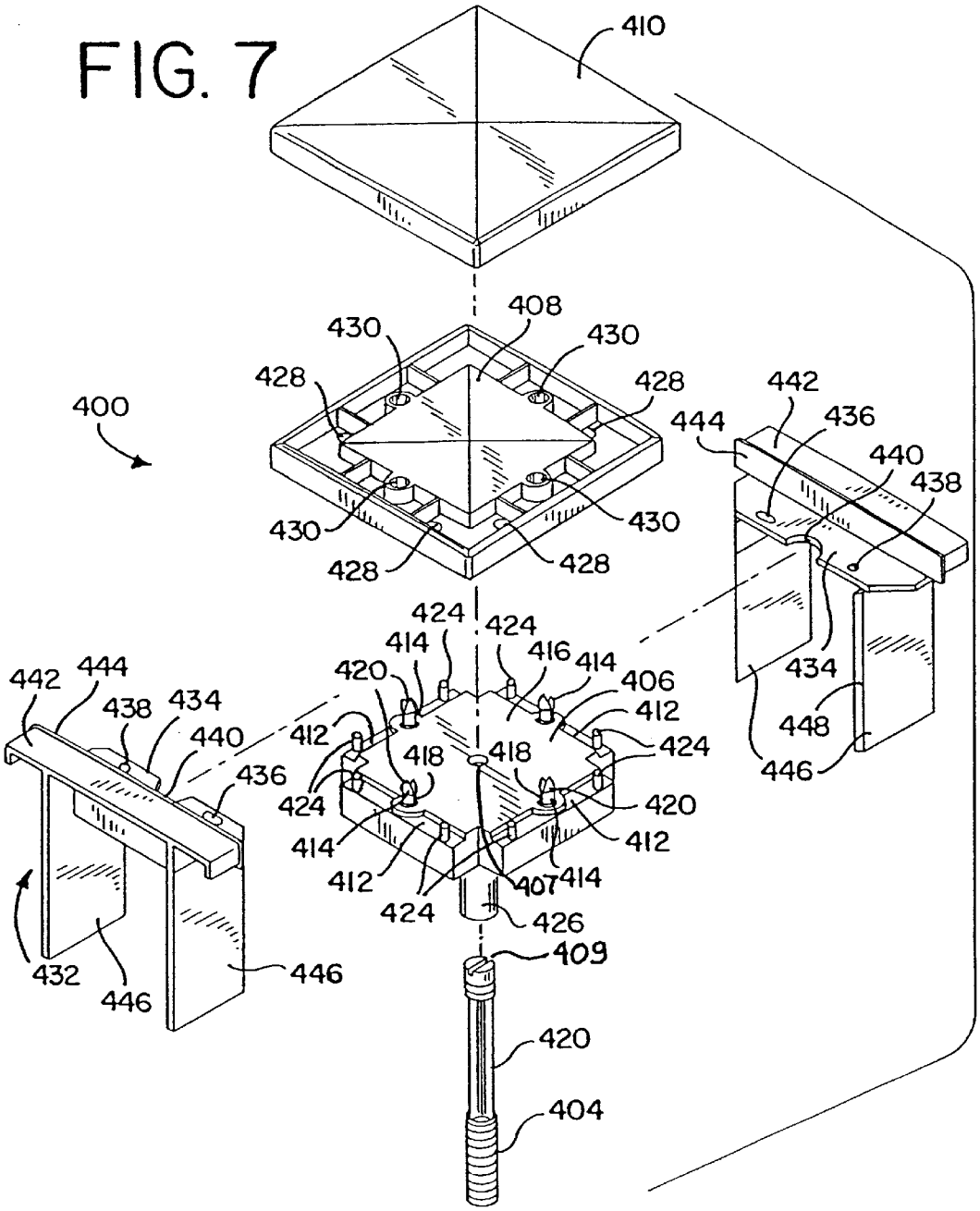
FIG. 7 is an enlarged exploded view of a corner post cap.

As shown in FIGS. 4, 5 and 7, the corner post 320 also includes a cap assembly 400 adapted to span the gap between adjacent top caps 110 installed on top of each wall panel. Preferably, the cap assembly 400 is plastic. FIGS. 4, 5 and 7 show the cap assembly which includes a post member 420. The post member 420 has a threaded end 404 that threadably engages the threaded hole 328 in the upper plate 324 secured in the end of the tube 322. The cap 400 also includes a base member 406, a lock member 408 and a cover member 410. The base member 406 includes a step portion 412 on each side of the base and a primary post member 414 extending upwardly from the middle of each side of the top surface 416 of the base member. Each primary post member 414 includes a shaft portion 418 and a head portion 420. Each primary post member 414 is slotted so as to make the head and shaft portions flexible and resilient. Two secondary post members 424, positioned on opposite sides of the primary post member, extend upwardly from each step portion 412 of the base member. A cylindrical sleeve portion 426 extends downwardly from the bottom of the base member 406. An opening 407 is formed in the base member and overlies the cylindrical sleeve portion 426. The sleeve portion 426 is adapted to receive the top of the post member 402, so that the post member supports and rotatably engages the base member 406. The post member 420 includes a slot 409, or other configuration for receiving a tool, such that the post member 420 can be accessed through the opening 407 and rotated from above the base member 406. Alternatively, the post member includes is ribbed such that the shaft thereof is grippable and can be gripped and rotated by a user. The post member 402 allows the height of the corner post cap to be adjusted as it threadably engages the upper plate 324 in the tube 322. In addition, the post member 420 is slender so that cables, wires and the like can be disposed around the post member as they pass from the upper horizontal channel 88 of one panel to the next.

The lock member 408 is rectangular and includes openings 428 adapted to receive the secondary post members 424. The lock member 408 also includes four openings 430 adapted to receive the head and shaft of the primary post member 414. A shoulder is disposed inside each opening so that when the primary post member is inserted into the opening, the head extends through the plate member and engages the shoulder to thereby releasably secure the plate member to the base member. The cover member 410 is releasably secured to the top of the lock member 408. The cover member 410 is attached to the lock member with a two-sided tape or adhesive mechanical, although it should be understood that other mechanical fasteners could also be used. Alternatively, the cover member and lock member can be integrally formed as a single member.

Referring to FIGS. 3–7, a light seal member 432 is provided to connect the top cap on the wall panel with the corner post cap. The light seal member 432 includes a mounting flange 434 having two holes: a slotted hole 436 and a round hole 438. The holes 436, 438 are adapted to receive the secondary post members 424. The mounting flange 434 also includes a semicircular cut-away portion 440. The light seal member 432 is installed on the base member 406 by inserting the secondary post members 424 into the openings 436, 438 in the mounting flange 434. The bottom of the mounting flange 434 engages the step portion 412 so that the top of the flange lies flush with the top surface of the base member 406. The cut-away portion 440 is disposed around the primary post member 414. The lock member 408 is installed on the base member 406 so as to releasably secure the light seal 432 to the base member 406.

The light seal member 432 includes an insert portion 442 with a rib 444 defining an end of the insert portion 442. The insert portion 442 is adapted to be received in the open end of the top cap 110 mounted on each wall panel. The light seal member 432 also includes downwardly extending legs 446. The legs extend downwardly between the upwardly extending sidewall members 36 of the adjacent upper frame member and the cover member 340, 348 disposed on the side of the corner post so as to prevent light from penetrating the gap between the two members. Each leg 446 also includes a beveled edge 448 that mates with an opposing edge of an adjacent leg when two light seals are installed at 90° to each other. The light seal is preferably made of plastic and the legs can be trimmed to the proper length before installation.

In an alternative embodiment of a corner cap and light seal assembly, best shown in FIGS. 135–143 and 157, a corner cap 6000 comprises a horizontal cap portion 6002 and four downwardly extending sidewalls 6004. Each sidewall 6004 comprises a plurality of protuberances 6006, or tabs, extending from an inner surface 6008 thereof. The protuberances are preferably tapered as shown in FIGS. 136 and 143. Each sidewall further comprises a pair of L-shaped walls 6010 which form opposing channels 6012.

As best shown in FIGS. 138 and 139, a light seal member 6018, otherwise referred to as a corner cap connector, comprises an insert portion 6020 and a leg portion 6022 extending laterally downward therefrom. The light seal further comprise a channel 6024 formed on one end thereof. The channel is defined by an inner 6026 and outer wall 6028. The outer wall preferably has a pair of recesses 6030, preferably through-openings, formed therein and which define a pair of lips 6032. A portion of the outer wall 6028 is tapered between the lip 6032 and the edge 6034 of the wall.

During installation, the insert portion 6020 is received in an opening formed in the end of a top cap 110 disposed on a top of a wall panel. At the same time, one of the sidewalls 6004 of the corner cap is disposed in the channel 6024, such that the protuberance 6006 rides along the tapered portion of the outer wall 6028 until it is received in the recess 6030 and engages the lip 6032 in a snap-fit engagement. At the same time, opposite ends 6034 of the outer wall 6028 are dimensioned to be slidably received in the opposing channels 6012 formed along the sidewalls 6004 of the corner cap. In this way, one, two, three or four light seals, or corner cap connectors (which may or may not be configured with a leg portion), can be secured to the corner cap depending on the number of wall panels being attached respectively to the corner post lying therebelow. When the insert portion 6020 of the light seals 6018 are inserted into the top caps 110, the corner cap is both supported and aligned above the corner post without further attachment to the corner post below.

In an alternative embodiment, best shown in FIGS. 140, 141 and 157, wherein one or more sides of the corner post are left exposed, or covered with a cover member, a clip 6040 can be releasably secured to the respective sidewall 6004 of the corner cap. The clip includes a wall 6042 having a pair of recesses 6044 defining lips 6046 and end portions 6048 dimensioned to be received in the opposing channels. The wall 6042 includes a tapered portion between the lip 6046 and the edge 6050 of the wall. The clip can be connected to the sidewall 6004 in a snap-fit engagement as described above. The clip further includes a flange that forms a channel 6054 which faces laterally outward from the corner cap. The channel 6054 is configured to receive an upper horizontal flange 345 formed on the cover member as shown in FIG. 157.

Figure 6:
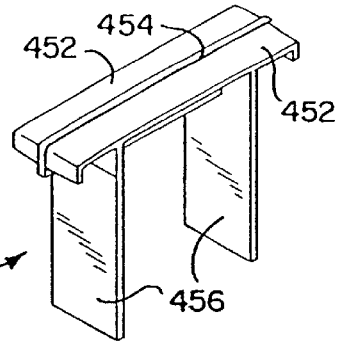
FIG. 6 is an enlarged perspective view of a panel-to-panel light seal.

Referring to FIG. 6, a light seal member 450 is provided to bridge the gap between the top caps on two panels placed end-to-end and connected to each other. In this embodiment, the light seal member 450 includes two insert portions 452 facing away from each other and that are separated by a rib 454. The insert portions 454 are received in each wall panel top cap 110. The rib 454 provides a smooth and continuous transition between the top caps 110. The legs 456 of the light seal extend downwardly and conceal the gap between the adjacent upwardly extending sidewalls of the two panels.

In an alternative embodiment, shown in FIGS. 144–146, the light seal 6060 includes insert portions 6062 with a single downwardly extending leg 6064 extending laterally therefrom. Each end of the insert portions 6062 is tapered so as to facilitate the insertion of the insert portion into the opening defined at the end of the top cap. Each wing of the insert portion further includes a tapered crush rib 6066 that engages the inner surface of the top cap so as to provide a friction fit therewith. In addition, a first pair of stops 6068 extends downwardly from the wings and are configured to abut an end of the top cap so as to prevent the insert portion from being inserted too far into the end cap. In addition, a pair of guides 6078 slidably engage an inner edge of the top cap to further secure the light seal to the top cap 110 and prevent lateral movement therebetween.

Figure 72:
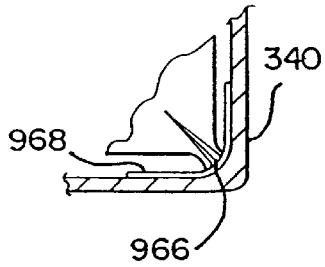
FIG. 72 is a partial top view of the seal member and cover member.

Referring to FIGS. 68–72, a corner post light seal member 960 is shown. The light seal includes a base portion 962 that is supported on the upper plate member of the corner post. The base portion 962 includes an opening that is aligned with the opening 328 in the upper plate member that receives the post member, such that the post member 420 can be disposed through the hole in the base portion and threadably engage the plate member. A plurality of arm portions 966 extend upwardly from the base portion. Each arm portion includes a pair of flexible fins 968 that extend laterally outwardly from the arm portion in a substantially perpendicular relationship to each other. The fins span at least a portion of the gap formed between adjacent wall panels oriented at right angles, or between the various wall panels and cover members. The flexible fins 968 are folded or bent inwardly to fit beneath the cover member 340 that is mounted to one or more sides of the corner post as shown in FIG. 72.

Figure 68:
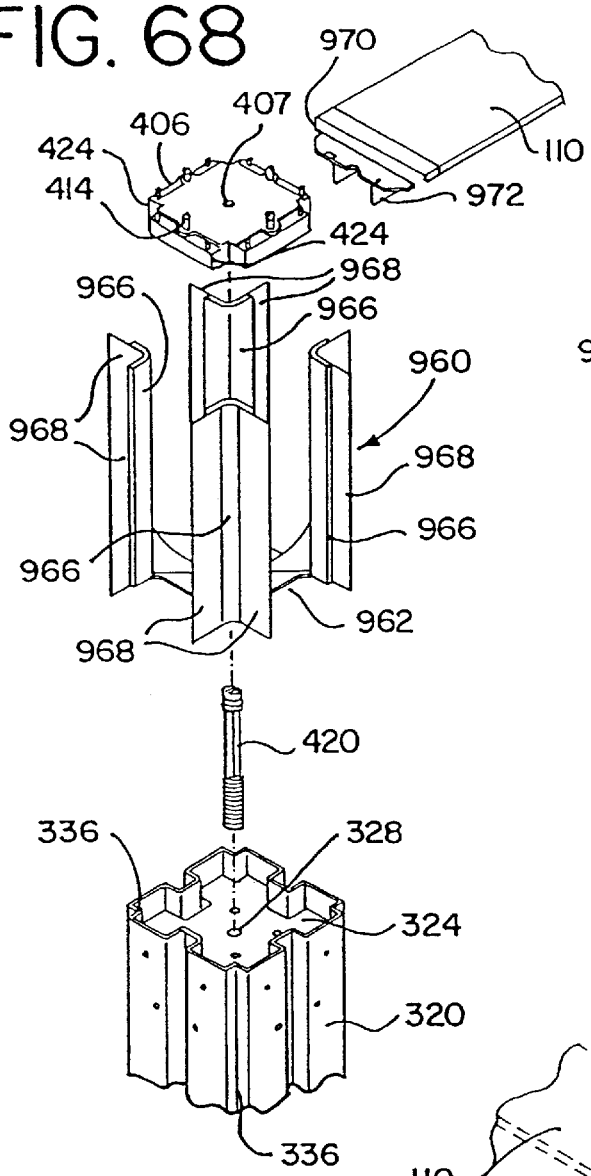
FIG. 68 is an exploded assembly view of a corner post with seal members and a corner post cap.
Figure 69:
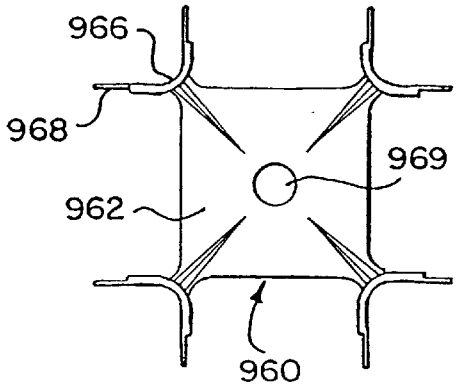
FIG. 69 is a top view of a seal member.
Figure 70:
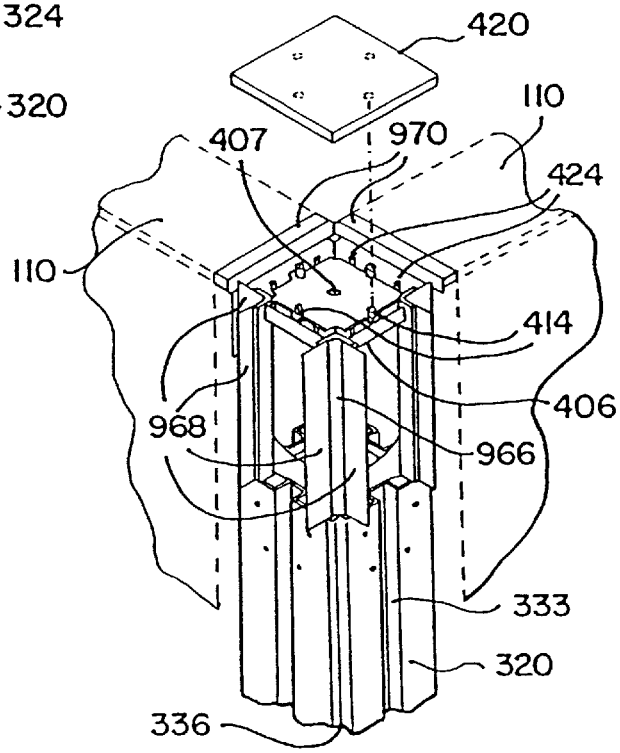
FIG. 70 is a perspective view of the alternative corner post configuration shown in FIG. 68 with a cover member being applied thereto.
Figure 71:
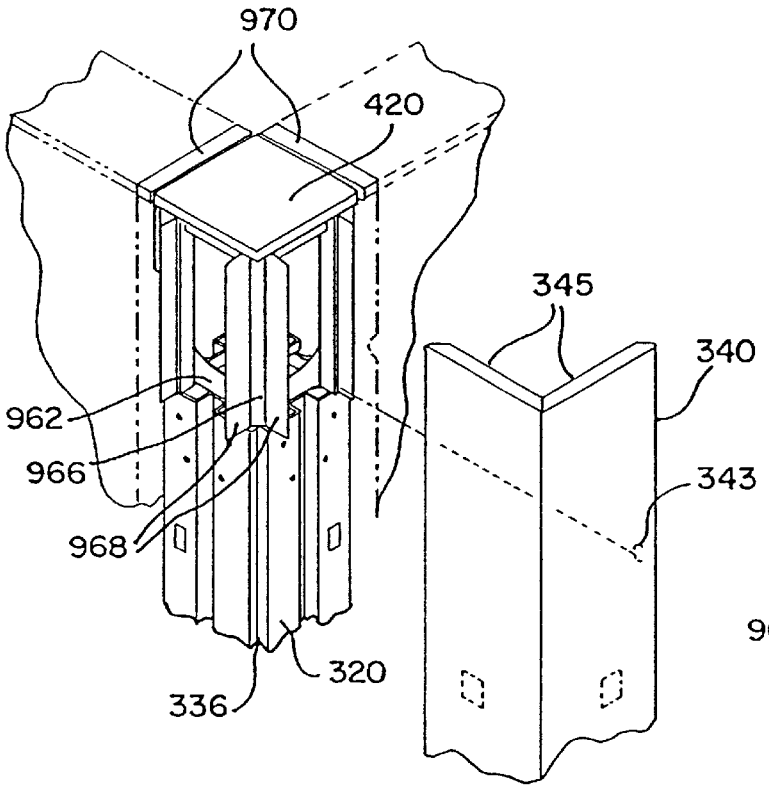
FIG. 71 is a perspective view of the corner post configuration shown in FIG. 70 with a cover member being applied thereto.

As shown in FIGS. 68 and 70, a light seal member 970 is shown with relatively short downwardly extending legs that overlap with the upwardly extending arms and fins of the light seal. The light seal member 970 includes a mounting flange 434 with a slotted hole 436, a round hole 438 and a cut out 440, which mate with the post members in the manner described above with respect to light seal member 432. The corner post light seal configuration shown in FIGS. 68–72 has several advantages. First, because the light seal member is supported by the corner post and includes upwardly extending arm portions, it does not need to be removed when the top caps are removed for wiring changes and the like. In addition, the light seal member 970 can be configured with shorter legs, and is more easily installed.

Figure 73:
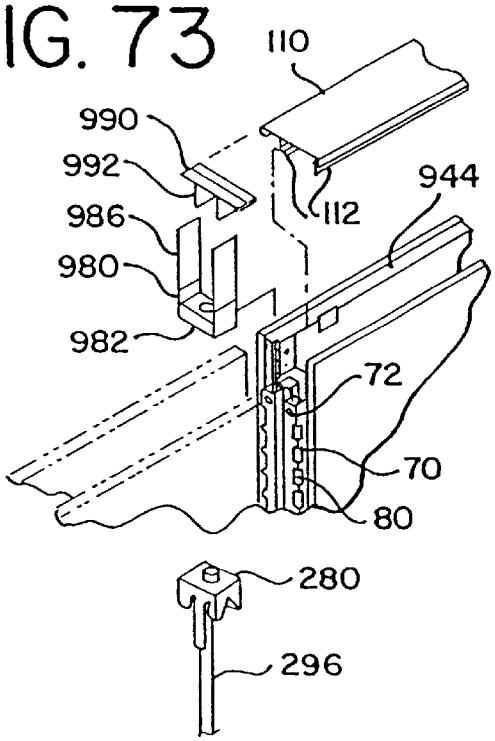
FIG. 73 is an exploded assembly view of alternative light seal members being applied to a pair of wall panels placed end to end.
Figure 74:
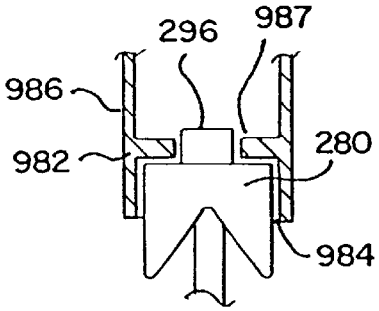
FIG. 74 is a partial cross-sectional view of a light seal member disposed on an upper draw block.

As shown in FIGS. 73 and 74, another embodiment of a light seal member 980 includes a base portion 982 that is supported on top of an upper draw block 280 and draw rod 290. In particular, the base portion has a recess 984 shaped to receive the draw block 280 as the end of the draw rod 290 extends upwardly in an opening 987 formed in the base portion. The light seal member includes a pair of upwardly extending arm portions 986 that bridge the gap between adjacent wall panels positioned in an end-to-end configuration. A light seal member 990 similar to member 450 shown in FIG. 6, but with shorter legs 992, is then installed between the adjacent top caps installed on top of the wall panels arranged in the end-to-end configuration. Again, the light seal member 980 remains seated on the draw block when the top cap is removed for access to the top channel, and the top cap can be more easily installed because of the relatively short length of the legs extending downwardly from the light seal.

In yet another embodiment of a light seal 5080, shown in FIGS. 147 and 148, the base portion 5082 includes a horizontal portion 5084, a pair of sidewalls 5086, and a pair of end walls 5088. An opening 5087 is formed in the horizontal portion. The opening is dimensioned to receive an end of the draw rod connector. A pair of recesses 5090, preferably through openings, are formed in each end wall 5088, and preferably extends into the junction formed with the horizontal portion of the base portion. The recess defines a lip 5092 in each end wall. The inner surface of the end wall 5088 includes a tapered portion between the lip 5092 and a terminal edge of the wall. The light seal further comprises a pair of longitudinally extending leg portions 5094. Each leg portion further comprises a flexible flange portion, or fin, 5096, which extends laterally therefrom and preferably each leg portion includes a flange extending laterally in the opposite direction from the other. The fins 5096 can be folded or bent out of the way when the light seal is mated with a cover member. At least one of the leg portions further comprises a tab 5098 extending laterally inward toward the other leg. Alternatively, both leg portions can be provided with a tab. The tab can be grasped by a user to hold and locate the light seal during installation.

Referring to FIG. 152, an alternative embodiment of a connector draw block 6080 is shown that is similar to the draw block shown in FIG. 28. The draw block 6080 includes a horizontal surface 6082, a pair of vertical end surfaces 6084 and a pair of vertical side surfaces 6086. A pair of protuberances 6088, or tabs, extend from each end of the draw block near the juncture with the horizontal surface. The protuberances 6088 preferably include an upper tapered portion that facilitates the installation of the light seal thereover. It should be understood that any of the draw blocks illustrated in the figures could be similarly configured with protuberances.

During installation, the light seal 5080 is disposed on the draw block 6080, which is received in the recess, such that the horizontal portion 5084 of the light seal is disposed on the horizontal surface 6082 of the draw block. At the same time, the protuberances 6088 slide along the tapered portions of the end walls 5088 until they are received in the recess 5090 and are engaged with the lip 5092 in a snap-fit engagement. As such, the light seal and draw block, or connector, are releasably attached and can be manipulated as a unit for installation and the like. One of skill in the art should understand that the protuberances and recesses, with the defined lip, could be reversed, with the protuberance formed on the light seal, and preferably on the end wall, and with a recess and lip formed in the draw block, preferably on an end surface.

When installed, as shown in FIG. 157, a pair of light seals 5080 are releasably connected to a pair of draw block 6080 connectors, with the draw block connectors further engaging a corner post and an adjacent wall panel. In this embodiment, the light seals 5080 disposed on the draw blocks 6080, which connect the wall panels to the corner post, in combination with the overlapping leg portions 6022 of the light seals 6018 releasably attached to the corner cap and top caps, serve to block any light that may tend to seep or leak between the corner post and wall panel.

In addition, the light seal and draw block can be used to connect a pair of wall panels arranged in an end-to-end configuration, as shown in FIG. 156. In such a configuration, the light seal 6060 is further installed to span between adjacent top caps 110 disposed on the wall panels with its leg 6064 extending downwardly in an overlapping relationship with the upwardly extending legs 5094 of the light seal so as to prevent light from seeping between the wall panels.

Referring to FIGS. 36 and 38–40, a connector member is provided to attach a shorter wall panel to a taller wall panel. In this configuration, the connector member includes an upper and lower draw block and a draw rod. The upper draw block 460 includes a pair of wedge members 462 on one side and a pair of hook members 464 on the opposite side. The hook members 464 are adapted to engage the slots 86 in the hanger bracket 70 attached to the side of the taller wall panel. The wedge members 462 engage the top 298 of the hanger bracket channels 72 on the shorter wall panel as described above. To connect the panels, the draw rod 296 is tightened to pull the two wall panels together. A light seal 470 is installed on the shorter panel so that its legs 472 are disposed on either side of the upper draw block 460. An insert portion 474 of the light seal 470 is received in the top cap 110 attached to the top of the shorter panel. The end of the light seal 470 is defined by a flat surface 478 which extends downwardly from a rib 476. The flat surface 478 abuts the hanger bracket 70 on the taller panel.

In an alternative embodiment of the light seal 7000, shown in FIGS. 149–151, the light seal 7000 comprises a base portion 7002 having a horizontal portion 7004, a pair of outer sidewalls 7006, a pair of inner sidewalls 7008 and an end wall 7010. The inner sidewalls 7008 and the end wall 7010 have an opening 7012, or recess, formed therein. The recess 7012 defines a lip 7014. Each of the inner sidewalls 7008 includes a tapered portion extending laterally toward an edge of the sidewall. The horizontal portion includes a cut-out 7016 shaped to receive an end of the draw rod connector. The light seal further includes a pair of longitudinally extending leg portions 7018, with one of the legs preferably comprising a laterally extending tab 7020 suited for grasping by a user.

Figure 38:
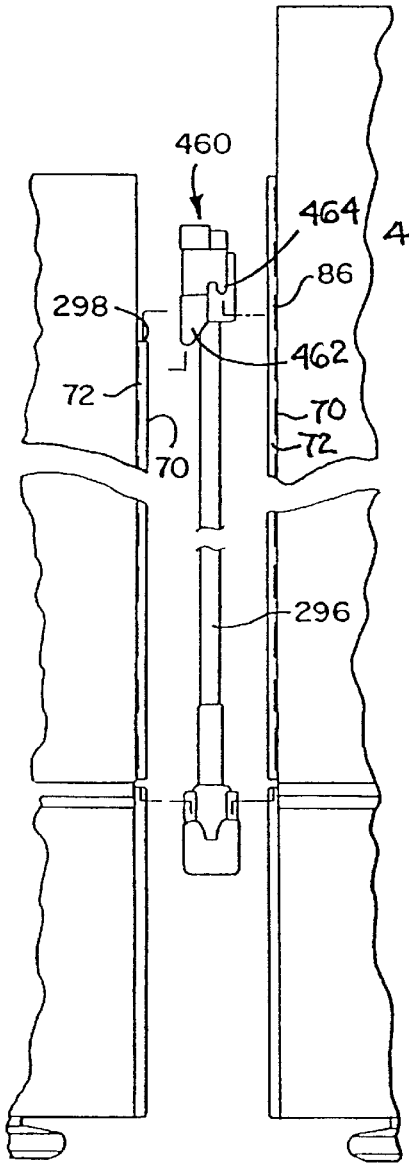
FIG. 38 is an exploded side view of different height wall panels with a draw rod and draw blocks interposed between the panels.
Figure 39:
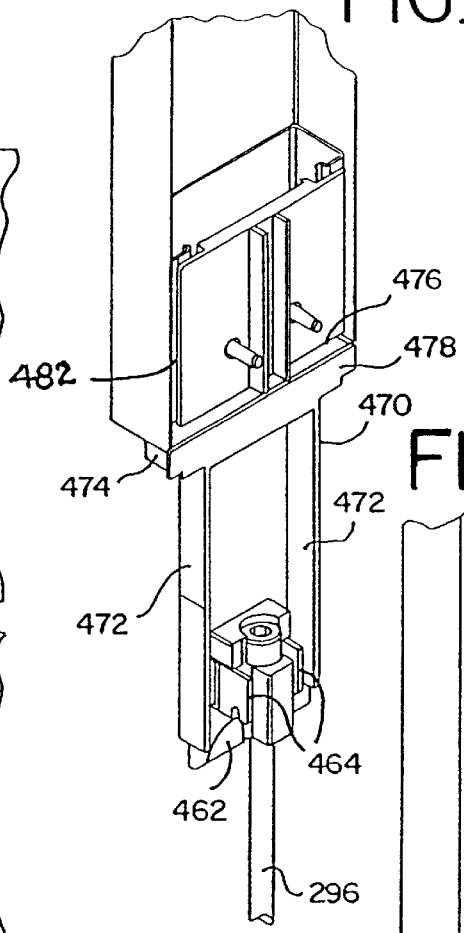
FIG. 39 is a partial inner perspective view of a draw rod with a partial end cover.

As shown in FIG. 153, an alternative embodiment of the change-of-height draw block connector 7060 shown in FIG. 38 as draw block 460, includes a horizontal surface 7062 and opposite side surfaces 7064. A protuberance 7068, or tab, extends from each side surface. The protuberance 7068 is preferably tapered. During installation, the light seal 7000 is preferably slid over the draw block 7060 from an end thereof such that the tapered portion of the inner sidewalls 7008 rides over the tapered portion of the protuberance 7068 until the protuberance engages the lip 7014 of the inner sidewall in a snap fit engagement. The upper surface of the protuberance further engages a second lip 7022 formed along the bottom of the recess to prevent the vertical separation of the light seal and draw block connector. One of skill in the art should understand that the recess and protuberance could be reversed as between the light seal and the draw block connector. Once installed in a releasable configuration, the light seal 7000 and draw block 7060 assembly can be manipulated by a user, for example, by grasping the tab, as needed to position the assembly between adjacent wall panels.

Figure 3:
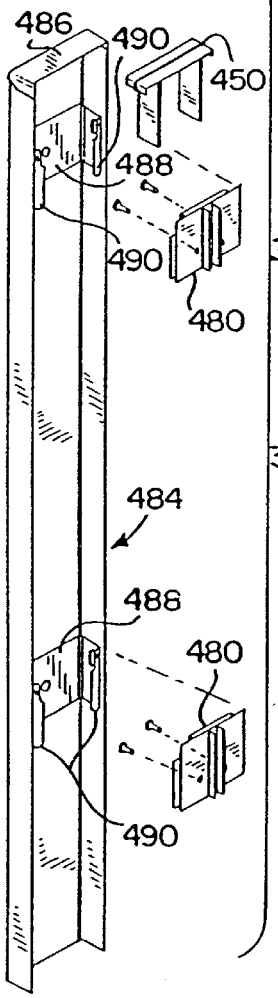
FIG. 3 is an exploded view of a wall panel end cover.
Figure 36:
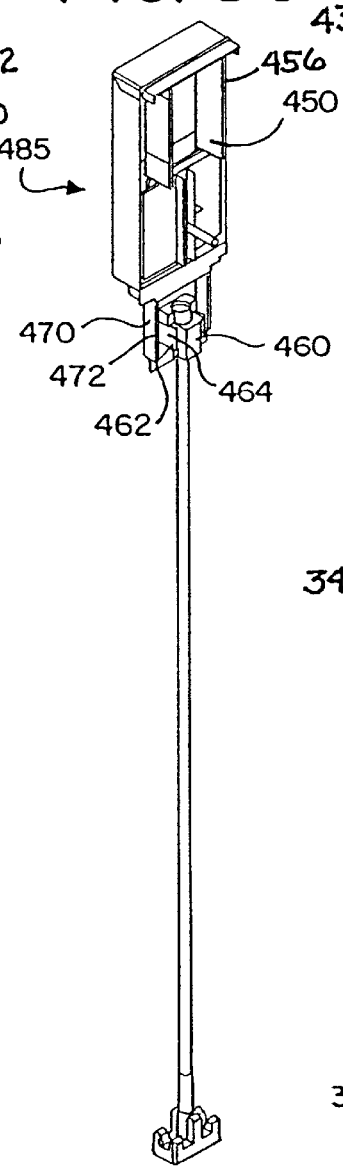
FIG. 36 is a perspective view of a draw rod with a partial end cover.
Figure 37:
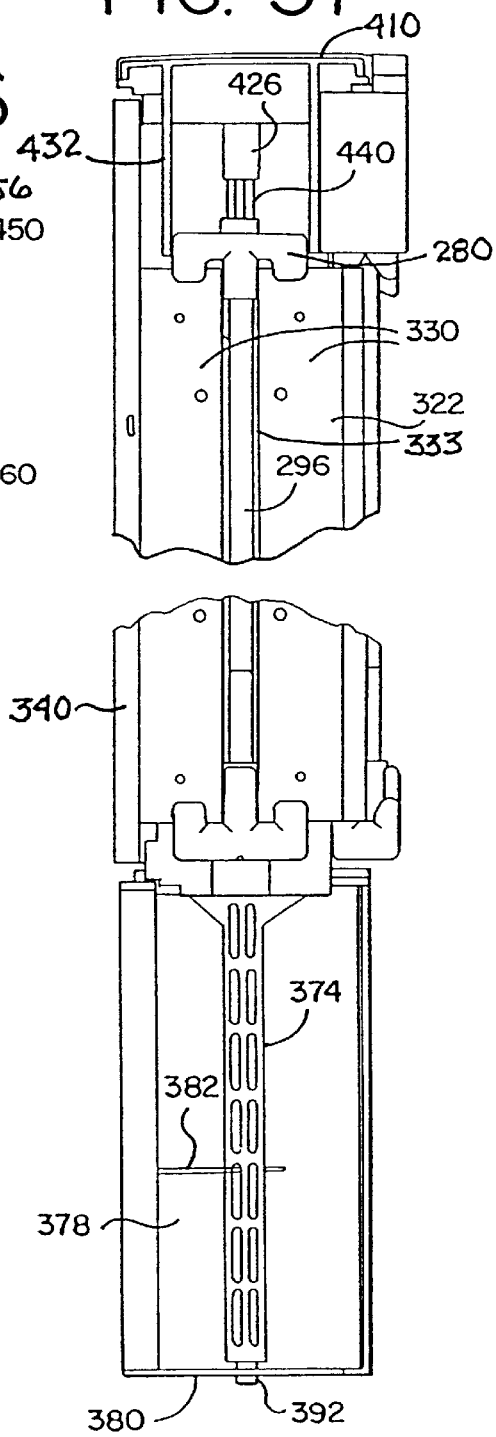
FIG. 37 is a side view of a draw rod and draw blocks engaging a corner post.

Referring to FIGS. 3, 36, 39 and 57, a pair of end cover brackets 480 are installed on the exposed end of any wall panel which is not connected to another wall panel or a corner post. The end cover bracket 480 includes a pair of outwardly facing grooves 482 running along opposite side edges of the bracket. An end cover 484 is attached to the bracket 480 on the end of the panel to provide a finished appearance. The cover 484 comprises a channel with a top wall 486 closing the upper end of the channel. The end cover also includes a pair of U-shaped brackets 488 mounted inside the channel. The brackets each include inwardly facing flanges 490 which are inserted into the grooves 482 in the end cover bracket mounted to the end of the wall panel. A light seal can be installed between the end cover and the top cap of the wall panel, as shown in FIGS. 3 and 36.

In an alternative embodiment, shown in FIGS. 154–155, a longitudinally extending light seal 7080 comprises a first and second flange 7082, 7084. The first flange 7082 extends laterally from the second flange 7084, which is connected to the inner surface of the cover channel 7086. The second flange is preferably attached to the cover with a double-sided tape, or other adhesive, although it should be understood that other ways of attaching the light seal would be acceptable, for example by way of mechanical fasteners such as staples and the like. The second flange 7084 preferably extends laterally out of the channel, as shown in FIG. 155, such that it has a greater lateral extent than the sidewalls 7088 of the end cover. The term lateral means that the first flange 7082 is not co-planar with the second flange 7084 but rather extends at some angle (not necessarily perpendicular) from the second flange.

When the end cover is installed on the end of the wall panel, the first flange 7082 can flexibly abut the end of the panel. Alternatively, the flange 7082 extends into and is received in the outwardly opening upper horizontal channel of the wall panel so as to prevent light from leaking or seeping between the end cover and the wall panel. The first flange 7082 can achieve a flexible abutment in more than one way. For example, the entire light seal, and in particular the first flange, can be made of a flexible material, such that the flange itself flexes as it abuts the end of the wall panel. Alternatively, the first flange, which can also be made of a non-flexible material, can be flexibly attached to the second flange, for example by way of a hinge, and preferably a living hinge, such that it again flexibly abuts the end of the wall panel. Of course, the light seal could be made of a flexible material, such a plastic, and also include a hinge between the first flange and the second flange. It should also be understood that the first flange could be attached to the end cover in other configurations not necessarily involving another flange. Moreover, the first flange can be flexed completely within the channel 7086 when not needed, for example, when the end cover is installed over a member that extends into the channel.

Figure 40:
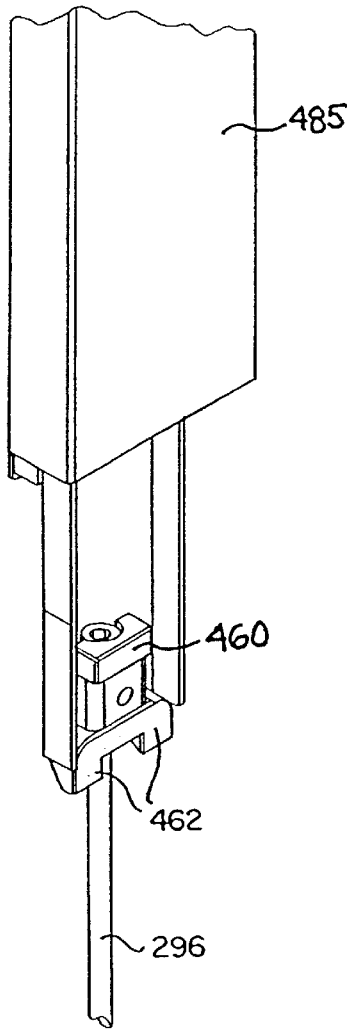
FIG. 40 is a partial outer perspective view of a draw rod with a partial end cover.

When installing a shorter panel adjacent to a taller panel, an end cover bracket 480 is mounted to the exposed portion of the hanger bracket and wall panel end extending above the shorter panel. A short end cover 485, shown in FIGS. 36 and 40, is mounted on the bracket so that the exposed upper portion of the taller wall panel is covered. A light seal 450 is then installed between the end cover and the top cap on the taller wall panel.

Figure 126:
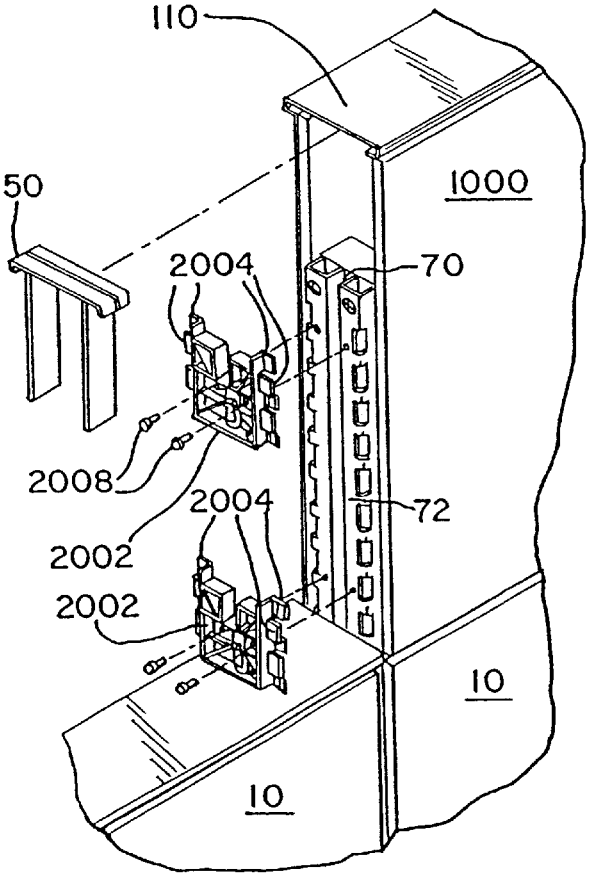
Figure 127:
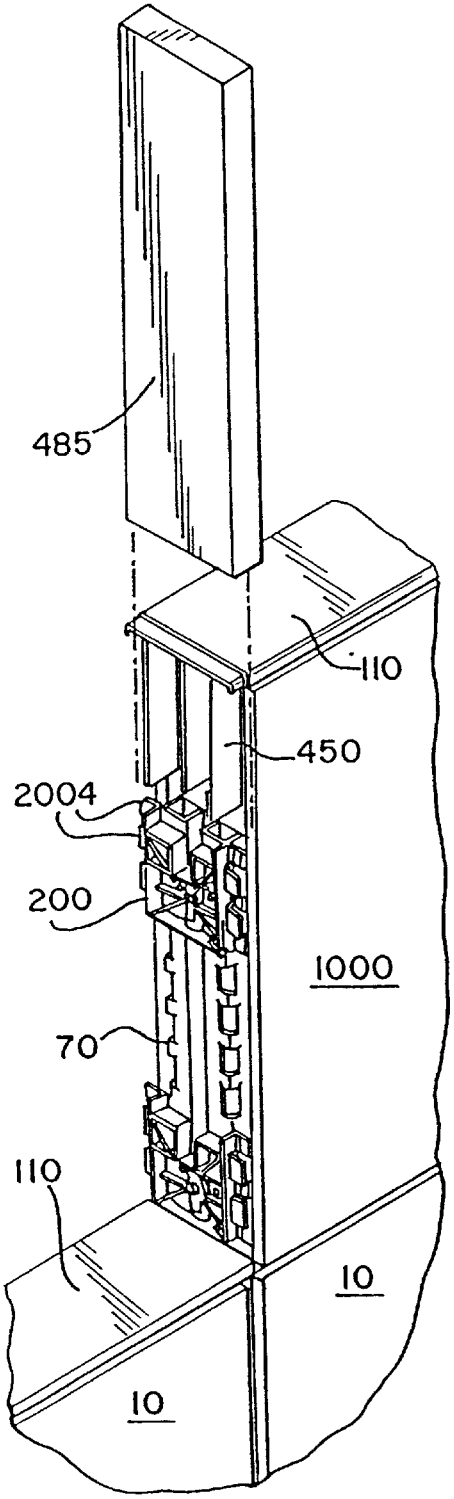

Alternatively, as shown in FIGS. 126 and 127, a clip 2002 has a plurality of offset tabs 2004. The flanges 490 of the bracket 480 are received in the spaces formed between the tabs 2004 as the end cover, with its brackets 480, is slid onto the clips 2002. The clips 2002 are attached to the hanger brackets with a pair of fasteners 2008.

Figure 41:
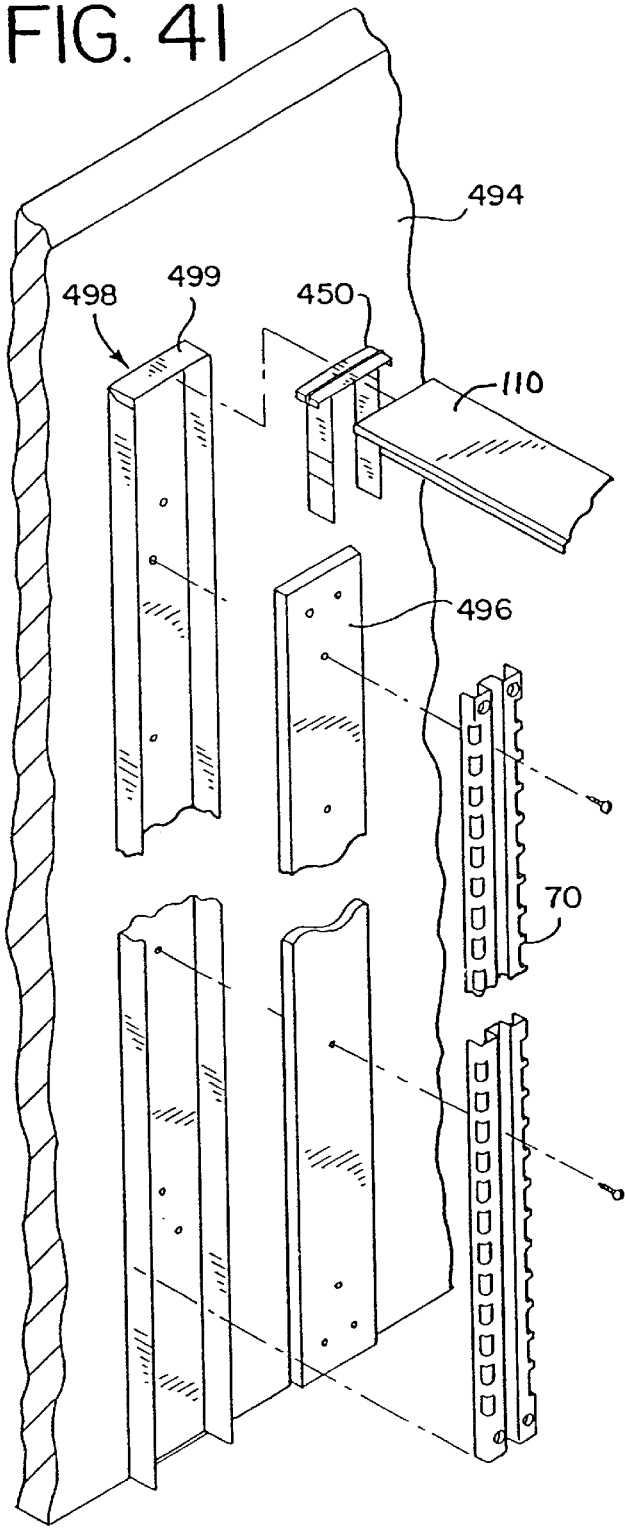
FIG. 41 is an exploded perspective view of a hanger bracket mounted on a permanent wall.
Figure 42:
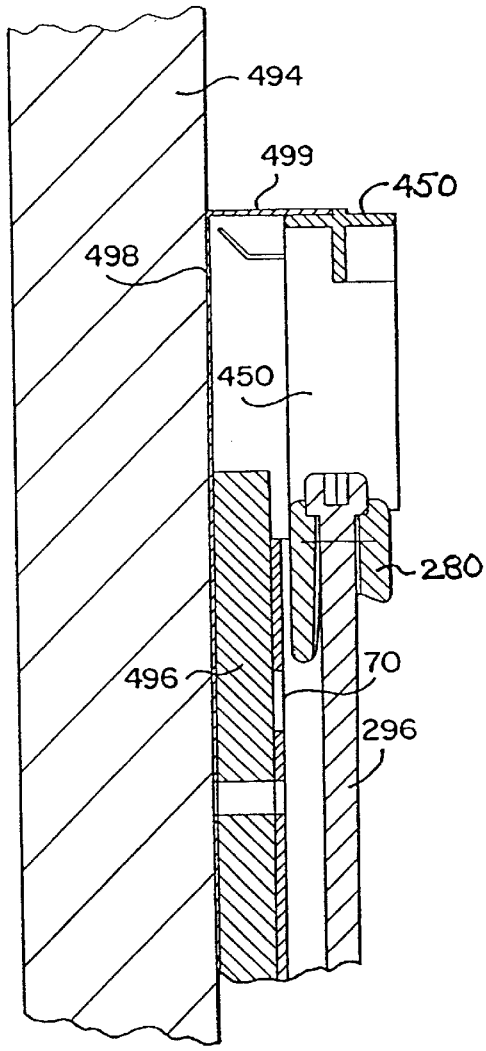
FIG. 42 is a partial cross-sectional view of the hanger bracket mounted on a permanent wall.

Referring to FIGS. 41–42, the wall panel also can be attached to a permanent wall 494. In this arrangement, a mounting plate 496 is disposed inside a channel-shaped cover 498 having a top wall 499, similar to an end cover. A hanger bracket 70, the cover 498 and mounting plate 496 are mounted on the permanent wall 494 with a plurality of fasteners. The wall panel is connected to the hanger bracket with a connector member, including an upper and lower draw block and draw rod, as described above, with a light seal 450 being inserted between the cover and the top cap of the adjacent panel.

As shown in FIGS. 75–81 and 120–129, one or more upper, stackable wall panels 1000 can be installed on top of one or more lower wall panels in various configurations. Each upper, stackable wall panel is preferably of the same construction as one of the wall panels described above, although it should be understood that wall panels of various constructions can be attached using the connector members described herein. Hanger brackets 70 are attached to the vertical side frame members of the upper wall member and extend downwardly from the bottom of the panel so that the bottom of the hanger brackets 70 overlies and is spaced apart from the top of the hanger brackets 270 mounted on the ends of the lower wall panel. As with the wall panels described above, each upper panel includes a upper channel forming a horizontal wire raceway that can be closed off with a top cap, and a pair of vertical wire raceways 108 that are aligned with the vertical raceways in the lower wall panels. The upper channel can be formed by the space between the wall members, or can include a separate channel member 940.

Figure 75:
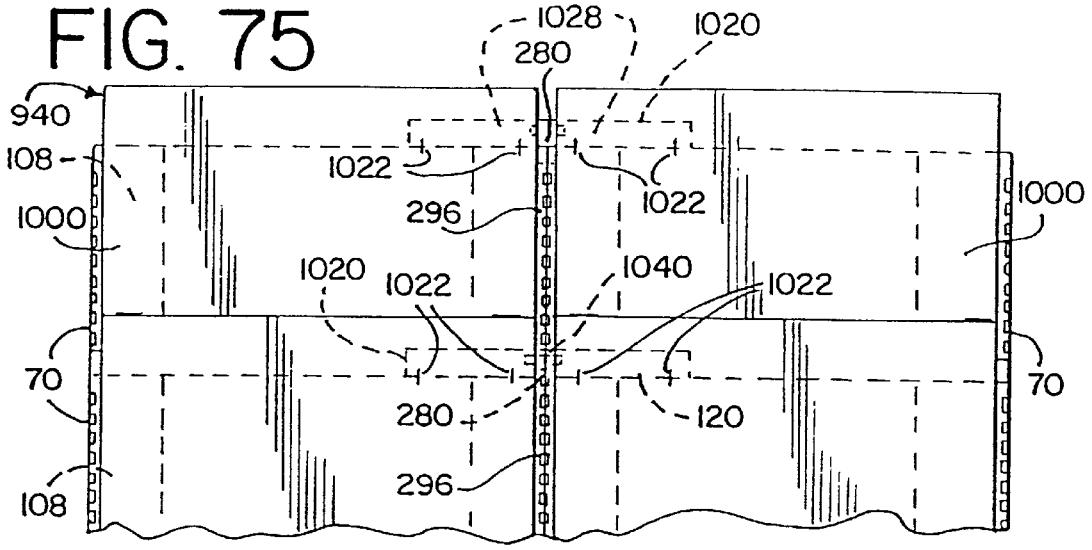
FIG. 75 is a side view of a pair of upper wall panels attached to a pair of lower wall panels of equal height positioned in an end to end configuration.
Figure 82:
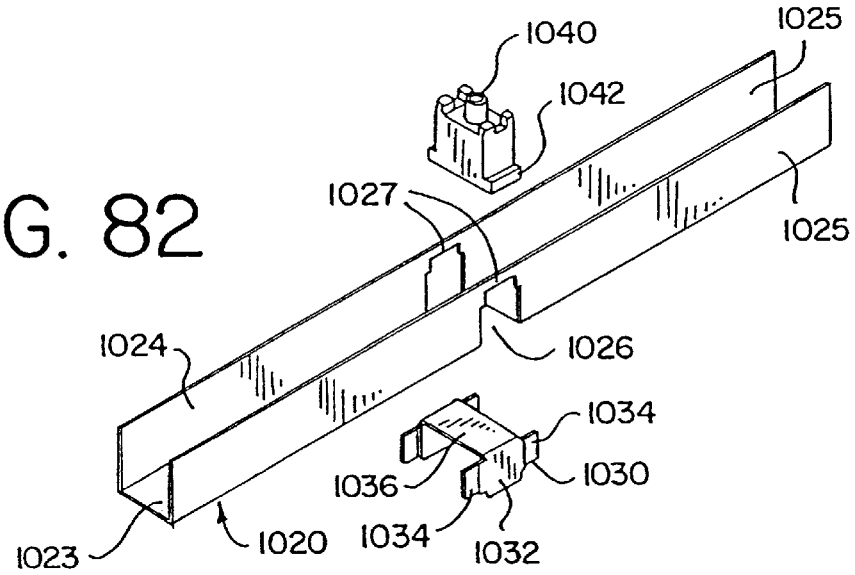
FIG. 82 is an exploded perspective view of a lower spanner assembly.
Figure 83:
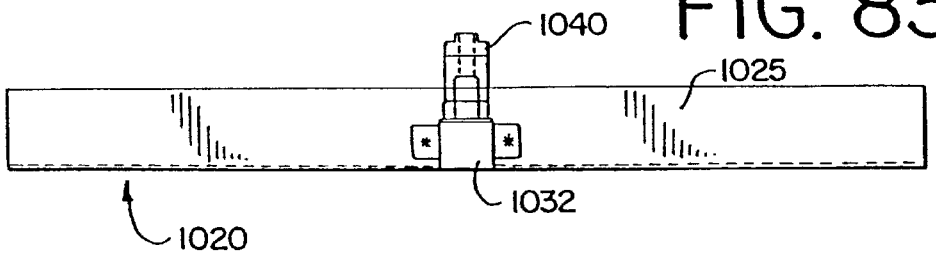
FIG. 83 is a side view of the lower spanner assembly.
Figure 84:
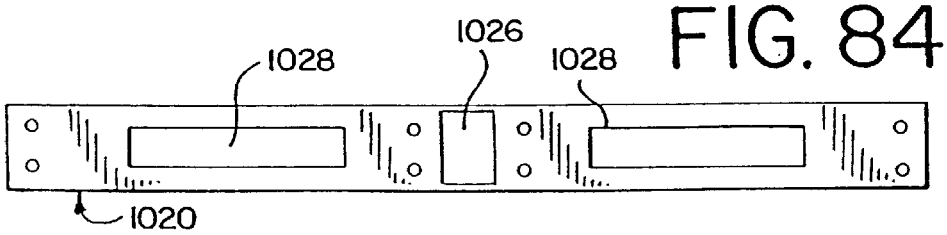
FIG. 84 is a top view of the spanner.
Figure 122:
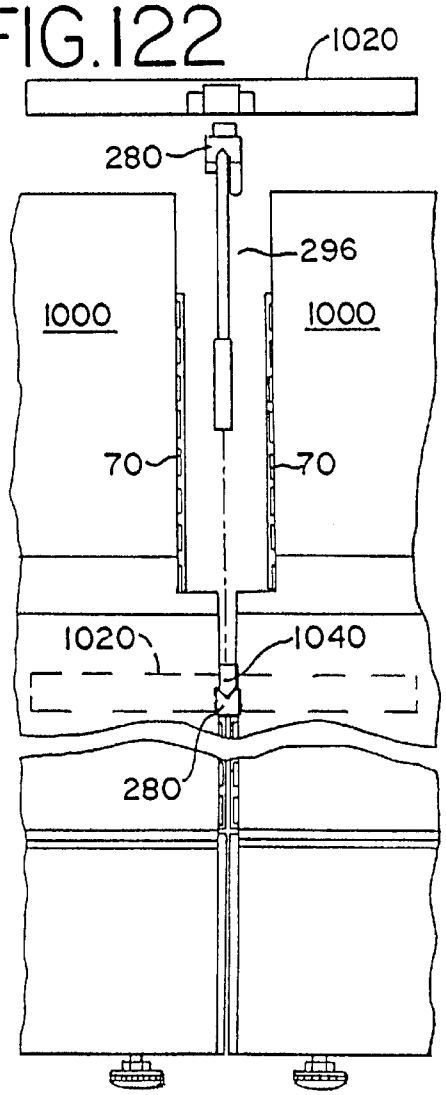
Figure 123:
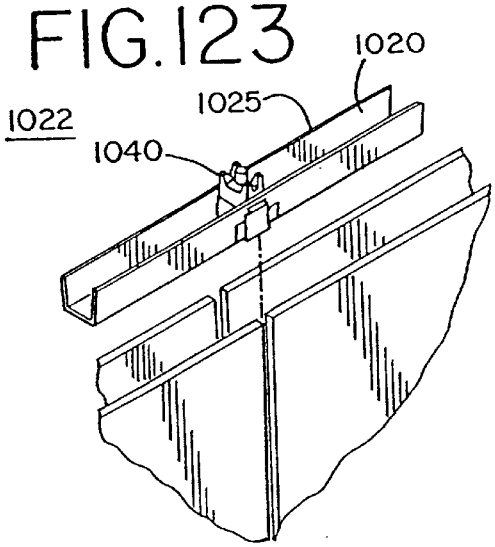

Referring to FIGS. 75 and 122–123, a pair of lower wall panels are positioned end-to-end and connected with a connector member, which includes upper and lower draw blocks and a draw rod as described above. A spanner member 1020, shown in FIGS. 82–84, is then disposed in the upper horizontal channels in each of the wall panels and is attached thereto with a plurality of fasteners 1022 which secure the spanner to the upper horizontal frame members of the adjacent lower wall panels. As used herein, the term spanner member is meant to refer to a member, such as a brace or bracket, that spans or bridges the distance between two adjacent members, shown as wall panels. The spanner member is formed as a channel member 1024 having a pair of openings 1028 formed in the base 1023 of the channel that are aligned with and provide access to the vertical raceways 108 of the wall panels that the spanner member connects. The channel member also has a cut out portion 1026 in the middle of the member that overlies the upper draw block and draw rod connecting the lower panels to each other. The spanner member also includes a bracket member 1030 having two side portions 1032, each with two flanges 1034 extending outwardly from the side portion. The side portions are joined by a cross member 1036 that forms a horizontal support surface. The bracket is inserted in the cut out portion of the channel member and the four flange portions are welded, or otherwise attached, to sidewalls 1025 of the channel member to strengthen the spanner assembly. As shown in FIG. 83, the bottom of the cross member 1036 is spaced above the bottom surface of the channel member to provide clearance for the underlying draw block and draw rod.

When used as a lower spanner member, a draw block 1040, shown in FIGS. 82 and 83, is inserted in the cutout prior to the bracket member being attached to the channel member. The draw block 1040 includes a pair of shelf portions 1042 extending from each side of the draw block. The shelf portions engage a top edge 1027 of the cutout on each of the channel sidewalls. The draw block also includes wedge members and draw surfaces, with a flat space therebetween, as described above with reference to the other draw blocks. The bottom surface of the draw block is supported by the bracket member cross member 1036 such that the draw block is trapped between the bracket member and channel member.

Referring to FIG. 75, a spanner member 1020 is also mounted across and within the top channels of the upper stackable wall panels, such that the openings 1028 are aligned with the vertical raceways 108 of the upper wall panels. The upper spanner member does not include a draw block, but is mounted over an upper draw block 280 that engages the hanger brackets on the adjacent upper, stackable panels. Draw blocks 280 and 1040 are connected with a draw rod 296. In this way, an upper connector member, including draw rod 296 and draw blocks 280, 1040, overlies the connector member connecting the lower panels and is used to connect the upper panels to one another and to the lower panels. In particular, the draw rod 296 is rotated so as to draw the upper and lower draw blocks 280, 1040 toward each other so as to thereby pull the hanger brackets together and to mount the upper, stackable wall panels to the lower wall panels.

Figure 76:
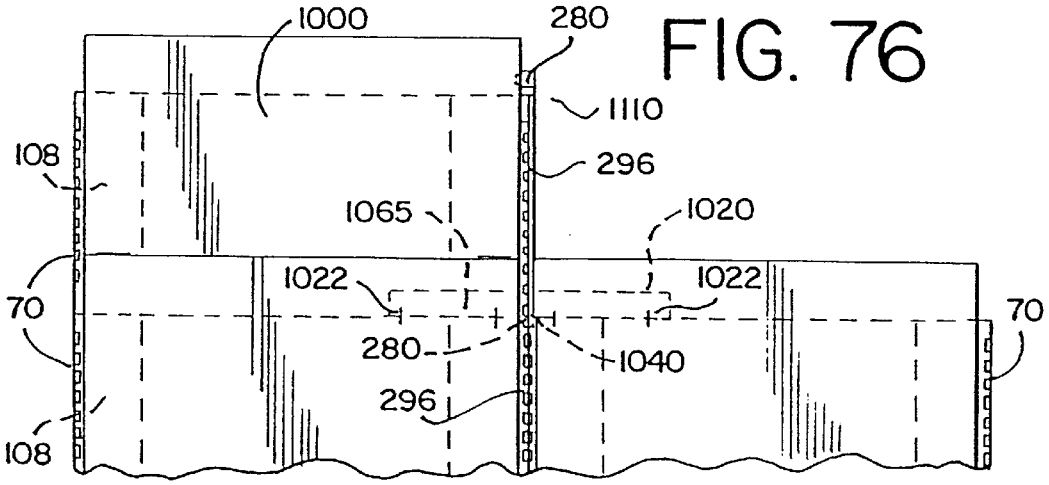
FIG. 76 is a side view of an upper wall panel attached to a pair of lower wall panels of equal height positioned in an end to end configuration.
Figure 124:
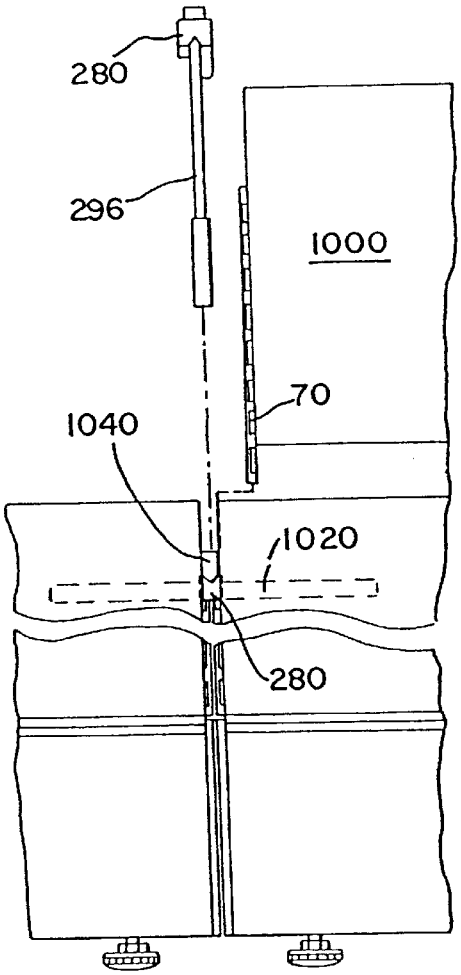

Now referring to FIGS. 76 and 124, an upper stackable wall panel 1000 is shown as being mounted to a pair of lower wall panels arranged in an end-to-end configuration. In this arrangement, a spanner member 1020 with a draw block 1040 is installed in the lower wall panels over a draw block 280 as described above and as shown in FIG. 123. An upper draw block 280 is then installed on the hanger bracket of the upper, stackable panel and a draw rod 296 is used to clamp the upper, stackable panel to the lower panels. In this way, the connector member, which includes the draw rod 296 and the upper and lower draw blocks 280 and 1040, connects the upper, stackable panel to the lower panels. A cover member can then be installed over the exposed hanger member and draw rod of the upper, stackable wall panel.

Figure 77:
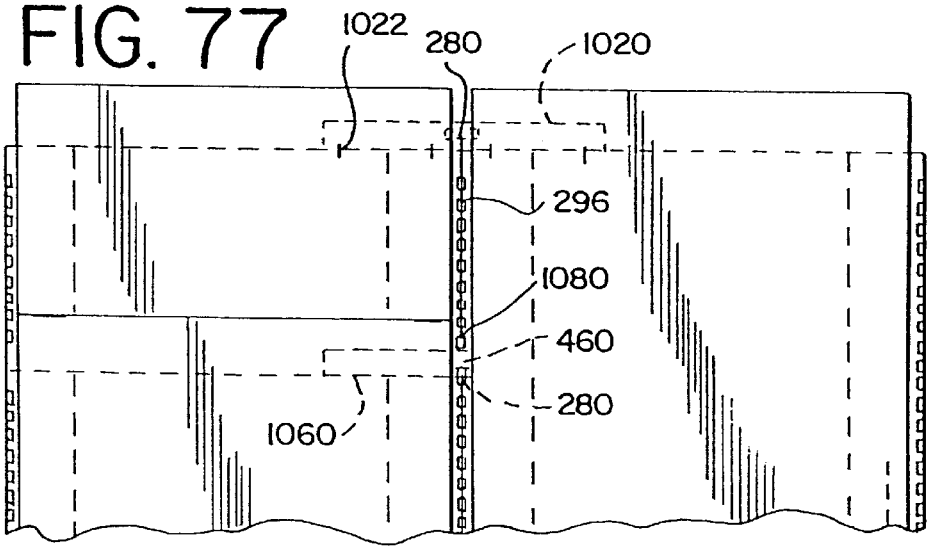
FIG. 77 is a side view of an upper wall panel attached to a short lower wall panel positioned in an end to end configuration with an adjacent tall lower wall panel.
Figure 121:
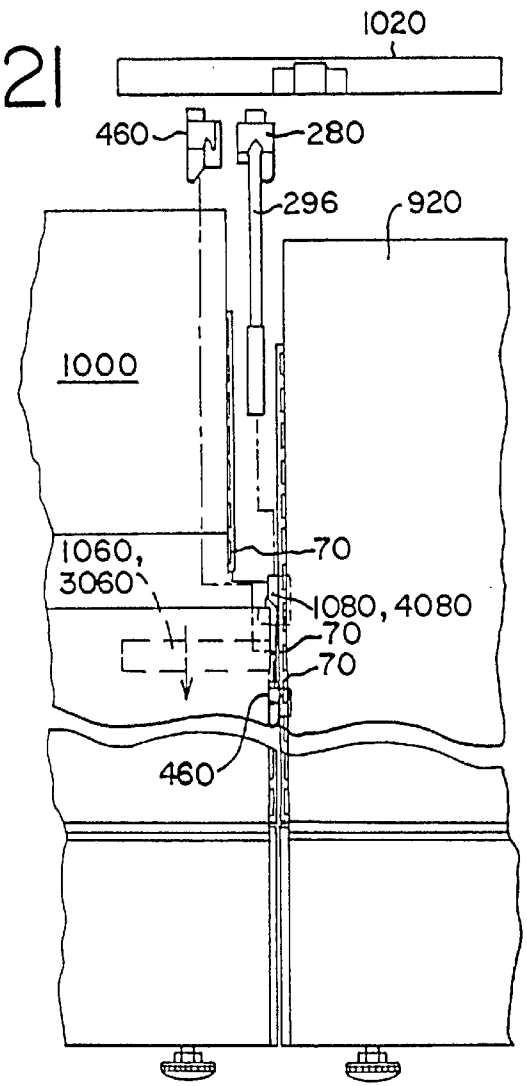
Figure 120:
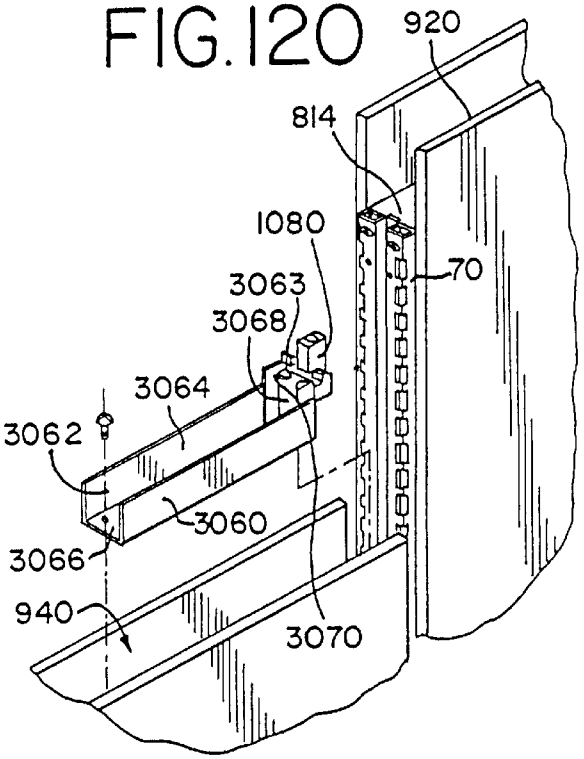

Now referring to FIGS. 77 and 120–121, a taller lower panel is shown attached to a shorter lower wall panel using a connector member, including draw block 460, in the manner described above with reference to FIGS. 36 and 38–40. An upper, stackable panel can then be installed on top of the shorter lower wall panel to equalize the height of the adjacent panels. In this configuration, a support bracket 1060, 3060, shown in FIGS. 87–89 and 120 respectively, is mounted to the shorter lower wall panel.

In one embodiment, the support bracket 1060 is formed as a channel 1062 with a base 1066 and a pair of sidewalls 1064. A support member 1068 includes a vertical flange that extends upwardly from one end of the bracket to close the channel on that end. A horizontal support flange 1070 extends outwardly from the vertical flange and includes an opening 1072. The support flange has a T-shaped configuration that is shaped to support a draw block 1080, shown in FIGS. 90–92.

In an alternative embodiment, shown in FIG. 120, the support bracket 3060 has a channel 3062 with a base 3066 and a pair of sidewalls 3064. The end of the channel is closed by a support member 3068, which formed as an upstanding channel that nests between the sidewalls 3064. The support member can be attached to the sidewalls by welding, with fasteners, or any other well known method of attachment. The support member has a pair of mounting holes 3063.

Figure 90:
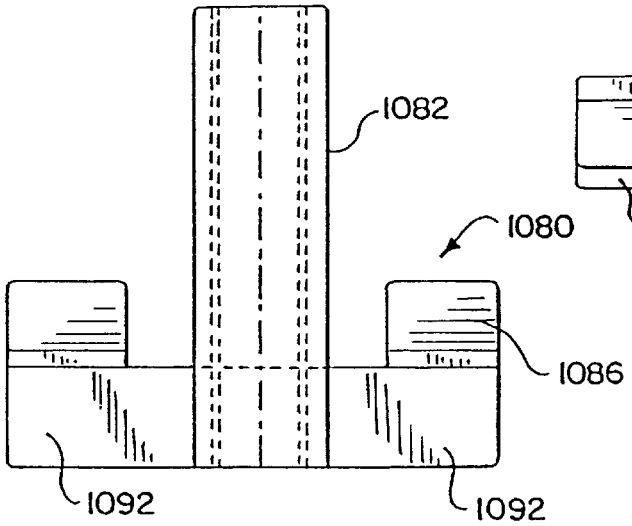
FIG. 90 is a side view of an alternative embodiment of a lower draw block.
Figure 91:
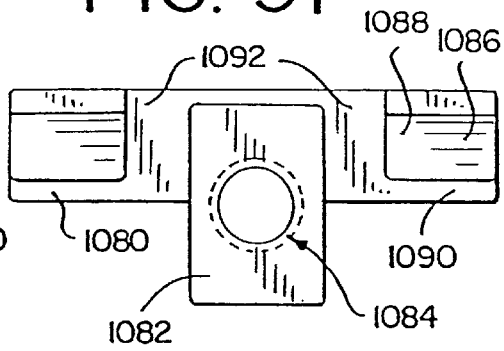
FIG. 91 is a top view of the lower draw block shown in FIG. 90.
Figure 92:
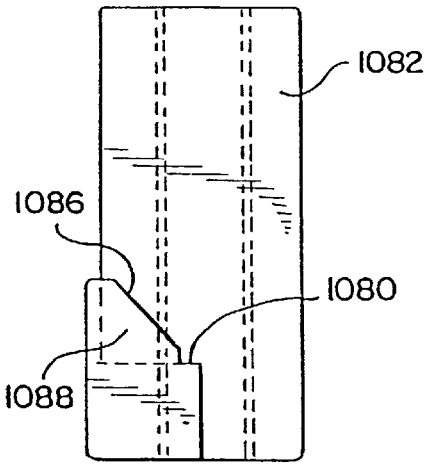
FIG. 92 is an end view of the lower draw block shown in FIG. 90.

As shown in FIGS. 90–92, the draw block 1080 includes a middle portion 1082 having a threaded opening 1084 running therethrough and a pair of draw surfaces 1086 formed along the top of wedge members 1088 disposed on outwardly extending side portions 1092. A ledge 1090 or shelf is formed on each side portion at the base of each wedge member and is designed to engage the lower end of the hanger bracket attached to the upper, stackable wall panel. The draw block is attached to the closed end of the channel. In particular, the draw block is disposed on top of the support flange 1070 with the middle portion and wedge members extending upwardly therefrom and is secured to the flange with a bolt 1102, or like fastener extending through the hole in the flange member. Alternatively, the draw block can be secured to the flange member by welding or the like. The bottom of the support flange, and the head of the bolt extending therethrough, is spaced above and provides clearance for the underlying draw block that clamps the shorter lower wall panel to the taller lower wall panel.

In an alternative embodiment of the draw block 4080, which is similar to the draw block 1080 as shown in FIGS. 131 and 132, the side portions 4092 act as a spacer and extend outwardly from the middle portion (away from the draw surfaces) so as to ensure that the threaded opening is aligned with the draw rod. The draw block 4080 also has a pair of mounting holes 4094 disposed laterally through the side portions 4092. The mounting holes 4094 are positioned to be aligned with the mounting holes 3063 in the support member 3068. The draw block 4080 is then mounted to the vertical support member 3068 with a pair of fasteners, shown as bolts. Alternatively, the draw block could be welded to the support member, or adhesively secured thereto.

The support bracket 1060, 3060, with the draw block 1080, 4080 attached thereto, is disposed in the top channel of the lower wall panel such that an opening 1065 formed in the support bracket overlies and is aligned with the vertical raceway and such that the sidewalls of the support bracket are laterally supported by the channel sidewalls. The support bracket is mounted to the upper frame member with a plurality of fasteners, adhesive, or a combination thereof.

Referring to FIGS. 77 and 121, a spanner member 1020 is installed between the upper, stackable wall panel and the taller lower wall panel as described above with reference to FIG. 75. A draw block 280 is mounted on the adjacent hanger members and a short draw rod 296 is used to connect the upper and lower draw blocks 280, 1080 so as to thereby mount the upper panel to the shorter and taller lower wall panels. The draw rod 296 and upper and lower draw blocks 280, 1080 comprise a connector member, which connects the upper panel to the shorter and taller lower wall panels and overlies the connector member, which includes a pair of draw blocks and a draw rod, connecting the lower wall panels. The draw rod 296 threadably engages the upper portion of the hole 1084 in the draw block 1080, while the bolt 1102 threadably engages the lower portion thereof. Alternatively, the draw rod can be rotatably secured to the draw block.

Now referring to FIG. 78, a shorter lower panel is again shown as attached to a taller lower panel, with a first upper, stackable panel attached to the lower panel in the manner just described, except that the spanner member 1020 connecting the taller lower panel and the first stackable wall panel includes a draw block 1040, again with the draw block and cross member spaced above the upper draw block 280, which is part of the connector member used to clamp the first stackable wall panel to the taller lower wall panel and to the shorter lower wall panel. In addition, a second stackable panel is attached to the top of taller lower panel in the same manner as described above with reference to FIG. 76.

Figure 125:
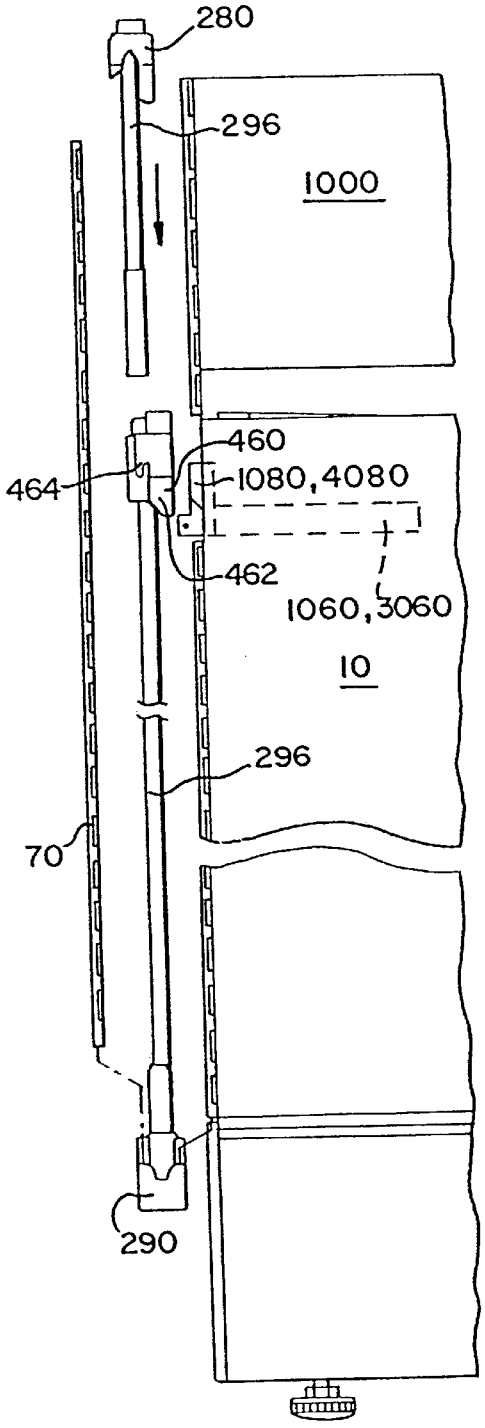

Now referring to FIGS. 79 and 125, an upper stackable wall panel is shown as attached to a lower wall panel, with the two panels forming an exposed end of the wall panel assembly. In this configuration, a stand-alone hanger bracket 70 functions as a connector member. The hanger bracket 70 has a length equal to the combined height of the lower and upper wall panels and is placed adjacent the two panels. A second connector member, including an upper draw block 460, along with a draw rod 296 and a lower draw block 290, are used to connect the stand-alone hanger bracket, or first connector member, to the lower wall panel as described above with reference to FIGS. 36 and 38–40. In particular, the wedge members 462 engage the hanger bracket 70 on the lower panel, while the hook members 464 engage the slots 86 on the stand-alone hanger bracket 70. A support bracket 1060, 3060, with draw block 1080, 4080 attached thereto, is then butted up against the hanger bracket 70 so as to overlie the draw block 460. An upper draw block 280, a draw rod 296 and lower draw block 1080,4080, which function as a third connector member, is used to connect the upper panel to the hanger bracket connector member and to the lower panel. In particular, the upper draw 280 is installed to engage the hanger bracket on the upper, stackable panel and the stand-alone hanger bracket. The second draw rod 296 is then used to clamp the upper, stackable panel to the stand-alone hanger bracket and to the support bracket 1060 mounted to the lower wall panel as described above. It should be understood that the stand-alone hanger bracket, or first connector member, the draw blocks 460, 290 and draw rod 296, or second connector member, and the draw blocks 280, and 1080, 4080, or third connector member, can also be considered in combination as a single connector member for connecting the upper wall panel to the lower panel.

Figure 93:
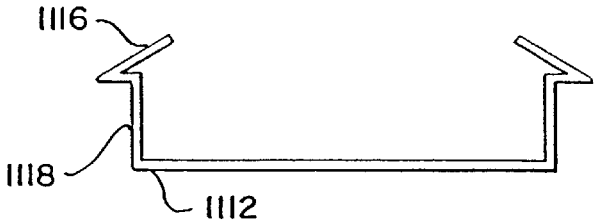
FIG. 93 is an end view of an alternative embodiment of a clip for a cover member.
Figure 94:
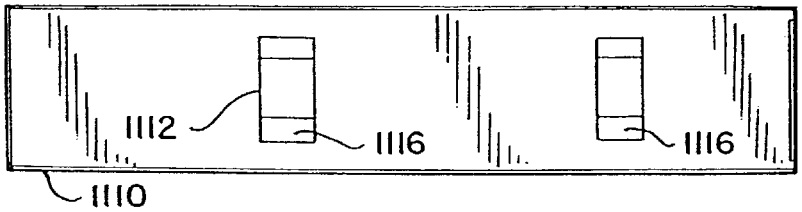
FIG. 94 is a cover member assembly.

A cover 1110, shown in FIGS. 93–94 is then installed on the exposed stand-alone hanger bracket to provide a finished appearance. In this configuration, the exposed portion of the stand-alone hanger bracket is opposite of the exposed portion of a hanger bracket attached to the end of the panel. To facilitate the attachment of the cover member to the inverted hanger bracket, a pair of clip members 1112 are installed inside the cover 1110. Each clip member 1112 includes a resilient arm portion 1114 having an end portion 1116 that releasably engages the channels of the hanger bracket. An alternative embodiment of the clip 6112 having resilient arm portions 6114 and end portions 6116 that releasably engage the slots is shown in FIG. 134.

Figure 85:
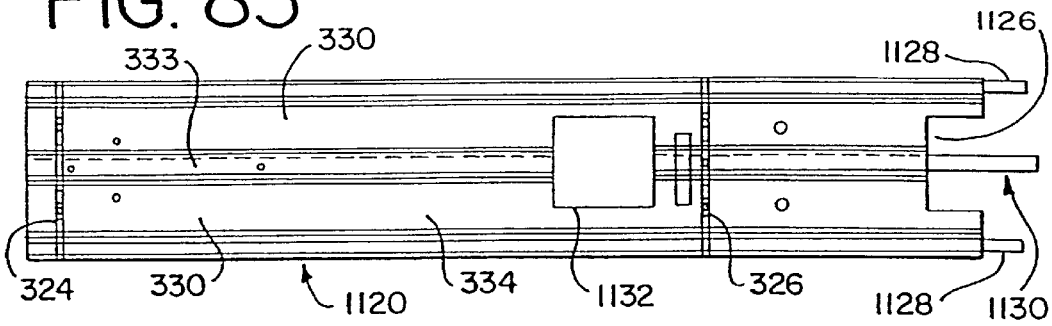
FIG. 85 is a side view of the corner post extension.
Figure 86:
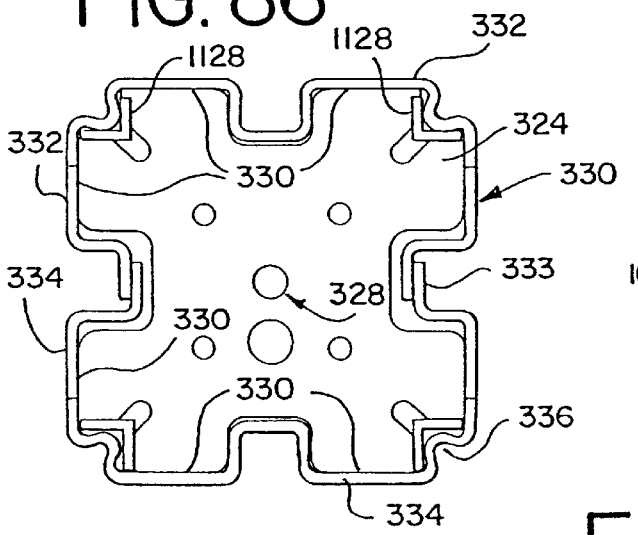
FIG. 86 is a bottom view of the corner post extension.
Figure 89:
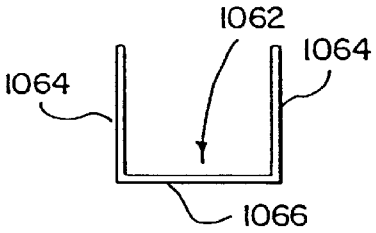
FIG. 89 is an end view of the upper wall panel support bracket.
Figure 87:
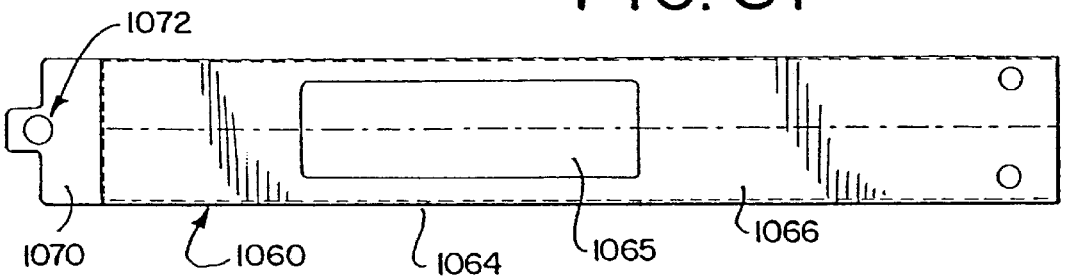
FIG. 87 is a top view of upper wall panel support bracket.
Figure 88:
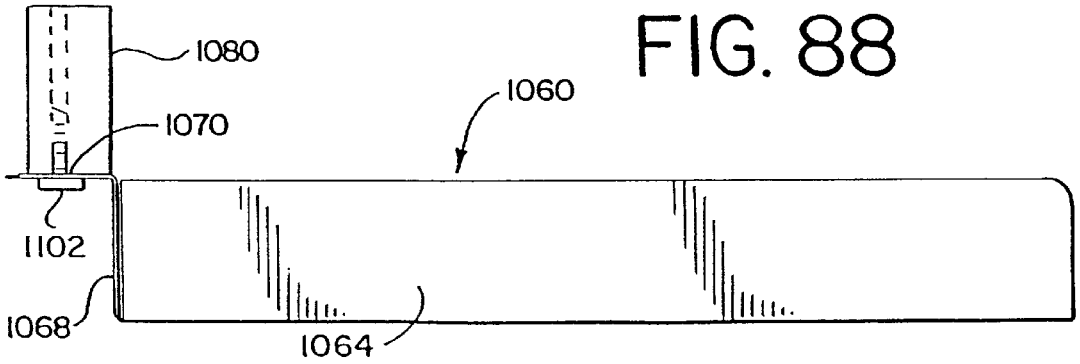
FIG. 88 is a side view of the upper wall panel support bracket.
Figure 98:
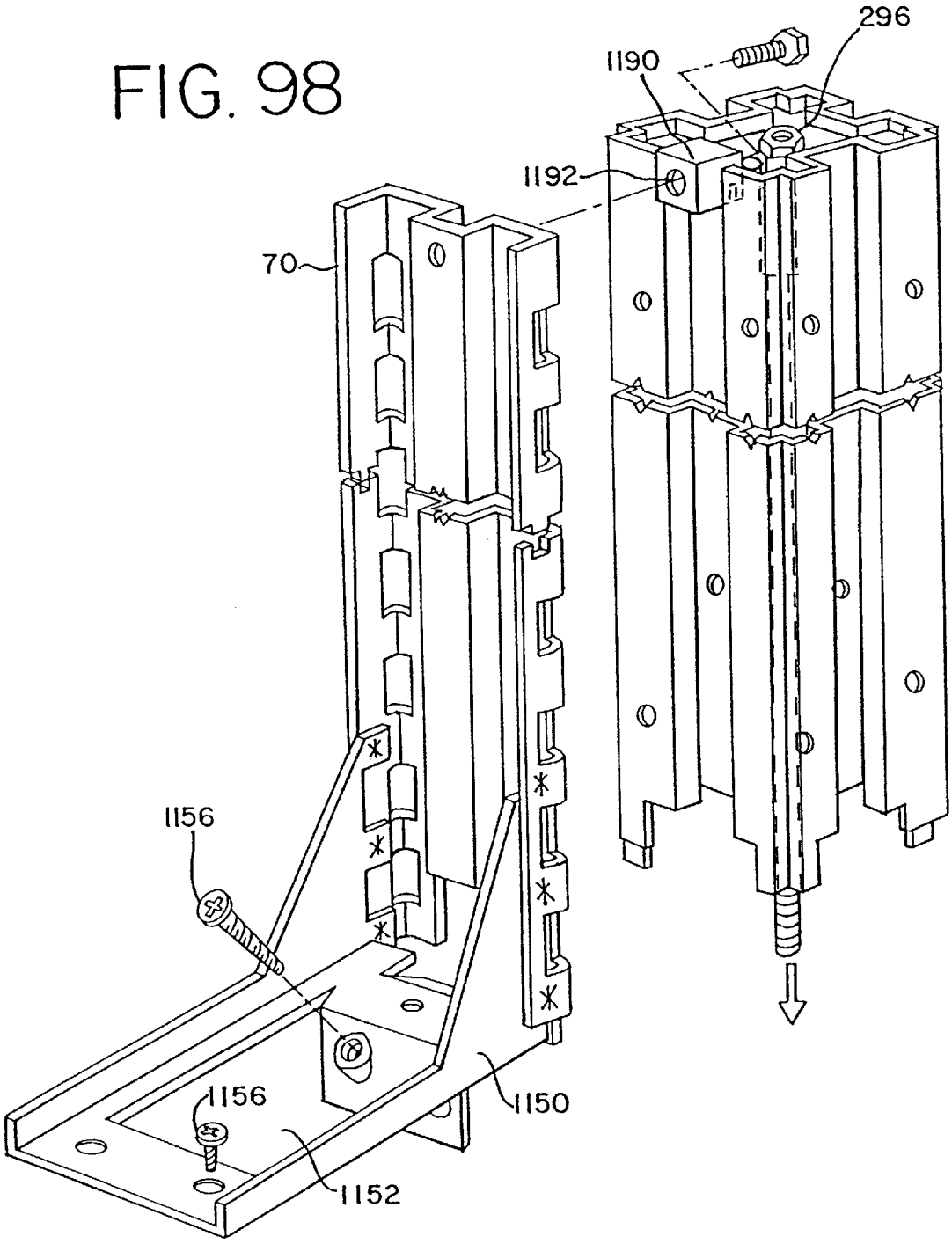
FIG. 98 is a perspective view of a bracket member and a corner post extension.

Now referring to FIG. 80, a pair of lower wall panels are shown as attached to a corner post as described above. As described above, the corner post 320, in combination with one or more pairs of draw rods 296 and upper and lower draw blocks 280, 290, function as a connector member to connect the lower wall panels. A corner post extension 1120, shown in FIGS. 85 and 86, is then mounted to the top of the corner post, and can also be considered as part of the connector member. In a first embodiment, the corner post extension has the same construction as the corner post described above (with the same reference numbers calling out those aspects that are the same), except that the lower plate member 326 is mounted distally from the lower end of the extension. In addition, each side of the extension has a cut out 1126 along the lower end of the extension below the lower plate member. A leg portion 1128, formed as an L-shaped angled member, is welded in each corner of the extension and extends downwardly therefrom. The extension 1120 is mounted on the corner post such that the leg portions 1128 are disposed in each inner corner of the upper portion of the corner post and are supported on the upper plate member 324 of the corner post. A bolt 1130 is then installed through the plate member and threadably engages the upper plate member in the corner post 320 to clamp the extension to the corner post. Alternatively, as shown in FIG. 98, a draw rod 296 is inserted through the opening in the upper plate of the extension member. The draw rod extends through the lower plate until it engages the hole in the upper plate of the corner post. In the embodiment shown in FIGS. 85 and 86, a window 1132 is provided in the extension, both to install the bolt, as well as to provide access for a tool or the like to tighten the bolt.

Figure 119:
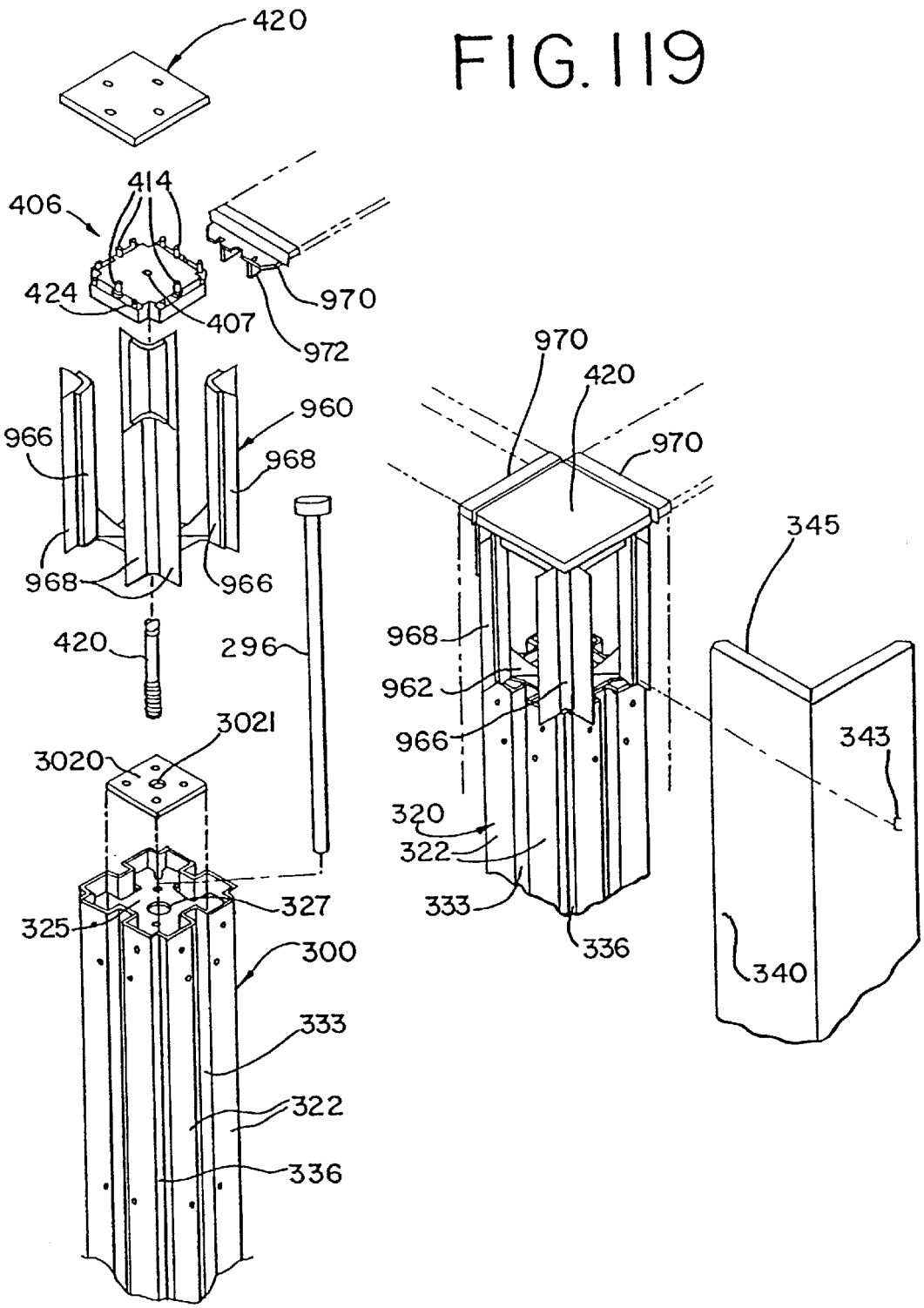

In another embodiment of the corner post extension, shown in FIG. 133, the leg portions 1128 are more elongated and hold the corner post extension above the lower corner post to provide clearance over the draw blocks used to mount the lower wall panel or panels to the corner post. In addition, two plate members 323 and 325 are mounted in an upper portion of the corner post extension. A draw rod 296 engages the plate member 323 and clamps the corner post extension to the corner post below as it engages the opening in the plate member disposed in the lower corner post tube. The second plate member 325 includes a relative large opening 327 centered above the opening 328 in the first plate member so that the draw rod can be installed and accessed through the opening 372 by a tool or the like. As shown in FIG. 119, a plate member 3020 is then mounted on the plate member 325 to cover the opening 325. The plate member 3020 is mounted to the plate member 325 with a double-sided tape, adhesive, welding and/or fasteners. The plate member 3020 also includes an opening 3021 adapted to threadably receive the post member 402, which supports the corner post cap. The corner post light seal is also supported by the plate member 3020.

Again referring to FIG. 80, the lower wall panels are mounted to the corner post as described above. The extension is then mounted to the corner post with the cut outs 1126 providing clearance over the draw blocks used to mount the lower wall panel or panels to the corner post. A support bracket 1060 is then mounted in the upper channel of the lower panel with a draw block 1080 as described above. An upper draw block 280 is then installed so as to engage the upper edge of the corner post extension 1120 and the hanger bracket 70 of the upper, stackable panel. A draw rod 296 is used to connect the draw blocks 280, 1080 so as to securely mount the upper, stackable panel to the corner post extension and lower panel. In this way, the draw rod 296, draw blocks 280, 1080 and corner post extension 1120 can be considered a connector member connecting the upper panel to the lower panels. It should be understood, that an upper panel could also be installed on the other lower panel, or panels, in the same manner.

Figure 81:
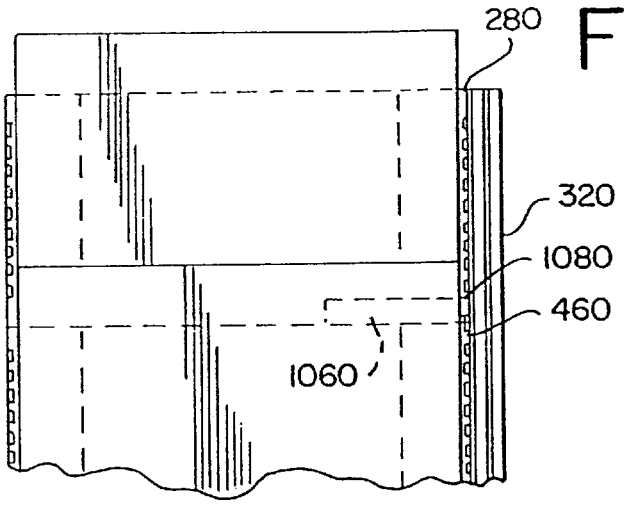
FIG. 81 is a side view of an upper wall panel attached to a lower wall panel and to a corner post without an extension.

Referring to FIG. 81, a corner post 320 is shown as having a height equal to the combined height of the lower and upper wall panels. The lower wall panel is attached to the corner post using a draw block 460. The corner post has a pair of slots formed in each side which are shaped to receive the hook members 464 of the draw block 460. The upper, stackable wall panel is then attached to the lower wall panel and corner post using a support bracket 1060, 3060 with a draw block 1080, 4080 overlying the draw block 460, an upper draw block 280 and a draw rod 296 as described above.

In an alternative embodiment, an upper stackable panel can be attached to a lower wall panel simply by removing the hanger brackets on both the upper and lower panel and replacing them with a single hanger bracket having a length equal to the combined height of the upper and lower panels. The hanger bracket is attached to each wall panel using a plurality of fasteners to secure one panel to the other.

In another embodiment, shown in FIGS. 128 and 129, a stand-alone hanger bracket 70 is attached to the upper portion of the hanger bracket of a lower wall panel with a plurality of fasteners 5001. The stackable upper wall panel is then attached to the stand-alone hanger bracket using a support bracket 1060, 3060 with a draw block 1080, 4080, draw rod 296 and draw block 280 in the same manner as described above with respect to FIGS. 79 and 125.

In yet another embodiment, shown in FIG. 98, a support bracket includes a base portion 1150 having an opening 1152 that overlies and is aligned with the vertical channel. A flange 1154 extends downwardly from an outer edge of the opening and abuts the inner surface of the vertical frame member. A plurality of fasteners 1156 are used to secure the bracket to the upper horizontal frame member and to the vertical frame member. A hanger bracket 70 is attached, preferably by welding, to an outer end of the bracket and extends upwardly therefrom. An upper wall panel is then installed between opposing hanger brackets and attached thereto with a plurality of fasteners. The hanger brackets can then be secured to any one of an adjacent hanger bracket, corner post or corner post extension (shown in FIG. 98) using the various draw block assemblies described above. Alternatively, as shown in FIG. 98, a draw block 1190 having a horizontally oriented opening 1192 includes a hook portion 1194 that engages an upper edge of the corner post extension. A fastener is installed through the opening and threadably engages a hole in the upper portion of the adjacent hanger bracket.

In yet another embodiment of a stackable wall panel assembly, shown in FIGS. 158 and 163–165, a first and second upper wall panel 1000 are connected to a lower wall panel, both of which are shown in the figures as comprising only a core 800, 1000 for the purpose of illustrating the various stackable components. Likewise, FIG. 214 illustrates an upper wall panel 800 connected to a lower wall panel 1000. It should be understood that opposing wall members can be affixed to each side of the cores as explained above. In this way, each upper and lower stackable wall panel is preferably of the same construction as one of the wall panels described above. Of course, it should be understood that wall panels of various constructions, including solid wall panels, would also work.

Each upper and lower wall panel has a top 801, 1001, a bottom 803, 1003, vertically extending opposite ends 805, 1005 and opposite sides 807, 1007. As best shown in FIGS. 160–164, a rail 8000 formed as a shallow channel is secured to the top 801 of the lower wall panel. The rail 8000 includes a pair of openings 8002 that are aligned with the vertical channels 108 or raceways formed in the lower wall panel. A pair of stanchions 8004 each include a lower foot portion 8006 that is disposed in the rail channel 8000 and is attached to the lower wall panel, and a side wall portion 8008 that is secured to an end of the hanger bracket 70 extending upwardly from the lower wall panel, preferably with a pair of mechanical fasteners. The stanchion 8004 further comprises an upwardly extending post 8010 and an upper support portion 8012 having a platform 8014.

Referring to FIGS. 198, 203–204 and 207–208, an alternative embodiment of a stanchion includes a pair of secondary platforms 8005 that extend upwardly from the platform 8014. The secondary platforms have end portions that are indented opposite each other so as to form a recess 8007 around an elongated opening 8009 formed through the support portion 8012 on each side thereof. Likewise, the foot portion 8006 of the stanchion includes a pair of elongated openings 8011 formed therein. Preferably, the openings 8009, 8011 in the foot portion and support portion are aligned. The stanchion 8004 further includes a pair of openings 8013 formed in the foot portion and a pair of openings 801 formed through the support portion. A fastener is inserted through the openings 8013 and is engaged with the lower panel 800 to secure the stanchion thereto. The stanchion 8004 further includes a pair of upwardly extending locating tabs 8017, positioned adjacent an outboard end of the stanchion. A platform 8019 is formed adjacent to and between the tabs and is level and coplanar with the upper surface of the secondary platform 8005. A rail or channel 8000 is disposed on top 801 of the lower panel 800. The rail 8000 has opposite end portions that have cut-outs 8021, which are aligned with the vertical raceways in the lower panel with the ends 8023 of the rail disposed on opposite sides of the stanching.

Referring to FIGS. 160, 161, 198, 202 and 207–208, a rail member 8020, also configured as a channel, spans the distance between the stanchions 8010. The rail 8020 includes a bottom 8024 and a pair of upwardly extending walls 8026 each having an inwardly extending rib portion 8028. In the embodiment shown in FIGS. 160 and 161, an upper flange 8030 extends outwardly from a top portion of each wall. The bottom 8024 of the rail is secured to the support portion 8012 of the stanchion with a plurality of mechanical fasteners engaging openings 8015. The rail includes a pair of openings 8022 that are aligned with the vertical raceways 108 of the upper wall panel. It should be understood that in alternative embodiments, the rail can be integrally formed with the stanchions or can be attached by welding, bonding or the like and the like. Although a pair of stanchions are shown, it should be understood that a plurality of stanchions greater than two could also be used.

As shown in FIGS. 198, 202 and 207–208, one alternative embodiment of the rail includes a pair of elongated and laterally extending openings 8025 that are shaped to receive the secondary platforms 8005 of the stanchion as the rail is supported on the platform 8014. In this embodiment, the rail preferably does not include an outwardly extending flange. As shown in FIG. 214, one or more brackets 8027, similar to those shown in FIG. 13, can be secured to an underside of the bottom of the rail. Various electrical power distribution servers 220, including electrical harnesses 222 as described above, are secured on tab members extending from the bracket, as shown for example in FIGS. 158 and 214. The electrical harness can be electrically connected to other harnesses located in adjacent panels, in the base of the lower panel, or in other areas of the panel system.

Referring to FIG. 161, in one embodiment, a post 8040 extends upwardly from the bottom of the rail 8020. In a preferred embodiment, the post is defined by a frustoconically shaped spacer 8042 that is secured to the rail and stanchion with a fastener 8044. The head 8046 of the fastener preferably is the same diameter of the top of the spacer 8042 so as to further define the post. It should be understood that the post alternatively could be integrally formed with either the stanchion, wherein the post extends through an opening in the rail, or with the rail. In the embodiment shown in FIG. 202, the assembly does not include a post.

Referring to FIGS. 171–173, a pair of spacer members 8050, configured as blocks, are secured to the bottom 1003 of the upper wall panel adjacent opposite ends thereof. Each spacer member 8050 comprises a lower portion 8052 and an upper portion 8054. The lower portion 8052 has a width dimensioned to be received in the rail channel 8020 between the ribs 8028 of the walls. The upper portion 8054 has a width dimensioned to be received in the channel between an upper portion of the walls 8026. The spacer member 8050 comprises three clearance holes 8056 passing therethrough, a pair of fastener holes 8058 and a slotted hole 8060, which receives the post 8040. One or more of the holes 8056 are shaped and dimensioned to receive a draw rod, as explained below. The spacer member 8050 is secured to the bottom 1003 of the upper wall panel with a pair of fasteners 8062, which extend through holes 8058. The holes 8058 are preferably countersunk to receive the heads of the fasteners, which are preferably flat, so as to maintain a flat bottom surface on the spacer member.

The upper wall panel 1000 is disposed on the rail 8020 such that the post 8040 is received in the slotted hole 8060 formed in the spacer member as the upper and lower portions of the spacer member are received in the channel. The conical shape of the post 8040 facilitates the insertion of the post into the slotted hole 8060 and aligns the wall panels as it is fully inserted into the opening. It should be understood that the spacer member could be integrally formed with the upper wall panel, or that the upper wall panel could be provided with an opening shaped to receive the post.

In an alternative embodiment, shown in FIG. 199, the bottom of the upper panel, and in particular the bottom of the lower frame member 8818, has a downwardly extending insert portion 8819 having a width that is less than the overall width of the wall panel. The width of the insert portion is dimensioned to be received in the rail channel 8060, with the rib portions 8028 preferably engaging the sides of the insert portion 8819. The insert portion 8819 can be provided with an opening shaped to receive the post, or it preferably can simply rest on the secondary platforms

8014, 8019. In this embodiment, the wall panel does not have any spacer members.

As shown in FIGS. 207 and 208, the tab members of the stanchion are received in the ends of the hanger bracket channels, which rest on the platform 8019, while the bottom of the insert portion 819 rests on the secondary platforms 8005. The inboard side of the tabs 8017 engages the end of the insert portion, or the end of the upper wall panel, and locates the wall panel on the stanchion.

As explained above, a channel member 940 is secured to the top of the upper wall panel 1000. The channel member includes a bottom and a pair of walls 942 extending upwardly therefrom. A rib 944 extends inwardly from each wall.

If only a single upper wall panel is attached to the lower wall panel, in one embodiment, a connector member 8070, best shown in FIG. 159, is disposed in the channel 940 secured to the top of the upper wall panel. The connector member 8070 is preferably formed as a plate 8076 having a pair of slotted openings 8072 terminating in an enlarged opening 8074. The connector member further comprises an alignment member 8078, preferably formed as a tab, which extends laterally outward and downward from the plate 8076. The alignment member 8078 has a width dimensioned to be received in the channel 300 formed in the hanger bracket 70 of an adjacent wall panel. A connector member, with the alignment member extending upward, can be attached to an adjacent panel for mating and alignment therebetween.

A pair of interior draw members 8096, preferably configured as draw rods, are inserted through and extend from the top to the bottom of the upper wall panel. A head 8098 on each draw member is inserted through the enlarged opening 8074 of the connector member, and the connector member 8070 is thereafter slid outboard such that the head engages the connector member as the shaft of the draw member extends through the slotted opening 8072. The draw members 8096 are tightened to releasably secure the upper wall panel 1000 to the rail 8020 and stanchion 8004, and ultimately to the lower wall panel. It should be understood that one or more draw members, and preferably two, can be used to secure each end of the upper wall panel to the stanchion and lower wall panel. In an alternative embodiment, explained below, the upper wall panel is secured to the lower wall panel and stanchion with only external draw members, rather than with internal draw rods.

As shown in FIGS. 163–164, the bottom of the rail 8024 and the bottom of the first upper wall panel 1003 are spaced above the top 801 of the lower wall panel. The space 8090 formed between the upper and lower wall panels provides an ideal location for the routing of various power and communication cables and lines. Moreover, as shown in FIG. 158, various outlets 8092 can be secured to one or more of the upper and lower wall panels in the space formed between the upper and lower wall panels, as explained above.

Referring to FIG. 198, in one embodiment of a belt-line panel, a top cap 110 is secured to the rail 8020 instead of an upper panel. In this embodiment, the lower wall panel is provided with a belt-line space, which can house the electrical harness as explained above. The space is formed between the rail and the top of the wall panel.

In an alternative embodiment of the wall panel, the upper horizontal frame member 8816 and the vertical side frame members 8814 are machined to form a channel 8825, 8827, with a base portion 8823 and upstanding wall portions 8817, which preferably have tapered or beveled ends 8821. Hanger brackets 70 are installed in the relatively shallow channels 8827 formed along the side of the wall panel and are secured to the side frame members. A top channel member 940 (not shown in FIG. 200) is mounted in the channel 8825 formed in the upper horizontal frame member between the opposing wall portions. A filler member 150 is installed in the panel as explained above, while partition members 140 form a pair of vertical raceways with the side frame members. A first and second sheetlike wall member 8820 is secured to the outer side surface of the frame members, preferably with an adhesive. A decorative sheet 930 (not shown), preferably a fabric, is stretched over the outer surface of the wall member, preferably with a barrier sheet disposed therebetween. The edges of the sheet are wrapped around the edges of the wall members 8820 and the ends of wall portions 8821 of the frame members and are secured to the inside surface of the wall portions with adhesive and/or fasteners, such as staples, or other like known fastening devices. In this embodiment, the wall panel, with its outer hardboard wall member 8820, is not tackable and is preferably about 3 inches thick. The wall panel construction shown in FIGS. 199 and 200 as just described can be used for either or both of the upper and lower wall panels, depending on whether tackability is desired. Of course it should be understood that the upper wall panel can assume any of the other above-described constructions.

Referring to FIG. 201, preferably, the wall portions 8817 of the belt-line wall panel do not extend beyond the bottom surface of the channel of the upper frame member as much as they do with non belt-line wall panels. For example, as shown in FIG. 201, the wall portions 8817 extend above the bottom surface of the wall member about ⅜ inch, while, as shown in FIG. 200, the wall portions 8817 extend above the bottom surface about 1.20 inches. The shorter wall members used on the belt-line panel provide additional access to the space created between the rail and the top of the wall panel.

As shown in FIGS. 158 and 174–175, a cover member 9010 is preferably connected to the lower wall panel. In particular, the cover member 9010 comprises an outwardly extending web 9012 having a downwardly and inwardly extending, curved flange 9014 and an outwardly extending flange 9016. A flange portion 9018 also extends outwardly from the bottom and top of the cover member. The inwardly and outwardly extending flanges 9014, 9018 form a cavity 9020 therebetween along a bottom of the cover member. A flange member 9022 extends from a top of the cover member to form a channel and includes an outwardly extending hook portion 9024. The flange members 9022, 9018 form a cavity therebetween along a top of the cover member. The flange member 9022 engages the flange of the rail, while the flange member 9014 engages the lower wall panel. The cover member can include openings that are aligned with and provide access to various outlets that may be installed in the space 8090 formed between the upper and lower wall panels. It should be understood that the cover could alternatively be hingedly connected to one or more of the upper wall panel, the rails or the stanchions, or could be removably connected to the wall panel assembly.

In an alternative embodiment, best shown in FIGS. 211–213, a cover 9011 assembly includes a cover member 9013 and a pair of support brackets 9015 secured to the cover member. The cover member 9011 includes opposite downwardly and upwardly extending channels 9017 formed on an inboard side thereof along the top and bottom edges respectively. A notch 9019 is formed in the down and up turned edges of each channel. The bracket 9015 includes an upper and lower insert portion 9021 that is shaped and dimensioned to be received in the channels of the cover member. A bracket 9015 is slid into the each end of the cover member 9013 until a pair of detents 9023 engage the notches formed in the cover member. The bracket includes an upper, laterally extending catch member 9025 having a ramped insert surface 9027 and a catch surface 9029. The bracket further includes a lower, downwardly and laterally extending catch member 9031 formed as a hook. Preferably, a bracket is inserted in each end of the cover member, although it should be understood that additional brackets can be slideably engaged with the cover member depending on the number of stanchions or like support members that are being used to define the belt-line space.

Referring to FIGS. 212 and 213, the hook 9013 is inserted in the opening 8011 formed in the stanchion foot portion. The cover member 9013 is then pivoted inwardly until the upper catch member 9025 engages the support portion at opening 8009 formed therein, preferably with the ramped surface 9025 engaging the bottom of the support portion to bias the catch member downwardly until it engages the support portion with a snap fit engagement. It should be understood that the cover assembly can be used with a stackable wall assembly, or with a single belt-line wall panel.

As best shown in FIGS. 211 and 212, a light seal 9023 includes a T-shaped insert portion 9035 extending longitudinally therealong. The insert portion is received in a longitudinally extending channel 9039 formed along an outer portion of the bracket. The light seal further includes a blade portion 9037 that extends outwardly from the end of the cover member and assists in blocking at least a portion of the gap formed between adjacent panels, or between the panel and a corner post.

As best shown in FIG. 213, the post 8010 of the stanchion has a lesser width than the thickness of the wall panels so as to provide a space between the sides of the stanchion 8004 and the interior surface 9026 of the cover members. As such, the various utility lines can be routed around the stanchion post and passed from one panel to the next, as shown for example in FIG. 158.

As shown in FIGS. 163–165, a first and second upper wall panel are connected to a lower wall panel. A second stanchion 9030 is disposed in the channel 940 secured to the top of the first upper wall panel. The second stanchion 9030, which is preferably formed as an alignment block, comprises a housing 9032 having a cavity 9034 open to the back of the housing. A slotted opening 9036 is formed in a bottom of the stanchion and terminates in an enlarged opening 9038. A plurality of holes 9040 are formed in the top of the stanchion, and a post 9042, preferably having a frustoconical shape, extends upwardly from the top of the stanchion. Upper and lower alignment members 9046, 9048, or tabs, extend laterally from a front of the housing. The alignment members are vertically and horizontally offset or staggered, with the inner face 9050, 9052 of each member being substantially aligned one above the other. The alignment members are slightly tapered, with the inner and outer vertical faces being slightly angled from a plane formed parallel to the sides of the wall panels, such that the alignment members are more easily matingly interfaced.

The second stanchion 9030 is disposed in the channel 940 of the first upper wall panel, with the head 8098 of the draw member 8096 first extending through the enlarged opening 9038 formed in the bottom of the stanchion. The stanchion 9030 is thereafter slid outwardly such that the head of the draw member 8098 engages the bottom of the stanchion as the draw member extends through the slot 9036. The draw member 8098, whose opposite end is threadably engaged with the first stanchion as described above, is tightened to secure the second stanchion 9030 and first upper wall panel to the first stanchion 8004 and lower wall panel. The second upper wall panel, with its spacer members 8050, which is preferably substantially identical to the first upper wall panel with its spacer members, is then disposed on the second stanchions 9030, with the post 9042 received in the slotted opening 8060 formed in the spacer. The lower portion 8052 of the spacer is received between the ribs 944 of the channel, while the upper portion 8054 is received between the upper portion of the channel walls 942. One or more draw members 8096 extend through the second upper wall panel from top to bottom and the heads 8098 are thereafter engaged with the connector member 8070 at the top of the second upper wall panel. The draw members 8096, preferably two, are threadably engaged with the second stanchion 9030 and are tightened to connect the second upper wall panel to the second stanchion, and ultimately to the first upper wall panel. It should be understood that other upper wall panels could be successively stacked on the first and second upper wall panels using additional stanchions and draw members.

In an alternative embodiment, best shown in FIGS. 205–206, 209–210 and 214–215, a locator member 9041, which can be considered to be yet another stanchion, which should be understood to mean a support positioned between two or more spaced apart members. The locator member 9041 is preferably configured as plate member having a opposite sides 9043 forming primary platforms and a pair of elongated secondary platforms 9045 extending therefrom. The locator member further includes a pair of upwardly extending tabs 9047 and a pair of downwardly extending tabs 9047, with a platform formed 9049 adjacent to and between each pair of tabs. The platform 9049 is preferably coplanar with the secondary platform 9047. If no belt-line power is desired in a stackable panel assembly, the locator member can be secured to a lower wall panel with fasteners, which extend through openings formed in the secondary platforms, as shown for example in FIGS. 200, 210, and 215. The inside of the downwardly extending tabs 9047 engages the side of the lower wall panel and locates the locator member on the lower wall panel, with the downwardly facing secondary platform 8045 and the platform 9049 engaging the top of the lower wall panel.

Preferably, a rail 8020 is disposed in the channel formed on the top of the lower wall panel. The secondary platforms 9045 of the locator member 9041 are received in the openings 8025 formed in the rail. The locator is then secured to the wall panel with fasteners as it clamps the rail between the locator member and the wall panel.

Alternatively, the rail 8020 is disposed on top of the locator members, preferably with one located at each end of the lower wall panel. The openings 8025 formed in the rail are received over the secondary platforms 9045 such that the rail is disposed on the platform 9043, with the upper surface of the bottom 8024 of the rail preferably located below the upper surface of the secondary platform 9045 and the platform 9049.

In either embodiment, the locator members are preferably secured to the lower wall panel with fasteners, which are inserted through the openings formed in the locator member. The upper wall panel is inserted into the channel formed by the rail 8020 disposed between the wall members of the lower wall panel. The bottom of the upper wall panel is disposed on the platforms 8045, 9049, with the tabs 9047 of the locator member received in the ends of the hanger bracket 70 and with the inner surface of the tabs engaging the outer surface of the ends of the upper wall panels to locate the upper wall panels on the locator member. In this way, the locator member aligns the upper and lower wall panels. After installation, a gap is formed between the upper edge of the wall member on the lower wall panel and the bottom edge of the wall member on the upper wall panel. Of course, it should be understood that the locator member could be used in a similar fashion to locate a second upper wall panel relative to a first upper wall panel.

As shown in FIG. 158, a first stackable wall panel assembly comprising a wall panel with a second stanchion 9030 can be serially connected with a second stackable wall panel assembly also comprising a second stanchion 9030. In such a system, the alignment members 9046, 9048 of each stanchion are matingly interfaced as the two assemblies are interconnected. In particular, the inner surface 9050 of the upper alignment member 9046 of one wall panel abuts the inner surface 9050 of the upper alignment member 9046 of the opposite wall panel. Likewise, the inner surfaces 9052 of the lower alignment members 9048 are abutted. In this way, a pair of identical modular alignment blocks, or stanchions, can be used to align adjacent serially connected wall panels by rotating the alignment block 180 degrees as it is attached to adjacent ends of the serially adjacent wall panels. This orientation allow the alignment members to matingly interface. The tapered configuration of the alignment members facilitates the installation process as the adjacent panels are maneuvered into position. When assembled, the alignment members align the serially connected wall panels and also provide laterally stability to the wall panel system. The stackable wall panel assemblies are connected one to another using various interior draw rods as explained above. When positioned adjacent a corner post, the alignment members are received in the channel formed in the corner post to help align the stacked wall panels with the corner post.

In an alternative embodiment of a stackable wall panel connector system, the first upper wall panel is connected to the lower wall panel with an external connector system. Likewise, the second upper wall panel is connected to the first upper wall panel with an external connector system. In particular, as shown in FIGS. 177–181, a draw block 9200 is disposed on the top edge 298 of the hanger bracket 70 attached to one end of the lower wall panel, such that a pair of draw surfaces 9202 engages the top edge of the hanger bracket. A draw rod 296 is inserted through an opening 9204 formed in one end of the draw block, with the head of the draw rod 296 disposed in a recess 9206 formed in the draw block. An insert portion 9208 of the draw block is received in the channel 300 of the hanger bracket 70 so as to maintain the alignment of the draw block. The draw block 9200 has a cavity 9210 formed therein which is open to opposite sides 9212 of the draw block, such that the cavity extends through the draw block in a direction substantially perpendicular to the orientation of the length of the lower wall panel when installed thereon.

A pair of engagement members 9214 extend inwardly so as to form interior shoulders 9216 that define in part the cavity. The engagement members are spaced to form an opening 9218, preferably formed as a slot, in the end of the draw block that communicates with the cavity 9210. The opening is further enlarged in a circular pattern 9220 above the opening in the other end of the draw block, which also communicates with the cavity, so as to allow the head of the draw rod to pass through the opening and be disposed in the recess formed in the draw block. As explained above, the draw block 9200 can engage hanger brackets on adjacent, serially aligned wall panels, or can engage a wall panel and a top edge of a corner or connector post.

In an alternative embodiment, shown in FIGS. 214, 215 and 217–222, the draw block 9201 includes a cavity 9203 which is open to opposite sides thereof and has eye-shaped opening 9205 formed in a top thereof which communicates with the cavity. It should be understood that the opening 9205, which functions as a key-hole, could have other shapes besides the eye-shape. The opening 9205 is shaped to receive an insert 9207 having a locking portion 9209 having an engagement surface 9211, or shoulder. Preferably, the locking portion 9209 is shaped, such as with the eye-shape, to be matingly received through the opening 9205. The insert 9207 can then be turned, for example by rotating an attached draw rod 296, so as to rotate the locking portion 9209 inside the cavity 9203 such that the shoulder 9211 engages an interior shoulder 9213 formed in the draw block. The cavity 9203 includes a pair of offset shoulders 9215 that engage the ends of the locking portion as it is rotated to an engaged position so as to prevent the locking portion from rotating 180 degrees, wherein it could again be passed through the opening. To disengage the locking portion 9209, the draw rod 296 is simply loosened such that the locking portion again rotates until the ends thereof engage the opposite side of the shoulders 9215 wherein it is aligned with the keyhole, or opening 9205. The draw block 9201 can be used to connect a non beltline lower and upper wall panel by engaging the upper edge of the hanger bracket on the lower wall panel, or to connect a pair of upper wall panels by engaging the hanger bracket on the lower upper wall panel.

Referring to FIGS. 177 and 182–184, a draw block 9230 is shown as having a cavity 9232 opening to opposite sides 9234 of the draw block, with the cavity oriented parallel to the length of the wall panel. The draw block is disposed on the top edge 298 of the hanger bracket 70 attached to one end of the first upper wall panel, such that a pair of co-planar draw surfaces 9236 engages the top edge of the hanger bracket. A draw rod 296 is inserted through an opening 9238 formed in one end of the draw block, with the head of the draw block disposed in the cavity formed in the draw block. An insert portion 9240 of the draw block is received in the channel 300 of the hanger bracket 72 so as to maintain the alignment of the draw block. The cavity 9232 has a height sufficient to accommodate the head of the draw rod and a lower portion 9252 of an insert 9250. The draw block includes a pair of engagement members 2942 that extend inwardly so as to form interior shoulders 9244 that define in part the cavity. The upper end of the draw block has curved exterior shoulders 9247 to facilitate the installation of the draw block by diminishing the footprint thereof. The engagement members are spaced to form an opening 9246, preferably formed as a slot, in the end of the draw block that communicates with the cavity. The opening is further enlarged in a circular pattern 9248 above the opening in the other end of the draw block, which also communicates with the cavity, so as to allow the head of the draw rod, or a tool, to pass through the opening and be disposed in the cavity formed in the draw block. As explained above, the draw block 9230 can engage hanger brackets on adjacent, serially aligned wall panels, or can engage a wall panel and a top edge of a corner or connector post.

Referring to FIGS. 178 and 185, an insert 9250 includes a lower portion 9252 forming a pair of engagement members 9254. A neck portion 9256 connects the lower portion to a connector portion 9258, and defines an upper and lower pair of shoulders 9260, 9262. The neck 9256 is dimensioned to be slideably received in the slotted opening 9246, 9218 formed in the draw block 9200, 9230 such that the lower portion 9252 is removeably received in the cavity. In this position, the shoulders 9262 formed by the engagement members of the insert engage the shoulders 9216, 9244 formed by the engagement members of the draw block so as to prevent vertical movement or separation of the insert and draw block in response to a tensile force applied thereto. In one embodiment, shown in FIG. 177, the shoulders 9244, 2962 are tapered to form opposing draw surfaces. Likewise, the upper shoulders 9260 of the insert engage the top of the draw block to support the insert on the draw block such that it does not drop down into the cavity. In the embodiment shown in FIG. 177, the insert includes a stop portion 9264 that defines the upper shoulders 9260, with a connector portion extending upwardly therefrom. The connector portion 9250 is received in the channel 300 formed in the hanger bracket 72, and includes a threaded opening 9266 formed in an end thereof.

In an alternative embodiment, shown in FIGS. 215 and 216, a draw block 9217 is shown as joining a belt-line lower wall panel and an upper wall panel. The draw block includes an upper portion 9219 having a cavity 9203, key-hole opening 9205 and shoulders 9213, 9215 as explained above. The draw block further includes a stem portion 9221 extending downwardly from the upper portion and terminating in a lower portion 9223, that is configured with draw surfaces 9202. The stem portion 9221 allows the draw block to be configured to span the distance between the upper wall panel and the lower belt-line wall panel. As shown in FIG. 215, a non belt-line wall panel is configured with a hanger bracket having an opening 9225 formed therein below the top edge thereof. The opening defines an edge 9227 in the hanger bracket that is engaged by the draw surfaces of the draw block 9217 as the draw block joins the lower wall panels. In particular, the draw block draw surfaces engage the upper edge of the hanger bracket on the belt-line lower wall panel and the edge 9927 of the hanger bracket on the non belt-line lower wall panel. A draw rod 296 has a head disposed in the cavity 9203 as the draw rod extends through the draw block stem and between the adjacent lower wall panels wherein it is engaged with a lower draw block 290 engaging the bottom edges of the hanger brackets 70 attached to each lower wall panel.

In installing the connector system, the draw block 9200, 9201, 9217, 9230 is engaged with the upper edge 298 of the hanger bracket 72 and a draw rod 296 extends between and connects the draw block with a lower draw block 290 engaged with a bottom edge of the hanger bracket 72 and an adjacent panel or connector post. In one embodiment, the insert 9250 is then slid into engagement with the draw block as the lower portion 9252 is received in the cavity 9210. Or in the alternative embodiment, the insert 9207 is inserted through the key-hole opening 9205 and is rotated such that the shoulders 9211 of the insert engage the opposing shoulders 9213 of the draw block. The draw block 9230, 9201, 9200 is then engaged with the upper edge 298 of the hanger bracket 72 of the first upper wall panel as the upper wall panel is disposed on the lower panel, and more preferably on the stanchion 8004. A draw rod 296 is inserted through the draw block 9230 and is threadably engaged with the threaded opening 9266 formed in the end of the connector portion 9258 of the insert. The draw rod 296 is tightened to clamp the first upper wall panel to the lower wall panel, and more preferably with the stanchion disposed therebetween. Alternatively, in the embodiment shown in FIGS. 220 and 221, the locking portion 9209 of the insert is rotated by the draw rod into the engaged position wherein the ends engage the stop 9213 or shoulders formed in the cavity.

As best shown in FIG. 177, a second upper wall panel can then be installed on the first upper wall panel, and more preferably, is installed on the stanchion 9030, 9270. An insert 9250, 9207 is slideably or rotatably disposed in the cavity 9232, 9203 of the draw block engaging the upper edge of the hanger bracket of the first upper wall panel. A draw block 280, 9201 is engaged with the upper edge 298 of the hanger bracket on the second upper wall panel. A draw rod 296 is inserted through the draw block 280, 9201 engaged with the second upper wall panel and is threadably engaged with the connector portion 9258 of the insert so as to connect the second upper wall panel to the first upper wall panel.

In a preferred embodiment, the stanchion 9270 is configured as a simple adapter block, shown in FIG. 176. The adapter block is disposed in the channel 940 secured to the top of the first upper wall panel. A hanger bracket insert 9300, shown in FIGS. 177 and 186–188, is secured to a front of the block with a pair of fasteners 9302. The block 9270 includes a pair of vertically oriented grooves 9272 that are dimensioned and spaced to receive a pair of flanges 9304 extending inwardly from the hanger bracket insert. The body 9306 of the hanger bracket insert has a substantially similar shape to the hanger bracket, and includes a pair of inwardly facing channels 9308, which define an outwardly facing channel 9310 therebetween. A plurality of slots 9312 is formed in the outer corners of the hanger bracket insert. The hanger bracket insert further comprises an upper and lower stop flange 9314, 9316 which engages the channel 300 of the hanger brackets 72 attached to the first and second upper wall panels respectively so as to prevent the adapter block 9270, with the hanger bracket insert 9300 attached thereto, from being pushed inwardly away from the end of the wall panels during installation. A lower portion of the hanger bracket insert is cut-away and forms an opening 9318 shaped to be disposed over the draw block, while the lower stop flange 9316 extends down behind the draw block. The connector portion of the insert 9258 is disposed in the channel 9310 of the hanger bracket insert.

In alternative embodiment, the second upper wall panel is simply connected to the first upper wall panel with the external draw block and draw rods, and with a pair of locator members 9041, otherwise referred to as stanchions, disposed between the upper wall panels, as described above.

Referring to FIGS. 189 and 190, an alternative connector post assembly is shown that can be used to interconnect two or more lower wall panels, with one or more upper wall panels connected thereto, in a two-way, three-way or four-way configuration. The connector post assembly includes a lower corner, or connector post 320 and a first and second upper corner or connector post 9400. This stackable connector post assembly is preferably used to connect one or more stackable wall panel assemblies where pass-through capabilities between adjacent wall panels connected to the corner post assembly are important, e.g., for cables, wires and the like. In addition, the stackable connector post assembly provides the user with greater flexibility in reconfiguring various office spaces in that the various levels of the post can simply be removed rather than having to remove the entire post and replace it with a post of a different height.

A first and second spacer post 9450 are disposed respectively between the lower connector post 320 and the first upper connector post 9400 and between the first and second upper connector posts 9400. Referring to FIG. 191, a first embodiment of the connector post 9400 has a generally rectangular cross-section defined by four lobes or tubes. Each lobe has a longitudinally extending groove 9404 running along the length of the connector post. The groove 9404 is shaped and configured to receive a portion of a cover member. The lobes 9402 are spaced from each other to form longitudinally extending channels 9406 that are dimensioned to receive a portion of the draw rod 296. Each lobe 9402 includes a pair of upper and lower outer edges 9408, 9410, with the upper edges 9408 being engaged by draw blocks 9230 that also engage the upper edges of the adjacent hanger bracket. The four lobes are connected by a center tube 9413. A pair of lugs 9412, 9414 extend inwardly from the tube, with a first lug 9412 having a greater inner diameter than the second lug 9414.

In an alternative embodiment, best shown in FIG. 192, four lugs 9412, 9414 extend inwardly from the tube, with pairs of smaller and larger diameter lugs offset from each other respectively.

In yet another alternative embodiment, best shown in FIGS. 223–225 and 227, the upper connector posts 9276 are of the same construction as the lower corner post 320, as describe above. An upper and lower plate member 9251, 9253 are recessed in the top and bottom end of the corner post tube, and is preferably disposed in grooves 9255 formed on the channels 333 as the two pieces of the corner tube are brought together. The outer peripheral edge 9257 of the plate forms eight gaps 9259 or opening between the four edges of the plate and the inner surfaces of the eight channels 330. The plates also can be welded to the tube, or otherwise affixed by methods known in the art. The connector plates are configured with two larger diameter diagonally opposed holes 9261 shaped and dimensioned to allow the draw rods to pass therethrough. The connector plates are further configured with two smaller diameter diagonally opposed holes 9263, which are threaded and dimensioned to be threadably engaged by the end of the draw rod. The plates are further configured with a centrally located hole 328 configured to engage a light seal post member.

Referring to FIGS. 193 and 194, a first embodiment of a spacer post 9430 includes a body 9432 and a pair of end portions 9434, with the end portions separated from the body by an annular shaped stop flange 9436. Preferably, the spacer post, and its various portions, has a generally cylindrical configuration. The body and end portions each have a pair of longitudinally extending channels 9438 formed along a length thereof on opposite sides thereof. The flanges likewise each have a slot 9440 that is generally aligned with one of the channels. On the opposite side, a pair of vertically aligned openings 9442 are formed in the flanges and are positioned within the channel 9438.

In an alternative embodiment of the spacer post, shown in FIGS. 195–197, the body 9450 and end portions 9452 are configured as cross-shaped members. The stop flanges 9456, 9458 each have four openings formed therein between the cross-shaped members. A first flange 9456 has four openings 9460, 9456, 9458 each having the same approximate diameter. The second flange 9458 has two larger and two smaller openings 9462, 9460, with the pairs of larger and smaller openings offset from one another. The larger openings allow the draw rod to extend therethrough.

In yet another alternative embodiment of the spacer post 9273, shown in FIGS. 223–225, the end portions 9265 of the spacer post are configured as support platforms with a plurality of fingers 9267, shown as eight, extending upwardly and downwardly from the upper and lower platforms 9265 respectively. Each support platform is provided with diagonally offset larger openings 9269 and diagonally offset smaller openings, with the larger openings 9271 in the upper plate being aligned with the smaller openings in the lower plate.

During installation of the connector post assembly, a spacer post 9430, 9450, 9273 is first connected to a bottom of the first and second upper connector posts 9400 with one or two fasteners 9470. In the two-holed embodiment, the fastener 9470 is inserted through the slot 9440 or opening 9442 in the upper flange 9436 of the spacer post 9430 and is threadably engaged with the smaller diameter lug 9414 formed in the bottom of the upper connector post. In the four-holed embodiments, the spacer post 9450 is secured to the upper connector post with a pair of fasteners 9470 that extend through the holes 9460 in the flange 9456 or support platform and engage the smaller diameter lugs 9414 formed in the center tube. In the embodiment shown in FIGS. 223–225, the fingers 9267 are further received in the openings 9259 formed between the edges of the connector plate and the inner surface of the connector post channels.

The upper connector post, with the spacer post connected thereto, is then disposed on the lower connector post. Depending on the embodiment being used, one or two draw rods 296 are then inserted through the larger diameter lug(s) 9412 or openings 9261 adjacent the top of the upper corner post. The draw rod(s) 296 extend through the upper connector post and through the spacer post 9430, 9450, 9273 and are threadably engaged with a threaded opening formed in the top of the lower connector post, preferably in a plate secured and recessed in the end thereof. In a first embodiment, the draw rod 296 is received in the channel 9438 formed in the spacer post and extends through the slots 9440 or openings 9442 formed in the flanges. In the other embodiments, the pair of draw rods 296 are disposed in the spaces formed between the adjacent walls of the cross-shaped members forming the body and end portions of the spacer post and extend through the openings 9460, 9462, 9269 formed in the flanges. The draw rods 296 threadably engage a pair of openings formed in the lower connector post.

A second upper connector post is secured to the first upper connector post in a like manner. In particular, draw rod(s) 296 extends through a second upper connector post and a second spacer post 9430, 9450, 9273, in the channel 9438 or space between the cross-shaped members formed opposite the opening(s) occupied by the fastener(s) 9470 securing the second spacer post to the second upper connector post. The draw rod(s) 296 engage the opening(s) 9414, 9271 opposite the opening(s) 9414, 9269 in the top of the first upper connector post opposite those occupied by the draw rods securing the first upper connector post to the lower connector post.

As shown in FIG. 223, a taller spacer post can be used in a belt-line stackable wall assembly, while a shorter spacer post can be used in a non belt-line stackable wall assembly.

As shown in FIGS. 189 and 190, a light seal 9480, having a similar outer shape as the connector posts, can be disposed about the spacer posts so as to prevent light from seeping from one side of the wall panel assembly to the other.

Draw blocks engage the upper edges of the first and second connector posts as they connect the connector post assembly to first and second upper wall panels respectively, as discussed above, together with draw rods that are received in part in the channels 9406 formed between the lobes 9402, or in the channels 333 formed in the connector post. It should be understood that, on those sides to which no wall panels are secured, the connector post assembly can be covered with various cover members as described above.

In yet another embodiment, a corner post 9291 has a height equal to the combined height of the lower and one or more upper wall panels. Referring to FIG. 226, for example, the corner post includes one or more windows formed in the sides thereof that define an edge 9287, 9289 which can be engaged by a draw block secured to an adjacent wall panel. Preferably, at least two and preferably three windows are provided at each level of stackability. For example, an upper window 9281 defines an edge 9287 that is engaged with a draw block engaging the top edge of a hanger bracket secured to a non belt-line lower wall panel. A middle window 9285 defines an edge 9293 that is engaged with a draw block engaging a top edge of a hanger bracket secured to a belt-line wall panel. The lower window 9283 defines an edge 9289 that is engaged with a draw block engaging an even shorter wall panel. The window 9285 is slightly shorter than the other windows since it need only accommodate the lower portion 9223 of draw block 9217, rather than the entire draw block 9201.

Referring to FIG. 227, an alternative embodiment of a draw block 7001 includes opposite side flange members 7003 defining a pair of draw surfaces 7005, preferably formed at an angle of about 80 degrees. The draw block further includes front and back flanges 7007 terminating in an end portion. In operation, the draw surfaces 7005 engage the top edge of the corner post, while the flange 7007 extends into the channel 333. The draw block is preferably made of steel that is stamped or formed to form the various flanges. In this way, the draw block can be made inexpensively. Preferably, the hole in the top of the draw block is not threaded, but rather receives the draw rod. However, it should be understood that the hole could be threaded such that the draw block can serve as a lower draw block.

A lower draw block 7021 is shown as including an upwardly extending support flange 7023 having an opening 7029 and a laterally extending base portion 7025 having a vertically extending opening 7031. A pair of tabs 7027 extend laterally outward from each side of the body portion. The flange 7023 is shaped and dimensioned to be received in the channel 333 formed in the corner post. A fastener secures the flange to the channel, although it should be understood that the draw block could be secured by welding, adhesive and the like. The tabs 7027 are received in openings 7033 formed in opposing corners of the channels 330. A draw rod 296 has a head engaged with an upper draw block 7001 and extends to and is threadably engaged with the opening 7031 formed in the body portion of the draw block. The upper draw block engages an adjacent stackable panel so as to connect the stackable panel to the corner post. It should be understood that the stackable panels can come in different heights, e.g., 14 inches and 28 inches. Preferably, however, the draw rods used to connect the stackable panels have only one length.

Accordingly, when a taller upper stackable wall panel is secured to an adjacent corner post or a taller wall panel, a lower draw block 7021 is secured to the corner post or taller wall panel, and is subsequently engaged by a draw rod connecting an upper draw block engaging the stackable wall panel and the corner post or taller wall panel and the lower draw block. Alternatively, when a shorter upper stackable wall panel is secured to the corner post or taller wall panel, the draw rod connects the upper draw block 7001 and one of the various draw blocks 9200, 9201, 9217, 9230, which are engaged between the corner post and the lower wall panel.

Referring to FIGS. 228 and 229, the change-of-height draw block 460 is made of two pieces and includes a U-shaped member 7043 having a pair of hook members 464 formed on opposite side portions thereof. An upper block portion 7041 includes opposite shoulders 7045 that engage the top edge 7047 of the U-shaped member. Crush ribs 7053 are formed on the side of the upper block portion and help secure the member 7043 to the block portion with a friction fit. The block portion includes an opening shaped and dimensioned to receive the draw rod, with a landing 7051 for engaging the head of the draw rod. A recess is formed around the opening and is shaped to receive the draw rod head.

In operation, as shown in FIG. 229, the hook members 464 engage the slots 7061 in the hanger bracket. The draw rod 296 is then inserted through the opening 7049 in the block portion and is threadably engaged with a lower draw block 7021 so as to clamp the block portion to the U-shaped member 7043 and with draw surfaces 7071 formed on the block portion engaging an adjacent wall panel, and in particular, the upper edge of a hanger bracket. The lower draw block 7021 is secured to the hanger bracket with a fastener 7081, and with the tabs 7027 disposed in opposing slots 7033 formed in the corners of the hanger bracket channels 72.

The construction of the frame members and panel, as described above, is ideally suited for improved manufacturability of the wall panel. In one embodiment, the method for making each vertical frame member includes providing a core member 28, a hanger bracket 70 and a pair of sidewall members 34, each having an edge portion 40 with an outer leg 118 having an outer surface. The hanger bracket 70 is attached to the outer surface 50 of the core member as discussed above.

Figure 50:
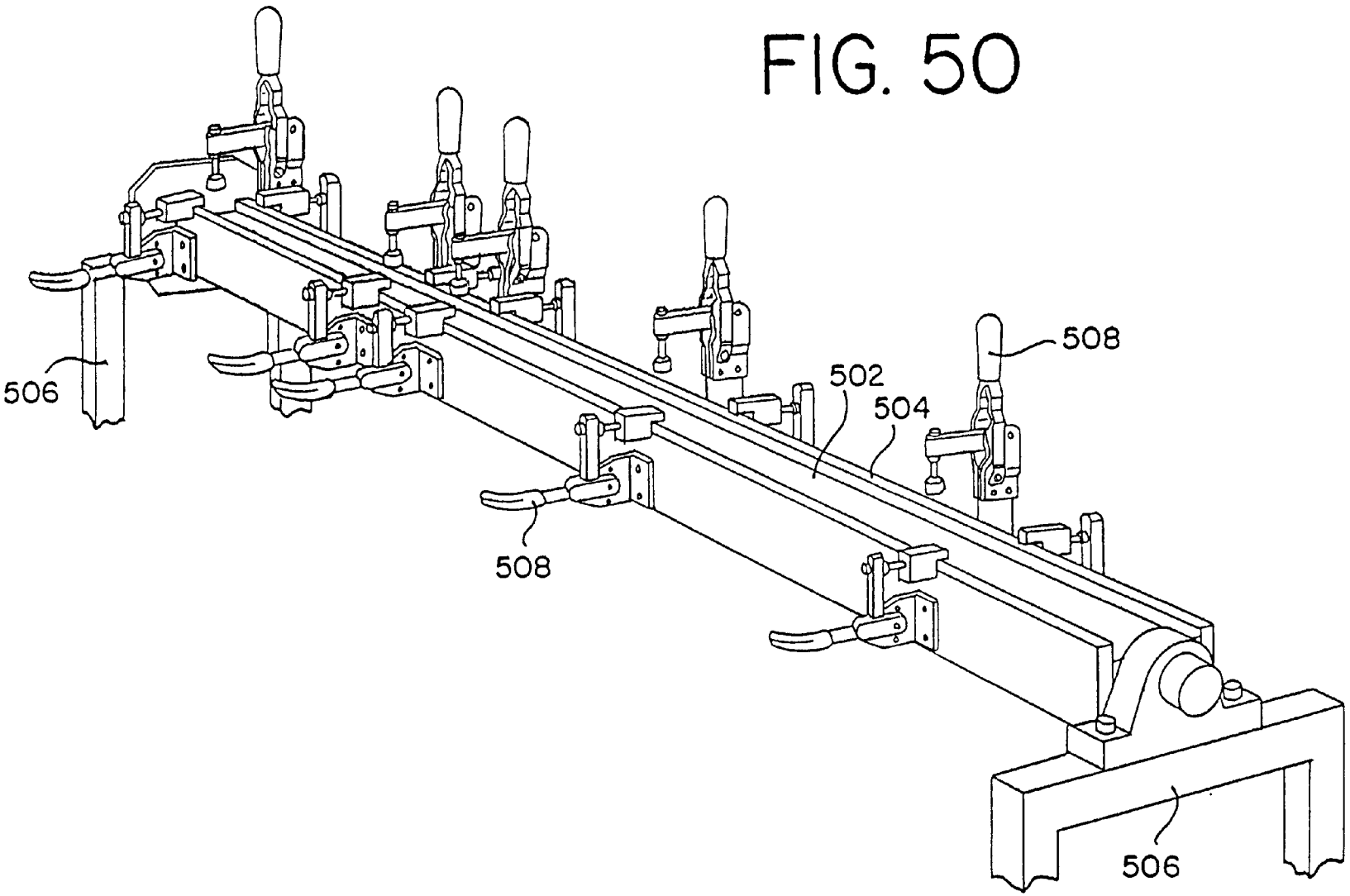
FIG. 50 is a perspective view of a vertical side frame member tool fixture.
Figure 51:
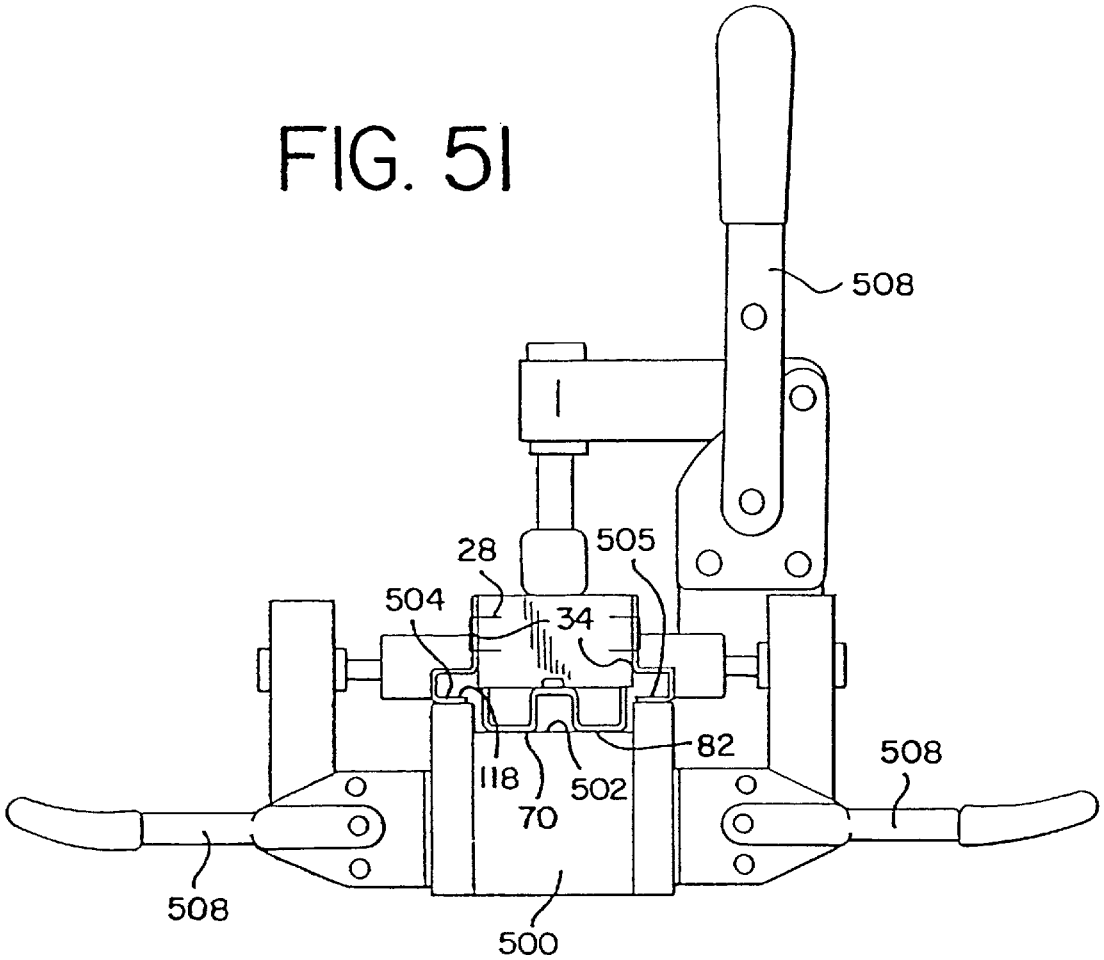
FIG. 51 is an end view of the side frame tool fixture with a side frame member installed therein.

Referring to FIGS. 50–51, the core member 28 and hanger bracket 70 are placed in a fixture 500, which has a first surface 502 spaced apart from a second and third surface 504, 505. The fixture 500 is rotatably attached to supports 506 at each end of the fixture 500. In this way, fixture surfaces can be provided on opposite sides of the same fixture for different frame members. The fixture is simply rotated so that the surfaces to be employed are accessible to the assembler.

As illustrated in FIG. 51, the core member 28 and hanger bracket 70 are positioned in the fixture such that an outer surface of the hanger bracket engages the first surface 502. The sidewalls 34 are then inserted into the fixture 500 on opposite sides of the core member. The ends of the sidewalls and the ends of the core member are positioned relative to each other in the fixture using a locator pin as the outer leg 118 of the edge portions of the two sidewalls engage the second and third surfaces 504, 505 of the fixture respectively. The core member, hanger bracket and sidewalls are clamped together in the fixture using a plurality of clamps 508. The sidewalls are then attached to the core member with a plurality of fasteners, preferably staples. Alternatively, the sidewalls can also be bonded to the core member using a suitable adhesive, or bonded and mechanically fastened.

It should also be understood by one skilled in the art, that various aspects of the assembly process can be automated. For example, the hand clamps shown in FIG. 51 can be replaced with pneumatically controlled clamps. Similarly, the fastening process can be automated, whereby the application of adhesive and stapling is done automatically.

By using a fixture as just described, the distance between the outer surface of the hanger bracket and the outer leg of each sidewall can be maintained as a relative constant with relatively tight tolerances. Thus, when two panels are installed end-to-end, the gap between adjacent opposing sidewalls will be maintained with tight tolerances so as to provide a uniform appearance when viewing a system of interconnected wall panels. In essence, the gap at each joint between adjacent panels is maintained as a relative constant. Moreover, this method of manufacture ensures that the slotted portion of the hanger bracket is always maintained a constant distance from the outer leg 118 of the sidewall edge portion. Thus, the user is ensured that components can be consistently installed on the hanger bracket without having to force the component past a protruding sidewall.

Another advantage of this method is realized when different thickness fabrics are installed on the panel. Typically, when a thicker fabric is installed on one panel, the fabric fills more of the gap between connected panels, and can therefore interfere with the installation of components on the hanger brackets, as well as creating a displeasing appearance as between adjacent joints. With the current construction, the distance between the first and second and third surfaces in the fixture can be altered to provide more or less distance between them so as to accommodate thicker or thinner fabrics respectively.

Figure 52:
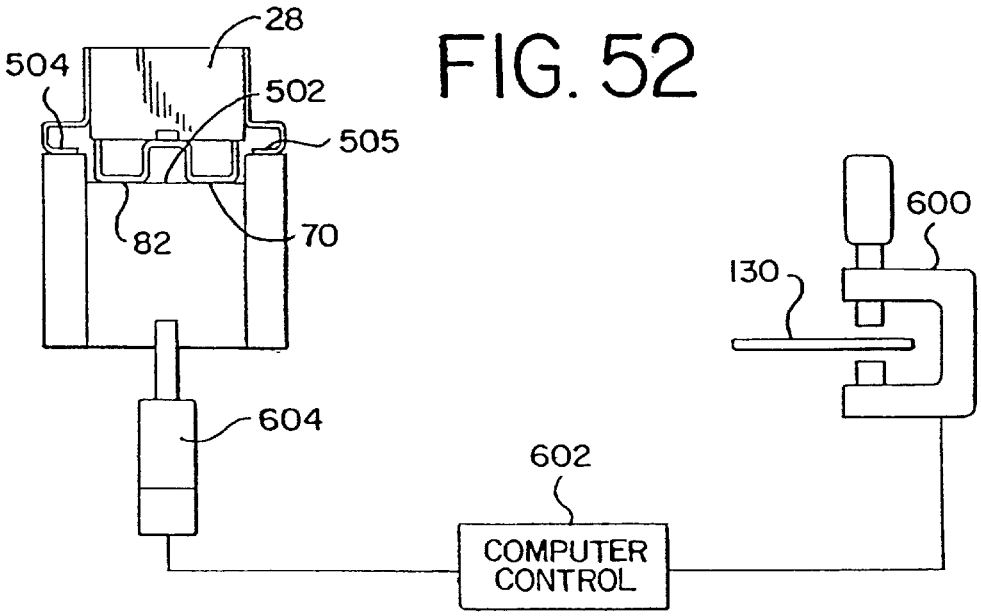
FIG. 52 is a schematic of an automated tool fixture for assembling the side frame member.

Referring to FIG. 52, a scanner 600 or caliper can be used to measure the thickness of the fabric 130 being installed and provide that data to a computer. The computer 602 employs logic and actuates a servo motor 604 that changes the relative distance between the first and second and third surfaces so as to provide a uniform gap between panels once the fabric is installed. It should be understood that actuators could alternatively be used to adjust the second and third surfaces relative to the first surface. In this way, the second surface could be spaced a greater distance from the first surface than the third surface is from the first surface so as to accommodate two different thickness fabrics on each side of the panel. For example, it may be desirable to employ a heavy thick fabric on the outside wall of a panel system forming a walkway which experiences a lot of abuse, while providing a thinner fabric, for reasons of color selection etc., on the inside wall of the system forming the workspace.

Another advantage is realized by using a wooden core member in each of the frame members in that the sidewalls can be attached extremely fast and inexpensively with staples, rather than by expensive welding or mechanical screw and bolt type fasteners.

Figure 53:
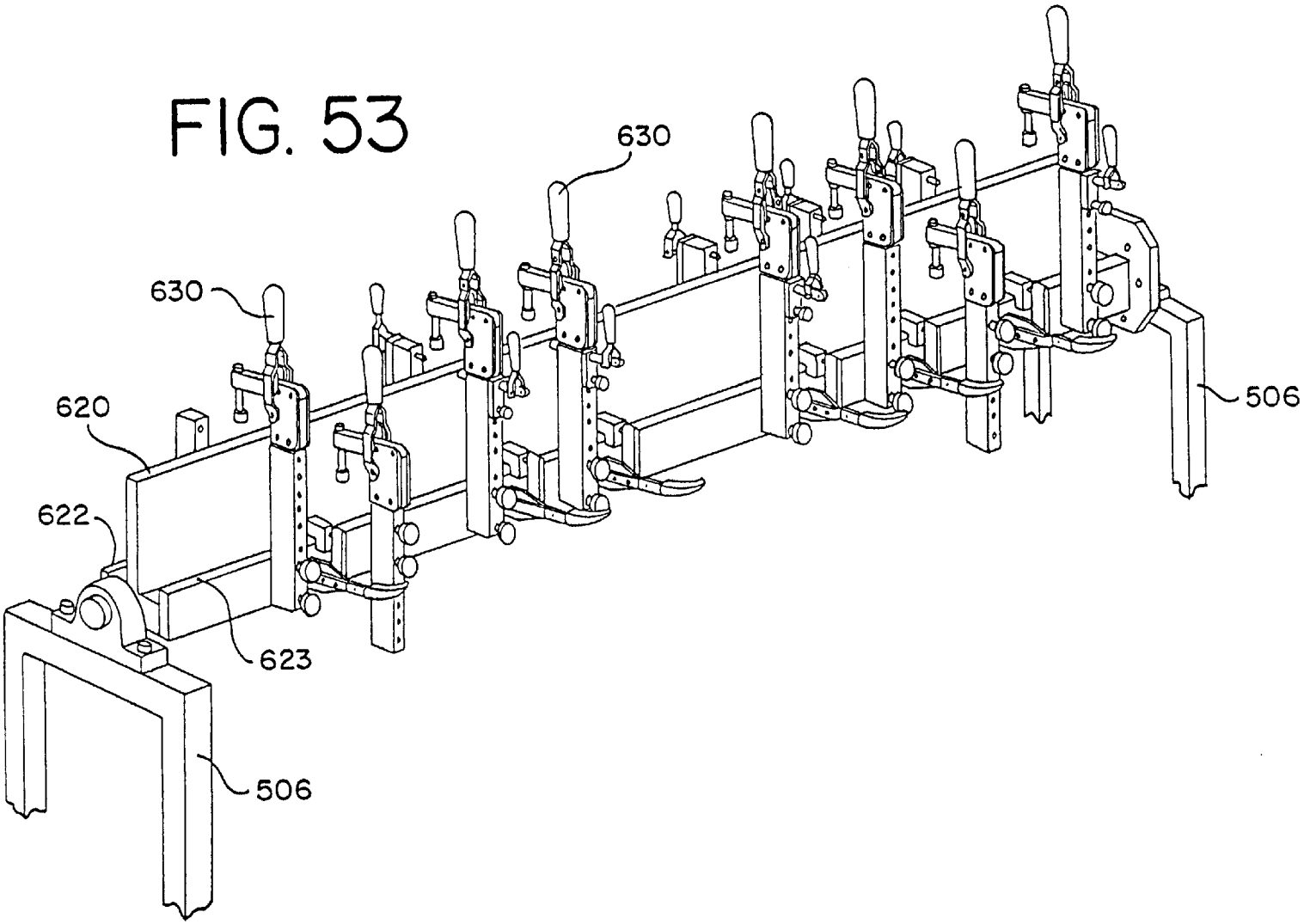
FIG. 53 is a perspective view of an upper and lower frame member tool fixture.
Figure 54:
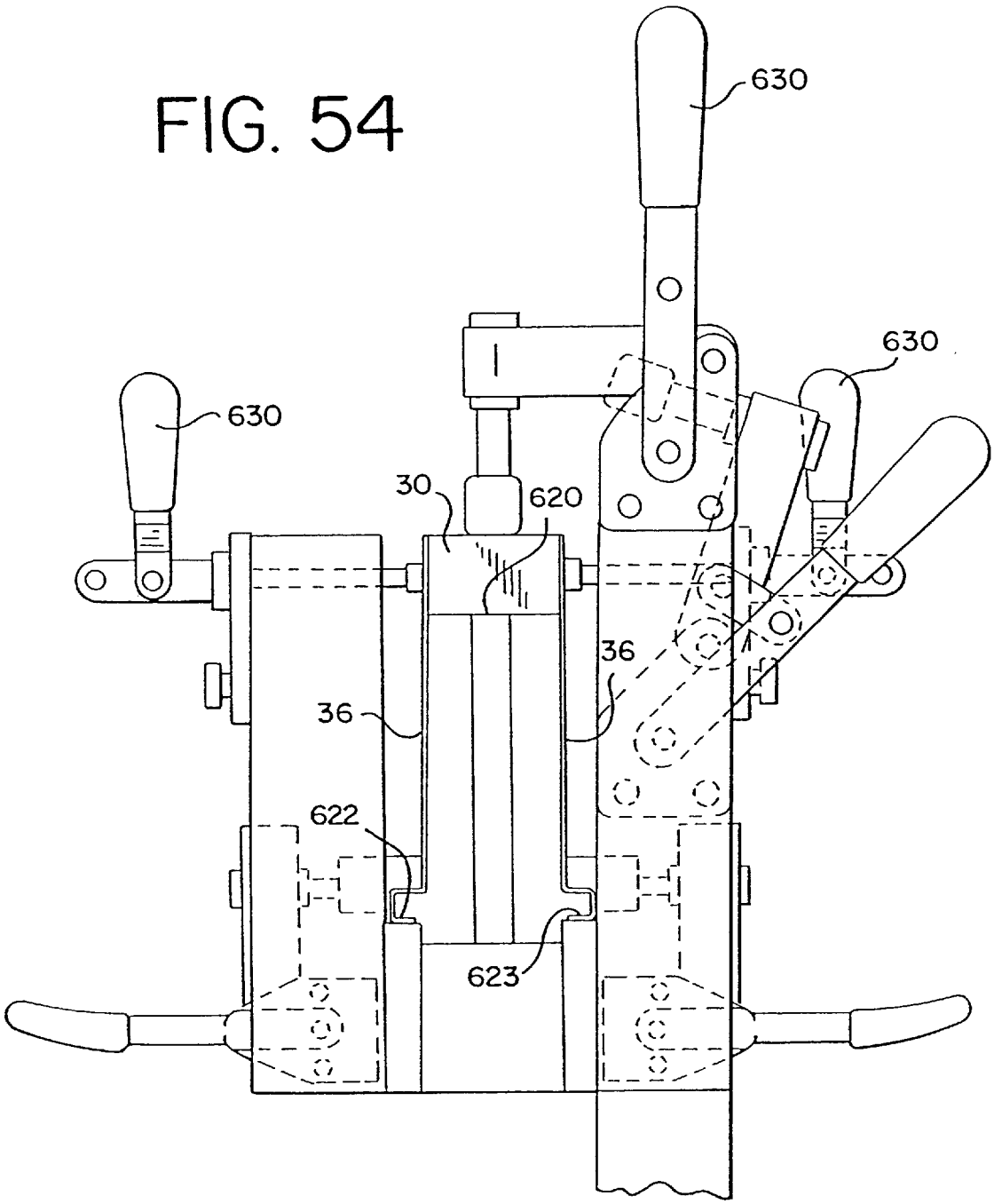
FIG. 54 is an end view of the upper frame tool fixture with an upper frame member installed therein.

The upper and lower frame members are made in a similar manner, except that the first fixture surface 620 engages the core member rather than the hanger bracket as shown in FIGS. 53–54. The sidewall members are installed so that the outer legs 118 engage the second and third fixture surfaces 622, 623 respectively The bracket and mounting strip are installed on the outer surface of the lower core member with mechanical fasteners. The groove 33 positioned along the bottom of the bottom core member allows space for ends of a tool locator which positions the bracket and mounting strip relative to the bottom of the panel.

Figure 55:
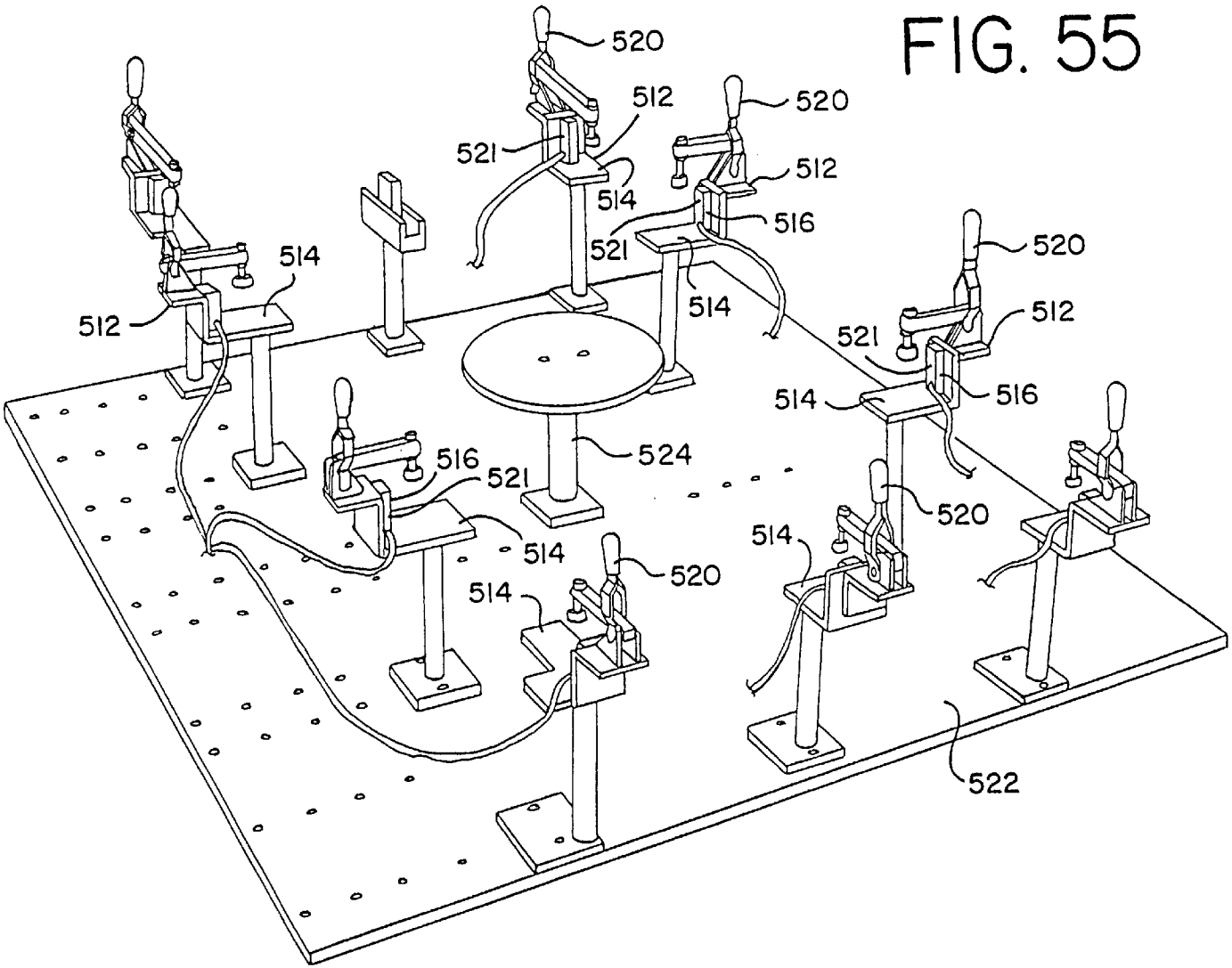
FIG. 55 is a perspective view of the wall panel assembly fixture.
Figure 58:
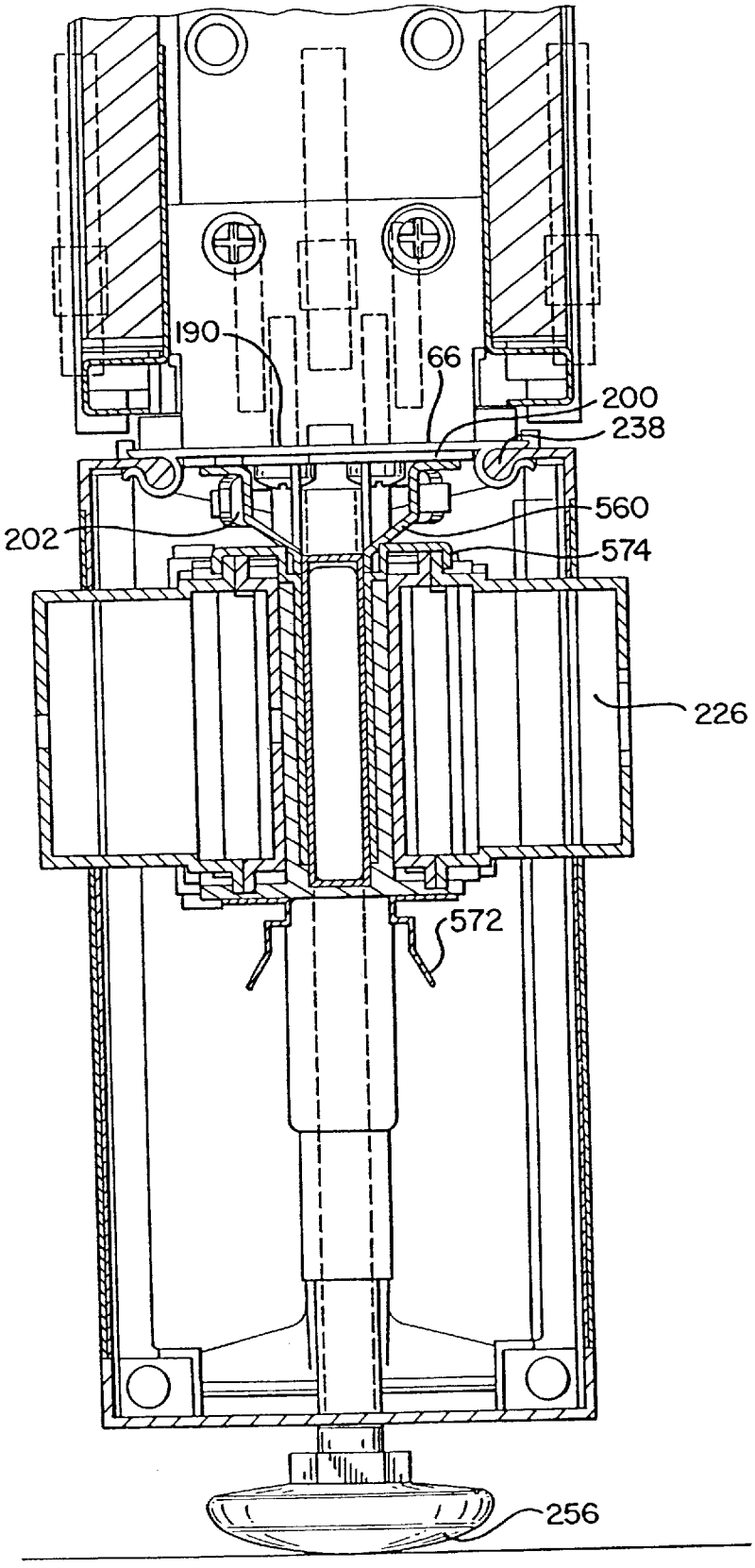
FIG. 58 is an end view of a wall panel with a power distribution server attached to the bottom of the wall panel as taken along line 58—58 of FIG. 31.

A method is also provided to assemble the wall panel. The method includes providing a plurality of fixtures 512 having horizontal surfaces 514 and vertical surfaces 516. The fixtures 512 are arranged in a rectangular configuration on a bed 522, as shown in FIGS. 55–56. A pedestal support 524 extends upwardly from the bed in the middle of the fixture arrangement. Each fixture is provided with a clamp 520. Adhesive is applied to the inner surface of one of the wall members around its edge. The wall member is then placed on the horizontal surface 514 of the fixtures with the inner surface facing upward. The pedestal support 524 supports the outer surface of the wall member. The four frame members, i.e., the vertical frame members 14 and the upper and lower frame members 16, 18, are placed in the fixtures such that the sidewalls 34, 36, 38 of each frame engage the fixture surfaces oriented around the panel. The sidewalls of the upper frame member are pinched together and inserted between the upwardly extending sidewalls 68 of the vertical frame members and then released so that the sidewalls overlap. Similarly, the outwardly extending sidewalls 38 of the lower frame member are overlapped with the exposed core of the vertical frame members 550. The vertical surfaces 516 of the fixture are magnetized with magnets 521 to attract and hold the frame members to the vertical surfaces 516.

A partition member 140, with adhesive applied to the mounting flange 142, is then installed at each end of the panel by bonding the mounting flange to the inner surface 122 of the wall member. The boundary flange 144 extends away from the wall member to form the vertical channel 108. Because the partition member is preferably made of cardboard, it can be easily installed by bonding rather than be welding or mechanically fastening as would typically be required for metal or wood partitions.

Adhesive is applied to both sides of the honeycomb filler member 150 and it is disposed inside the frame on the inner surface 122 of the wall member 120. The filler member 150 substantially fills the space between the upper and lower frame members and between the two partition members. In a preferred embodiment, an outlet box 270 is mounted to a hardboard base plate with a fastener. The base plate is adhesively bonded to the inner surface 122 of the wall member. One of a portion of the partition member or filler material is removed to allow the outlet box to be installed on the inside of the frame. The outlet box can be installed between the partition members, or such that one side of the box is aligned with the partition member to thereby provide a wall defining the inner surface of the vertical channel. The conduit 276 connecting the outlet box to the power system is disposed in the vertical channel and extends through the space between the bottom core member and the vertical core member.

Adhesive is applied around the edges of the inner surface 122 of the second wall member. The wall member 120 is positioned in the recess formed on a second side of the frame by the edge portions of the sidewalls. When an outlet box has been installed on the first wall member, a hole is cut in the second wall member so as to be substantially aligned with the outlet box once the second wall member is installed. The two wall members and frame are clamped together and to the fixtures. A staple gun, preferably a dual action staple gun 640 accessing both sides of the panel simultaneously, as shown in FIG. 56, is used to mechanically fasten the two wall members to the four frame members, and in particular, to staple through the wall member and sidewall member and into the core member. Fasteners are also installed in the overlapping portions of the upwardly extending vertical sidewalls, the sidewalls of the upper frame member and the wall member, as described above. As described above, it should be understood that various aspects of this assembly process could be automated. For example, the clamping could be pneumatically controlled, and the positioning of the wall members, filler member, partition members and frame members could be automated.

Because the core members are preferably made out of wood, the wall members can be easily and cheaply secured to the frame. This construction avoids the use of expensive and time consuming welding operations and/or the use of expensive screw and bolt type fasteners.

The support leg is installed by press fitting the upper portion of the leg into the opening between the bracket and core member. The foot member is attached to the leg member.

The barrier sheet is disposed on both sides of the wall panel, and is either adhesively or mechanically attached to the wall member or the frame members. Alternatively, the barrier sheet can be wrapped around the edge portions of the sidewall members underneath the decorative sheet, which secures the barrier sheet to the wall panel, as shown in FIG. 47A.

Next, the decorative sheets are installed by disposing a sheet on each side of the panel and attaching the strip to the edge portion of each sidewall as described above, including the steps of tucking the excess fabric corner patch located at the corners into the edge portion channel and inserting a flexible corner block into each corner to secure the fabric in the channel.

It should be understood that all of the aforementioned steps of manufacture can be interchanged without departing from the spirit and scope of the invention. As such, it is intended that the foregoing order of steps be regarded as illustrative rather than limiting.

Additional steps can be included to accessorize the panel. For example, a top cap typically is installed on each panel. In addition, the power distribution system can be installed by attaching the power distribution server, including the receptacle modules and harnesses, to the bracket on the bottom of the lower frame member. In addition, the base cover can be installed on the mounting strip to conceal and protect the power distribution system. The base cover is installed by securing the two sidewalls to the mounting strip attached to the bottom of the lower frame member.

In another aspect of assembly, a system is provided for assembling the core assembly 800 component shown in FIGS. 60 and 62 and the wall member 920 components shown in FIGS. 61 and 62 to form a wall panel, as shown in FIGS. 62 and 103. First, the top channel member 940 is attached to the upper horizontal frame member 816. The core assembly, with the attached top channel member, is then transported to a station where a pair of hanger brackets 70 are attached to the core assembly; one to each vertical side frame member 814.

It should be understood that the term "core assembly," as used herein, refers generally to an internal element of a wall panel that supports or is connected to at least one outer wall member. For example, the core assembly may include, but is not limited to, the constructions disclosed herein, including for example a frame having inner wall members attached thereto and a filler member. The core assembly may further include hanger brackets and a top channel. Alternatively, for the sake of the centering aspect described herein below, the core assembly may be comprised of a solid component, such as wood, or could be made of other materials, such as metal or plastic, including for example, a metal frame and/or wall members. It should also be understood that the term "core assembly" is also meant to encompass a single integral component, including for example, a single block of wood, notwithstanding the use of the term "assembly" in conjunction with the term "core."

In the exemplary embodiment, the core assembly 800, including the attached top channel member 940 and hanger brackets 70, is transported to a machine having at least a pair of fences driven by a pair of rack and pinion mechanism as shown in FIGS. 104–106 and 116–118. The core assembly 800 enters the machine leading with the top channel member 940 as it is carried by a pair of drive belts 1302 that run the longitudinal length of the machine and which are driven by a motor 1304. Preferably, the belts are V-belts that ride on pulleys. A referencing device 1306 includes two cylinders 1308, 1310 and a link member 1312. Preferably, the cylinders are air or gas driven (i.e., pneumatic) which are relatively fast and clean, although it should be understood that hydraulics could also work. In addition, mechanical linkages, including for example drive belts and the like, could also be provided to drive the link member.

The first cylinder 1308 is pivotally attached to a frame 1300 at horizontal axis 1316. A suitable cylinder is the cylinder 'A' Series Model #P3AM-0611C-CAA2 manufactured by NUMATICS. An extensible shaft 1314 extends from the first cylinder and is pivotally attached to the link, which is also pivotally attached to the frame at axis 1320. A support bracket 1322 is mounted to the link member. The second cylinder 1310 is mounted to the support bracket, and includes an extensible shaft having a locator member 1324 attached to the end of the shaft. A suitable cylinder is the cylinder model #F0311.24-M3 manufactured by BIMBA. The locator member 1324 includes a C-shaped channel member 1326 and a referencing block 1328 mounted inside the channel member 1326.

Figure 105:
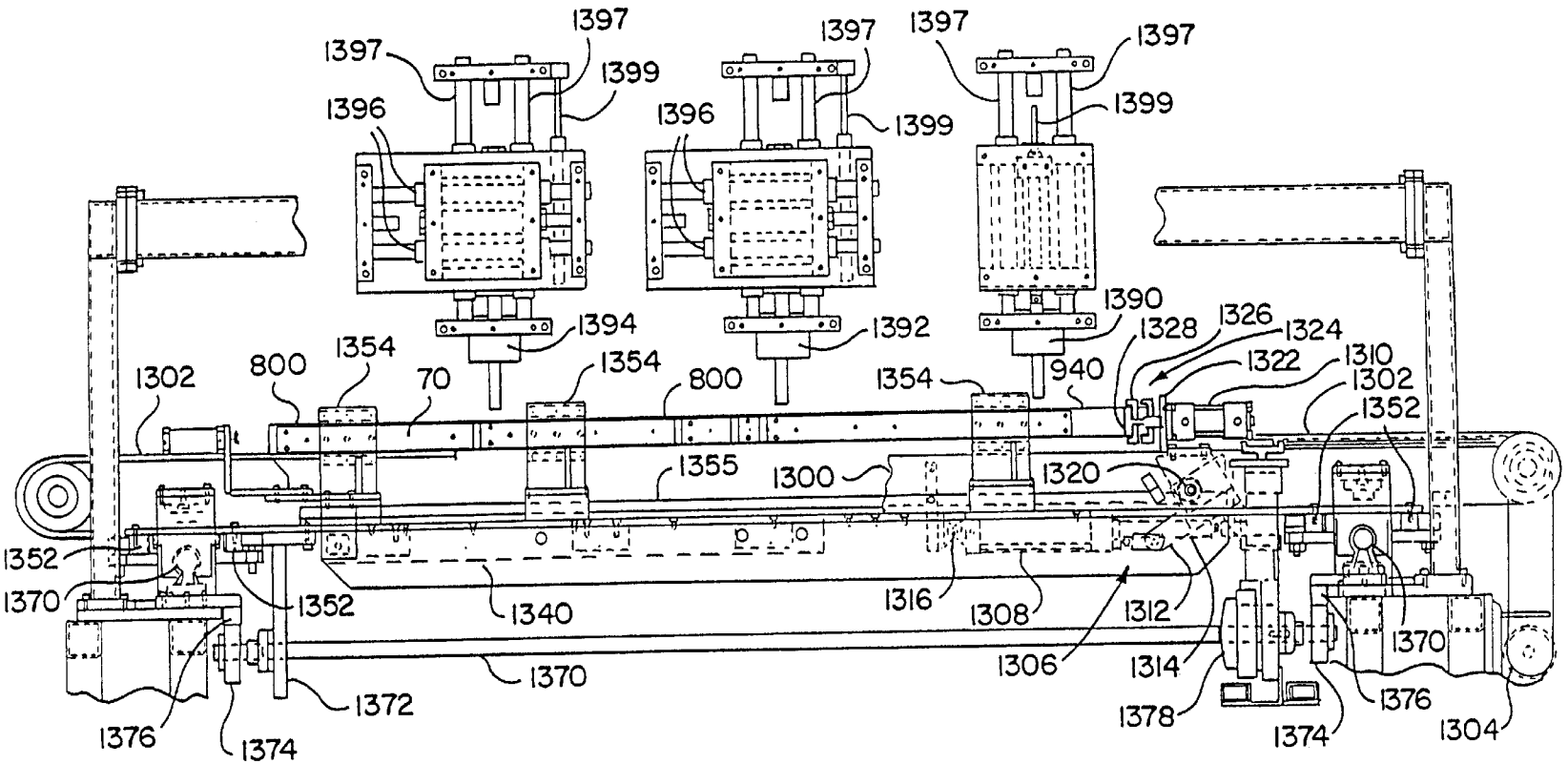
FIG. 105 is a partial side view of the machine shown in FIG. 104.

In operation, as shown in FIG. 105, the referencing device 1306 is moveable between a referencing position, where the device engages the core assembly, and a stored position, where the referencing device is moved below the plane of the upper belt surface of the belts 1302, which support the core assembly. The belts 1302 transport the core assembly out of the machine without interference from the referencing device when it is pivoted to the stored position. In one embodiment, the belts can transport the core assembly into and out of the machine at speeds of about 100 ft/min. In operation, the cylinder 1308 is actuated to retract shaft 1314 which rotates the link member 1312 counter clockwise about axis 1320, with reference to FIG. 105. As the link member 1312 is rotated about axis 1320, the support bracket, cylinder 1310 and locator member 1324 are pivoted from a vertical stored orientation (with the locator member facing upwardly) below the upper surface of the belts 1302 to a horizontal referencing orientation such that the channel member 1326 and referencing block 1328 are open to and face the incoming top channel member 940 of the core assembly as the core assembly is transported along the machine on belts 1302. The cylinder 1310 is actuated to extend the channel member and referencing block to engage the top channel member 940 of the core assembly. In particular, the referencing block engages the upper surface of the ridges 944 formed along the top channel member 940 while the channel member 1326, which is dimensioned to receive the top channel member 940, prevents the sidewalls of the top channel member 940 from spreading apart as the core assembly, and in particular, the ridges 944, are butted up against the reference block. In this way, the position of the core assembly from top to bottom in the machine is referenced for further operation, whereby successive core assemblies will have the same positioning of locator openings. One should understand that other referencing surfaces, or contacts, could also be used. For example, a referencing device could be provided to engage the bottom of the top channel member, or the outer most part of the sidewalls thereof.

After, or at the same time, the core assembly is referenced by the referencing device 1306, the fences 1340 are moved to center the core assembly in the machine whereinafter the locator holes are drilled and/or routed through the core assembly 800 adjacent the top and bottom of the core assembly along the centerline thereof. In particular, a pair of pinion gears 1350, each having a vertical axis of rotation, each engage a pair of parallel racks 1352 extending along opposite sides of the pinion gear. A suitable pinion gear is the model #NSS8P44 spur gear manufactured by Browning. The fences 1340 are attached to one corresponding rack 1352 on each end of the machine and are supported on linear bearings 1370 along each end. A suitable rack is the gear rack model #4NSR8X1¼X48 manufactured by Browning, while a suitable linear bearing is the combination of a pillow block (model #PB-24-OPN) and rail assembly (model #SRA-24) available from Thompson. Each fence includes a plurality of laterally opening C-shaped brackets 1354 that support the core assembly along its sides. Each bracket is shaped to receive the core assembly, including the hanger brackets attached therealong. The brackets 1354 are moveably secured to a track running longitudinally along the length of the fence.

In one mode of operation, one of the fences 1340 is pushed inwardly as it is supported by the bearings 1370 as the core assembly is situated on the locator member 1324. As the fence is pushed inwardly, the racks 1352, attached at opposite ends of the fence being actuated, rotate the pinion gear 1350 so as to simultaneously move the other pair of racks and attached fence on the opposite side of the core assembly. In this way, the core assembly is engaged on both sides by the fences, with both fences moving toward each other at equal rates and distances so as to center the core assembly in the machine. The actuated fence can be pushed inwardly by hand, or can be acted upon by a cylinder or other actuating device as explained below. Alternatively, the pinion gear can be actuated, by way of a belt, chain or hand tool, so as to simultaneously move both racks, and attached fences, to center the core assembly in the machine.

Figure 116:
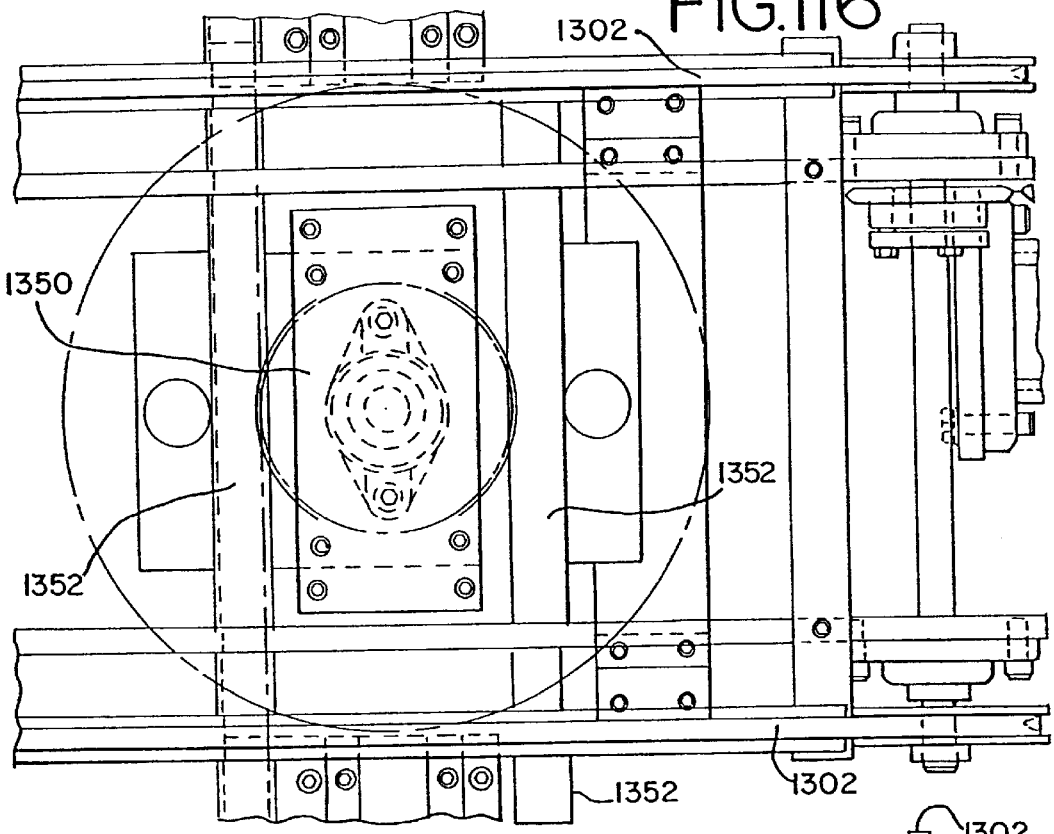
Figure 117:
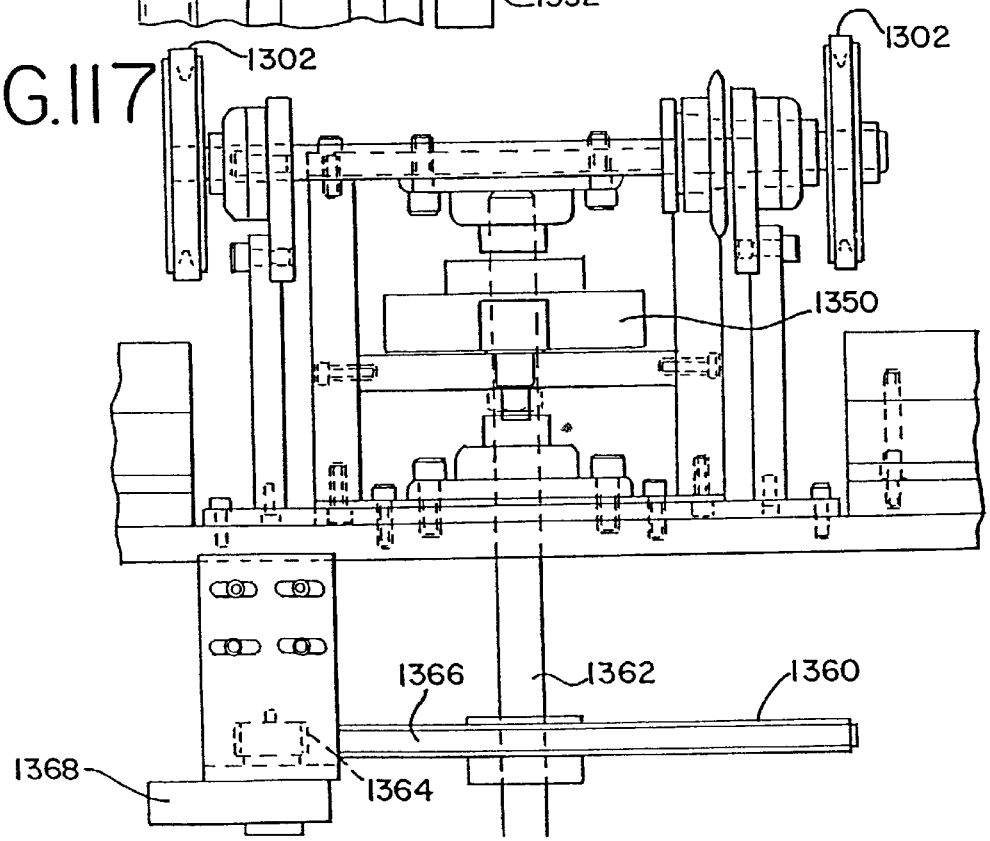
Figure 118:
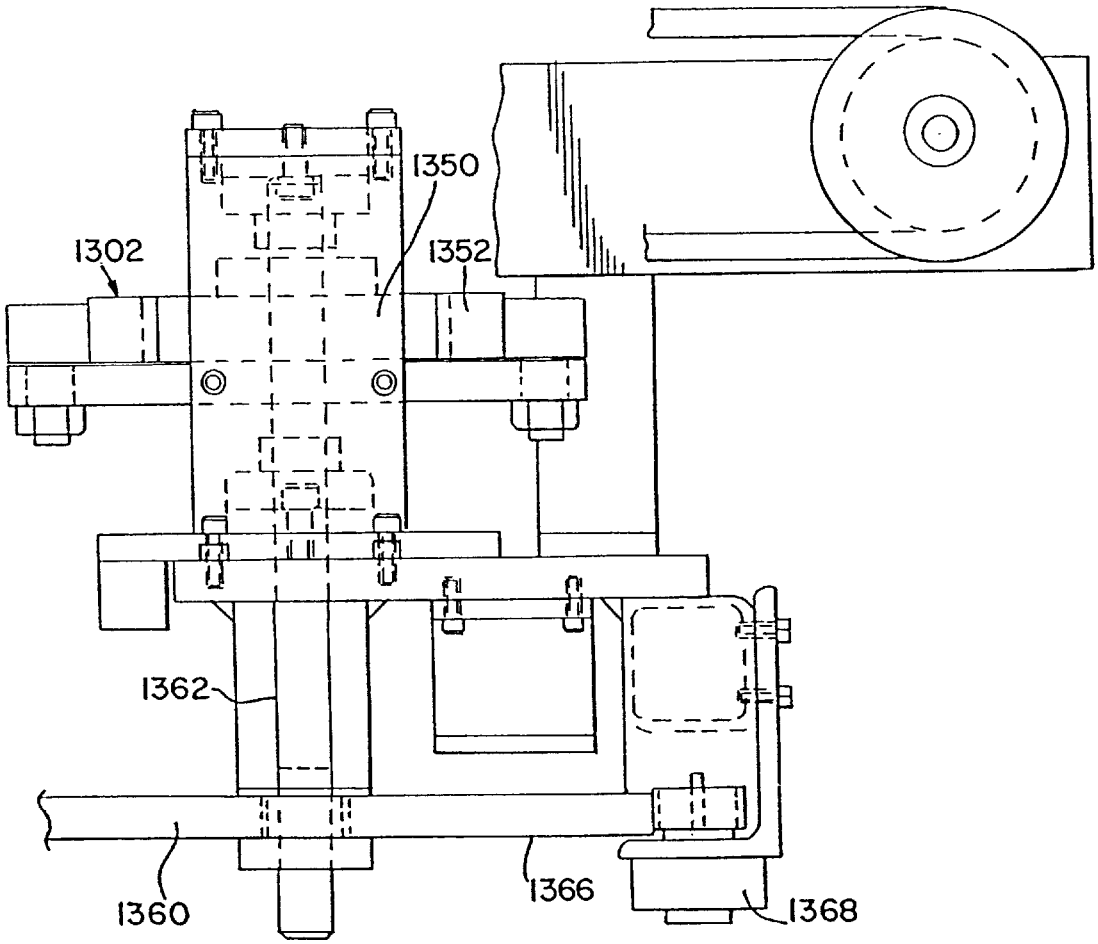

Referring to FIGS. 116–117, on one end of the machine, a gear 1360 is connected to the pinion gear 1350 positioned at that end with a shaft 1362. The gear 1360 is then connected to another gear 1364 with a belt 1366. The gear 1364 is attached to a shaft extending from an encoder 1368, or controller/sensor. As the fences move inwardly and the pinion gear 1350 rotates, the gear 1360 rotates the gear 1364 and spins the encoder 1368. The encoder can be programmed, or be connected to a computer, so as to allow a tool component to be activated for operation on the core assembly only if the encoder registers a rotation of the gear 1364 corresponding to a range of acceptable core assembly widths. In essence, the encoder detects whether the core assembly is too wide, or not wide enough, and prevents the tool component from being activated if the core assembly falls outside the range. The encoder, or computer, can also be programmed for several different ranges corresponding to various core assembly widths. One suitable encoder is an Allen-Bradley encoder model #845TK-F2500-25.

Figure 106:
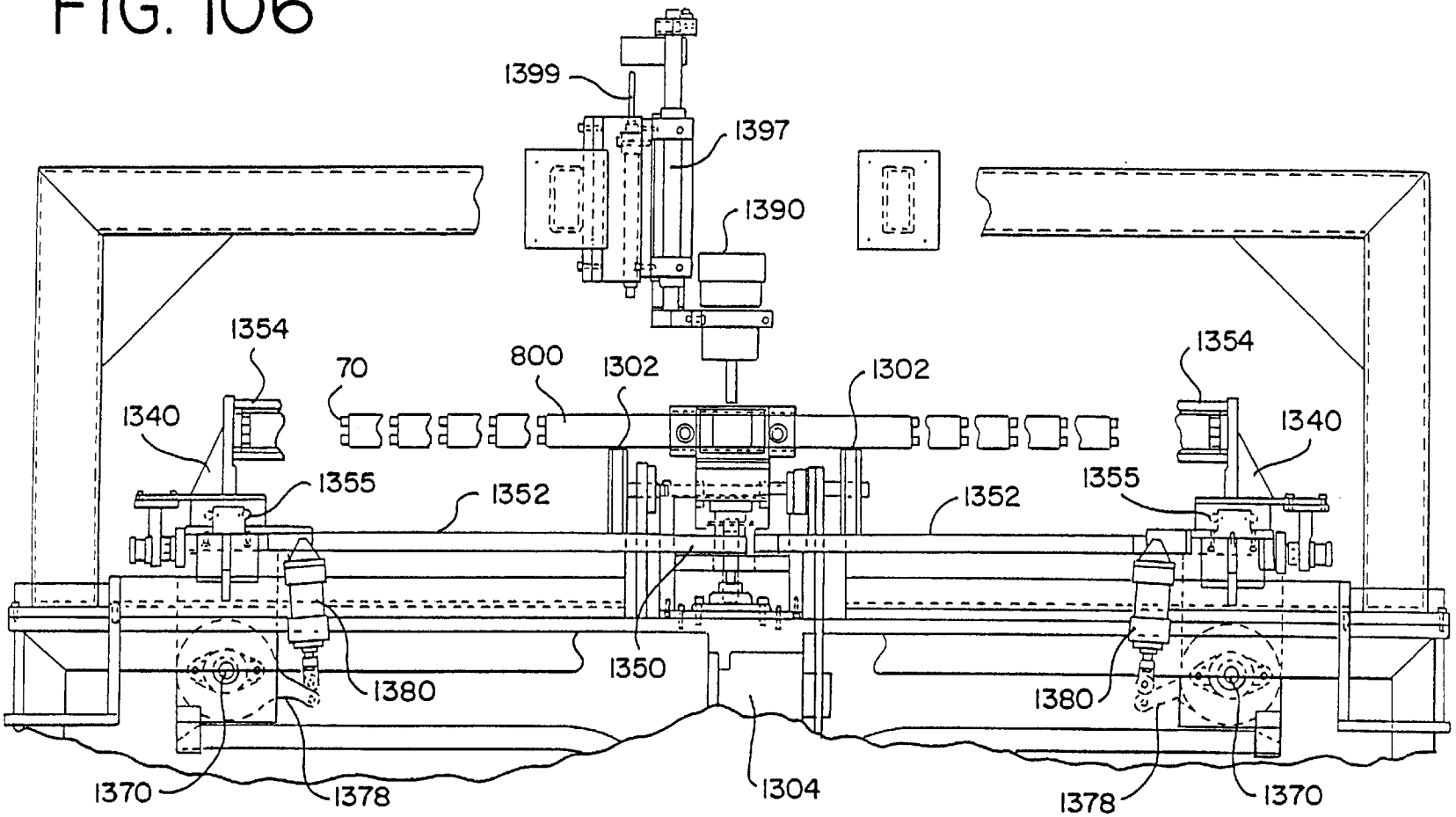
FIG. 106 is a partial end view the machine shown in FIG. 104.

In addition to the movement of the fences being controlled by the corresponding movement of the racks attached to each end thereof, the machine can also be configured with a pair of shafts 1370 that are located beneath the fences and extend longitudinally along the length of the machine, as best shown in FIGS. 105 and 106. The shafts 1370 are rotatably supported by a pair of brackets 1372 that extend downwardly from the fence. A gear 1374 is attached to each end of each shaft. The gear meshes with a rack 1376 that is fixedly attached to each end of the frame, preferably with a plurality of bolts or like fasteners. A suitable rack and gear arrangement includes a gear rack model #6NSR8X1¼X36 and spur gear model #NSS8H32, both manufactured by Browning. In operation, the shafts 1370 are rotated so as to move the fences 1340 inwardly as the gears 1374 mesh with the racks 1376. In this way, the shafts 1370 facilitate the centering of the core assembly while also keeping the core assembly square in the machine.

In one embodiment, the shafts 1370 can also be actuated to move the fences so as to center the core assembly in the machine. In particular, as shown in FIG. 106, a shaft brake 1378 is disposed around each shaft adjacent one end of the machine. The shaft brakes 1378 are pivoted by a cylinder 1380 that is pivotably secured to the fence. The shaft brake 1378 is actuated to clamp onto the shaft 1370. The cylinder 1380 is then extended or retracted so as to rotate the shaft brake and shaft, which in turn moves each of the fences toward or away from each other as explained above. However, it should be understood that the shafts 1370 can be used without the shaft brakes so as to simply ensure that each end of the fence is moved the same amount at the same time so as to keep the core assembly square in the machine.

Figure 107:
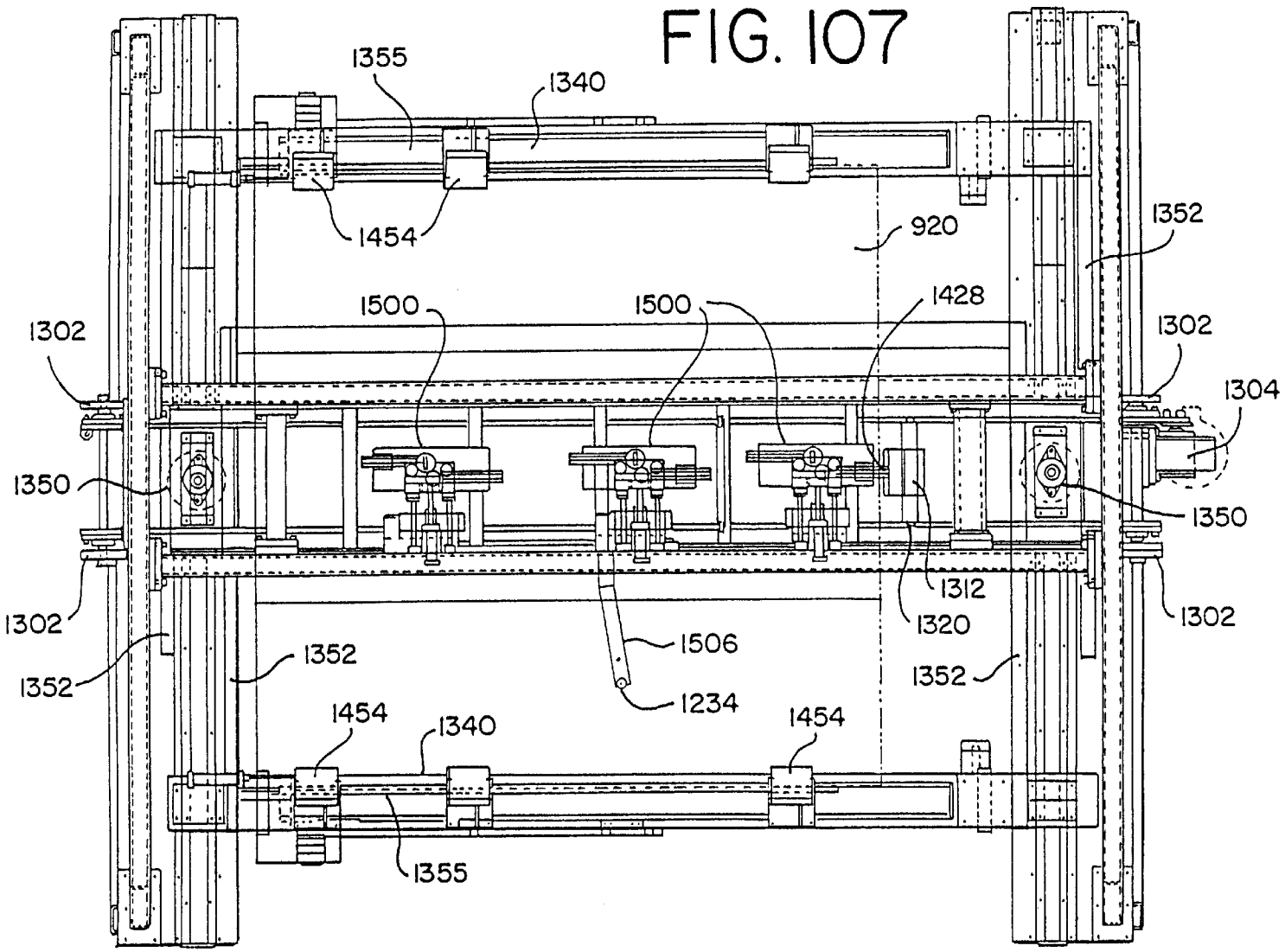
FIG. 107 is a plan view of a machine used to attach locator members to a wall member.

Referring to FIGS. 105–107, a plurality of tool components, shown as three routers 1390, 1392, 1394 are suspended from a framework above the core assembly. It should be understood that other tool components could be provided to operate on the core assembly when centered in the machine, such as various staple guns, drills, routers, jigs, and the like, and the term tool component is not limited to the disclosed router. The first router 1390 is used with every core assembly and is programmed to make a single, circular locator opening through the core assembly, including through each of the inner wall members attached to the frame, at a predetermined distance from the top of the core assembly, as determined by the distance between the router bit, or drill bit, and the locating member 1324. The second and third routers 1392, 1394 are programmed to form a machine direction slot through the core assembly. As such, the second and third routers are moveably mounted to the frame, and are actuated by the piston assemblies 1396, while the first router is fixedly mounted thereto. Only one of the second and third routers is used at a time, with the second router 1392 being used for shorter core assemblies, and the third router 1394 being used with longer core assemblies. A suitable router for use as the first, second and/or third router is a Porter Cables Model #6902 (23,000 rpm). Preferably, the router bits are ½ inch carbide. The routers are oriented along the centerline of the core assembly and are actuated to penetrate the core assembly after the core assembly has been centered in the machine. After the locator hole and slot are formed, the core assembly is released as the referencing device pivots out of the way into the stored position and is thereafter transported by the belts 1302 to the next station where it is ready for mating with the wall members 920.

Referring to FIG. 61, the assembly of the wall member involves first positioning the wall member 920 over a piece of decorative sheet 930 and barrier sheet 530. The plurality of strip members 824 are positioned around the periphery of the wall member. The decorative sheet 930 is stretched from the top and bottom of the wall member and attached to the wall member and strip members along the top and bottom of the wall member. The decorative sheet is then stretched from each side of the wall member and again attached to the wall member and strip members along the sides of the wall member. It should be understood that the order of stretching the decorative sheet from the top and bottom and from each side can be reversed, or can be done simultaneously. After the decorative sheet and strip members are attached, any excess decorative sheet material that may be gathered at the corners is trimmed, folded and secured to the wall member, preferably with staples or like fasteners.

The wall member 920 is then transported to a locator member attachment to machine that has many features and parts similar to the router machine. Those parts and features are referenced by the same reference numbers. In essence, both the router machine and locator member attachment machine have the same bed for moving the wall panel components, including the core assembly and wall member, and centering those components for further operations thereto. In particular, and referring to FIGS. 107–108, the locator member attachment machine includes a pair of rack and pinion mechanisms 1350, 1352 and fences 1340 that center the wall member in the machine as described above with respect to the core assembly in the router machine. A referencing device includes a cylinder 1308 pivotally connected to the frame 1300 about axis 1316 and to a link 1312, which is also pivotally connected to the frame about axis 1320. A referencing block 1428 is mounted to the link 1312, such that when the link is pivoted from the stored position beneath the upper surface of the belts 1302 to the referencing position, it is in position to engage the top edge of the wall panel as it is transported by the belts 1302.

Figure 108:
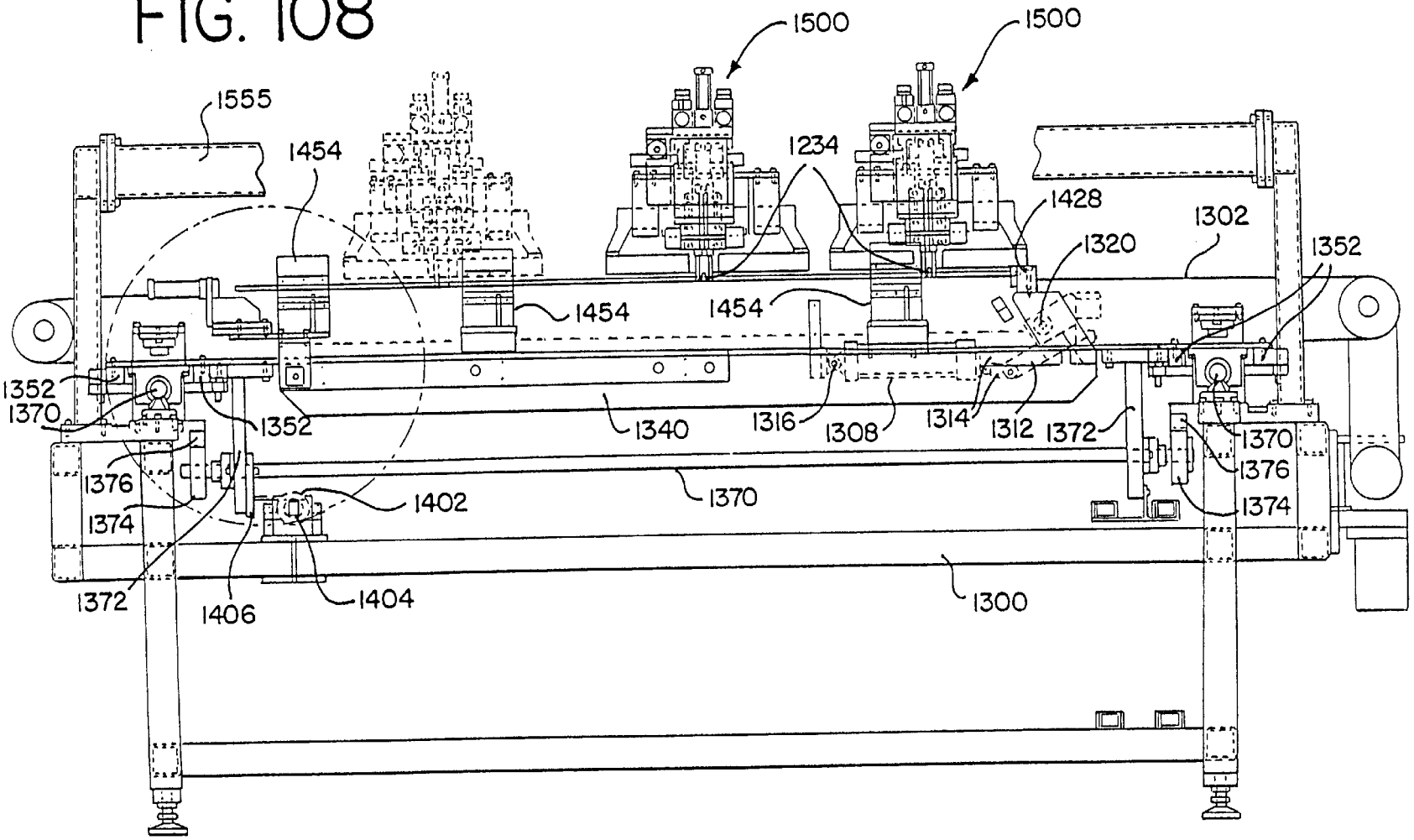
FIG. 108 is a side view of the machine shown in FIG. 107.
Figure 109:
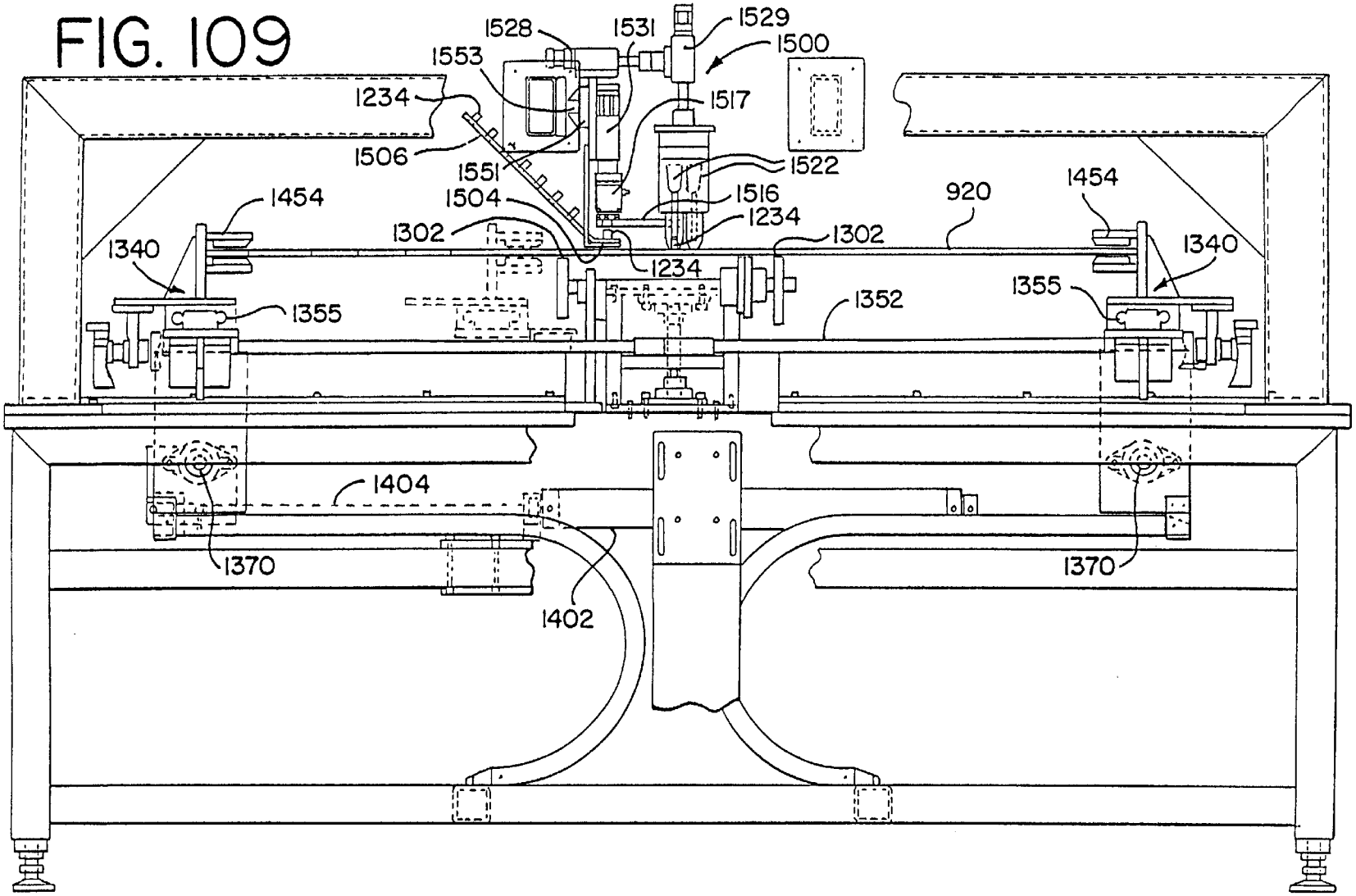
FIG. 109 is an end view the machine shown in FIG. 107.

Referring to FIGS. 108 and 109, another embodiment for moving the fences is shown. It should be understood that this embodiment would also work with the fences on the router machine, and conversely, the devices and methodologies for moving the fences of the router machine would also work with the fences on the locator member attachment machine. In particular, a cylinder 1402, and preferably a pneumatic cylinder, is mounted to the frame. A suitable cylinder is the cylinder model #5024-DXP manufactured by BIMBA. A rod 1404 extends from the cylinder and is attached to a bracket 1406 extending downwardly from one of the fences, as shown in FIGS. 108 and 109. The cylinder 1402 can be actuated to move the rod laterally so as to move the attached fence inwardly or outwardly. As the fence 1340 is moved, it causes the pinion gears 1350 on the opposite ends of the machine to move, by way of the attached racks 1352, so as to thereby cause the other fence to move a corresponding amount by way of its attached racks 1352. In addition, the fences each include a shaft 1370 having a pair of gears 1374 that engage a rack 1376 on each end of the frame so as to keep the fences, and wall member engaged thereby, square in the machine. As shown in FIG. 109, the fences 1340 each include a plurality of C-shaped bracket 1454 shaped to receive the wall member therein. Again, the brackets 1454 are moveably mounted on a track that extends along the length of the fence.

Referring to FIGS. 108 and 109, a plurality of tool components, shown as two locator member dispensers 1500, are suspended from a framework over the wall member. The first dispenser is preferably fixed, while the second dispenser can be moved between a plurality of positions. Each locator member dispenser 1500 positions a locator member 1234 over the wall panel. The position of each locator member is programmed to correspond to the location of the locator openings, including the circular hole or slot, positioned in the core assembly.

Figure 110:
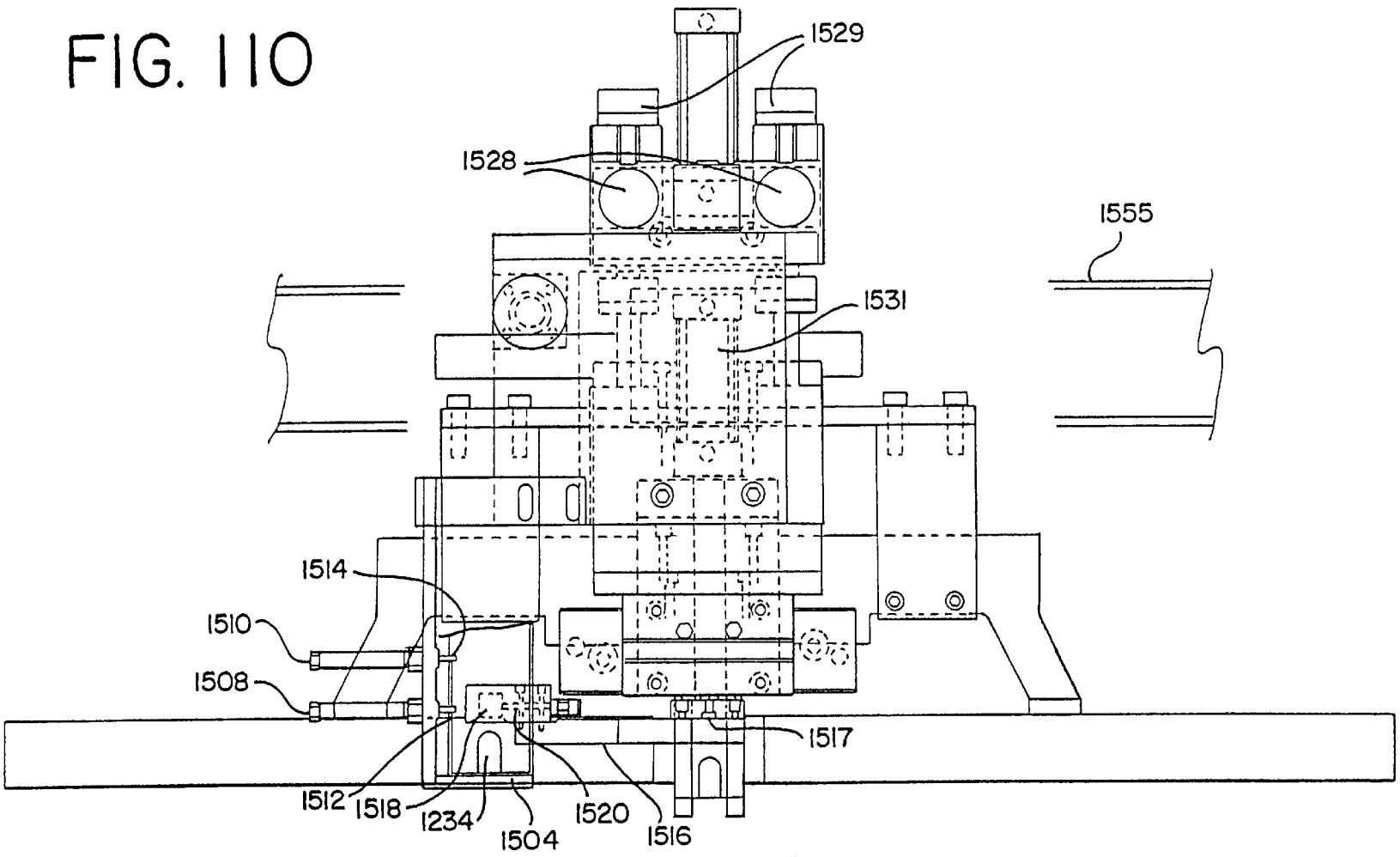
FIG. 110 is a side view of a locator attachment tool.
Figures 111, 112:
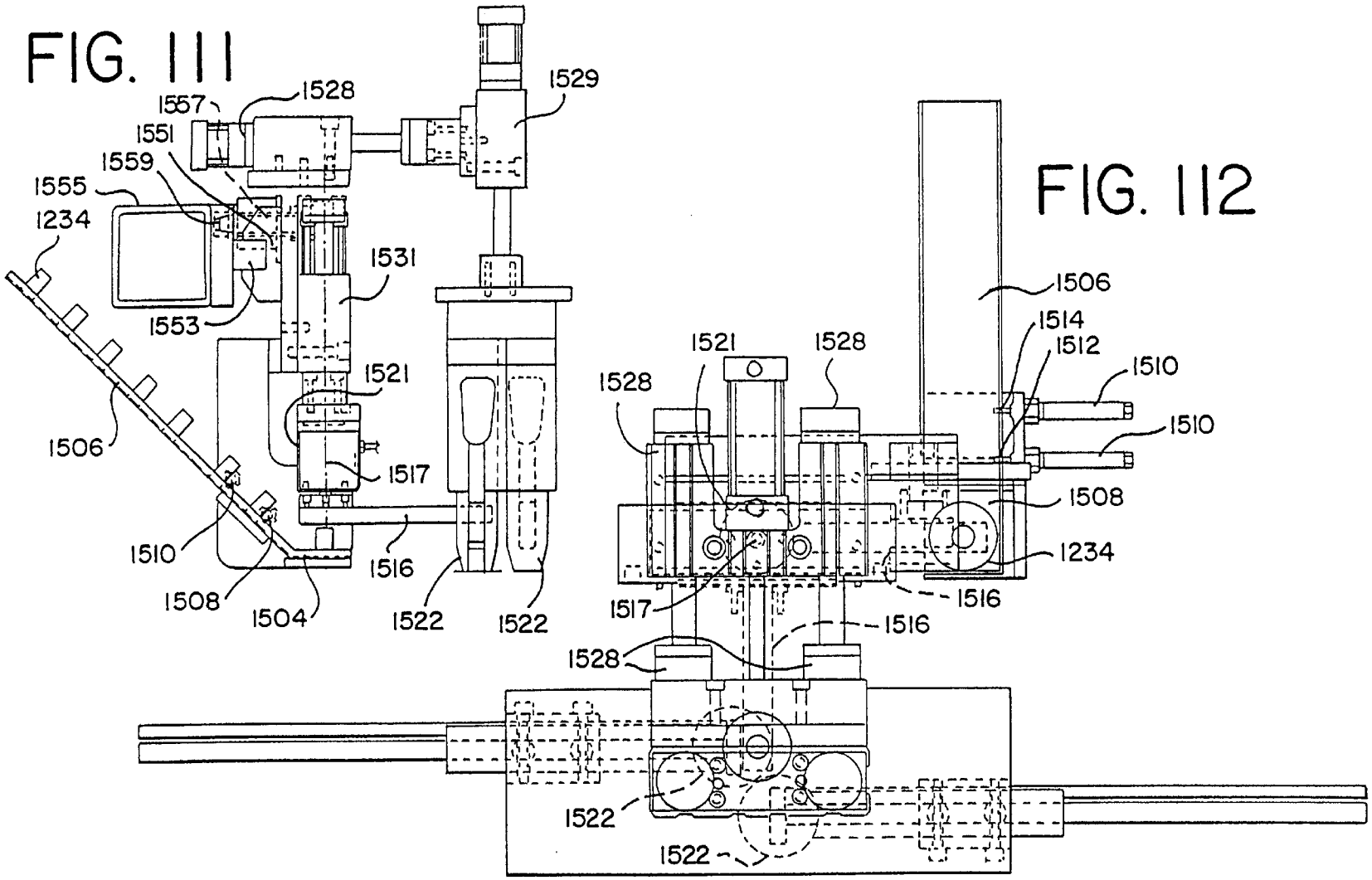
FIG. 111 is an end view of the tool shown in FIG. 110.
FIG. 112 is a plan view of the tool shown in FIG. 110.

In particular, and referring to FIGS. 110–112, the dispenser 1500 includes a locator member magazine 1502 having a tray with a horizontal holding portion 1504 and an angled portion 1506 extending upwardly from the horizontal portion. The tray is shaped to slidably hold a plurality of locator members 1234. A pair of cylinders 1508, 1510 each having a pin 1512, 1514 can be successively operated to permit one locator member to slide from the angled portion to the horizontal portion. In particular, the lower cylinder 1508 is actuated to retract the pin 1512 so as to allow the locator member, which was retained thereby, to slide down onto the horizontal holding portion 1504. The upper cylinder 1510 is then actuated to retract the pin 1514 so as to permit another locator member to move into position against the lower pin 1512, which is extended to stop the locator member.

An arm member 1516 is pivotally about axis 1517 is moved over the locator member positioned in the horizontal portion of the tray. The arm includes and end portion 1520 that has a recess 1518 shaped to receive the locator member 1234. The arm is displaced over the locator member while a vacuum is applied. The arm 1516 is then pivoted outwardly about axis 1517 to position the locator member along the centerline of the wall member. A pair of staple guns 1522 are then successively actuated to secure the base portion 1236 of the locator member to the wall member with a pair of flaring staples, whose ends flare out in the wall member as they penetrate the member. The staple guns 1522 are moveable in the lateral cross-machine direction when actuated by a pair of actuators 1528. A suitable actuator is the series SD slide model #SDC23x1-½xM-J2-AR-AE, manufactured by PHD. In this way, the staple guns can be successively moved into place to attach the locator member. An actuator 1529 is also provided to control the vertical position of the staple guns. Similarly, an actuator 1531 controls the vertical position of the arm 1516 and end portion 1517. As shown in FIG. 111, the dispenser includes a guide 1551 that slideably engages a track 1553 that runs along the length of a longitudinally extending frame member 1555. The dispenser 1500 also includes a lock pin 1557 that can be retracted and extended to engage a plurality of recesses 1559 in the track 1553. In operation, the lock pin 1557 is retracted from one of the recesses so that the dispenser 1500 can be slid along the track 1553 to a new position where the lock pin 1557 can be extended to engage a new recess in the track so as to lock the dispenser in position for a subsequent operation. One of skill in the art should understand that the positioning of the lock pin and recess could be interchanged, with the lock pin located on the track, or frame member, and the recess located on the dispenser.

As with the routers, preferably only two dispensers are used with any one panel, depending on the size of the panel. However, it should be understood that additional dispensers and routers can be provided to provide a plurality of locator members and openings numbering greater than two.

The locations of the locator members are determined by the distance between the end portion 1520 of the arm and the reference block 1428 that engages the top edge of the wall member. This distance is programmed to correspond to the position of the locator openings formed in the core assembly. After the locator members are secured to the wall member, preferably along the centerline of the wall member, the wall member is ready for mating with the core assembly and can be carried from the machine by the belts.

One of skill in the art should understand that, in an alternative embodiment, the position of the locator members and openings could be reversed, with the locator members attached to opposite sides of the core assembly, and with the locator openings formed in the wall member, but preferably not passing all of the way therethrough. The preferred construction is with the locator openings in the core assembly, however, since only one drilling, or routing, operation need be made, as opposed to separately drilling, or routing, each of the wall members. Moreover, the concern with penetrating the entire thickness of the wall member is eliminated, although the locator opening could be made all of the way through the wall member if necessary or desired.

At this stage, hot melt adhesive is applied to one or both of the wall members 920 and/or the outer surface of the wall member 820 of the core assembly and the locator members 1234 are inserted in the locator holes 1230, 1232. In addition, mechanical fasteners, such as staples and the like, can be used to secure the wall member to the core assembly. In this way, the wall members 920 are centered on the core assembly so as to provide an equal overhang along both sides of the panel, which thereby provides for equal exposure to the hanger brackets and maintains equal gaps between adjacent panels installed end to end.

Figure 113:
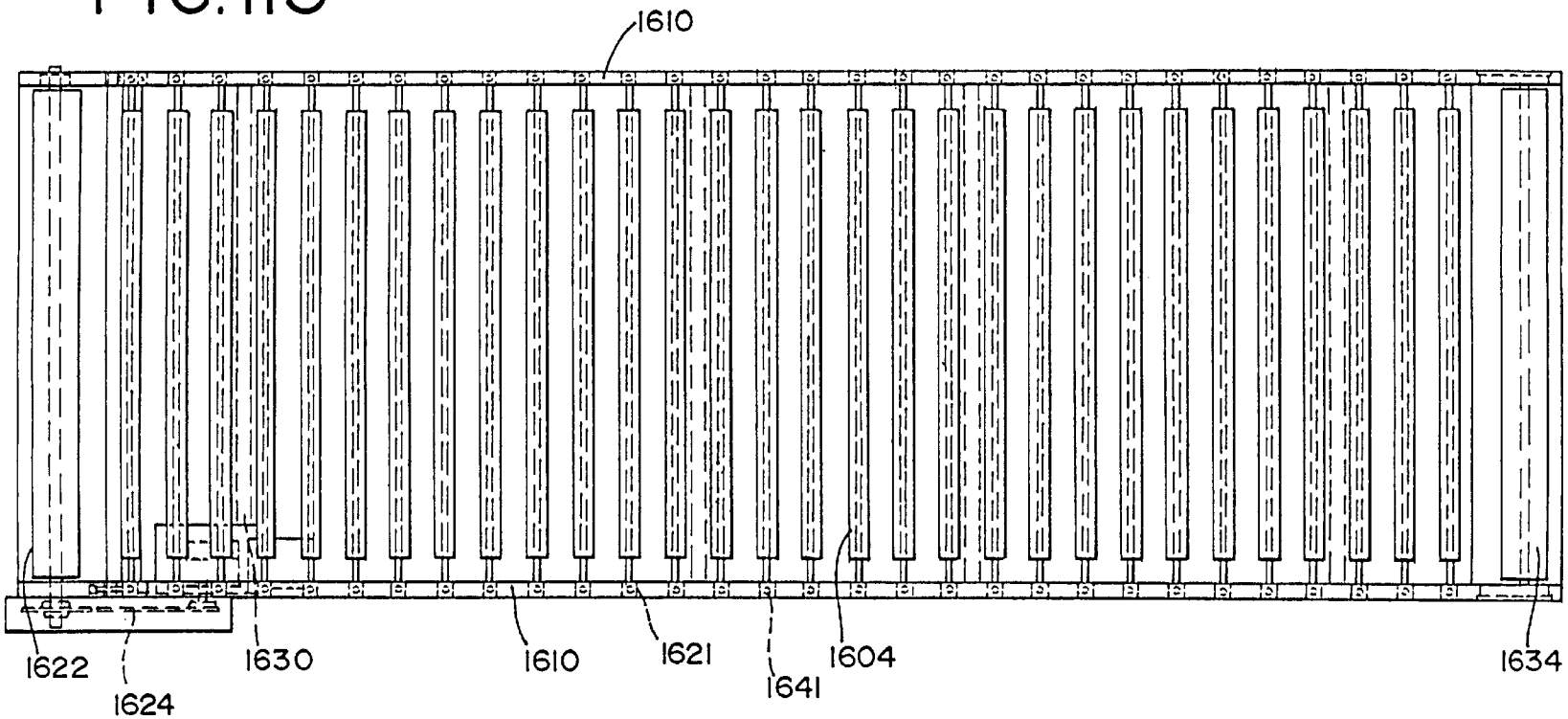
FIG. 113 is a plan view of a press convey or machine.
Figure 115:
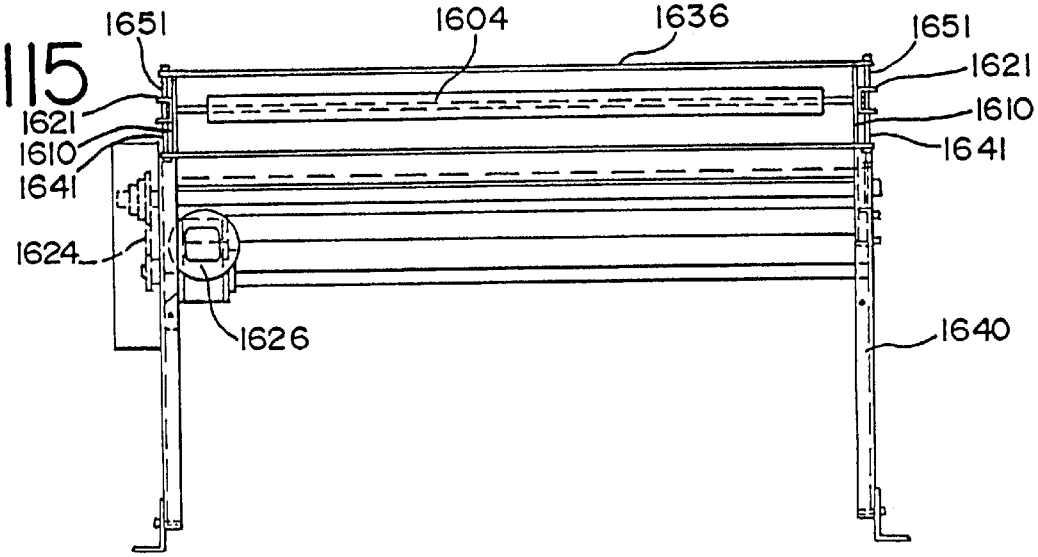
FIG. 115 is an end view the machine shown in FIG. 113.

After the wall members are located on the core assembly, the completed wall panel is passed through a pinch roll to firmly bond the wall members to the core assembly. The wall panel is thereafter transferred to a press conveyor 1600, shown in FIGS. 113–115, which is approximately 17 feet in length. The press conveyor includes a belt 1602, preferably about 5–6 feet wide, that carries and moves the wall panel though the press conveyor. The belt preferably travels at a rate of about 4 ft/min. A second belt 1606 is welded, or vulcanized along the underside of the length of the belt 1602. As shown in FIG. 130, the belt 1606, which is preferably a V-belt, rides in a longitudinally extending (machine direction) groove 1608 formed in the bed 1620 of the machine to keep the belt 1602 centered and tracking on the machine. The belt 1602 is supported by the bed and is driven by a drive roller 1622. The belt is also supported by roller 1634 on the opposite end of the machine. The bed and frame are supported by four legs 1640, which are height adjustable. In addition, a series of rollers 1630 underlie the belt to maintain the tension thereof. The drive roller is driven, with a belt or chain 1624, by a motor 1626.

A plurality of gravity rollers 1604 engage the upper wall member of the wall panel and apply a load thereto by way of their weight being supported by the wall panel. Each roller 1604 is moveably supported along both ends by a C-shaped bracket 1621 that is slideably supported on a vertically oriented post 1641 mounted in a side frame member 1610, which is configured as an outwardly opening channel. Alternatively, the ends of the rollers can be disposed in vertically oriented slots formed in the side frame member. Lateral supports 1636 interconnect the side frame members 1610. The rollers are preferably steel. In a preferred embodiment, the bottom surface of the rollers are positioned just slightly below the plane formed by the upper surface of the wall panel, such that as the wall panel is introduced into the press conveyor, the crown on the rollers 1604 allows the rollers to ride up over the edge of the wall panel and be supported thereon. For example, in one embodiment, the rollers are positioned at about 2 and ⅞ inches above the belt 1602, have a diameter of about 2 and ½ inches and are positioned in a spaced apart and substantially parallel relationship with a successive distance between each other of about 6 inches from center to center. The press conveyor applies a load by way of the weight of the rollers, which are about 30 lbs. in an exemplary embodiment, to the wall panel as it is moved to a next station. In addition, a spring 1651 is disposed around each post 1641 between the upper flange of the frame member 1610 and the top of the C-shaped bracket 1621. The springs 1651 bias the roller against the wall panel as it travels along the length of the press conveyor. The applied load prevents the wall members from peeling back from the core after the wall panel leaves the pinch roll while the adhesive or bonding agent sets up. The press conveyor, by virtue of its length, can carry two or more wall panels at a time, depending on their length.

When assembled in a system of panels, the horizontal channel formed along the top and bottom of the panels provides the user with an ideal and easy to access space for storing and routing cables and wires, such as communication and data lines. Moreover, the vertical channels in each panel allow the user to easily rout wires and cables from the top of the panel to the bottom. In addition, the vertical channels provide a ready-made space for routing electrical conduit from the outlet mounted in the panel to the base of the panel and the attached power distribution system.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A stackable wall panel assembly comprising:

a lower wall panel comprising a top, a bottom, vertically extending opposite ends and opposite sides;

a first upper wall panel comprising a top, a bottom, vertically extending opposite ends and opposite sides, wherein said bottom of said upper wall is positioned above said top of said lower wall;

a first draw block connected to said lower wall panel;

an insert releasably engaged with said first draw block;

a second draw block engaged with said upper wall panel; and a draw rod connecting said insert and said second draw block.

2. The stackable wall panel assembly of claim 1 wherein said first draw block comprises a cavity, and wherein said insert comprises a catch portion removeably received in said cavity.

3. The stackable wall panel assembly of claim 2 wherein said first draw block comprises a shoulder defining in part said cavity, and wherein said catch portion of said insert engages said first draw block shoulder so as to prevent movement therebetween in at least one direction.

4. The stackable wall panel assembly of claim 3 wherein said cavity has an opening on at least one end shaped to receive said catch portion therethrough, and wherein said insert is rotatable between at least an engaged position wherein said catch portion engages said shoulder and a disengaged position wherein said catch portion is aligned with said opening for passage therethrough.

5. A stackable wall panel assembly comprising:

a lower wall panel comprising a top, a bottom, vertically extending opposite ends and opposite sides;

a first upper wall panel comprising a top, a bottom, vertically extending opposite ends and opposite sides;

a first draw block connected to said lower wall panel, said first draw block comprising a shoulder defining in part a cavity;

an insert releasably engaged with said first draw block, wherein said insert comprises a catch portion removeably received in said cavity, wherein said catch portion engages said shoulder so as to prevent movement therebetween in at least one direction;

a second draw block engaged with said upper wall panel; and a draw rod connecting said insert and said second draw block;

wherein said cavity is open on opposite sides of said first draw block, wherein said catch portion is moveably disposed in said cavity from at least one of said open sides of said first draw block, and wherein said first draw block has an end opening formed in opposite ends thereof, said end openings communicating with said cavity, and wherein said insert comprises a neck portion extending through one of said end openings.

6. The stackable wall panel assembly of claim 5 wherein said insert further comprises a stop portion spaced from said catch portion, said stop portion engaging one of said ends of said first draw block to prevent movement therebetween in a direction opposite to said at least one direction.

7. The stackable wall panel assembly of claim 5 wherein said draw rod is a first upper draw rod, and further comprising a lower draw rod extending through said other of said end openings of said first draw block.

8. A stackable wall panel assembly comprising:

a lower wall panel comprising a top, a bottom, vertically extending opposite ends and opposite sides;

a first upper wall panel comprising a top, a bottom, vertically extending opposite ends and opposite sides;

a first draw block connected to said lower wall panel;

an insert releasably engaged with said first draw block;

a second draw block engaged with said upper wall panel;

a draw rod connecting said insert and said second draw block; and a second upper wall panel comprising a top, a bottom, vertically extending opposite ends and opposite sides, wherein said second upper wall panel is supported above said first upper wall panel, a third draw block engaged with said second upper wall panel, a second insert releasably engaged with said second draw block, and a second draw rod connecting said second insert and said third draw block.

9. The stackable wall panel assembly of claim 8 wherein said second draw block comprises a cavity, and wherein said second insert comprises a catch portion removeably received in said cavity of said second draw block.

10. The stackable wall panel assembly of claim 9 wherein said second draw block comprises a shoulder defining in part said cavity, and wherein said catch portion of said second insert engages said second draw block shoulder so as to prevent movement therebetween in at least one direction.

11. The stackable wall panel assembly of claim 10 wherein said opposite end of said lower wall panel comprises a hanger bracket, wherein said first draw block engages an end of said hanger bracket.

12. A connector assembly for use with a stackable wall panel assembly comprising:

a first draw block comprising a cavity having a cavity;

an insert comprising a catch portion removeably received in said cavity, wherein said insert is releasably engaged with said draw block;

a second draw block; and a draw rod connecting said insert and said second draw block.

13. The connector assembly of claim 12 wherein said first draw block comprises a shoulder defining in part said cavity, and wherein said catch portion of said insert engages said first draw block shoulder so as to prevent movement therebetween in at least one direction.

14. A connector assembly for use with a stackable wall panel assembly comprising:

a first draw block comprising a shoulder defining in part a cavity;

an insert comprising a catch portion removeably received in said cavity, wherein said insert is releasably engaged with said draw block, and wherein said catch portion engages said shoulder of said first draw block so as to prevent movement therebetween in at least one direction;

a second draw block; and a draw rod connecting said insert and said second draw block;

wherein said cavity is open on opposite sides of said first draw block, wherein said catch portion is moveably disposed in said cavity from one of said open sides of said first draw block, and wherein said first draw block has an end opening formed in opposite ends thereof, said end openings communicating with said cavity, and wherein said insert comprises a neck portion extending through one of said end openings.

15. The connector assembly of claim 14 wherein said insert further comprises a stop portion spaced from said catch portion, said stop portion engaging one of said ends of said first draw block to prevent movement therebetween in a direction opposite to said at least one direction.

16. The connector assembly of claim 14 wherein said draw rod is a first upper draw rod, and further comprising a lower draw rod extending through said other of said end openings of said first draw block.

17. A connector assembly for use with a stackable wall panel assembly comprising:

a first draw block comprising a shoulder defining in part a cavity;

an insert comprising a catch portion removeably received in said cavity, wherein said insert is releasably engaged with said draw block, and wherein said catch portion engages said shoulder of said first draw block so as to prevent movement therebetween in at least one direction;

a second draw block; and a draw rod connecting said insert and said second draw block;

wherein said cavity has an opening on at least one end shaped to receive said catch portion therethrough, and wherein said insert is rotatable between at least an engaged position wherein said catch portion engages said shoulder and a disengaged position wherein said catch portion is aligned with said opening for passage therethrough.

18. A connector assembly for use with a stackable wall panel assembly comprising:

a first draw block comprising a cavity;

an insert comprising a catch portion removeably received in said cavity, wherein said insert is releasably engaged with said draw block;

a second draw block;

a draw rod connecting said insert and said second draw block;

a third draw block;

a second insert releasably engaged with said second draw block; and a second draw rod connecting said second insert and said third draw block.

19. The connector assembly of claim 18 wherein said second draw block comprises a cavity, and wherein said second insert comprises a catch portion removeably received in said cavity of said second draw block.

20. The connector assembly of claim 19 wherein said second draw block comprises a shoulder defining in part said cavity, and wherein said catch portion of said second insert engages said second draw block shoulder so as to prevent movement therebetween in at least one direction.

* * * * *